US006860579B2

(12) United States Patent
Numata et al.

(10) Patent No.: US 6,860,579 B2
(45) Date of Patent: Mar. 1, 2005

(54) INK JET RECORDING APPARATUS AND METHOD USING REPLACEABLE RECORDING HEADS

(75) Inventors: Yasuhiro Numata, Kawasaki (JP); Kazuyoshi Takahashi, Kashiwazaki (JP); Yoshiaki Takayanagi, Yokohama (JP); Souhei Tanaka, Kawasaki (JP); Hiroshi Tajika, Yokohama (JP); Noribumi Koitabashi, Yokohama (JP); Hitoshi Sugimoto, Yokohama (JP); Miyuki Fujita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 166 days.

(21) Appl. No.: 10/370,687

(22) Filed: Feb. 24, 2003

(65) Prior Publication Data

US 2003/0146952 A1 Aug. 7, 2003

Related U.S. Application Data

(62) Division of application No. 08/953,663, filed on Oct. 17, 1997, now Pat. No. 6,565,184, which is a continuation of application No. 08/755,113, filed on Nov. 22, 1996, now abandoned, which is a division of application No. 07/822,617, filed on Jan. 17, 1992, now Pat. No. 5,625,384.

(30) Foreign Application Priority Data

Jan. 18, 1991 (JP) ..... 3-004400

(51) Int. Cl.[7] ..... B41J 2/165
(52) U.S. Cl. ..... 347/23; 347/19
(58) Field of Search ..... 347/23, 19, 14, 347/29, 30, 86, 87

(56) References Cited

U.S. PATENT DOCUMENTS

| | | | | |
|---|---|---|---|---|
| 4,313,124 A | 1/1982 | Hara | 346/140 R |
| 4,345,262 A | 8/1982 | Shirato et al. | 346/140 R |
| 4,459,600 A | 7/1984 | Sato et al. | 346/140 R |
| 4,463,359 A | 7/1984 | Ayata et al. | 346/1.1 |
| 4,500,895 A | 2/1985 | Buck et al. | 347/87 |
| 4,558,333 A | 12/1985 | Sugitani et al. | 346/140 R |
| 4,577,203 A | 3/1986 | Kawamura | 347/30 |
| 4,692,777 A | 9/1987 | Hasumi | 347/23 |
| 4,723,129 A | 2/1988 | Endo et al. | 346/1.1 |
| 4,740,796 A | 4/1988 | Endo et al. | 346/1.1 |
| 4,872,027 A | 10/1989 | Buskirk et al. | 346/140 R |
| 4,970,533 A | 11/1990 | Saito et al. | 347/86 |
| 5,049,898 A | 9/1991 | Arthur et al. | 346/1.1 |

(List continued on next page.)

FOREIGN PATENT DOCUMENTS

| | | |
|---|---|---|
| JP | 59-123670 | 7/1984 |
| JP | 59-138461 | 8/1984 |
| WO | WO 90/00974 | 2/1990 |

OTHER PUBLICATIONS

Lonis, R.A. "Storage of Operating Parameters in Memory Integrated with Printhead," *Xerox Disclosure Journal*, vol. 8, No. 8, p. 503.

*Primary Examiner*—Lamson D Nguyen
(74) *Attorney, Agent, or Firm*—Fitzpatrick, Cella, Harper & Scinto

(57) ABSTRACT

Replacement of a recording head on a recording apparatus is detected on the basis of a serial number allocated to each recording head. The recording head also carries head characteristic information such as color information, shading information and so forth. When the recording head is replaced with a new one, the head characteristic information of the newly mounted recording head is automatically stored, so that head driving conditions are automatically determined to optimize the recording conditions without requiring any manual adjustment. Recovery operation is automatically executed when replacement of the recording head is detected, so that required recording conditions are recovered without manual instructions.

2 Claims, 90 Drawing Sheets

U.S. PATENT DOCUMENTS 5,182,580 A 1/1993 Ikeda et al. ..... 346/140 R
5,235,351 A 8/1993 Koizumi ..... 346/140 R
5,365,312 A 11/1994 Hillmann et al. ..... 347/86 X
5,389,961 A 2/1995 Takagi ..... 347/29
5,956,052 A 9/1999 Udagawa et al. ..... 347/19
6,719,397 B1 * 4/2004 Hu et al. ..... 347/19
6,739,689 B2 * 5/2004 Choi ..... 347/19

* cited by examiner

FIG. 23
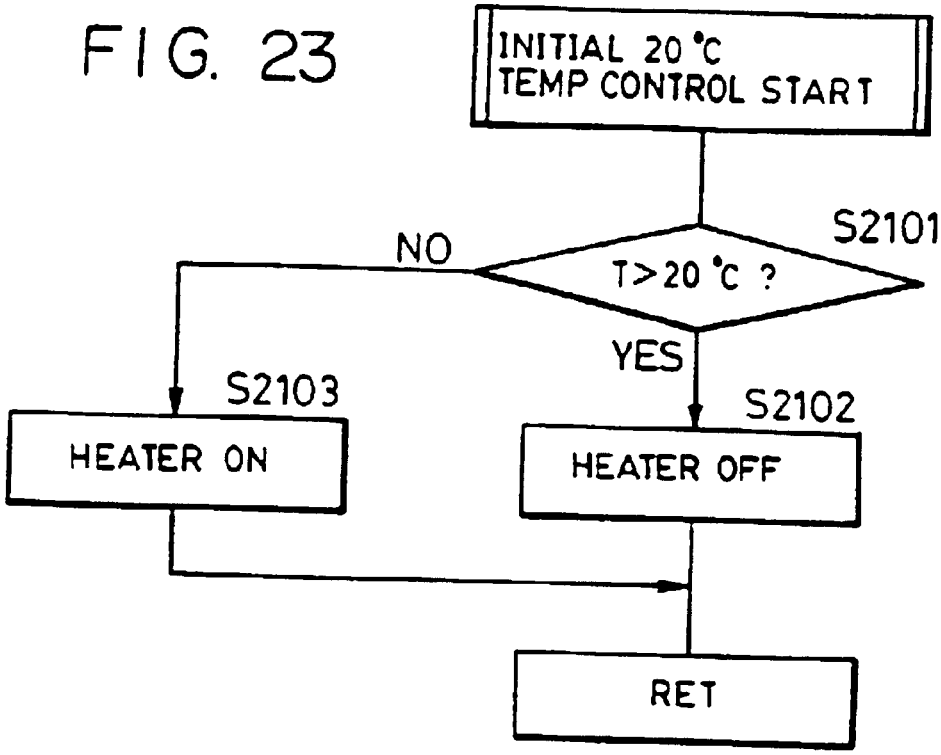
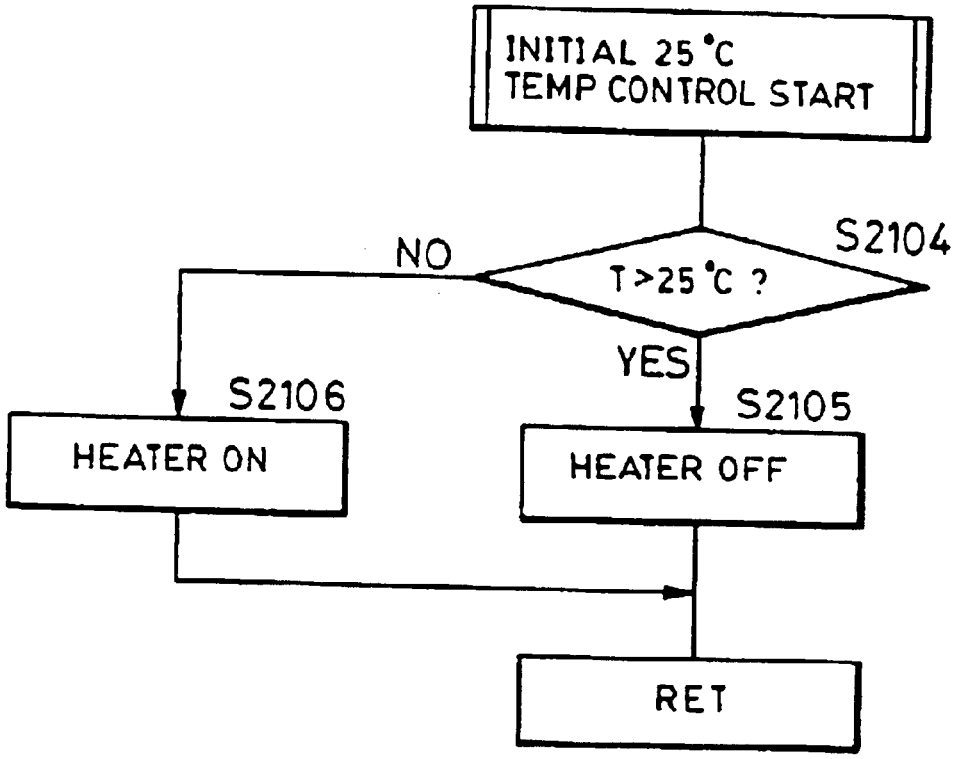

DETECTION OF PAPER WIDTH AND PAPER TYPE

CARRIAGE ADVANCED
S2401
TIMER START
S2402
S2403
CARRIAGE STOP ?
NO
YES
TIMER CHECK
DETERMINE PAPER WIDTH
S2404
ERROR
CARRIAGE START MOVE
S2405
TIMER START
S2406
S2407
STOP ?
NO
YES
TIMER CHECK
S2408
DETERMINE PAPER TYPE
ERROR
S2410
YES
RHS MODE FLAG CHECK
COAT PAPER
S2409
NO
OHP FLAG "1"
YES
S2411
NO
OHP FLAG "1"
YES
JAM
NO
END
FORCED END
END

DIGITS OF (3n+1) TH LINE

DIGITS OF (3n+2) TH LINE

DIGITS OF (3n+3) TH LINE

RHS MODE

OHP MODE

OHP PRINT

OHP

REDUCTION $P_1$ : PRE-HEAT PULSE ($=T_1$) [EXECUTES PWM]

$P_2$ : INTERVAL ($=T_2-T_1$)

$P_3$ : MAIN HEAT PULSE ($=T_3-T_2$)

Vop : DRIVE VOLTAGE

FIG. 62

| DRIVE CONDITION POINTER NO. $T_{A1}$ [HEX] | 15 | 16 | 17 | 18 | 19 | 1A | 1B | 1C |
|---|---|---|---|---|---|---|---|---|
| MAIN HEAT PULSE WIDTH $P_3$ [μ sec] | 4.675 | 4.488 | 4.301 | 4.114 | 3.927 | 3.74 | 3.553 | 3.366 |

※ $P_3 = T_3 - T_{A1}$ ( $= T_2$ )

FIG. 63

RANGE FOR USE

| | | | | | | | | | | | | | | | | | |
|---|---|---|---|---|---|---|---|---|---|---|---|---|---|---|---|---|---|
| | DISCHARGE RATE $V_{DM}$ (ng/dot) | 25.5 ~ 26.1 | 26.1 ~ 26.7 | 26.7 ~ 27.3 | 27.3 ~ 27.9 | 27.9 ~ 28.5 | 28.5 ~ 29.1 | 29.1 ~ 29.7 | 29.7 ~ 30.3 | 30.3 ~ 30.9 | 30.9 ~ 31.5 | 31.5 ~ 32.1 | 32.1 ~ 32.7 | 32.7 ~ 33.3 | 33.3 ~ 33.9 | 33.9 ~ 34.5 | 34.5 ~ 35.1 |
| | RWM POINTER NO. $T_{A3}$ | 9 | A | B | C | D | E | F | 0 | 1 | 2 | 3 | 4 | 5 | 6 | 7 | 8 |
| THEORY | PRE-HEAT PULSE WIDTH $P_1$ (HEX) | 11 | 10 | F | E | D | C | B | A | 9 | 8 | 7 | 6 | 5 | 4 | 3 | 2 |
| | DISCHAGE RATE CORRECTION AMOUNT ① $V_{DC}$ (ng/dot) | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 |
| EMBODIMENT | PRE-HEAT PULSE WIDTH $P_1$ (HEX) | C | C | C | C | C | C | B | A | 9 | 8 | 8 | 8 | 8 | 8 | 8 | 8 |
| | DISCHARGE RATE CORRECTION AMOUNT ② $V_{DC}$ (ng/dot) | 26.7 ~ 27.3 | 27.3 ~ 27.9 | 27.9 ~ 28.5 | 28.5 ~ 29.1 | 29.1 ~ 29.7 | 29.7 ~ 30.3 | 29.7 ~ 30.3 | 29.7 ~ 30.3 | 29.7 ~ 30.3 | 29.7 ~ 30.3 | 30.3 ~ 30.9 | 30.9 ~ 31.5 | 31.5 ~ 32.1 | 32.1 ~ 32.7 | 32.7 ~ 33.3 | 33.3 ~ 33.9 |

NON-USE RANGE

RANGE FOR USE

NON-USE RANGE

※ 1 [HEX] = 0.187 [μ sec]

FIG. 67(A)

| CONDITIONS \ TABLE NO. | [1] | [2] | [3] | [4] | [5] | [6] | [7] | [8] | [9] | [10] |
|---|---|---|---|---|---|---|---|---|---|---|
| HEAD TEMP $T_H$ [°C] | BELOW 26 | 26 OR ABOVE BELOW 28 | 28 ~ 30 | 30 ~ 32 | 32 ~ 34 | 34 ~ 36 | 36 ~ 38 | 38 ~ 40 | 40 ~ 42 | 42 OR ABOVE |
| PRE-HEAT PULSE WIDTH $P_1$ [Hex] | 0A | 09 | 08 | 07 | 06 | 05 | 04 | 03 | 02 | 01 |

FIG. 67(B)

| CONDITIONS \ TABLE NO. | [1] | [2] | [3] | [4] | [5] | [6] | [7] | [8] | [9] | [10] |
|---|---|---|---|---|---|---|---|---|---|---|
| HEAD TEMP $T_H$ [°C] | BELOW 26 | 26 OR ABOVE BELOW 28 | 28 ~ 30 | 30 ~ 32 | 32 ~ 34 | 34 ~ 36 | 36 ~ 38 | 38 ~ 40 | 40 ~ 42 | 42 OR ABOVE |
| PRE-HEAT PULSE WIDTH $P_1$ [Hex] | 0B | 0A | 09 | 08 | 07 | 06 | 05 | 04 | 03 | 02 |

FIG. 67(C)

| CONDITIONS \ TABLE NO. | [1] | [2] | [3] | [4] | [5] | [6] | [7] | [8] | [9] | [10] |
|---|---|---|---|---|---|---|---|---|---|---|
| HEAD TEMP $T_H$ [°C] | BELOW 26 | 26 OR ABOVE BELOW 28 | 28 ~ 30 | 30 ~ 32 | 32 ~ 34 | 34 ~ 36 | 36 ~ 38 | 38 ~ 40 | 40 ~ 42 | 42 OR ABOVE |
| PRE-HEAT PULSE WIDTH $P_1$ [Hex] | 09 | 08 | 07 | 06 | 05 | 04 | 03 | 02 | 01 | 00 |

FIG. 84

(MISCELLANEOUS DATA)

| SYMBOLS | NOS. OF BITS | CONTENTS |
|---|---|---|
| SENS | 4 | SENSOR CHARACTERISTICS |
| T1 | 4 | DRIVE PULSE P1 |
| T2 | 4 | DRIVE PULSE P3 |
| ID | 20 | HEAD PRODUCT SER. NO. |
| COLR | 2 | INK COLOR |
| P | 4 | RESIST CORRECTION AMOUNT 1 |
| Q | 4 | REGIST CORRECTION AMOUNT 2 |

INK JET RECORDING APPARATUS AND METHOD USING REPLACEABLE RECORDING HEADS

This is a divisional application of application Ser. No. 08/953,663, filed on Oct. 17, 1997, now U.S. Pat. No. 6,565,184, which is a continuation of application Ser. No. 08/755,113, filed on Nov. 22, 1996, now abandoned, which is a divisional application of application Ser. No. 07/822,617, filed on Jan. 17, 1992, which issued as U.S. Pat. No. 5,625,384 on Apr. 29, 1997.

BACKGROUND OF THE INVENTION

1. Field of the Invention

The present invention relates to an ink jet recording apparatus which employs replaceable recording heads and also to an ink jet recording method which uses such an ink jet recording apparatus.

2. Description of the Related Art

Office automation machines such as personal computers, wordprocessors and so forth have become popular in recent years. A recording method called the ink jet recording method, which records information on a recording medium by discharging ink and depositing it on a recording medium, has been available as one of the means of outputting information input in these office automation machines. Basically, the ink jet recording method employs an ink jet head having a plurality of openings through which the ink is discharged by mechanical or thermal energy towards the recording medium to effect recording.

There is an increasing demand for using this recording method in combination with color image apparatuses such as a color image reader or a color video recorder, for the purpose of reproducing color photographs or color original images. To cope with such a demand, there has been a concentrated effort to develop color ink jet recording apparatuses which employ a plurality of inks of different colors. Such color ink jet recording apparatuses are required to have the ability to record halftone color images, as well as high quality color images.

These requirements are met only when various requisites are simultaneously satisfied, such as uniformity of diameter and directivity of all discharge openings, as well as uniformity of discharge pressure applied to all discharge openings.

Unfortunately, however, different recording heads have different patterns of fluctuation or variation of the characteristics of their discharge openings, due to restrictions posed by the present level of production technology and the complicated construction of the head. In addition, variations in ink discharging performance or characteristics inevitably occur among recording heads which utilize thermal energy, because of slight differences in the electrical resistance of heat-generating resistors incorporated in these recording heads.

These variations are intensified by each other so as to produce substantial differences among different recording heads, such as difference in the ink discharge rate, differences in the ink jetting direction and so forth, not to mention differences in the ink discharge rate among discharge openings within individual recording heads. Such variations in the ink discharge characteristics cause unevenness of recording density, which is critical particularly in the recording of halftone color images, and fail to meet the demand for high quality image recordings.

In order to overcome this problem, a method has been proposed in which the patterns of density unevenness exhibited by individual ink jet recording heads are obtained by measurement when the heads are produced, and correction data for correcting parameters such as head driving conditions and image processing conditions are determined and stored in a semiconductor memory such as a ROM (read only memory) mounted on each recording head. In operation, each recording head discharges ink in accordance with the parameters corrected in accordance with the correction data, whereby the variation in density unevenness among different recording heads is suppressed or substantially eliminated.

Meanwhile, a recording head cartridge has been proposed with a recording head portion and an ink tank portion integrated with the recording head portion and which is replaceably used on recording apparatuses in order to simultaneously reduce the cost of the apparatus and increase the recording quality. When a recording head is constructed in the form of a recording head cartridge of the type described, it is necessary to match the recording apparatus and the cartridge in advance of using the cartridge. Such a matching, however, cannot be obtained prior to the use of the cartridge. It has therefore been proposed to provide each head cartridge with a semiconductor memory of the type mentioned before, i.e., a semiconductor memory which stores head characteristics peculiar to each recording head.

The recording characteristics of the replaceable recording head in the form of a head cartridge integrated with an ink tank tends to change or deteriorate due to impact or changes in environmental condition which may be incurred during transport. When a new recording head is mounted on a recording apparatus, therefore, it is necessary to effect a discharge recovery operation for the purpose of recovering the original discharge performance of the recording head before the head is actually operated.

In general, a color recording apparatus simultaneously mounts a plurality of recording heads of different colors, such as cyan, yellow, magenta and black. Replaceable recording heads, therefore, should have or be associated with suitable means for preventing erroneous mounting.

Known ink jet recording apparatuses require that a discharge recovery operation be manually triggered each time a new recording head is mounted. Thus, users are inconveniently obliged to conduct, in addition to the replacement of the recording head, an operation for manually triggering the discharge recovery operation. Recording under optimum conditions cannot be performed if the user has happened to forget triggering the discharge recovery operation. Furthermore, when the recording head is of the type which has a memory storing the aforesaid correction data, the user also is required to conduct an operation for enabling the recording apparatus to read the data in the memory.

Thus, various manual functions have to be performed by the user each time a recording head is replaced, in order to obtain the optimum recording condition.

SUMMARY OF THE INVENTION

Accordingly, an object of the present invention is to provide an ink jet recording apparatus, as well as a method, which facilitates optimization of recording after replacement of a recording head thereon, thereby overcoming the above-described problems of the prior art.

Another object of the present invention is to provide an ink jet recording apparatus, as well as a method, which automatically performs a discharge recovery operation of a newly mounted recording head.

Still another object of the present invention is to provide a recording apparatus, as well as a method, which can perform high quality recording even after replacement of one or more recording heads with new recording heads.

A further object of the present invention is to provide an ink jet recording apparatus, as well as a method, which can efficiently read head characteristic information carried by a newly mounted recording head.

In accordance with one aspect of the invention, an ink jet recording apparatus for recording information on a recording medium comprises at least one replaceable recording head, detection means for detecting replacement of the recording head, and discharge recovery means for effecting a discharge recovery operation on the recording head to recover ink based on discharge characteristics of the recording head. In addition, recovery control means causes the discharge recovery means to perform the discharge recovery operation when a new replacement recording head is detected by the detection means.

In accordance with another aspect of the invention, an ink jet recording apparatus for recording information on a recording medium comprises at least one replaceable recording head having identification information, detection means for detecting replacement of the recording head on the basis of the identification information, and discharge recovery means for effecting a discharge recovery operation on the recording head to recover ink based on discharge characteristics of the recording head. In addition, recovery control means causes the discharge recovery means to perform the discharge recovery operation when a new replacement recording head is detected by the detection means.

In accordance with yet another aspect of the invention, an ink jet recording method records information with an ink jet recording apparatus having at least one replaceable recording head with head identification information. The method comprises the steps of reading the head identification information from the recording head, detecting replacement of the recording head by comparing the head identification information from the recording head with head identification information stored in the ink jet recording apparatus, and executing a discharge recovery operation when replacement of the recording head is detected.

In accordance with still another aspect of the invention, an ink jet recording apparatus for recording information on a recording medium comprises at least one replaceable recording head having head characteristic information, checking means for checking a normal operating state of the recording apparatus, and detection means for detecting replacement of the recording head. The detection means includes reading means for reading the head characteristic information from the recording head, with the checking means checking the normal operating state after detection of a new replacement recording head by the detection means. In addition, memory means stores the head characteristic information read by the recording means, driving means outputs to the recording head a driving signal based on the head characteristic information stored in the memory means, and control means causes the memory means to store head characteristic information read from the recording head when a new replacement recording head is detected by the detection means.

In accordance with still another aspect of the invention, an ink jet recording method records information with an ink jet recording apparatus having at least one replaceable recording head with head characteristic information and head identification information. The method comprises the steps of checking a normal operating state of the ink jet recording apparatus and reading the head characteristic information and head identification information from the recording head. In addition, a new replacement recording head is detected based on the head identification information, head characteristic information is stored in a memory when a new replacement recording head is detected, and a driving signal based on the head characteristic information and stored in the memory is delivered to the recording head to perform recording.

These and other objects, features and advantages of the present invention will become more clear from the flowing description of the preferred embodiments when the same is read in conjunction with the accompanying drawing.

BRIEF DESCRIPTION OF THE DRAWINGS

FIG. 23 is a flow chart illustrative of 20° C. temperature control routine and 25° C. temperature control routine;

FIG. 62 is an illustration of the relationship between a table pointer TA1 and main heat pulse width P3 determined by the pointer TA1;

FIG. 63 is an illustration of the relationship between a table pointer TA3 and pre-heat pulse width P1;

FIGS. 67(A)–67(C) are illustrations of the relationship between the head temperature TH and the pre-heat pulse width P1;

FIG. 84 is an illustration of the content of the data stored in the ROM 854;

DETAILED DESCRIPTION OF THE PREFERRED EMBODIMENTS

Embodiments of the present invention will be described below with reference to the accompanying drawings.

Figure 1:
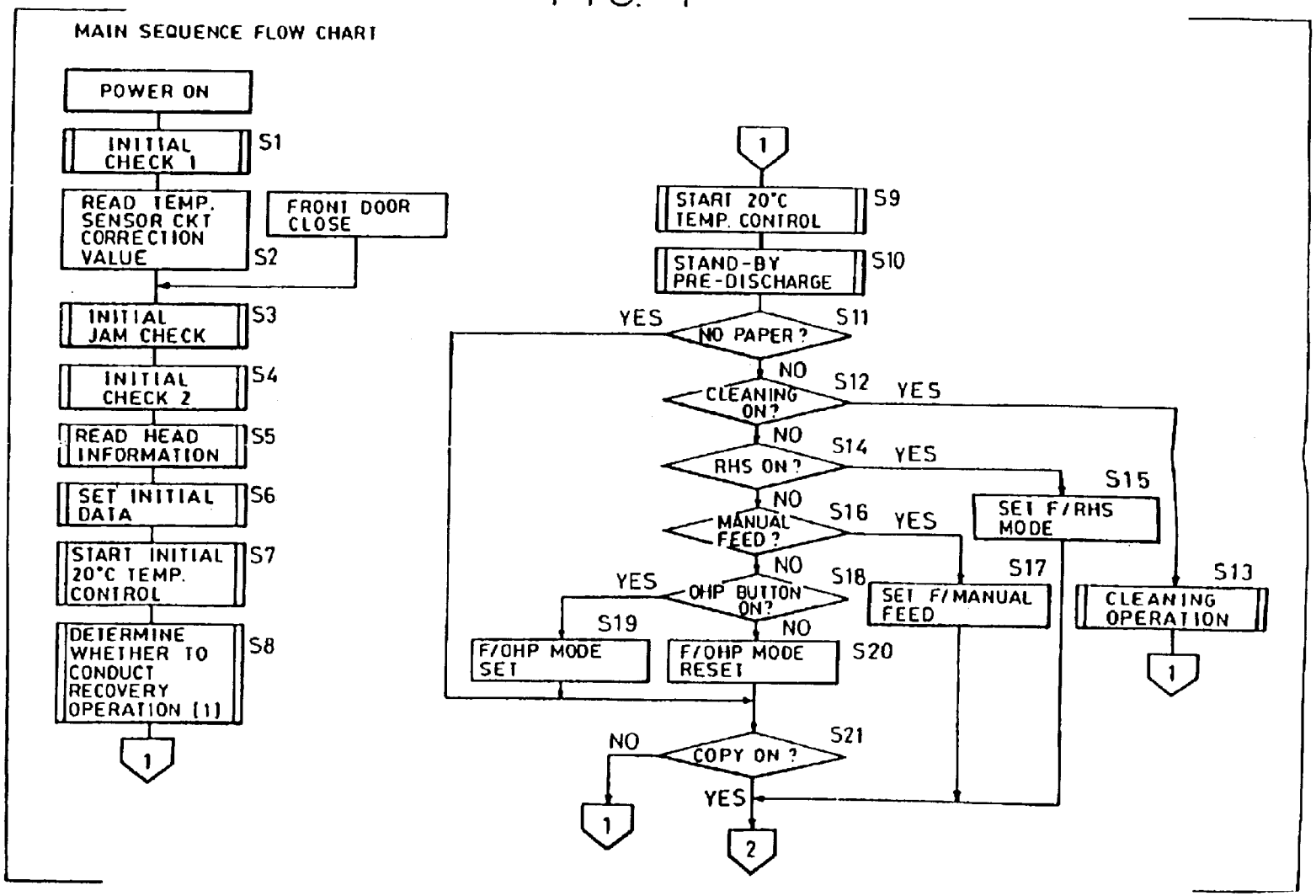
FIG. 1 is a flow chart showing a portion of the main flow of control performed in an embodiment of the ink jet recording apparatus of the present invention.
Figure 2:
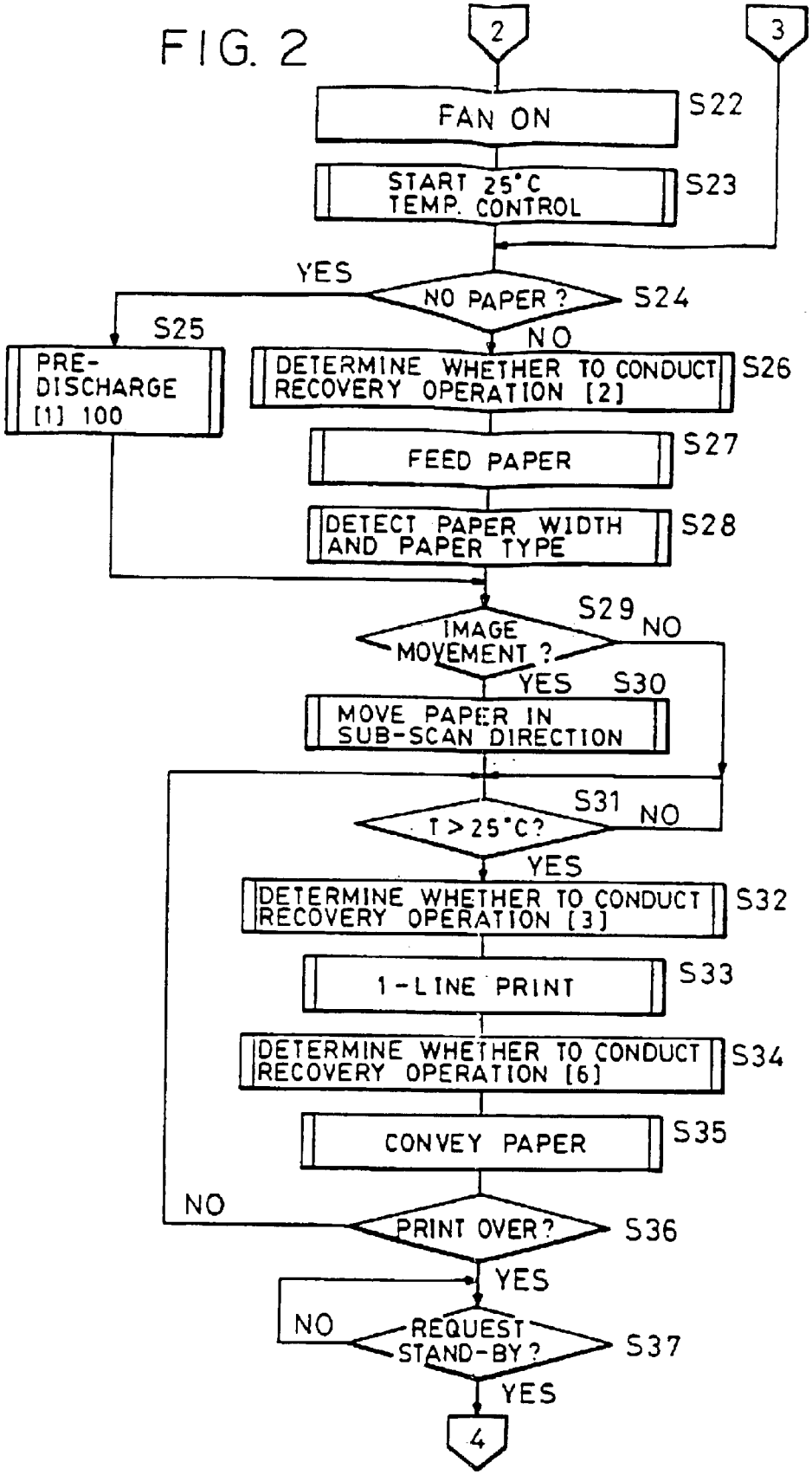
FIG. 2 is a flow chart showing another portion of the main flow of the control performed in the embodiment of the ink jet recording apparatus of the present invention.
Figure 3:
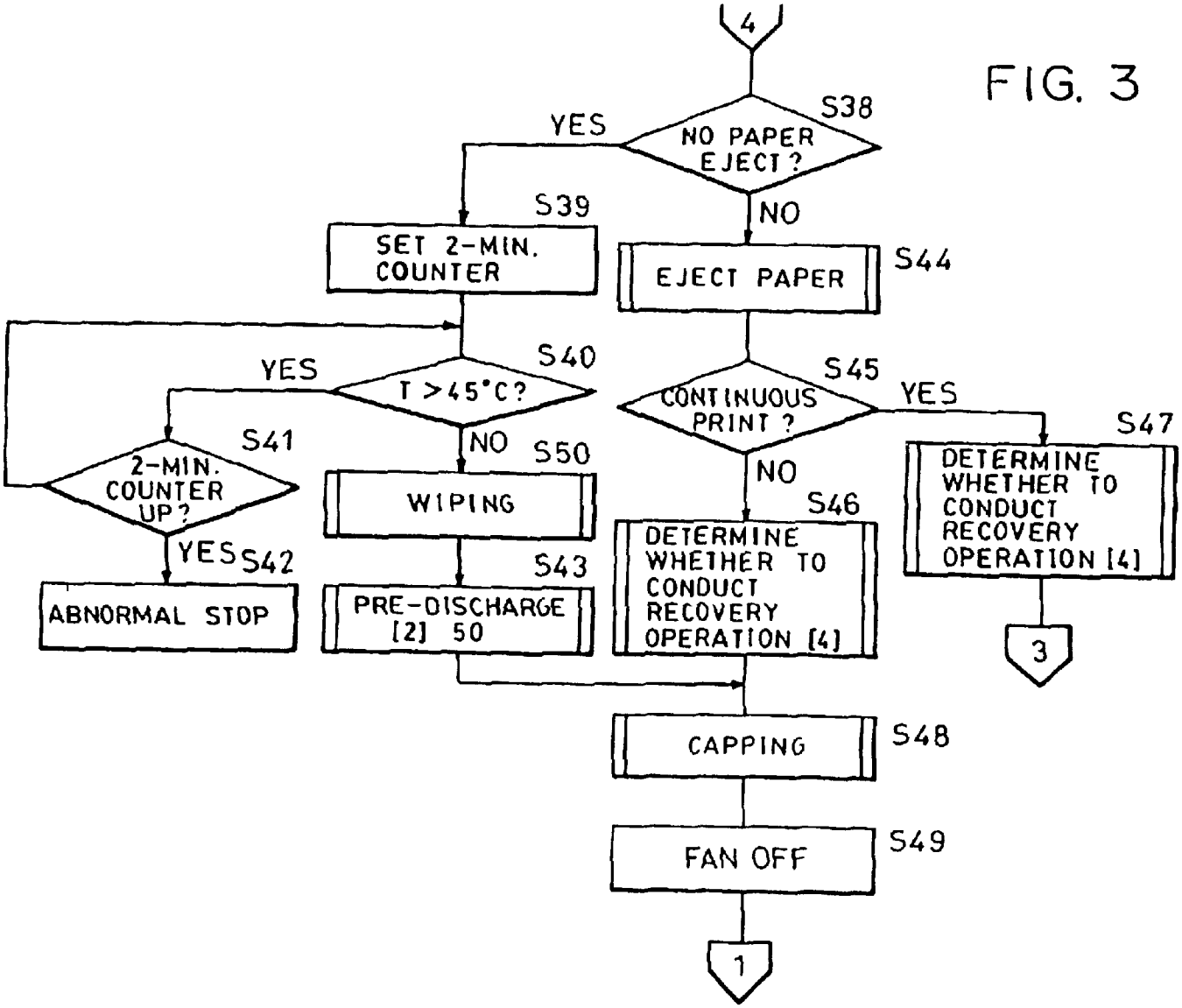
FIG. 3 is a flow chart showing still another portion of the main flow of the control performed in the embodiment of the ink jet recording apparatus of the present invention.

FIGS. 1 through 3 are flowcharts showing the main control operation of a first embodiment of an ink jet recording apparatus according to the present invention. Main control will now be outlined by referring to FIGS. 1 through 3.

When the recording apparatus is switched on, initial checking of the apparatus is performed in step S1. This initial checking operation involves checking of a ROM and a RAM (random access memory) on the apparatus. That is, in the initial checking process, it is checked whether a normal operation of the apparatus is available by checking programs and data. In step S2, the correction value of a temperature sensor circuit is read in. In step S3, initial jam checking is performed. In this embodiment, initial jam checking is performed when a front door is closed as well. In step S4, initial checking needed for reading in the data of a recording head in a subsequent step is performed. In step S5, data in the ROM incorporated in the recording head is read in. Next, in step S6, setting of the initial data is performed.

In step S7, initial 20° C. temperature control is initiated, and then determination of the recovery operation [1] (determination as to whether the suction recovery operation is performed when the apparatus is switched on) is performed in step S8, thus completing a sequence of operations required for waiting.

A flow of control operations required for standby will now be explained. In step S9, 20° C. temperature control is performed. In step S10, pre-discharge for standby is performed. In step S11, it is determined whether or not there is a sheet of paper. If there is no paper, the process goes to step S21. In step S12, it is determined whether or not a cleaning button has been pressed. If the cleaning button has been pressed, a cleaning operation is performed in step S13. In step S14, it is determined whether or not a RHS (Reader Head Shading) button has been pressed. If the RHS button has been pressed, a RHS mode flag is set in step S15. RHS indicates the head shading process in which the uneven density of the recording head is corrected. In this process, the uneven density of a printed pattern is read by a reading unit (a reader), and the read uneven density is corrected.

If it is determined in step S16 that manual paper feed has been performed, a manual feed flag is set in step S17, and then the process goes to step S22 to initiate a copying operation. If it is determined in step S18 that an OHP (Over Head Projector) button has been pressed, a OHP mode flag is set in step S19. If the OHP button has not been pressed, the OHP mode flag is reset in step S20. If it is determined in step S21 that a copying button has been pressed, the process goes to step S22 to initiate the copying operation. If the copying button has not been pressed, the process returns to step S9. The process returns to step S9 when the cleaning operation has been completed in step S13 as well.

Copying is performed in the following manner: in step S22, a fan for suppressing an increase in the temperature of the interior of the apparatus is turned on. In step S23, 25° C. temperature control is initiated. In step S24, it it determined whether or not there is a sheet of paper. If there is no paper, pre-discharge [1] (N=100) is performed in step S25, and then the process proceeds to step S29. Here, N indicates a number of times pre-discharge is performed. Next, in step S26, recovery operation determination [2] (determination as to whether or not the suction recovery operation is performed prior to paper feed) is performed. Thereafter, paper is fed in step S27. In step S28, the width of and type of paper are detected. In step S29, it is determined whether or not image movement is performed. If image movement is performed, paper is moved in a sub-scanning direction in step S30. If image movement is not performed, it is determined in step S31 whether or not the temperature of the writing head is 25° C. or above. If the temperature is 25° C. or above, recovery operation determination [3] (determination as to whether the recovery operation is performed which is based on the amount of ink evaporated in a non-capping state) is performed, and then a recording operation over 1 line is performed in step S33. Thereafter, in step S34, recovery operation determination [6] (determination as to whether the recovery operation is performed which is based on the wiping timing) is performed, and then the paper is conveyed in step S35.

In step S36, it is determined whether or not the recording operation has been completed. If it has been completed, data, e.g., a number of sheets of paper on which printing has been conducted, is written in a ROM of the recording head, and then the process goes to step S37. If the recording operation has not been completed, the process returns to step S31. In step S37, it is determined whether or not standby is requested. If standby is requested, process flow goes to step S38.

In step S38 and subsequent steps, paper ejection and recovery operation determination (4) after one sheet printing (removal of printing bubbles, removal of bubbles in the liquid chamber, cooling of the apparatus when the temperature thereof has been increased to an abnormally high value, recovery) are performed. In step S38, it is determined whether or not there is a sheet of paper to be ejected. If there is no paper to be ejected, reduction of the temperature to 45° C. or below is awaited in steps S39, 40 and 41. If reduction of the temperature does not occur within 2 minutes, abnormal stop of the apparatus is performed in step S42. If the temperature has been reduced to 45° C. or below, a wiping operation is conducted in step S50. Thereafter, a pre-discharge operation (N=50) is performed in step S43, and capping is conducted in step S48. If there is a sheet of paper to be ejected, a paper ejection operation is conducted in step S44. It is determined in step S45 whether or not continuous printing is performed. If continuous printing is performed, recovery operation determination [4] is performed in step S47, and then the process returns to step S24. If continuous printing is not performed, recovery operation determination [4] is performed in step S46, and then capping is performed in step S48, as in the case where there is no paper to be ejected. Thereafter, the fan is stopped in step S49, and then the process returns to step S9, thus completing the copying operation.

Figure 4:
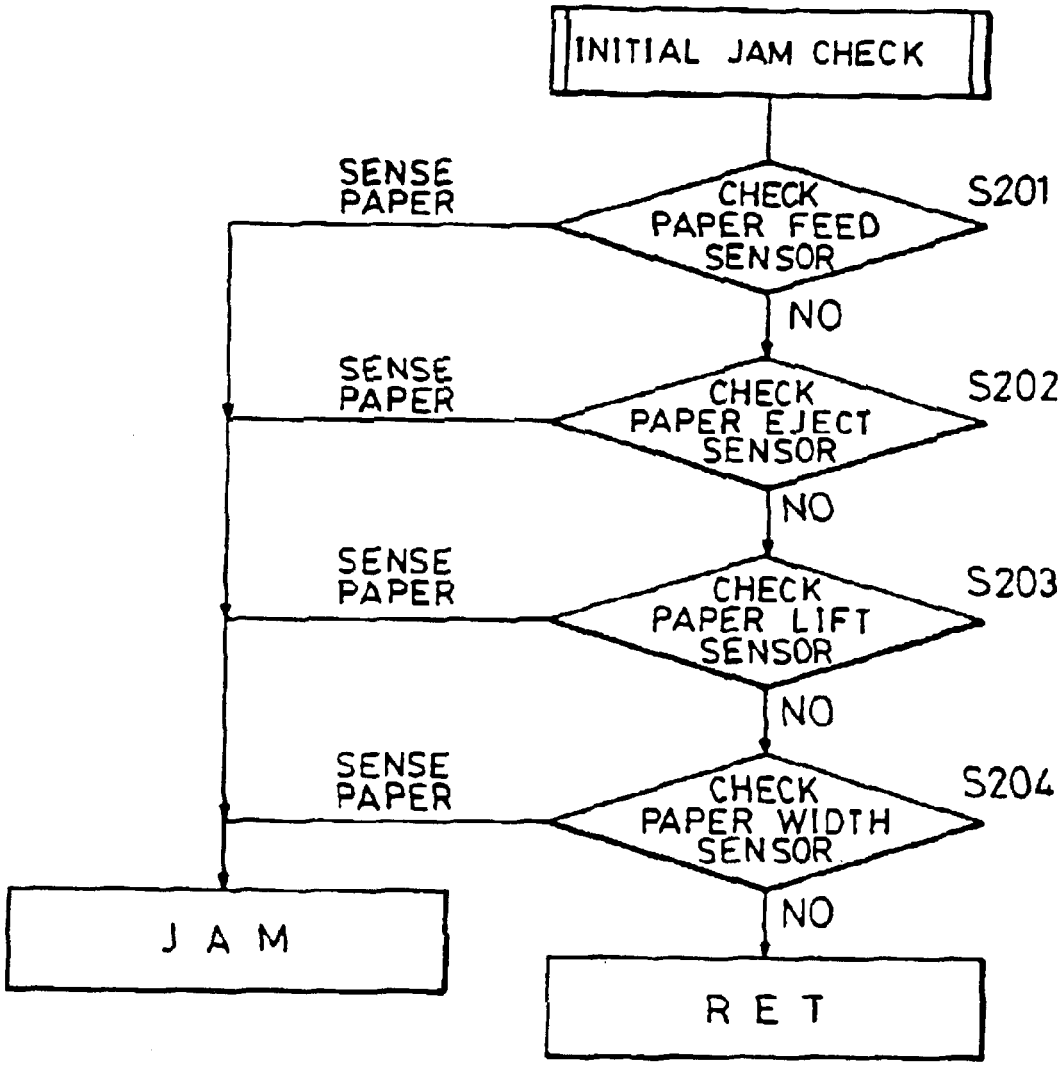
FIG. 4 is a flow chart showing the detail of an initial jam checking routine executed in Step S3 of the control process.

FIG. 4 is a flowchart showing in detail the initial jam checking routine executed in step S3. This routine is executed immediately after the apparatus is switched on. In steps S201 to step S204, it is determined using a paper feed sensor, a paper ejection sensor, a paper lift sensor and a paper width sensor whether or not a sheet of recording paper or other paper is present in a conveying path or near a carriage. If there is paper, it is determined that jam has occurred, and a jam alarm is issued. If there is no paper, the process returns to the main routine.

Figure 5:
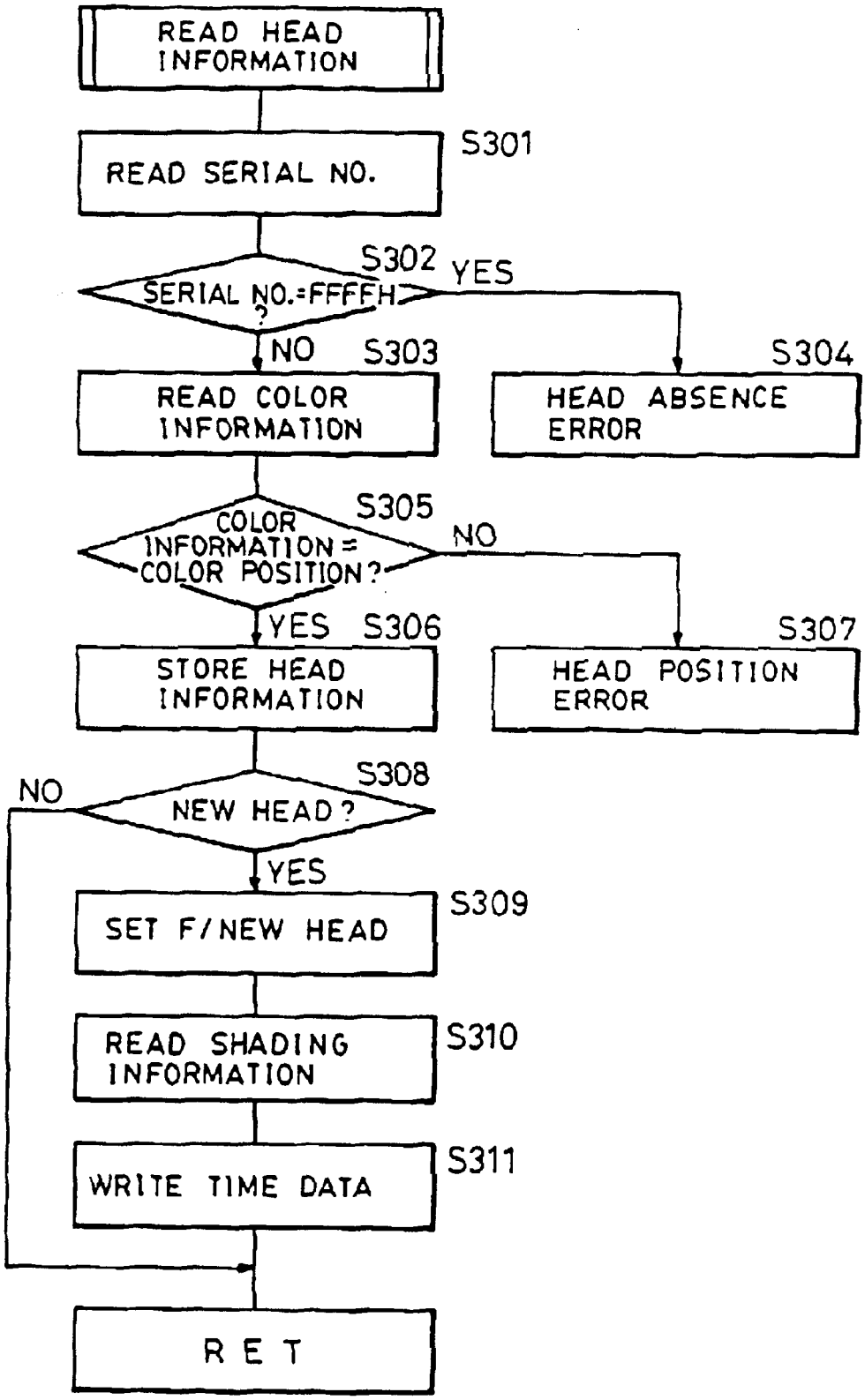
FIG. 5 is a flow chart showing the detail of a head information reading routine executed in Step S5 of the control process.

FIG. 5 is a flowchart showing the head data reading-in routine in detail. In step S301, serial no. given to a writing head is read in, and it is determined in step S302 whether or not the value of serial no. is FFFFH. If the value of serial no. is FFFFH, it is determined in step S304 that there is no head, and head absence error thus occurs. If the value of serial no. is not FFFFH, color data on the head is read in step S303. Thereafter, it is determined whether or not the head has been loaded at a normal position designated by that color using the color data. If the head has been loaded correctly, the process goes to step 306. If the head has been loaded at a wrong position, the process goes to step S307.

In step S306, the remaining head data (including the printing pulse width, the temperature sensor correction value, the number of sheets of paper the head has printed, the number of times wiping has been conducted) is read and stored. In step S308, it is determined using the head's serial No. whether or not the writing head which has been loaded is a new one. The serial no. of a head is stored in a back-up RAM so that it can be compared with the data read from the loaded head. If they are different, it is determined that a new head has been loaded. If they are identical, it is determined that the head has not been replaced with a new one. In this embodiment, this comparison of serial nos. is separately conducted on the heads of black, cyan, magenta and yellow. If it is determined that replacement of the head has not been performed, the head data reading-in routine is completed. If it is determined that a new head has been loaded, the new head data is stored in the memory in the apparatus and a flag (or data) indicating that the new head has been loaded is set in the memory in step S309. Next, in step S310, HS data (shading data) of the writing head is read, and then the time when this new head is used first is written in a non-volatile memory in the head from the clock incorporated in the apparatus in step S311, thus completing the head data reading-in routine.

The recovery operation (suction, pre-discharge, wiping) conducted during printing will be explained.

(Recovery Operation Determination [1])

Figure 6:
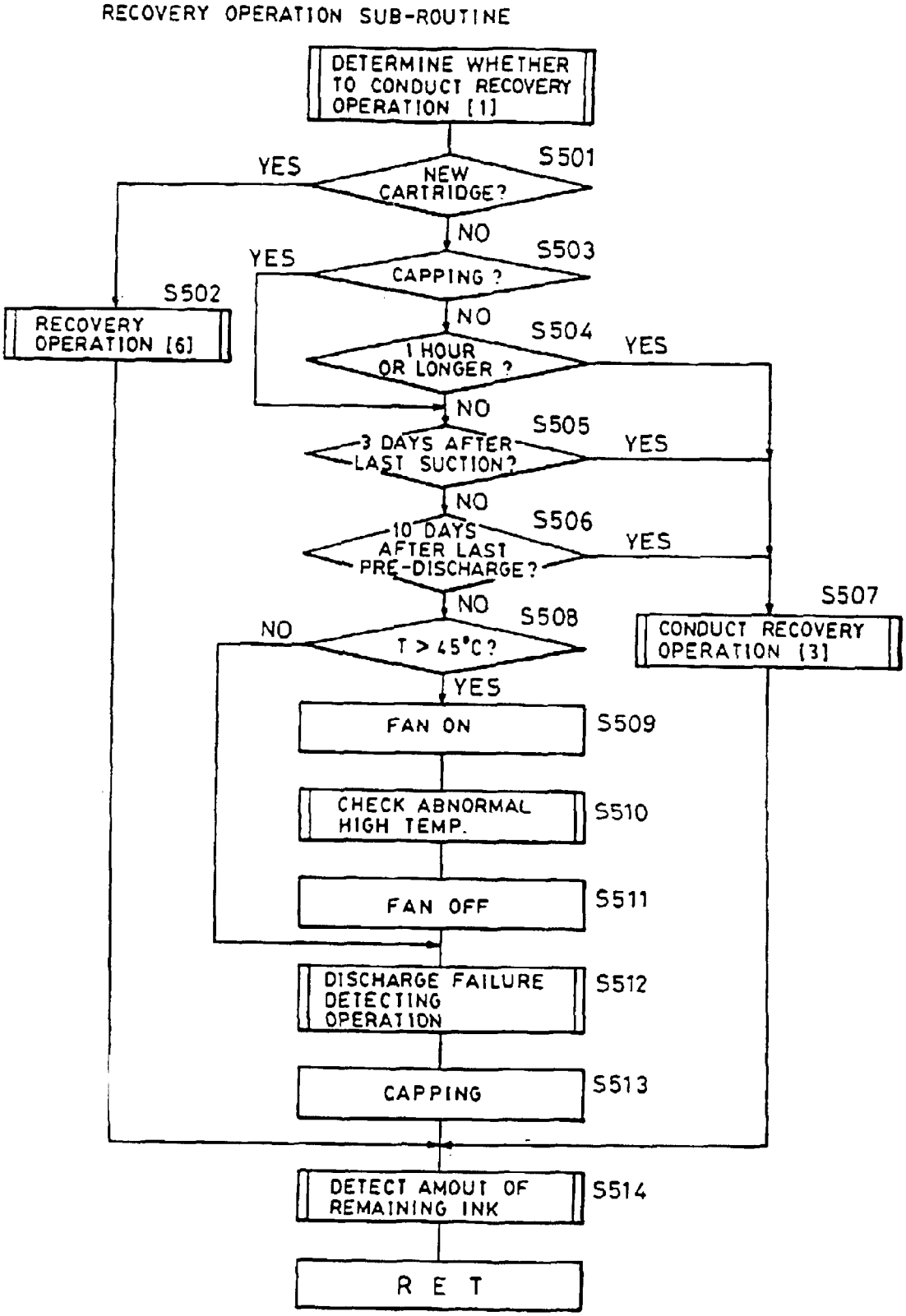
FIG. 6 is a flow chart showing the detail of a recovery operation determination routine [1] in Step S8 of the control process.

FIG. 6 is a flowchart showing in detail the recovery operation determination [1] routine conducted in step S8. In step S501, it is determined whether or not a new recording head has been loaded in the recording apparatus. If a new recording head has been loaded, the process goes to step S502 and recovery operation [6] (new cartridge suction recovery) is conducted. Thereafter, the amount of ink which remains is detected in step S514, thus completing recovery operation determination [1].

If a new head has not been loaded, it is determined in step S503 whether or not the recording head has been capped. If the recording head has been capped, the process goes to step S505. If no capping has been performed, it is determined in step S504 whether or not the recording head has not been capped for 1 hour or longer. If the recording head has not been capped for 1 hour or longer, the viscosity of the ink in the nozzles of the head is increased, thus requiring the recovery operation. If the non-capping state has not lasted 1 hour, it is determined using the apparatus which is in an operating state in step S505 whether or not it has been three days or more since the suction operation was last conducted. If three days have passed, a recovery operation is necessary. In step S506, it is determined from the apparatus which is in an operating state whether or not it has been 10 days or more since pre-discharge was last conducted. If 10 days have passed, the recovery operation is necessary. Under the aforementioned conditions, recovery operation [3] (timer suction recovery) is conducted in step S507.

If it is determined in step S508 that the head temperature is 45° C. or higher (an abnormally high temperature), the fan is rotated in step S509, and abnormally high temperature checking is conducted in step S510. After abnormally high temperature checking has been conducted, rotation of the fan is stopped in step S511, and then the process goes to step S512. If it is determined in step S508 that the head temperature is 45° C. or below, the process directly goes to step S512. In step S512, ink discharge failure detection is performed. Thereafter, in step S513, capping is conducted. In step S514, the amount of ink which remains is detected, thus completing the routine of recovery operation determination [1].

(Discharge Failure Detection Operation)

Figure 7:
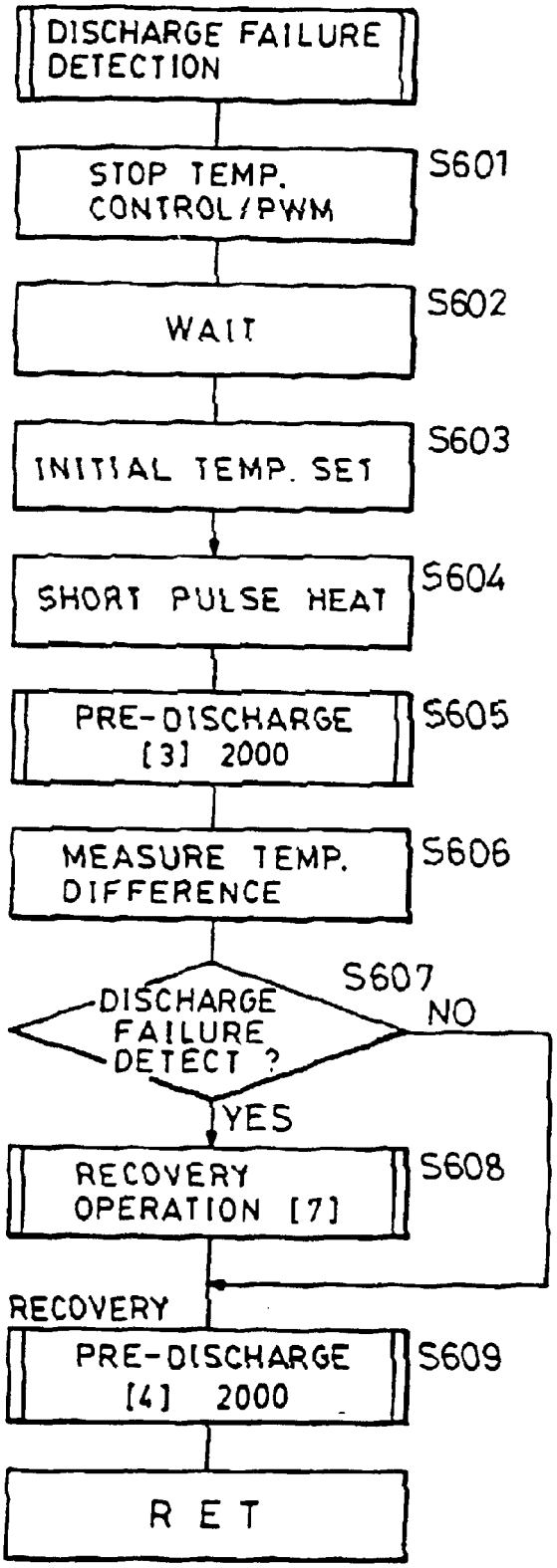
FIG. 7 is a flow chart showing the detail of a discharge failure detection routine executed in Step S512 of the control process.

FIG. 7 is a flowchart showing in detail the discharge failure detection operation routine executed in step S512. In step S601, temperature control/PWM (pulse width modulation) control are stopped, and stabilization of the head temperature is awaited in step S602. In step S603, the temperature of the head which is not yet operated is measured, and short pulse heating is conducted in step S604. This short pulse heating is one conducted using driving pulses of a short width. Thereafter, in step S605, pre-discharge [3] is conducted (N=2000, PWM control is not conducted, and double pulses of a fixed pulse width are used). In step S606, the head temperature after the discharge operation has been conducted is measured, and in step S607 determination is made as to whether there is a difference between the head temperature measured before the discharge operation is conducted and that measured after the discharge operation has been conducted. If the temperature increase exceeds a predetermined value, it is determined that discharge failure has occurred on the recording head, and recovery operation [7] (discharge failure detection suction recovery) is conducted in step S608. If it is not determined that discharge failure has not occurred, pre-discharge [4] is performed 2000 times in step S609.

Now, the discharge failure detection method will be explained in detail. This method for detecting abnormal discharge of the head is conducted when the apparatus is switched on.

First, the principle of this discharge failure detection method will be explained. The recording method employed in this invention employs thermal energy to discharge ink. Most of the generated heat is discharged from the head together with the ink droplet. Hence, although a large amount of thermal energy is generated for driving the head, the temperature of the head does not increase much. However, in a nozzle in which discharge failure has occurred, the generated energy does not escape with the ink droplet, and a higher degree of increase in the head temperature than in the normal case occurs. Hence, head temperature detection is performed by means of the temperature sensor before and after discharge is conducted a fixed number of times. If the detected temperature exceeds a predetermined value, it is determined that discharge failure has occurred.

More specifically, initially the head temperature control by means of a sub heater is stopped, and the head temperature is measured and stored in the memory. Next, short pulse heating is conducted. In this heating, pulses having a pulse width which is small enough not to allow for discharge are applied to the heater in the nozzle to reduce the increased viscosity of the ink in the nozzle. Double pulses are used for driving. Both pre-pulses and main pulses have a fixed width of 1 μsec. The heater is driven continuously. Next, pre-discharge of 4 KHz is conducted 2000 times. During pre-discharge, PWM control is not conducted, and double pulses having a fixed value are used so as to allow a fixed amount of thermal energy to be applied to the head during discharge failure detection. Finally, the head temperature is measured, and an increase in the temperature is calculated. If this value exceeds a reference value, it is determined that discharge failure has occurred in the head.

{Abnormally High Temperature Checking)

Figure 8:
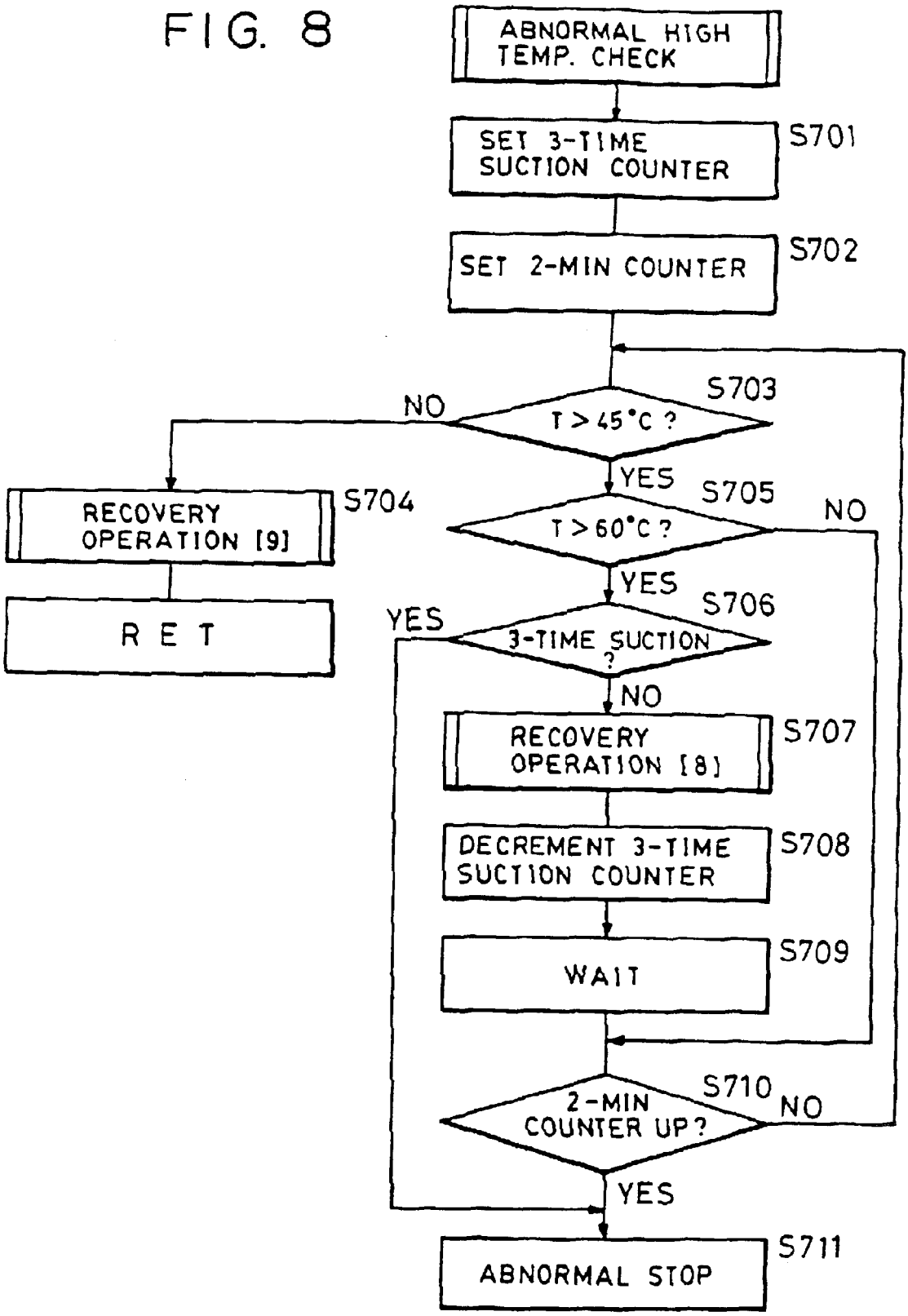
FIG. 8 is a flow chart showing the detail of an abnormal high-temperature checking routine.

FIG. 8 is a flowchart of the abnormally high temperature checking routine executed in step S510. In step S701, a three-time suction operation counter is set, and then a two-minute timer is set in step S702. Next, it is determined in step S703 whether or not the temperature of the recording head is 45° C. or above. If the temperature is 45° C. or above, the process goes to step S705. If the temperature is less than 45° C., a recovery operation [9] is performed in step S704.

In step 705, it is determined whether or not the temperature of the recording head is 60° C. or above. If the temperature is 60° C. or above, it is determined in step S706 whether or not the suction operation has been conducted three times or more by the apparatus. If the number of times the suction operation has been conducted is less than three, recovery operation [8] (high temperature printing suction recovery) is performed by the apparatus in step S707. Thereafter, subtraction of the three-time suction operation counter is conducted in step S708, and waiting for about 20 seconds is conducted in step S709. In this waiting period, reduction in the temperature of the head is awaited. If the suction operation has been conducted three times or more by the apparatus (step S706) or if high temperatures lasts for 2 minutes or longer (step S710), abnormal stop of the apparatus is conducted in step S711.

(Recovery Operation Determination [2])

Figure 9:
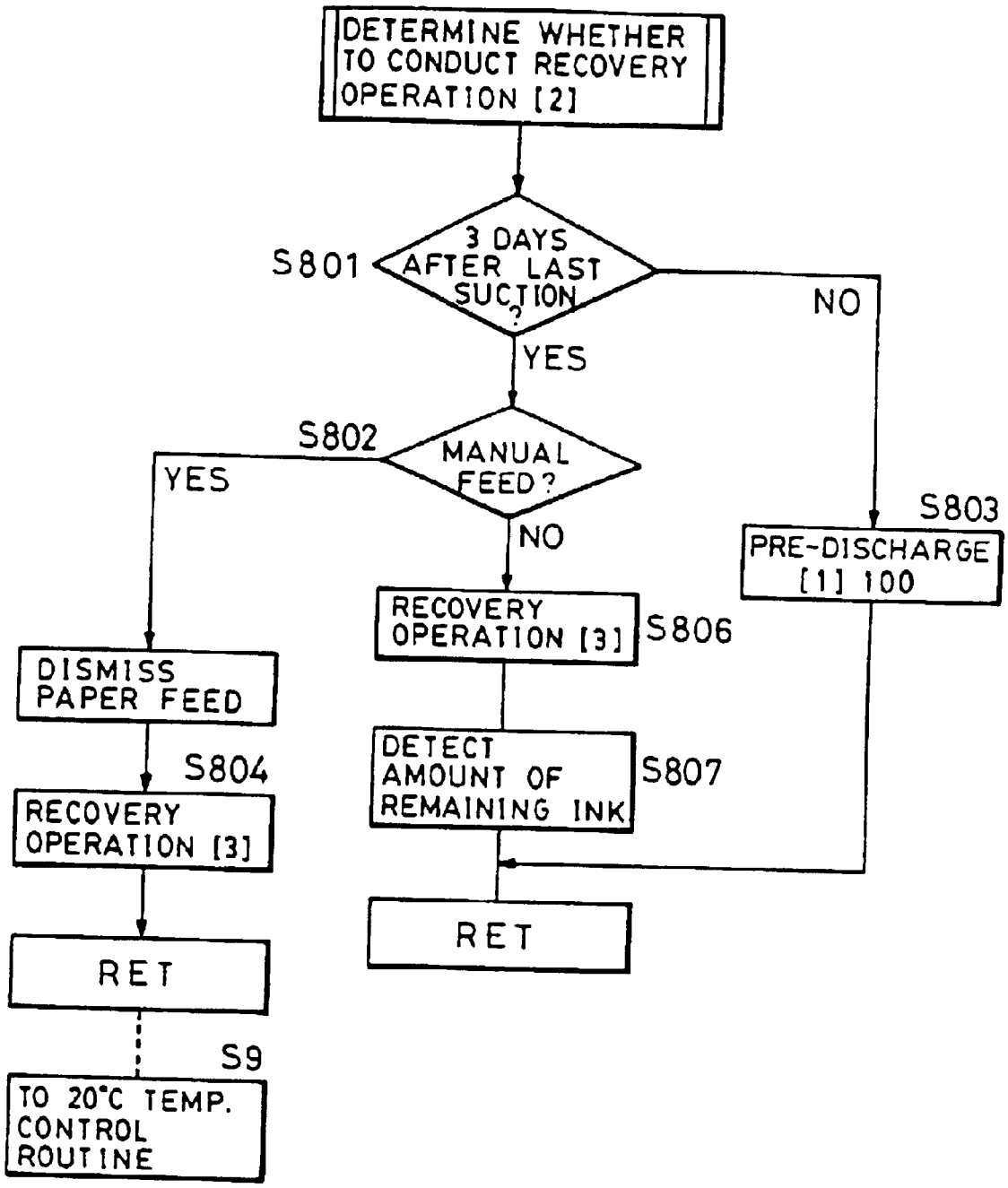
FIG. 9 is a flow chart showing the detail of a recovery operation determination routine [2] in Step S20 of the control process.

FIG. 9 is a flowchart of the recovery operation determination [2] routine executed in step S26. In step S801, it is determined whether or not printing has been conducted for three days or more since the recovery operation was last conducted. If printing has been conducted for three days or more, it is determined in step S802 whether or not manual feeding is conducted. If manual feeding is not conducted, a recovery operation [3] is conducted in step S806. Thereafter, the amount of ink which remains is detected in step S807, thereby completing a recovery operation determination [2] routine. If manual feeding is conducted, manual feeding is released in step S804, and then recovery-operation [3] is conducted in step S805. Thereafter, the process returns to step S9 of the main routine and 20° C. temperature control is conducted.

If it is determined in step S801 that it has been no more than three days since suction was conducted, pre-discharge [1] (N=100) is conducted in step S803, thus completing recovery operation determination [2].

(Recovery Operation Determination [3])

Figure 10:
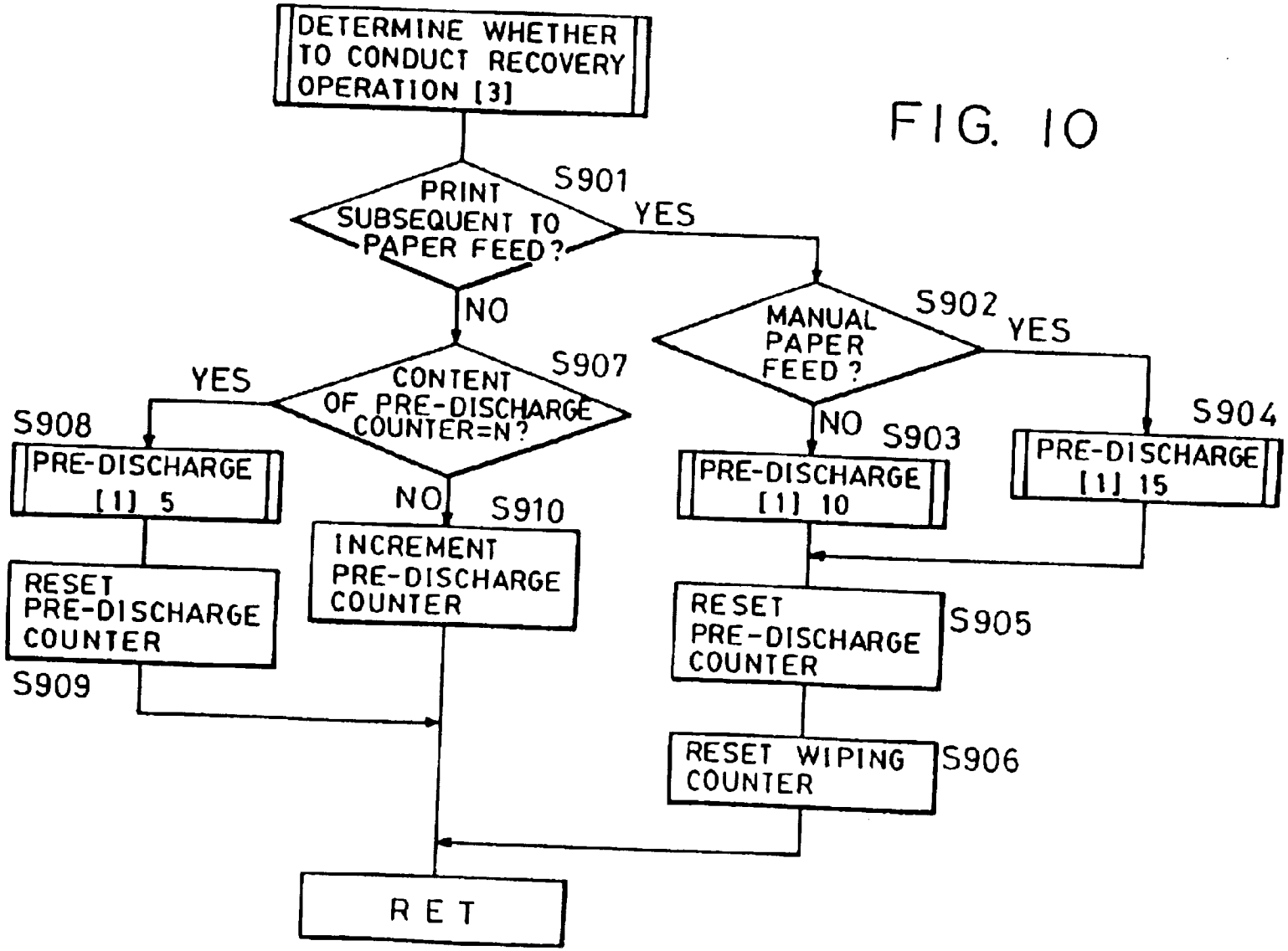
FIG. 10 is a flow chart showing the detail of a recovery operation determination routine [3]

FIG. 10 is a flowchart of the recovery operation determination [3] routine executed in step S32. In step S901, it is determined whether or not paper feed has just been conducted. If paper feed has just been conducted, pre-discharge is conducted a number of times corresponding to the type of paper feed. That is, if cassette feeding is conducted, pre-discharge [1] is performed 10 times. In the case of manual feeding, pre-discharge [1] is conducted 15 times (in steps S902, S903 and S904). Thereafter, a pre-discharge counter and a wiping counter are reset in steps S905 and S906.

If it is determined in step S901 that paper feed has not just been conducted, it is determined in step S907 whether or not the value set in the pre-discharge counter is N (N=2, in this embodiment). If the value is N, pre-discharge is conducted 5 times in step S908, and then the pre-discharge counter is reset in step S909, thus completing recovery operation determination [3] routine. If the value set in the counter is not N, addition of the pre-discharge counter is conducted in step S910, thereby completing the routine.

(Recovery Operation Determination [6])

Figure 11:
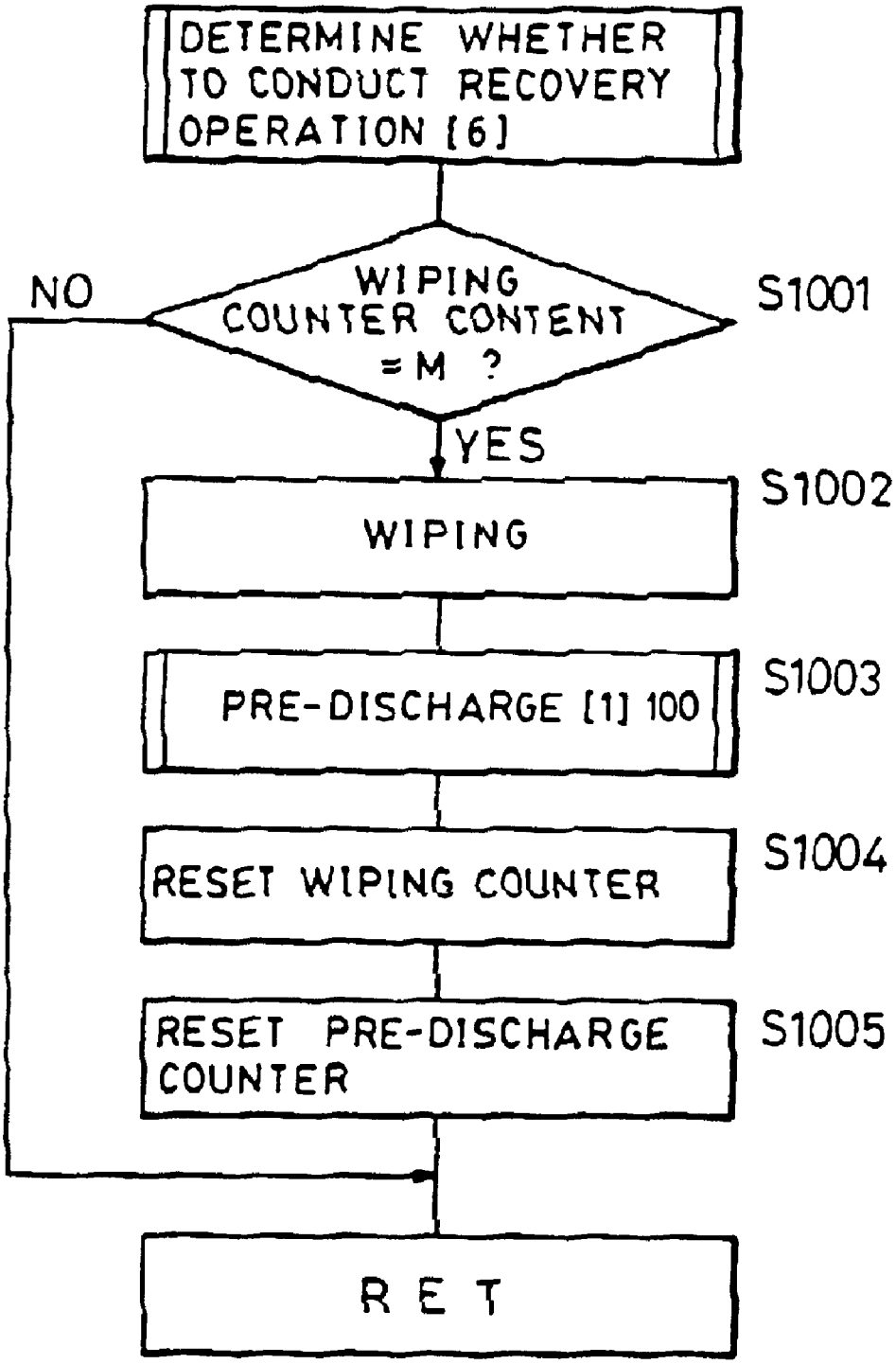
FIG. 11 is a flow chart showing the detail of a recovery operation determination routine [6]

FIG. 11 is a flowchart of the recovery operation determination [6] routine executed in step S34. In step S1001, it is determined whether or not the value set in a wiping counter is M (M=10 in this embodiment). If the value of the counter is M, wiping is conducted in step S1002, and then pre-discharge [1] is conducted 100 times in step S1003. Thereafter, the wiping counter is reset in step S1005, thereby completing the recovery operation determination [6] routine. If the value of the counter is not M, addition of the counter is conducted, thereby completing the routine.

(Recovery Operation Determination [4])

Figure 12:
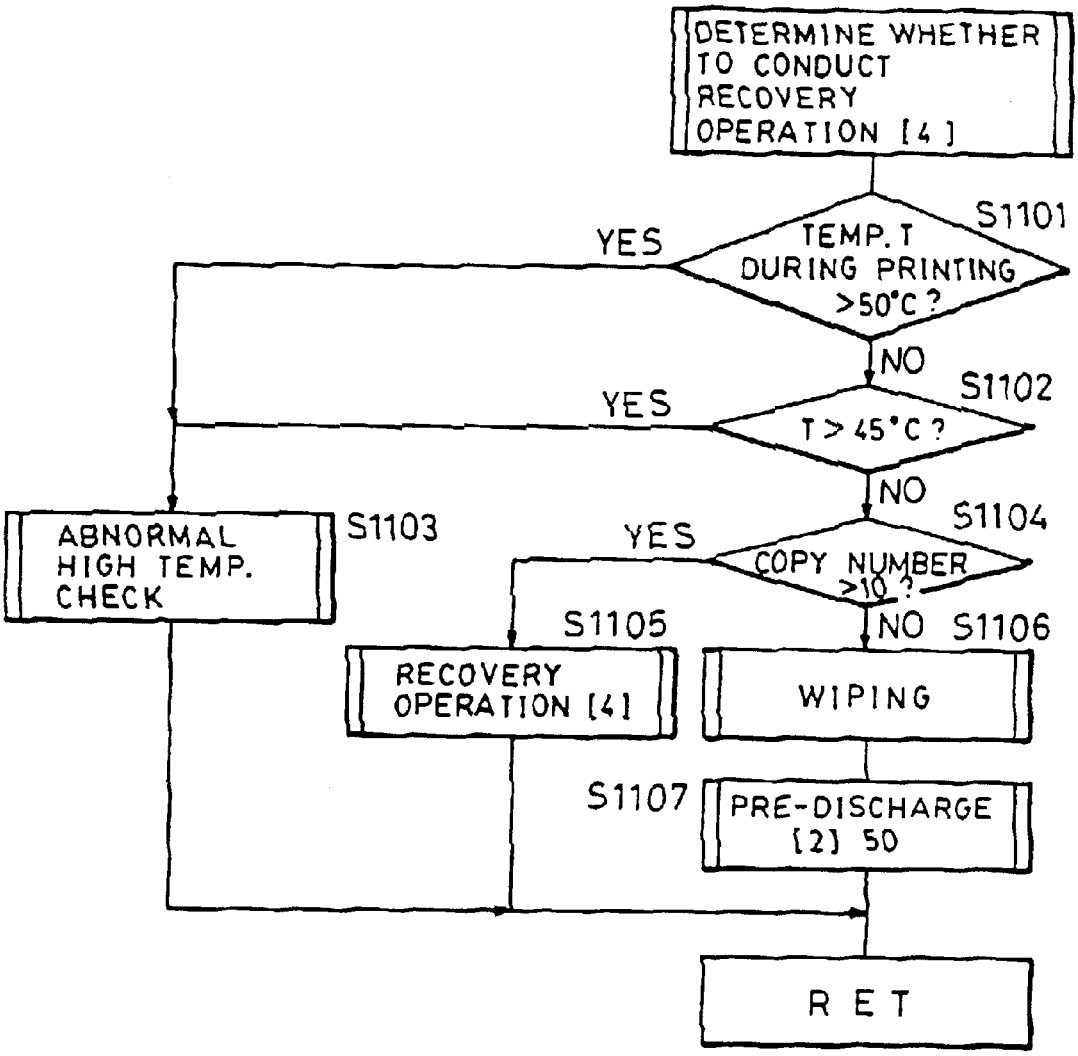
FIG. 12 is a flow chart showing the detail of a recovery operation determination routine [4]

FIG. 12 is a flowchart of the recovery operation determination [4] routine executed in step S47.

If it is determined that the temperature of the head during printing is 50° C. or above in step S1101 or if it is determined that the temperature has exceeded 45° C. after printing in step S1102, abnormally high temperature checking is conducted in step S1103. If the temperature has not exceeded 45° C. after printing, it is determined in S1104 whether or not the value set in a copying paper sheet number counter is 10. If the value of the counter is 10, recovery operation [4] (suction recovery after printing) is conducted in step S1105. If the value in the counter is not 10, wiping is conducted in step S1106, and then pre-discharge [2] (N=50) is conducted in step S1107, thereby completing recovery operation determination [4].

(Timer Suction Recovery)

Figure 13:
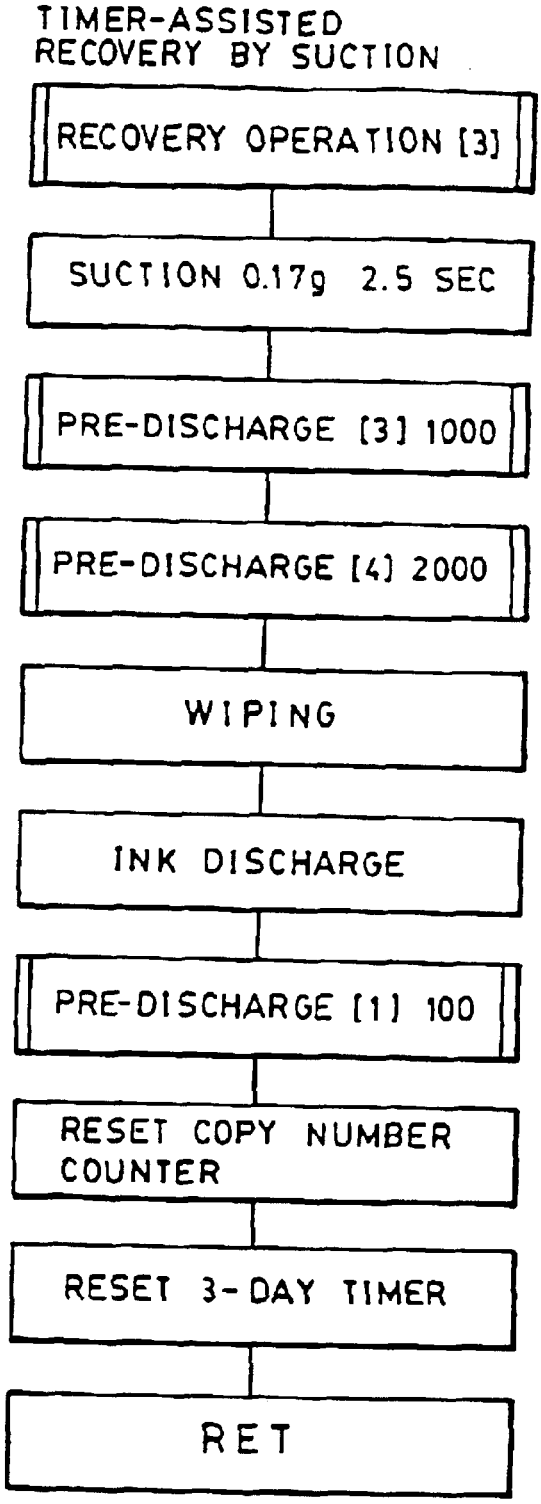
FIG. 13 is a flow chart showing the detail of a sucking discharge recovery routine (recovery operation [3])

FIG. 13 is a flowchart of the timer suction recovery (recovery operation [3]) routine. Where the suction recovery operation is not conducted for a long time, the viscosity of the ink in the liquid chamber of the head increases, thus increasing generation of bubbles in the liquid chamber of the head. Consequently, normal discharge may be prohibited. This recovery mode is conducted to prevent prohibition of normal discharge. Hence, it is conducted when it is determined that a fixed period of time has passed after the last suction or pre-discharge or in a non-capped state.

In the timer suction recovery operation, bubbles in the liquid chamber are removed by the suction of a pump to eliminate viscous ink. Furthermore, discharge is conducted concurrently with suction. In this way, instantaneous negative pressure is generated and the amount of negative pressure is thus increased, facilitating removal of-the bubbles in the liquid chamber. Furthermore, since an electrothermal energy conversion member is driven as means for generating bubbles to discharge ink, the temperature of the ink in each liquid passage is increased, and viscosity and, hence, the surface tension of the ink are reduced. Consequently, flow passage resistance of each liquid passage is further reduced, and removal of bubbles is thus further facilitated. Practically, a certain amount of negative pressure is generated in the liquid chamber of the head by means of a tube pump, and each of the nozzles is driven by the maximum driving frequency concurrently with generation of the maximum amount of negative pressure. At that time, however, flow of the ink in the liquid chamber is degraded and the density of the ink thus increases at the end portions of the nozzle array. Hence, the number of times discharge is conducted at the end portions is made larger than at the central portion so as to make the density of the ink in each nozzle the same in the printing conducted after recovery and thereby prevent uneven density due to increase in the viscosity of the ink. Maximum suction pressure of the pump is set as the suction pressure. Suction holding time is 2.5 seconds. The amount of ink which is sucked during that suction time is about 0.17 g. In pre-discharge [3] which will be described in detail later, pre-dishcarge is conducted on all the nozzles 1000 times. In pre-discharge [4], pre-discharge is conducted on the nozzles located at the end portions 2000 times. Therefore, the number of times discharge is conducted at the central portion is 1000 times, and that at the end portions is 3000. After suction, the orifice surface of the head is wiped using a rubber blade, and then pre-discharge is conducted.

(Suction Recovery After Printing)

Figure 14:
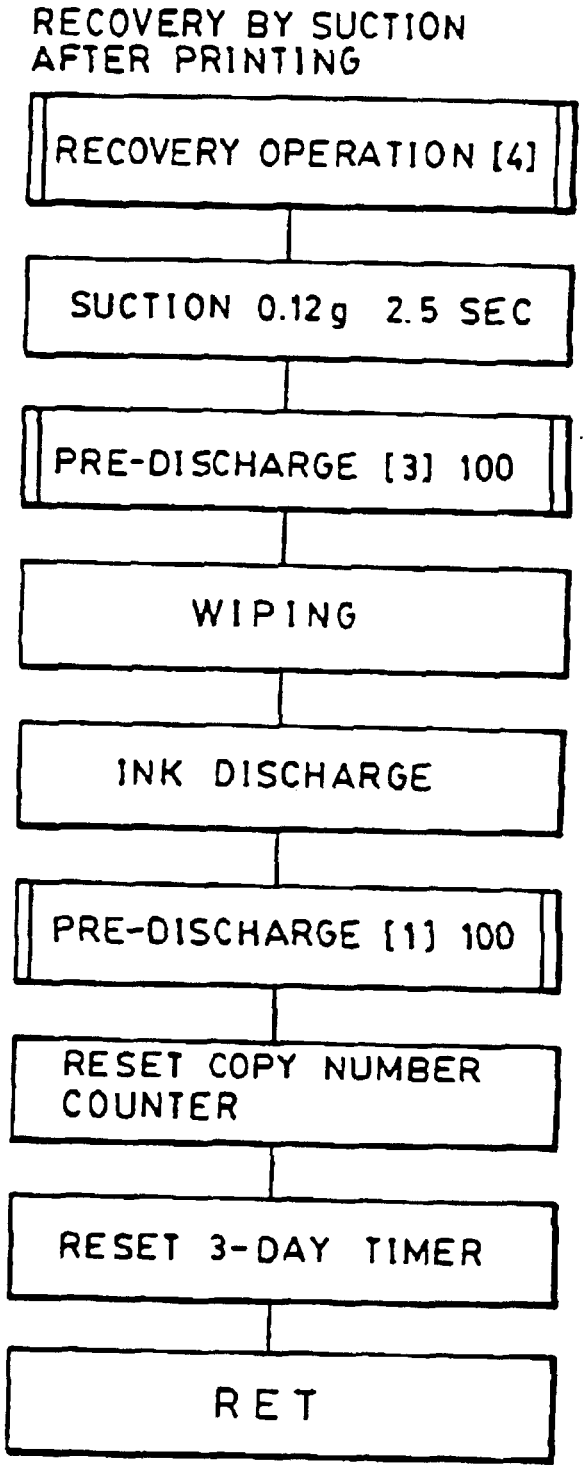
FIG. 14 is a flow chart showing the detail of a sucking discharge recovery routine which is executed after printing (recovery operation [4])

FIG. 14 is a flowchart showing in detail the suction recovery routine after printing (recovery operation [4]). Where the printing operation has been conducted for a long time, bubbles are generated in the liquid chamber of the head or the number of bubbles increases due to discharge. Consequently, normal discharge may not be conducted. In order to prevent this, this recovery mode is conducted. Hence, this recovery operation is conducted when printing has been conducted on a fixed number of sheets of paper after the last suction.

Bubbles in the liquid chamber are removed by the suction of the pump. Concurrently with suction, discharge is conducted. In this way, instantaneous negative pressure is generated and the amount of negative pressure required to remove bubbles in the liquid chamber is thus increased. Particularly, since this recovery operation is conducted immediately after printing, the temperature of the ink in each liquid passage is high, and the viscosity and, hence, the surface tension of the ink are low. Consequently, flow passage resistance in the liquid passage is low, and removal of bubbles is thus facilitated.

Practically, a certain amount of negative pressure is generated in the liquid chamber of the head by means of the tube pump, and each of the nozzles is driven with the maximum driving frequency concurrently with generation of the maximum negative pressure. The suction pressure is set to a value slightly smaller than the maximum pressure of that pump, because the viscosity of the ink is low and the maximum pressure is thus not necessary to remove bubbles and because it can prevent an increase of ink consumption. Suction time is 2.5 seconds, and the amount of ink which is sucked in that suction time is about 0.12 g. The number of times discharge is conducted is 100 for each nozzle. After suction, the orifice surface of the head is wiped using the rubber blade, and then pre-discharge is conducted.

(New Cartridge Suction Recovery)

Figure 15:
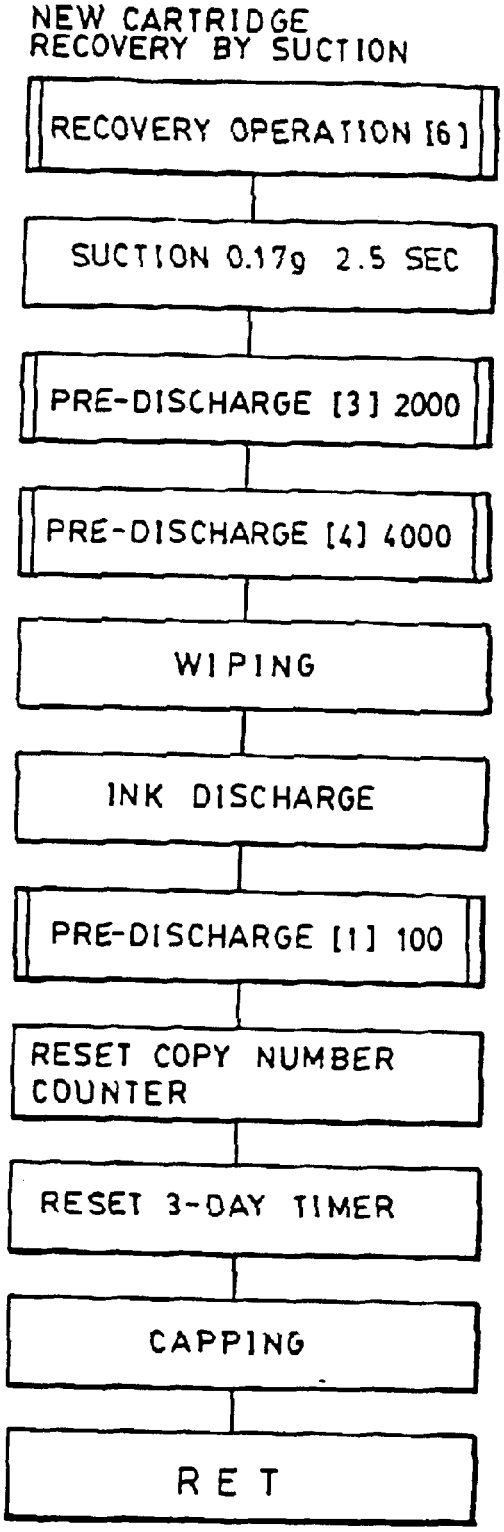
FIG. 15 is a flow chart showing the detail of a sucking discharge recovery routine which is executed on a newly mounted cartridge after a replacement (recovery operation [6])

FIG. 15 is a flowchart of the new cartridge suction recovery (recovery operation [6]) routine. When a new cartridge which is just unpacked is loaded in the apparatus, normal discharge may not be provided due to an increase in the ink viscosity or generation of or increase in the number of bubbles in the liquid chamber of the head. This recovery operation is conducted to prevent such a situation. Hence, it is conducted when it is determined that a new cartridge has been loaded in the apparatus.

Bubbles in the liquid chamber are removed by the suction of the pump so as to eliminate viscous ink. Furthermore, discharge is conducted concurrently with suction. In this way, instantaneous negative pressure is generated and the amount of negative pressure required to remove the bubbles in the liquid chamber is thus increased. Furthermore, since an electrothermal energy conversion member is driven as means for generating bubbles to discharge ink, the temperature of the ink in each liquid passage is increased, and viscosity and, hence, the surface tension of the ink are reduced. Consequently, flow passage resistance of each liquid passage is further reduced, and removal of bubbles is thus further facilitated. In the worst case, increase in the viscosity of the ink in the nozzle or liquid chamber is great in this recovery operation in comparison with other recovery operations. Hence, the number of times discharge is conducted simultaneously with suction is larger than in other recovery operations.

Figure 59:
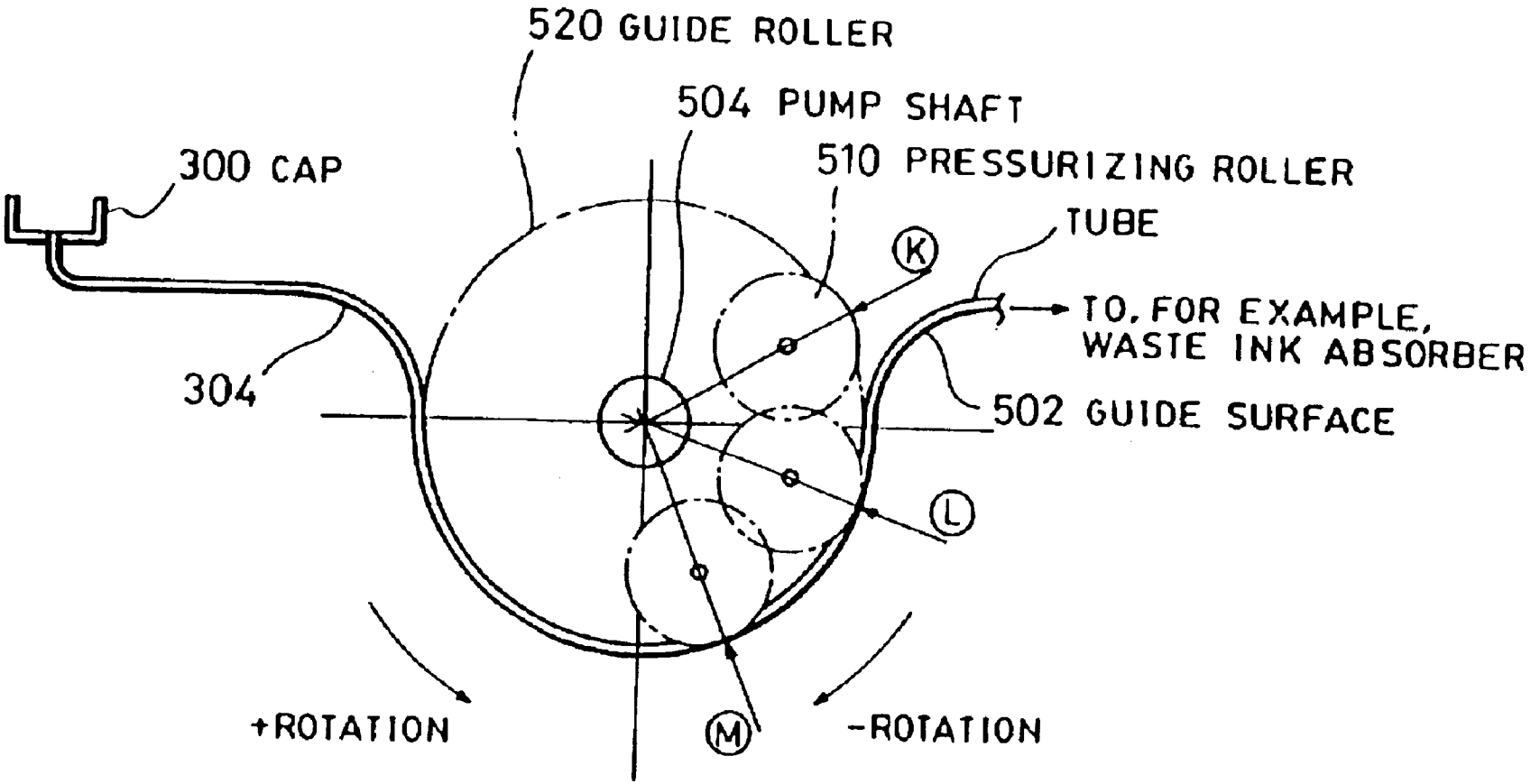
FIG. 59 is an illustration of an operation of a tube pump.

Practically, a certain amount of negative pressure is generated in the liquid chamber of the head by rotating a pressurizing roller of the tube pump shown in FIG. 59, which is located at position (K) in a head capped state, to position (L), and each of the nozzles is driven by the maximum driving frequency concurrently with generation of the maximum amount of negative pressure. At that time, however, flow of the ink in the liquid chamber is degraded and the density of the ink thus increases at the end portions of the nozzle array. Hence, the number of times discharge is conducted at the end portions is made larger than at the central portion so as to make the density of the ink in each nozzle the same in the printing conducted after recovery and thereby prevent uneven density due to increase in the viscosity of the ink. Maximum suction pressure of the pump is set as the suction pressure. Suction holding time is 2.5 seconds. The amount of ink which is sucked during that suction time is about 0.17 g. The number of times discharge is conducted at the central portion is 2000 times, and that at the end portions is 6000. After suction, the orifice surface of the head is wiped using a rubber blade, and then pre-discharge is conducted.

(Discharge Failure Detection Suction Recovery)

Figure 16:
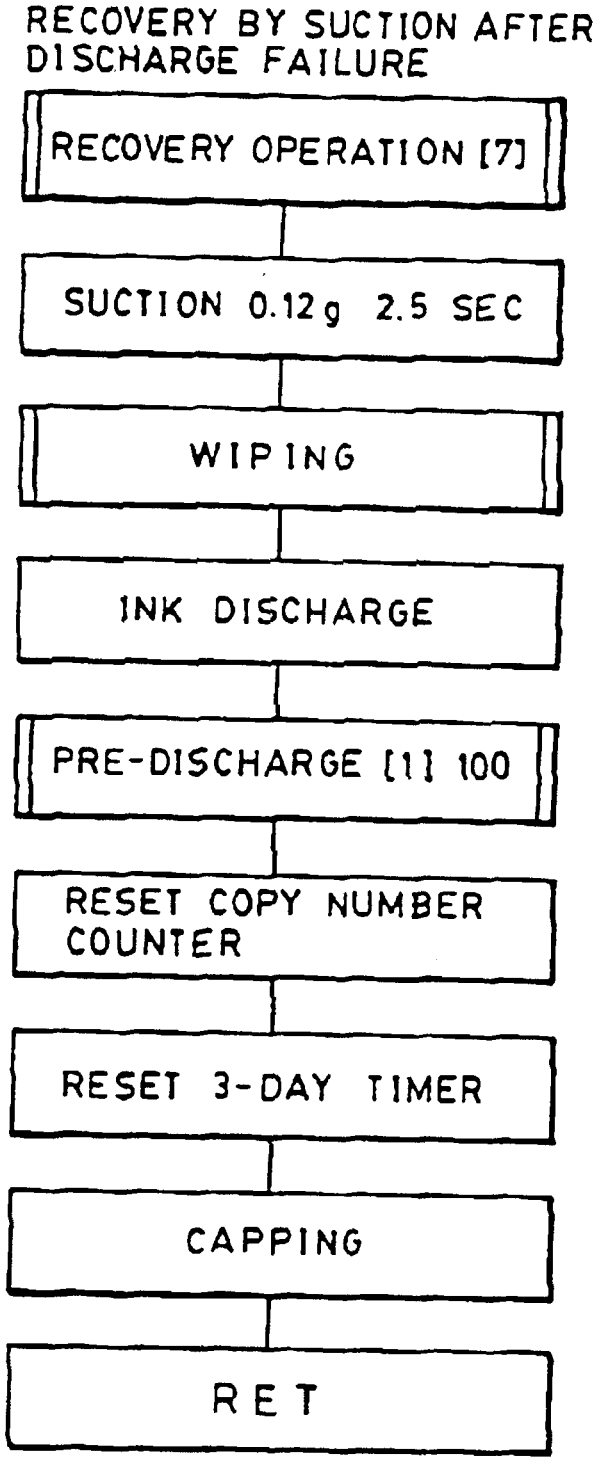
FIG. 16 is a flow chart showing the detail of a sucking discharge recovery-routine which is executed when a discharge failure has occurred (recovery operation [7])

FIG. 16 is a flowchart showing in detail the discharge failure detection suction recovery (recovery operation [7]) routine.

(Suction Operation After High Temperature Printing)

Figure 17:
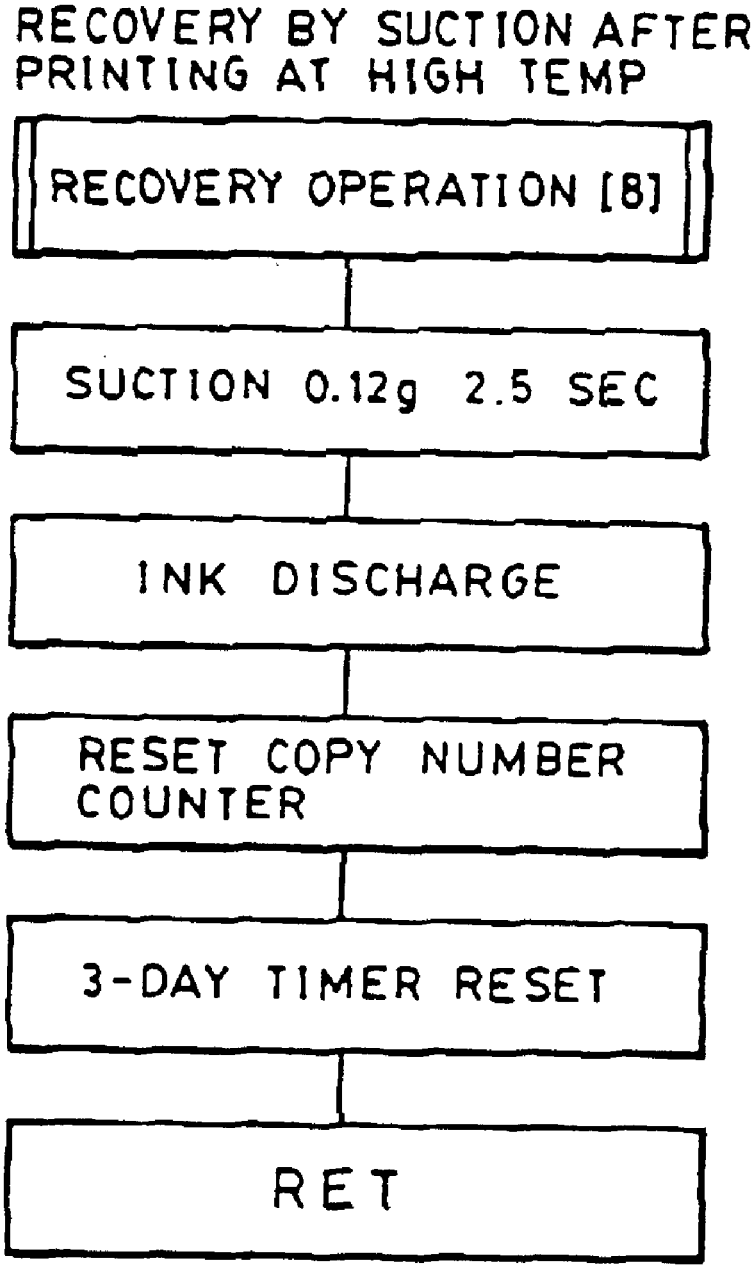
FIG. 17 is a flow chart showing the detail of a sucking discharge recovery routine which is executed after printing at higher temperature (recovery operation [8])

FIG. 17 is a flowchart showing in detail the suction recovery (recovery operation [8]) routine after high temperature printing. Where printing has been conducted for a long time, the temperature of the ink in the head increases to a value which does not allow for normal discharge. This recovery operation is conducted to prevent it. Hence, it is conducted when the temperature of the head is at a predetermined value or above.

High-temperature ink in the liquid chamber is discharged by the suction of the pump. At that time, discharge is not conducted in this recovery operation so as to prevent an increase in the temperature of the ink, although it is performed concurrently with suction in other recovery operations. The temperature of the ink in each of the liquid chambers is high, and the viscosity and, hence, the surface tension of the ink are low. Hence, the flow passage resistance in the liquid chamber is low, and low pressure is enough to replace high-temperature ink with low-temperature ink. A suction pressure slightly lower than the maximum pressure is set as the suction pressure, because the viscosity of the ink is low and a high pressure is thus not necessary and because it prevents an increase in the ink consumption.

Practically, a slightly low negative pressure is generated in the liquid chamber by rotating the pressuring roller of the tube pump shown in FIG. 59, which is located at position (K) in a head capped state, to position (M). Suction holding time is 2.5 seconds, and the amount of ink which is sucked in that suction time is about 0.12 g. After suction, the orifice surface of the head is wiped by the rubber blade.

(Recovery After High-Temperature Printing)

Figure 18:
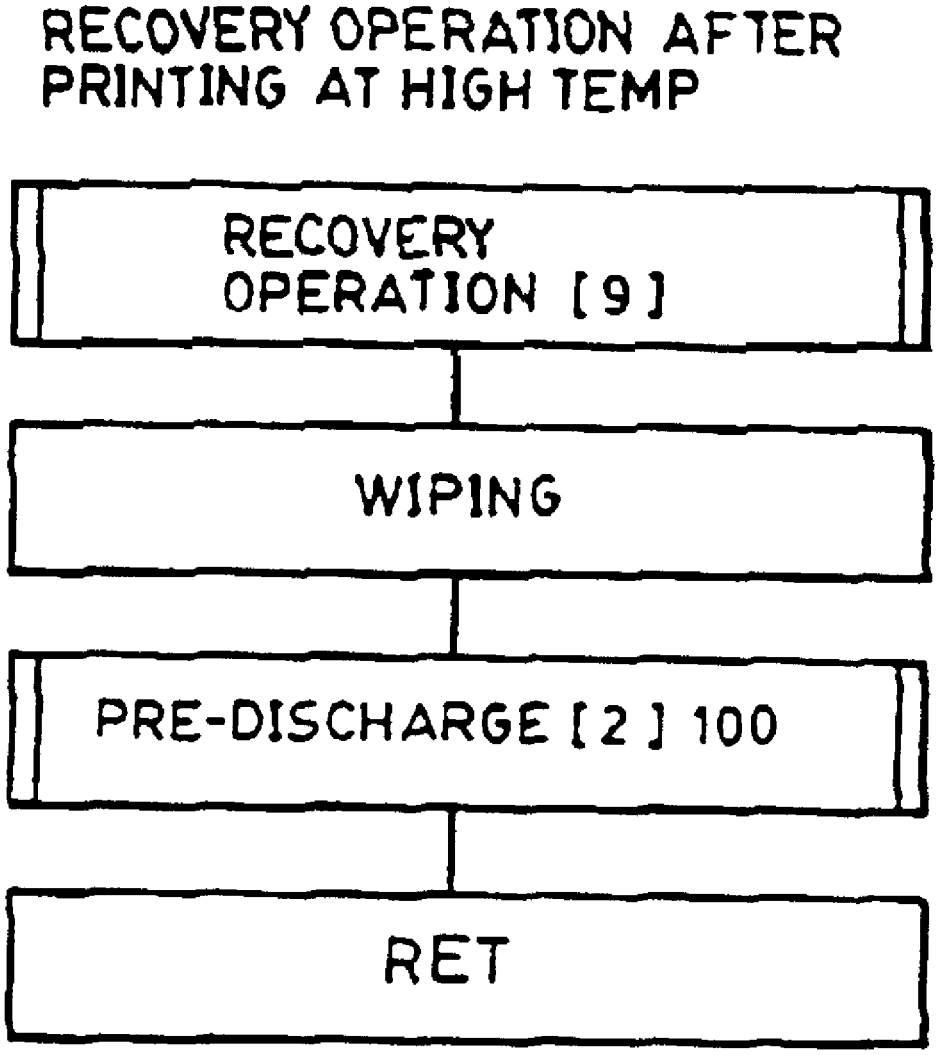
FIG. 18 is a flow chart showing the detail of a discharge recovery routine which is executed after printing at high temperature (recovery operation [9])

FIG. 18 is a flowchart of the recovery (recovery operation [9]) routine executed after high-temperature printing. This recovery operation is conducted when the process returns to the main routine from the abnormally high temperature operation routine. Since an increase in the temperature of the ink in the nozzle adversely affects printing, pre-discharge [2] is conducted as pre-discharge after wiping. In the pre-discharge [2], discharge is conducted with 500 Hz so as to prevent an increase in the temperature of the head.

(Recovery Switch)

Figure 19:
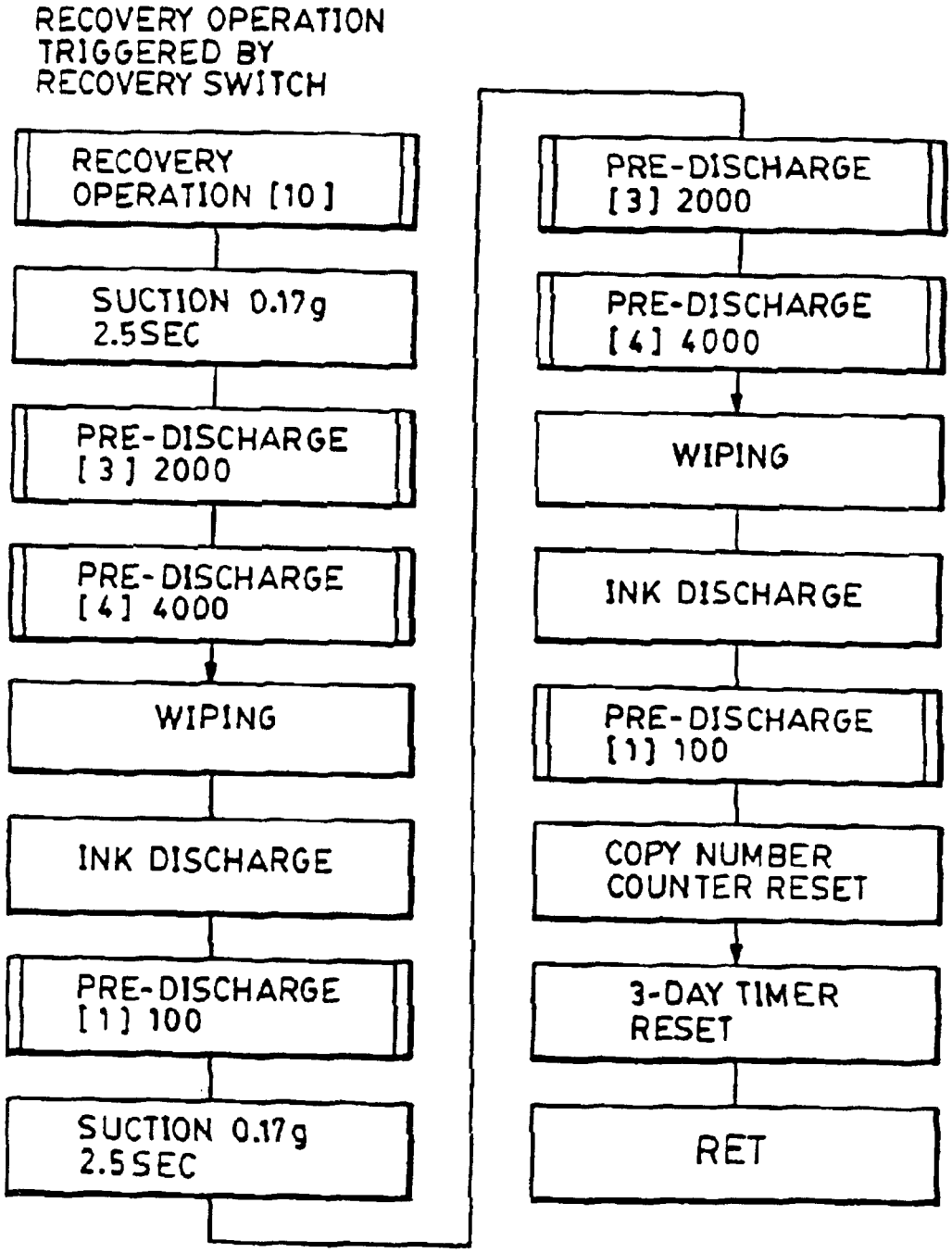
FIG. 19 is a flow chart showing the detail of a sucking discharge recovery routine which is triggered by a recovery switch (recovery operation [10])

FIG. 19 is a flowchart of the recovery switch routine (recovery operation [10]). This recovery operation is performed to recover normal discharge of the head when normal discharge of the head is not obtained in spite of the fact that the recovery operations on the operation sequence for the apparatus are conducted and when the user presses a recovery switch. This mode is not generally used. However, when it is used, a more intensive recovery operation is conducted than in other recovery operations so as to assure reliable recovery.

Bubbles in the liquid chamber are removed by the suction of the pump so as to eliminate viscous ink. Furthermore, discharge is conducted concurrently with suction. In this way, instantaneous negative pressure is generated and the amount of negative pressure required to remove the bubbles in the liquid chamber is thus increased. Furthermore, since an electrothermal energy conversion member is driven as means for generating bubbles to discharge ink, the temperature of the ink in each liquid passage is increased, and viscosity and, hence, the surface tension of the ink are reduced. Consequently, flow passage resistance of each liquid passage is further reduced, and removal of bubbles is thus further facilitated. Also, in order to provide reliable recovery, the suction operation is repeated twice in this mode when the recovery switch is pressed once.

Practically, a certain amount of negative pressure is generated in the liquid chamber of the head by rotating a pressurizing roller of the tube pump shown in FIG. 59, which is located at position (K) in a head capped state, to position (L), and each of the nozzles is driven by the maximum driving frequency concurrently with generation of the maximum amount of negative pressure. At that time, however, flow of the ink in the liquid chamber is degraded and the density of the ink thus increases at the end portions of the nozzle array. Hence, the number of times discharge is conducted at the end portions is made larger than at the central portion so as to make the density of the ink in each nozzle the same in the printing conducted after recovery and thereby prevent uneven density due to increase in the viscosity of the ink. Maximum suction pressure of the pump is set as the suction pressure. Suction holding time is 2.5 seconds. The amount of ink which is sucked during that suction time is about 0.17 g. The number of times discharge is conducted at the central portion is 2000 times, and that at the end portions is 6000.

After suction, the orifice surface of the head is wiped by the rubber blade. Sucked ink is sent to an exhaust ink absorber by turning the pressurizing roller of the tube pump located at position (L) twice and then stopping it at position (K). Next, pre-discharge is conducted. Thereafter, the aforementioned recovery operation is repeated.

Figure 20:
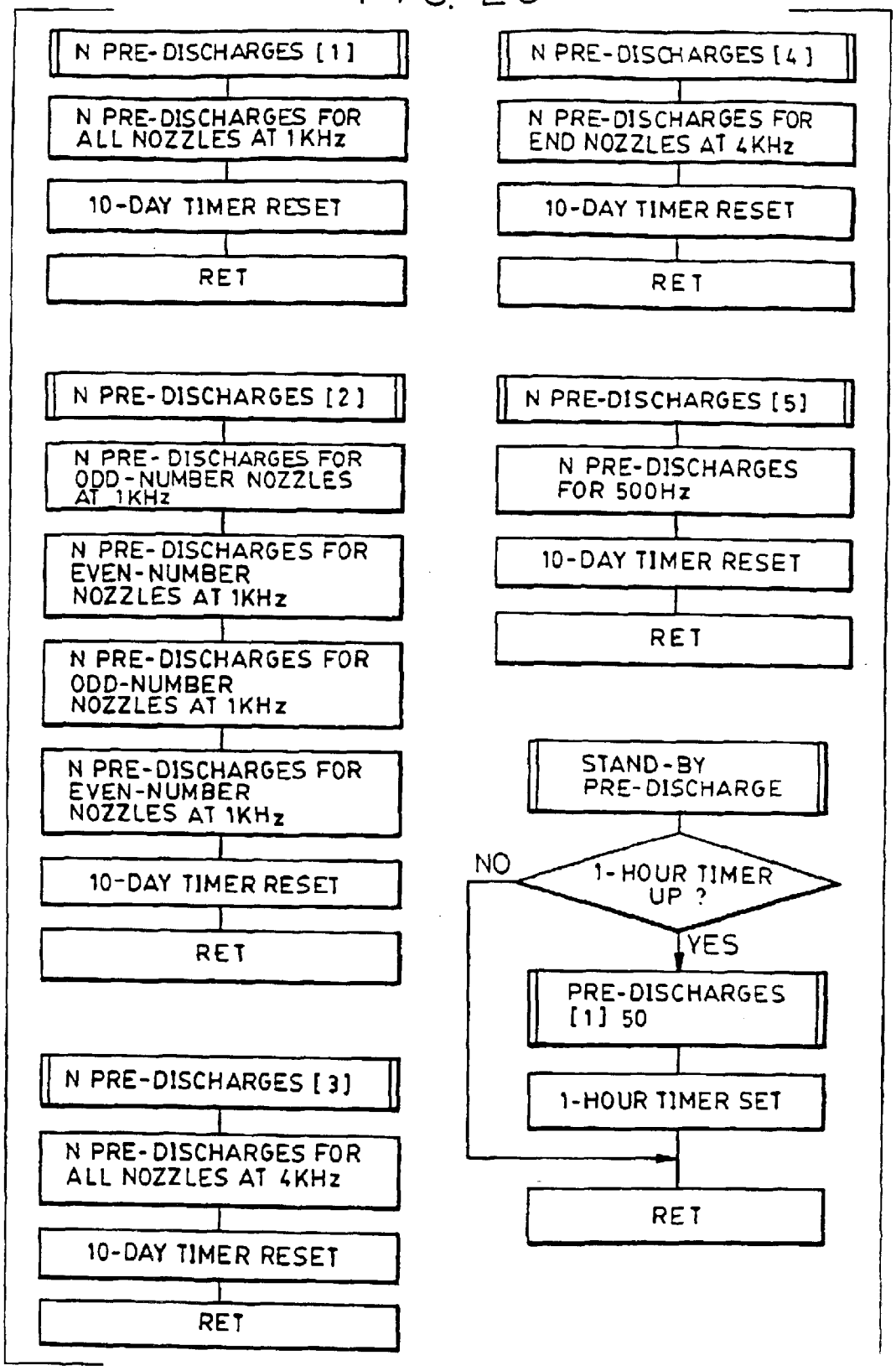
FIG. 20 is a flow chart showing the details of routines including pre-discharges [1] to [5] and stand-by pre-discharge.

FIG. 20 is a flowchart showing pre-discharge [1] through pre-discharge [5] and standby pre-discharge.

(Pre-Discharge [1])

This pre-discharge [1] is conducted with all the nozzles driven to discharge ink during printing and standby and after wiping. The discharge frequency is 1 KHz, because an increase in the temperature of the nozzles is not necessary.

(Pre-Discharge [2])

Pre-discharge [2] (patterned pre-discharge) is performed to remove fine bubbles generated in the nozzle. Presence of bubbles in the nozzle prevents normal bubbling. Furthermore, fine bubbles in the nozzle are combined with each other, and such combined bubbles close the nozzle, causing discharge failure.

Fine bubbles in the nozzle may be removed by suction. However, suction requires large ink consumption, and longer operation time. Hence, this pre-discharge method contributes to efficient removal of fine bubbles. That is, since bubbles are generated during printing, removal of the bubbles immediately after printing is desired. However, since the suction operation requires a relatively long operation time, the recording time and running cost of the apparats are thus increased.

The pre-discharge method [2] will be explained. Bubbles in the nozzle cannot be readily removed even when ink is discharged from the nozzle. However, bubbles are readily ejected from the nozzle when intermittent ink discharge is conducted on the adjacent nozzles of the desired one.

Practically, discharge is conducted 50 times with 1 KGz first only on the odd-numbered nozzles and then on the even-numbered nozzles. This one cycle of operation is repeated twice so as to obtain reliable bubble removal.

(Pre-Discharge [3])

This pre-discharge [3] is conducted on all the nozzles concurrently with suction or when discharge failure is detected. Driving frequency is set to the maximum driving frequency of 4 KHz, because it can increase the temperature of the nozzles, reduce the viscosity of the ink, increase the flow rate in the liquid chamber to its maximum value and enhance the suction property in the pre-discharge [3] conducted simultaneously with suction, and because it can enhance detection accuracy in the pre-discharge [3] conducted when discharge failure is detected.

(Pre-Discharge [4])

Where discharge or suction recovery has not been conducted for a relatively long time, an increase in the viscosity of the ink occurs starting with the one located near the wall of the liquid chamber of the head then directing toward the inner portion of the head. Since the nozzles at the end portions of the head are closer to the wall of the liquid chamber, the density of the ink discharged from the end portions of the head increases in the printing conducted without recovery after the head has not been used for a long time. Hence, in this pre-discharge [4], discharge is conducted only on the nozzles at the end portions to eliminate uneven ink density.

Practically, discharge is conducted with 4 KHs only on the nozzles in blocks 1 and 16 located at the end portions of the head. The plurality of nozzles of the head are divided into blocks and driven in blocks.

(Pre-Discharge [5])

In pre-discharge [5], discharge is conducted on all the nozzles after wiping conducted after the abnormally high-temperature suction recovery operation. Although discharge frequency after wiping is generally 1 KHz, driving frequency of this pre-discharge [5] is 500 Hz. In this way, an increase in the temperature of the nozzle portion is further prevented, and stable discharge is provided.

(Standby Pre-Discharge)

This pre-discharge is conducted during standby at time intervals of 1 hour. This is conducted to prevent an increase in the viscosity of the ink in the nozzle and the liquid chamber during standby and thus allow for stable printing which is free of uneven ink density when a copying switch is pressed. Practically, pre-discharge [1] (N=50) is conducted.

After the aforementioned suction operations, a 10-day timer, a 3-day timer and a copying paper sheet number counter are reset. After the aforementioned pre-discharge operations, the 10-day timer is reset.

(Wiping Operation)

Figure 57:
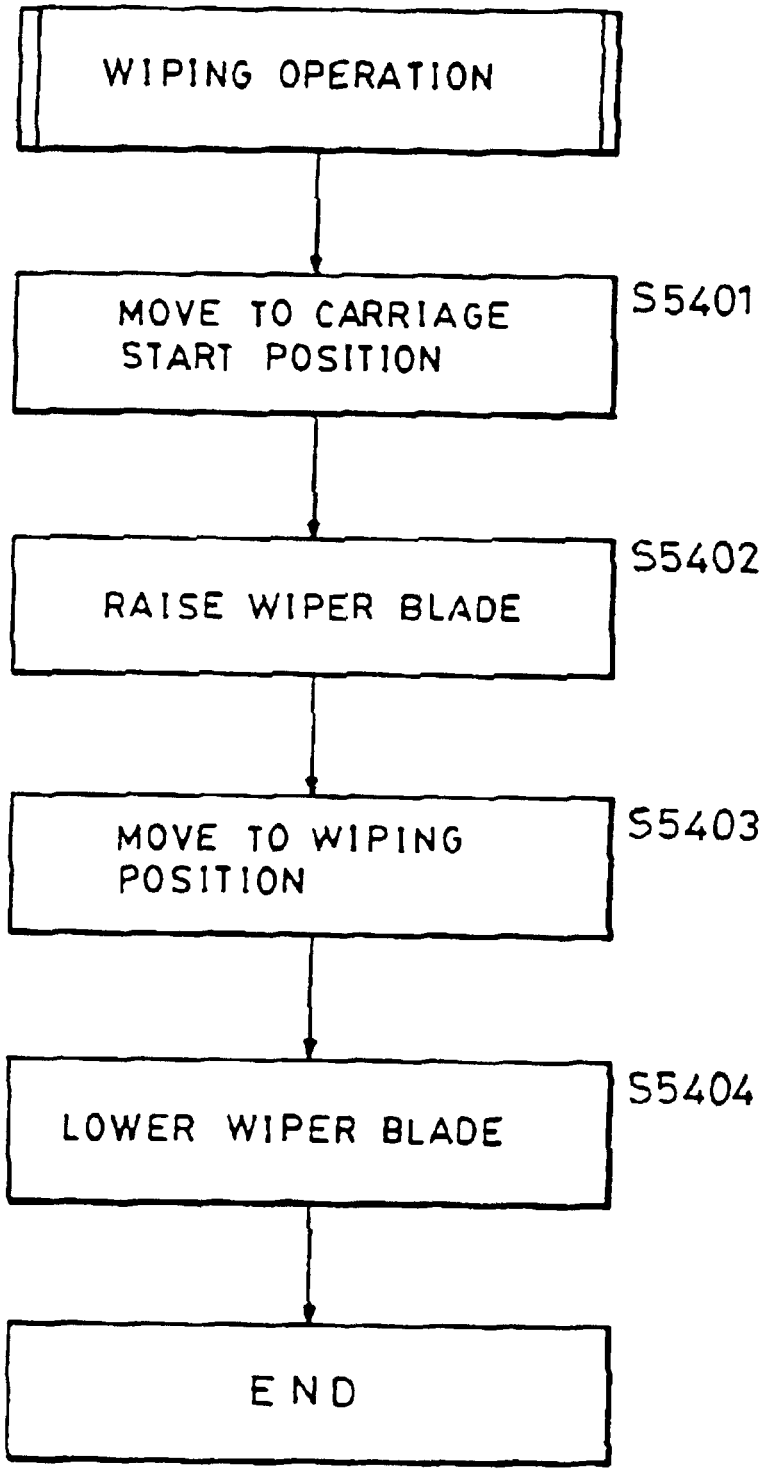
FIG. 57 is a flow chart illustrative of a wiping operation routine.
Figure 58A:
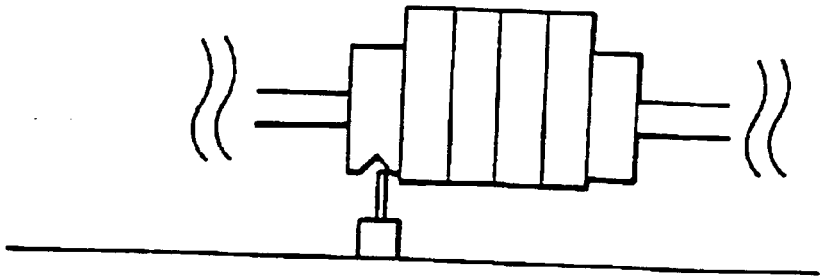
FIGS. 58(A)–58(D) are illustrations of the wiping operation.
Figure 58B:
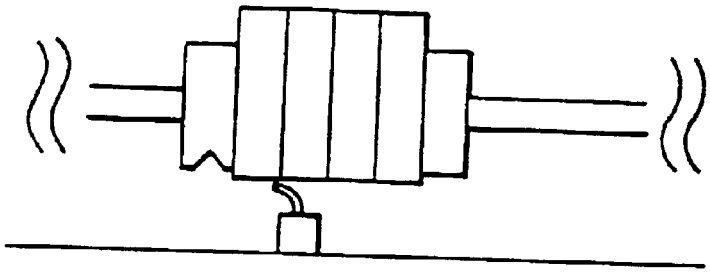
Figure 58C:
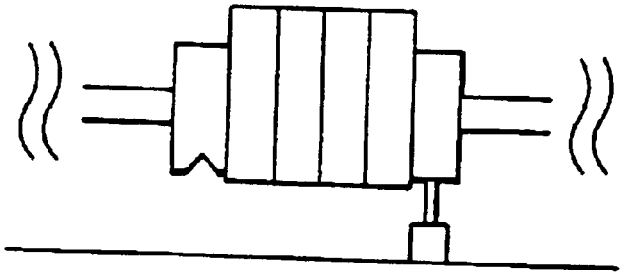
Figure 58D:
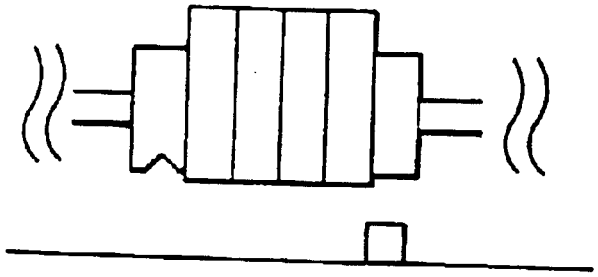

FIG. 57 is a flowchart of the wiping operation routine. In step S5401, a carriage is moved to its initial position. In step S5402, a wiping blade is raised. In step S5403, the carriage is moved to its wiped position. During movement, the nozzle portion of the recording head loaded on the carriage is wiped by the wiping blade. After the carriage has stopped at its wiped position, the wiping blade is lowered in step S5404.

FIG. 58 illustrates the wiping operation. FIG. 58(A) illustrates how the wiping blade is raised relative to the carriage located at its initial position. FIG. 58(B) illustrates how the carriage is moved to its wiped position from its starting position. FIG. 58(C) illustrates the carriage located at its wiped position with the wiping blade raised. FIG. 58(D) illustrates the carriage located at its wiped position with the wiping blade lowered.

The usage of the head ROM will now be explained in detail.

(Drive Setting)

The apparatus in this embodiment is of the type which employs a replaceable head (cartridge type) and has an advantage in that the user can replace heads when desired. Therefore, adjustment of the apparatus by a service man is not needed. Also, replaceable heads are supplied by mass production, and hence variations in the characteristics of the individual heads (including the area, resistance and film structure of a heater board (HB) occur during manufacture. To obtain stable good quality image, these variations in the characteristics must be corrected.

Differences in the set drive conditions of the individual heads may be corrected by using the ROM data which is read in or by correcting uneven density due to variations in the discharge rate within a single head which are caused by the uneven discharge apertures of the head (by using HS data which is read in).

If such a correction is not conducted on each head, discharge characteristics, particularly, discharge speed, discharge direction (striking accuracy), discharge rate (density), discharge stability (refilling frequency, non-uniformity or wetting) cannot be optimized. Consequently, a stable image cannot be obtained or great deterioration in the image occurs due to discharge failure or twist generated during printing.

Particularly, full color images are formed using four types of heads including cyan, magenta, yellow and black heads. Hence, the use of even a single head having discharge rate or control characteristics different from the standard heads degrades the quality of printed images. Particularly, variations in the discharge rate degrade color balance of the entire image and thus changes color tint or color reproducibility (increase color difference), degrading image quality. In a single color image, such as in black, red, blue or green, variations in the discharge rate vary the density. Variations in the control characteristics change half tone reproducibility. Accordingly, in this embodiment, variations in these discharge characteristics are corrected.

First, the printing method employed in this embodiment will be explained in detail.

(Printing Method)

Figure 60:
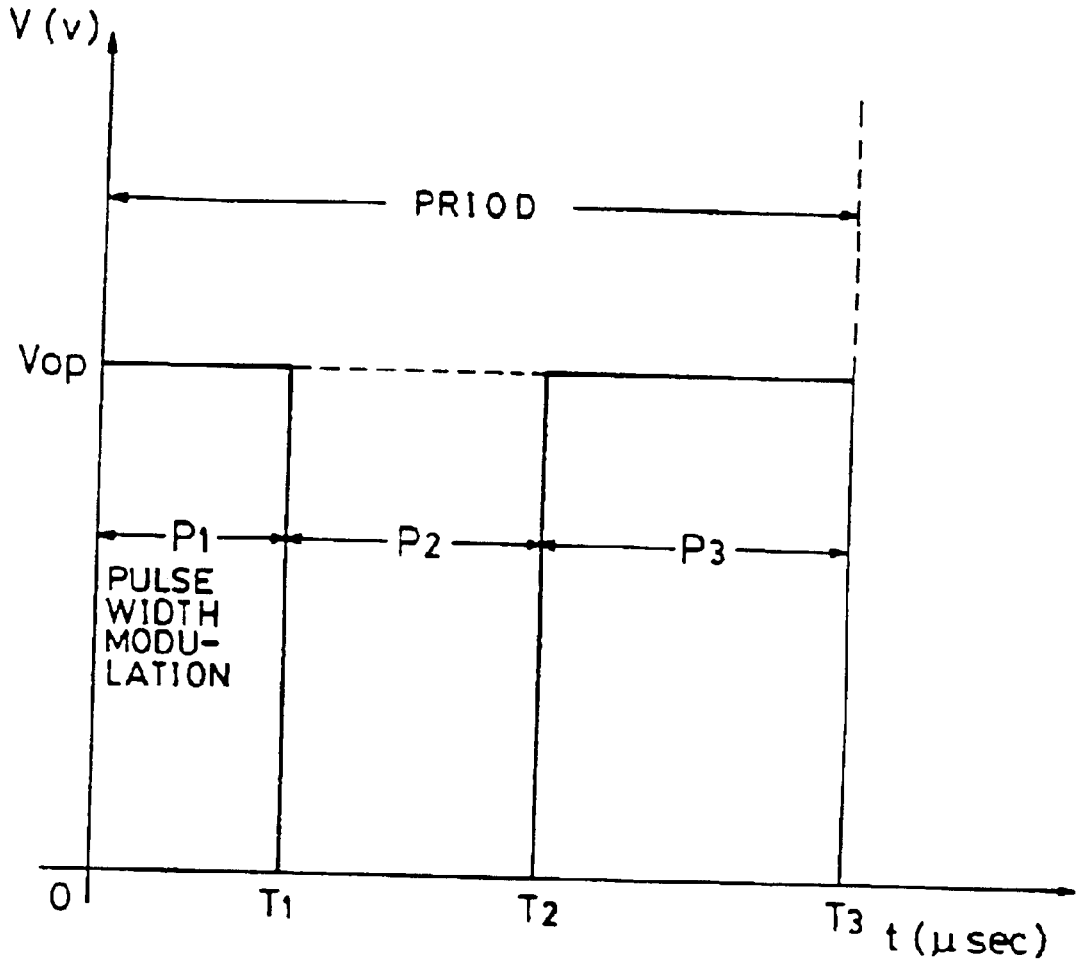
FIG. 60 is an illustration of a divided pulse width modulation driving method.

The present embodiment is characterized by its head driving method and printing method. The head driving method employed in this embodiment is the divided pulse width modulation (PWM) driving method. In FIG. 60, Vop indicates electrical energy for applying electric energy required to generate thermal energy on the heater board. Vop is determined by the area, resistance and film structure of the heater board and the nozzle structure of the head. P1 indicates a pre-heat pulse width, P2 denotes an interval time, P3 shows a main heat pulse width. T1, T2 and T3 are respectively time intervals between the rise of the pre-heat pulse and P1, between the rise of the pre-heat pulse and P2 and between the rise of the pre-heat pulse and P3. Therefore, T1, T2 and T3 respectively determine P1, P2 and P3.

In the divided pulse width modulation driving method, pulses are applied in the order of P1, P2 and P3. Pre-heat pulse P1 is applied mainly to control the temperature of the ink in the nozzle. The temperature of the head is detected utilizing the temperature sensor in the head to control the pulse width of P1. At that time, the pulse width is controlled such that pre-bubbling is not generated due to too much thermal energy applied to the heater board.

P2 is the interval time provided so as to prevent interference of the pre-heat pulse P1 with the main heat pulse P2 and to make temperature distribution of the ink in the nozzle uniform. Main heat pulse P3 is applied to generate bubbling on the heater board and thereby discharge an ink droplet from the nozzle. The pulse width of these pulses is determined by the area, resistance and film structure of the heater board, the nozzle structure of the head and ink properties.

Figure 61A:
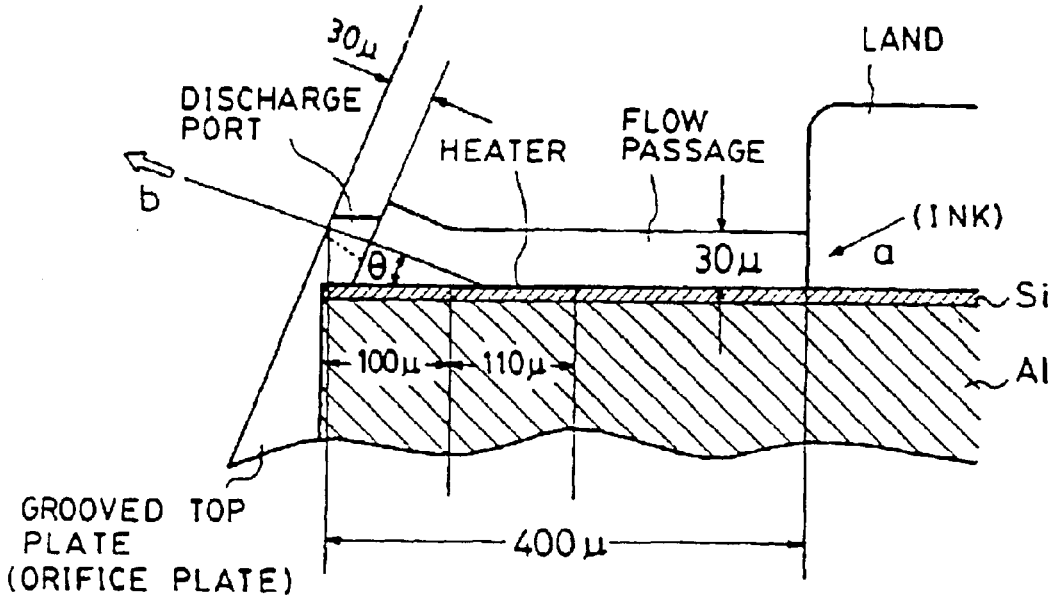
FIGS. 61A and 61B are illustrations of the construction of a recording head used in the present invention.
Figure 61B:
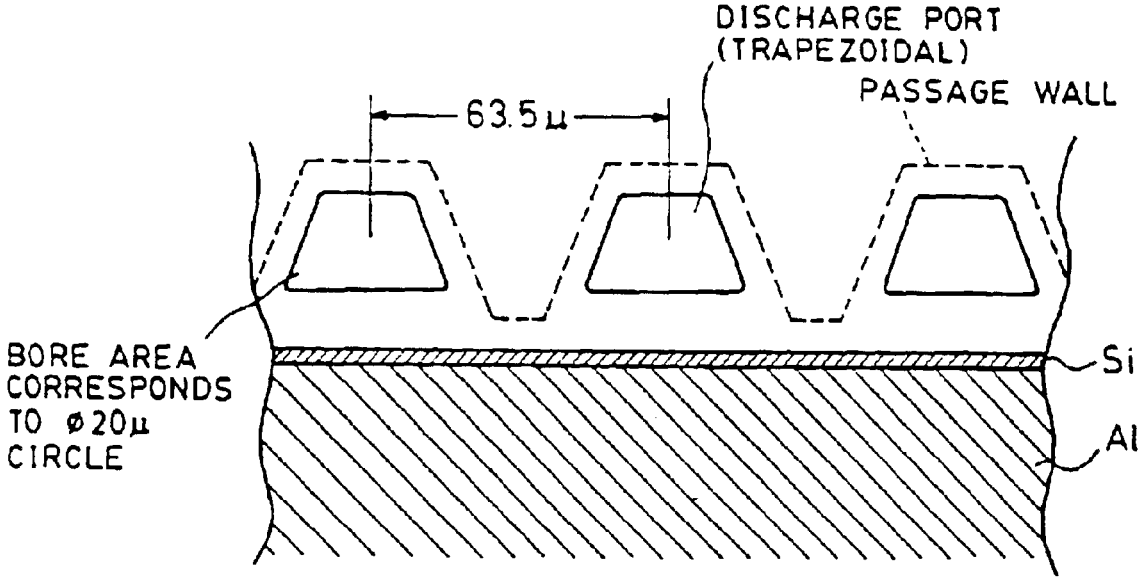

In this embodiment, a head having a structure shown in FIGS. 61A and 61B is used. When the temperature TH of the head is 25.0° C. and when Vop=18.0 (V), application of pulse P1 having a width of 1.867 ($\mu$sec) and pulse P3 having a width of 4.114 ($\mu$sec) assures the optimum driving of the head and hence provides stable ink discharge. At that time, the discharge rate Vd of ink is 30.0 ng/dot, and the discharge speed V=12.0 m/sec. The maximum driving frequency of the head is fr=4.0 KHz, and the resolution thereof is 400 dpi. 128 nozzles of the head are divided into 16 blocks, and are sequentially driven in blocks. The head employed in this embodiment is provided with a ROM in which the characteristics of that head are recorded. When variations in the characteristics of individual heads are corrected, the data stored in the ROM is read in by the apparatus.

The method of correcting variations in the discharge characteristics of each head to provide optimum image formation will be described below. When the apparatus on which the head is loaded is switched on, the data (ROM data) stored in the ROM of the head when the head is manufactured is read in by the apparatus. The data which is read in includes, ID no. of the head, color information, TA1 (driving condition table pointer of the head which corresponds to the printing pulse width), TA3 (PWM table pointer), the temperature sensor correction value, the number of sheets of paper the head has printed, the number of times wiping has been conducted and so on. In accordance with table pointer TA1 which is read in, the main head pulse width P3 of the divided pulse width modulation driving control method, which will be described later, is obtained by the apparatus.

FIG. 62 shows the relation between the table pointer TA1 and the main heat pulse width P3 obtained by TA1.

(1) Determination of TA1:

During manufacture of the head, discharge characteristics measurements of the head are performed under the standard driving conditions (heat temperature TH=25.0° C., driving voltage Vop=18.0 volts, P1=1,87 μsec and P3=4.114 μsec) so as to determine the optimum driving conditions for each head. The determined driving conditions are stored in the ROM of the head.

(2) Setting of Driving Conditions:

To set the pre-heat pulse width P1, the interval time duration P2 and the main heat pulse width P3 which are used in divided pulse width driving, the apparatus respectively sets the time intervals from the rise of the pre-heat pulse to P1, from the rise of the pre-heat pulse to P2 and from the rise of the pre-heat pulse to P3 to T1, T2 and T3, as shown in FIG. 60. At that time, T3 (T3=8.602 μsec) is a fixed value. P3 (P3=T3−T2=4.114 μsec) is determined from the value of the pulse width condition T2: TA1 (for example, TA1 ~4.488 μsec) given by the pointer read from the head.

Thus, variations in the discharge characteristics of the individual heads can be corrected by reading in the head driving condition setting table pointer TA1 stored in the ROM of the head as the data and by changing the setting conditions (driving conditions) of the apparatus in accordance with the read table pointer TA1. Consequently, even when a replaceable head is used, stable color image can be obtained easily.

(Correction Method By PWM)

A method of utilizing the PWM control method for correcting variations in the discharge characteristics of individual heads to obtain optimum image formation more efficiently will be described below.

Control conditions for PWM are read into the apparatus when the apparatus with the head loaded thereon is switched on as the ROM data of the head together with ID no. color, driving conditions and heater board data. In this embodiment, table pointer TA3 is read in as the control conditions for PWM. As will be mentioned later, TA3 indicates a number corresponding to the discharge rate (VDM) for the head. The upper limit of the pre-heat pulse width P1 for PWM is determined in accordance with the read TA3 in the apparatus.

Correction method by PWM will be described in detail.

(1) Determination of Table Pointer TA3:

During manufacture of the head, measurements of the discharge rate for each head are performed under the standard driving conditions (head temperature TH=25.0° C., driving voltage Vop=18.0 volts, P1=1.87 μsec and P3=4.114 μsec) to obtain a measured discharge rate VDM. Next, a difference between VDM and a standard discharge rate VD0=30.0 (ng/dot) is obtained as ΔV=VD0−VDM.

FIG. 63 shows the relation between ΔV and table pointer TA3. FIG. 63 shows how the obtained discharge rate is classified into groups to obtain TA3. TA3 for each head is stored in the ROM of that head.

To create table using ΔV, ΔV must be equal to ΔVP which is a change in the pre-heat pulse width P1 which can be controlled by the divided pulse width modulation driving method, which will be described later, because the discharge rate of the head is corrected using this pre-heat pulse width P1.

(2) Reading in of Table Pointer:

A head having data stored in its ROM is loaded on an ink jet recording apparatus in the manner described in connection with (1). When the apparatus is switched on, the data stored in the head ROM is stored in a SRAM of the apparatus body in accordance with the control operation shown in FIG. 5.

(3) Determination of Table for PWM Control:

1. In a head having a high discharge rate, the pre-heat pulse width P1 under the temperature condition of 25.0° C. is reduced to reduce the discharge rate and thereby make the discharge rate close to the standard one VDO.
2. In a head having a low discharge rate, the pre-heat pulse width P1 under the temperature condition of 25.0° C. is increased to increase the discharge rate and thereby make it close to the standard one.
3. The aforementioned operation is conducted on the basis of the relation between the table pointer TA3 and the pre-heat pulse width P1 which is determined in accordance with the discharge rate of a head, as shown in FIG. 63, to obtain the standard discharge rate VD0.
4. Thus, correction of variations in the discharge rate in the range of ±0.6 (ng/dot) is possible relative to the standard discharge rate VD0 (30.0 ng/dot).

As mentioned above, variations in the discharge characteristics of the individual heads can be absorbed by reading in the table pointer TA3 for PWM control as the ROM data of the head and by changing the setting conditions (driving conditions) of the apparatus in accordance with the read table pointer TA3. Consequently, even when a replaceable head is used, stable color image can be obtained easily. Furthermore, since yield of the head can be improved, production cost of the cartridge can be reduced.

Figure 64:
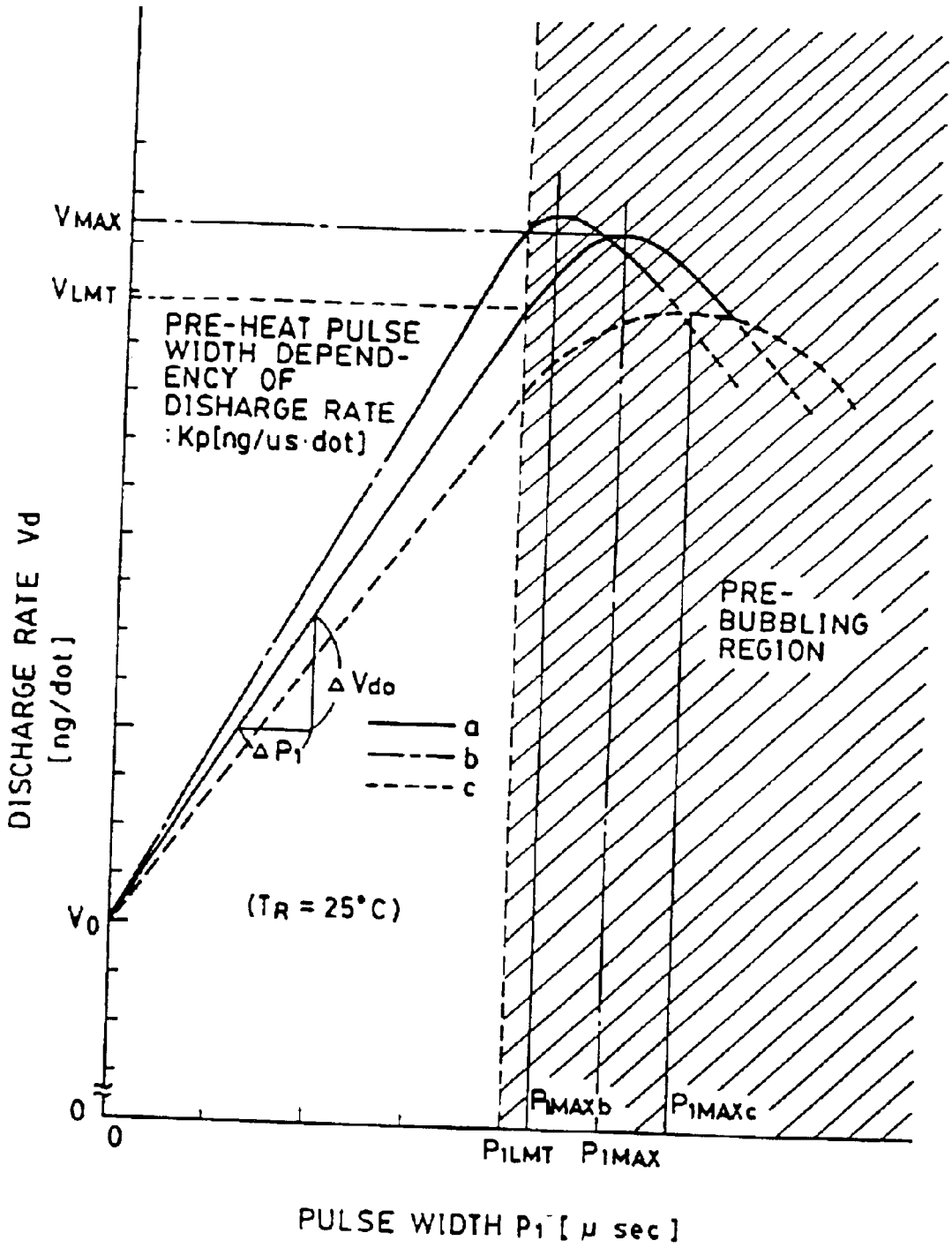
FIG. 64 is a graph showing the relationship between the pre-heat pulse width P1 and ink discharge rate VD.

A discharge rate control method using the pre-heat pulse width P1 will be described below in detail. FIG. 64 shows the relation between the pre-heat pulse width P1 and the discharge rate Vd when the heat temperature (TH) is constant. As can be seen from FIG. 64, when the pulse width P1 is equal to or less than P1LMT, the discharge rate increases linearly as the pre-heat pulse width P1 increases. With the pulse width P1 which is larger than P1LMT, bubbling by the main heat pulse P3 deteriorates due to pre-bubbling. With the pulse width P1 which is larger than P1MAX, the discharge rate decreases as the pulse width P1 increases.

Figure 65:
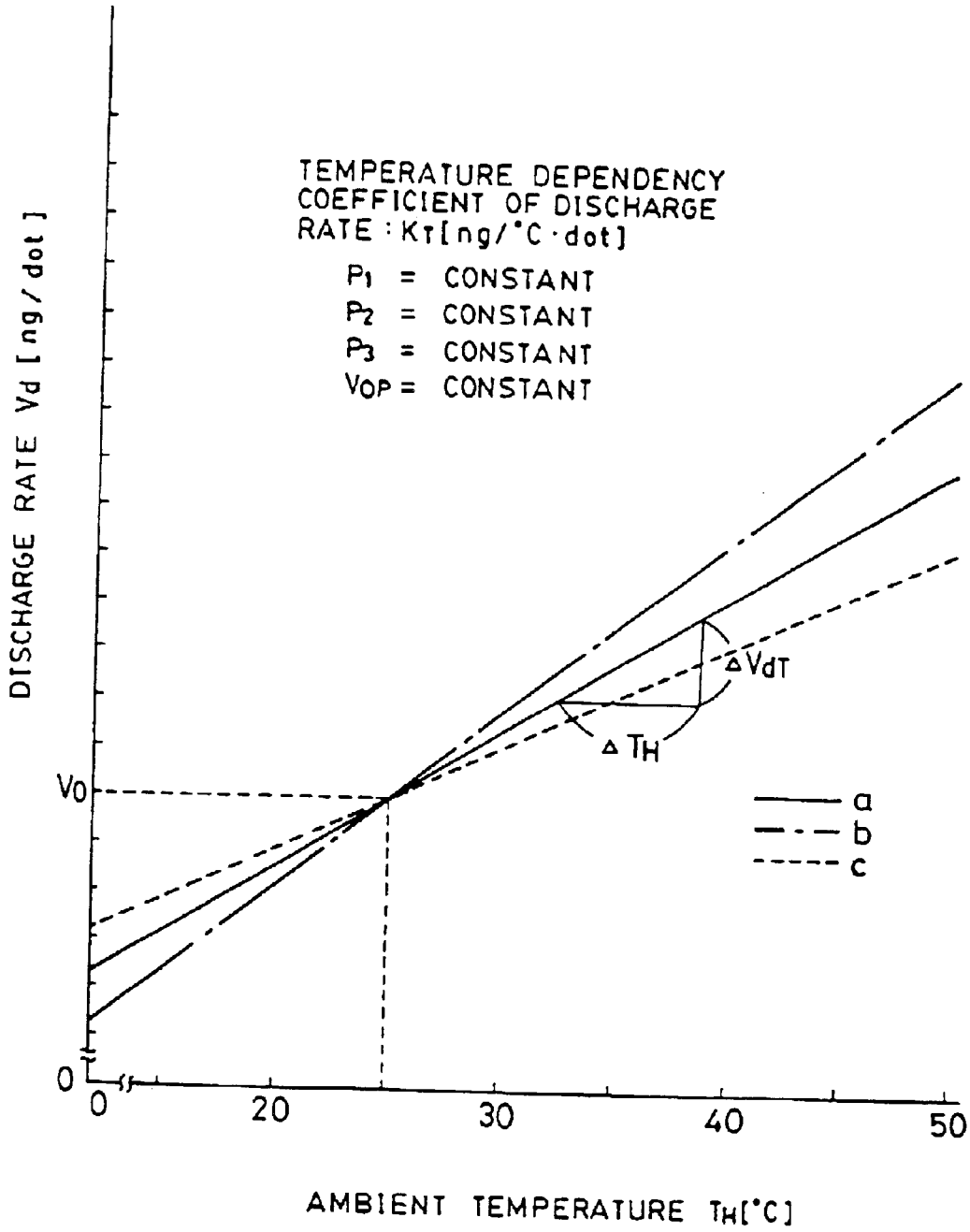
FIG. 65 is a graph showing the relationship between heat temperature TH and the ink discharge rate VD.

FIG. 65 shows the relation between the head temperature TH (ambient temperature) and discharge rate VD under the condition that the pre-heat pulse width P1 is constant. As can be seen from FIG. 65, as the head temperature TH increases, the discharge rate linearly increases. The coefficients for the region which shows linearity are:

Pre-heat pulse width dependency of discharge rate:

$$KP=\Delta VDP/\Delta P1\ (ng/\mu s\cdot dot)$$

Head temperature dependency of discharge rate:

$$KTH=\Delta VDT/\Delta TH \text{ (ng/° C.·dot)}$$

Figure 66:
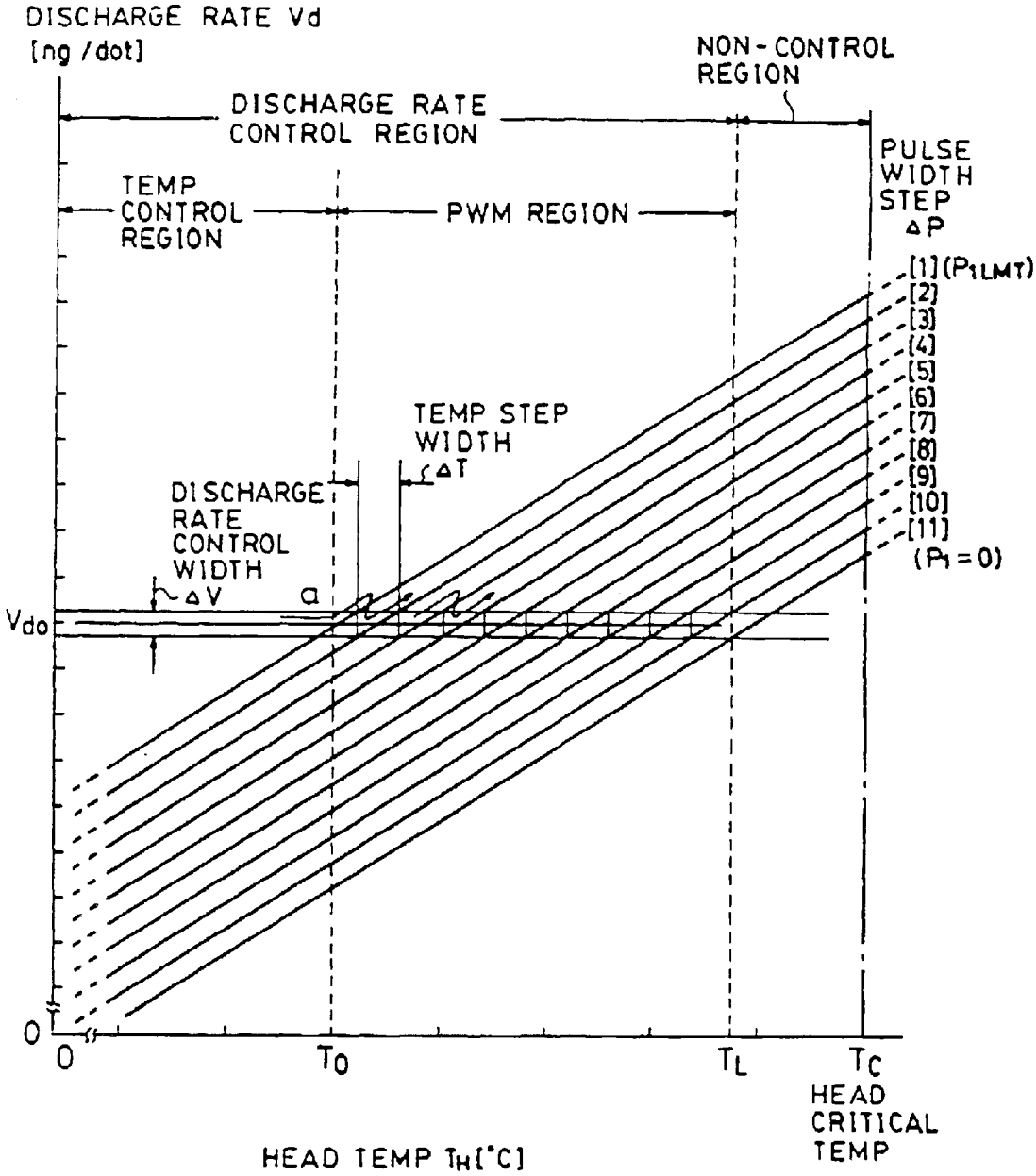
FIG. 66 is a graph showing the manner of discharge rate control in terms of the relationship between the head temperature and the discharge rate.

In the head structure shown in FIG. 61, KP=3.21 (ng/μsec·dot), and KTH=0.3 (ng/μsec·dot). By effectively utilizing these two relations in the manner described below, the ink discharge rate for the head can be always maintained constant even when the temperature of the head varies due to changes in the environmental temperature or changes in the head caused by printing. FIG. 66 shows how the discharge rate is controlled relative to the head temperature in terms of the relation between the head temperature and the discharge rate. In FIG. 66, T0 indicates the standard temperature, TL is the temperature limit for discharge rate control, and TC denotes the temperature limit for bubbling.

Discharge rate control is conducted under the following three conditions.

$$TH \leqq T0 \quad (1)$$

Discharge rate at low temperatures is compensated for by temperature control of the head.

$$T0 < TH \leqq TL \quad (2)$$

Discharge rate control is performed by the divided pulse width modulation (PWM) method.

$$TL < TH \ (< TC) \quad (3)$$

P1 is fixed to a certain value and no control is made.

The state indicated by (1) is the temperature control region shown in FIG. 66 in which discharge rate at low temperatures is assured. When the head temperature TH is equal or or lower than 25.0° C., discharge rate VD0=30.0 ng/dot) when TH=T0 is obtained by maintaining the temperature of the head TH to the control temperature TO of 25.0° C. T0 is set to 25.0° C. because it ensures that increase in the viscosity of the ink, solidification of the ink and temperature control ripples are generated the least. At that time, the pulse width P1=1.867 μsec.

The state shown by (2) is the PWM region in FIG. 66. In this state, the head temperature TH is between 26.0° C. and 44.0° C. Changes in the temperature of the head due to printing or in the environmental temperature are detected by a sensor. Pre-heat pulse width P1 may be varied for each range of the head temperature TH, as shown in FIGS. 67 (A) to 67(C), or in accordance with the control operation shown in FIG. 21.

In FIG. 67 (A), the reference value of P1 is 0A. Each time the head temperature increases by 2.0° C., the pre-heat pulse width P1 is varied by one step of 1H. In the cases shown in FIGS. 67 (B) and 67 (C), reference value of P1 is 0B and 09.

The pre-heat pulse width P1 is changed in accordance with the control operation shown in FIG. 21 in the following manner. In this control operation, in order to prevent erroneous detection of the head temperature and to obtain more accurate temperature, an average head temperature Tm of three previous temperatures (Tn−3, Tn−2 and Tn−1) and a new temperature Tn is obtained by the following equation:

$$Tm=(Tn-3+Tn-2+Tn-1+Tn)/4.$$

Also, an average value of the right and left sensors is obtained.

In a subsequent step, that value Tm is compared with the previous head temperature Tm−1 by the following manner, and correction is performed accordingly.

$$|Tm-Tm-1| \leqq \Delta T \text{ (in this embodiment, } \Delta T=1° \text{ C.)}, \quad (1)$$

A change in the temperature is within ±1° C., which is within one step shown in FIG. 67, and the pulse width P1 is not changed.

$$Tm-Tm-1 > \Delta T \quad (2)$$

Since changes in the temperature occur at high temperatures, the pre-heat pulse width P1 is reduced by lH so as to reduce the pulse width.

$$Tm-Tm-1 < -\Delta T \quad (3)$$

Since changes in the temperature occur at low temperatures, the pre-heat pulse width P1 is increased by 1H so as to increase the pulse width.

Figure 21:
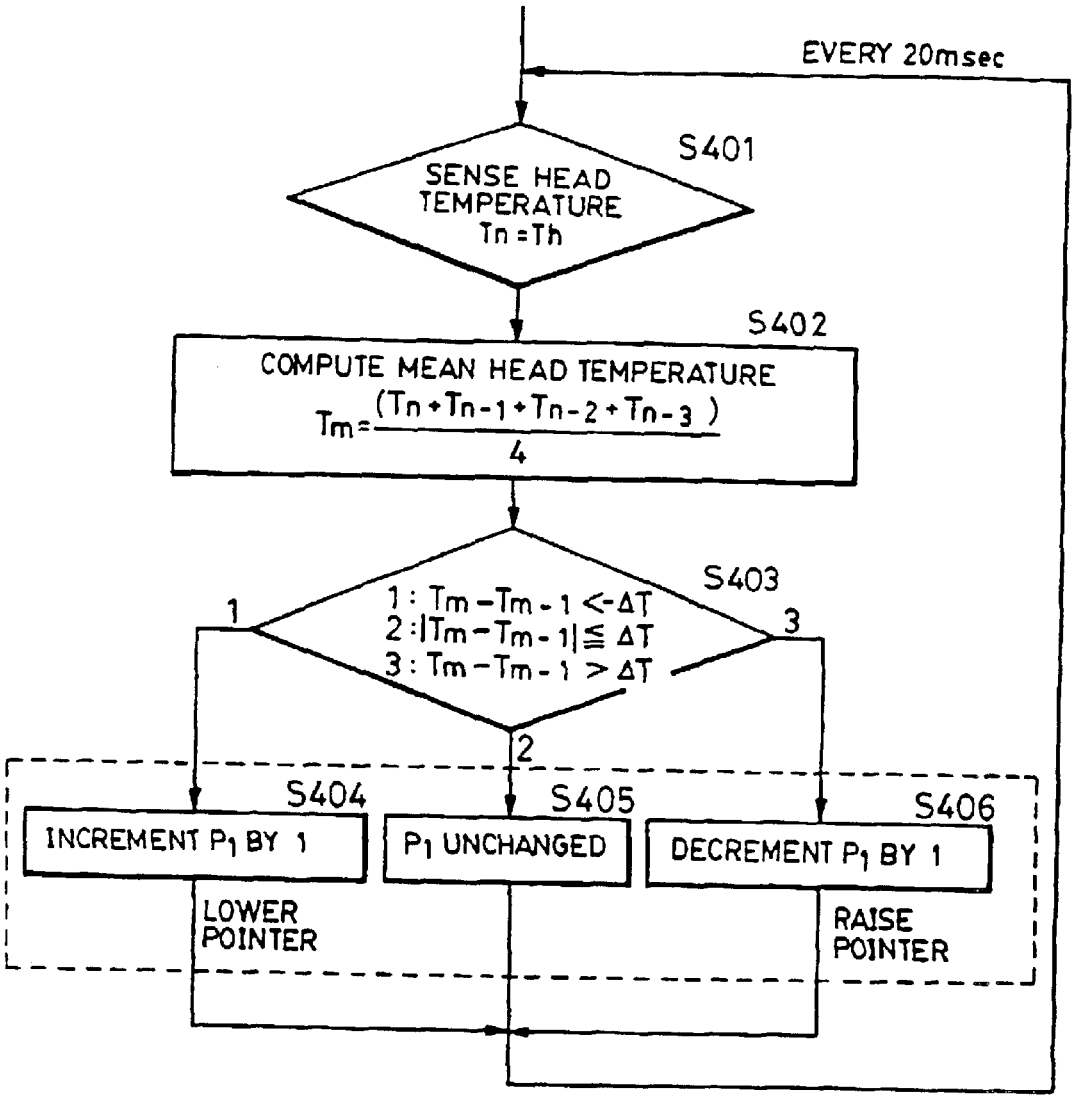
FIG. 21 is a diagram showing a sequence for setting the width of a pre-heat pulse.

FIG. 21 is a flowchart of the aforementioned control operation. This flowchart is an interruption routine executed in time intervals of 20 mseconds. In step S401, the temperature of the head is read in from the two temperature sensors of the head of each of four colors, and the average value of the previous three temperature values is calculated in each sensor in step S402. Next, the average value of the two temperatures is obtained for each head. Thereafter, when the relation between Tm and Tm−1 and ΔT is the aforementioned condition (3) in step S403, P1 is increased by 1H in step S404. When condition (1) is obtained in step S403, P1 is unchanged in step S405. When condition (2) is obtained in step S403, P1 is reduced by 1H in step S406.

In either case where the table shown in FIG. 67 is used or where the control operation shown in FIG. 21 is executed, if a change in P1 which is obtained in one correction operation is large, uneven density may occur. Hence, even when a change in the temperature which is larger than the correction range of one pointer occurs, a change in P1 which is conducted in one operation is made to be one pointer (which is 1H in this embodiment).

Where the control operation shown in FIG. 21 is used, the time required to change the pointer by 1 during printing (which is feedback time) TF is 20 msec. Hence, changes in the pointer can take place 40 times in one line (which is about 800 msec), and increase in the temperature of ΔTup=19.0° C. is possible at maximum. Consequently, generation of changes in the density is reduced over a wide temperature range. By using the average value of the four temperature values, erroneous detection due to noises of the sensors can be prevented, and smooth feedback can be provided. Moreover, variations in the density caused by control can be reduced to a minimum, and changes in the density at the connection (connection stripes) in a serial printing method can be reduced.

In this discharge rate control method, in the aforementioned temperature range, discharge rate can be controlled within a range of ±0.3 ng/dot with-respect to the objective discharge rate VD0=30.0 ng/dot. In this way, changes in the density which occur during printing of one sheet of paper are suppressed by about ±0.2, and generation of density non-uniformity or connection stripes in the serial printing method can thus be reduced.

Although influence of noises can be lessened and smooth changes can thus be obtained by increasing the average times the temperature detection is conducted, detection accuracy deteriorates in the control conducted on a real time basis and accurate control cannot be provided. Influence of noises is increased and rapid changes occur by reducing the average number of times temperature detection is conducted. However, in the control conducted on a real time basis, detection accuracy is enhanced, and accurate control can thus be made possible.

The state indicated by (3) is non-control region in which the head temperature TH is equal to or higher than 44.0° C. Although the head temperature may instantaneously reach this region when printing is conducted continuously at 100% capacity (printing at the maximum discharge frequency), the head is designed and driven such that the head temperature generally does not reach this region. If this state occurs continuously, it is determined that the apparatus is in an abnormally high temperature state, and the recovery operation is performed. Also, the pulse width P1 is set to 0.187 μsec so as to suppress heating by the pre-heat pulse and thereby reduce an increase in the temperature of the head caused by printing.

(Temperature Control)

Figure 72:
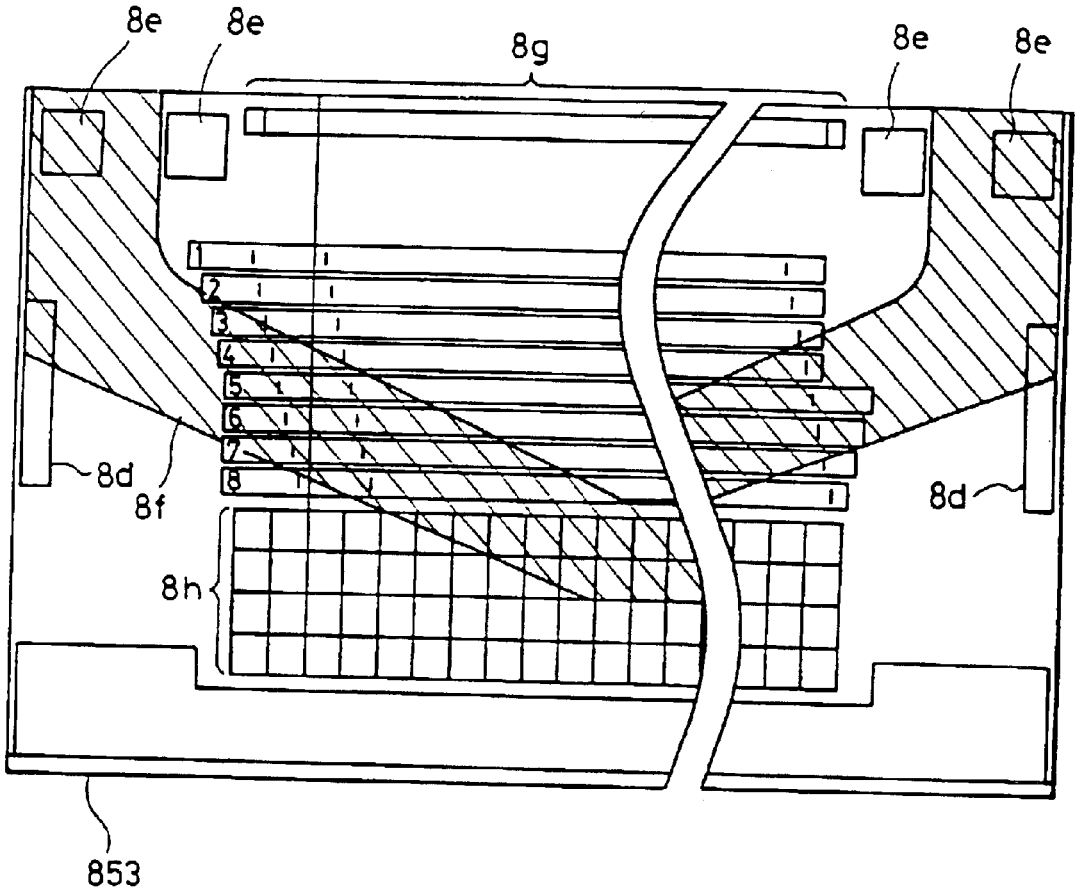
FIG. 72 is an illustration of the positional relationship between a head temperature sensor, a sub-heater and a discharge (main) heater which are used in the embodiment.

The temperature control operation will be described in detail. In this embodiment, right and left sub-heaters located on the head and right and left temperature sensors located near the discharge heater are used for this temperature control performed in the apparatus body. FIG. 72 schematically illustrates the heater board of the head which is used in this embodiment. Temperature sensors 8*e*, sub-heaters 8*d*, discharge portion rows 8*g* and driving devices 8*h* are formed on the same substrate in a positional relation shown in FIG. 72. In this way, the head temperature can be detected and controlled efficiently, and the head can be made compact while the manufacturing process can be simplified. FIG. 72 also illustrates an outer peripheral wall cross-section 8*f* of a ceiling plate for dividing the heater board into an area filled with ink and an area which is not filled with ink. As shown in FIG. 72, the temperature sensors 8*e* are disposed on the side of the outer peripheral wall 8*f* of the ceiling plate which is close to the discharge port, i.e., in the area filled with ink and near the discharge port. In this way, it is possible to efficiently detect the head temperature near the discharge port.

Temperature detection utilizes the average value of the four temperature values, as in the case of the discharge rate control method. At that time, the heat temperature TH is the average value (TH=(TR+TL)/2) of a temperature TR detected by the right sensor and a temperature TL detected by a left sensor. Current is supplied to the sub-heaters on the head on the basis of the detected temperature to conduct temperature control. Basically, on/off method is used for this temperature control. That is, a maximum power (1.2 W for each of the right and left sub heaters) is applied until the objective temperature TO=25.0° C. is reached. Once that objective temperature is reached, current supply is stopped. The temperature eventually lowers from the objective value, and current is supplied again. The time intervals in which the sub heaters are energized and deenergized are 40 msec.

As the time intervals increase, the width of ripples increases, increasing the period. Also, as the time intervals decrease, the width of ripples decreases, decreasing the period. In this embodiment, the ripple width at the objective temperature is about 2° C. However, since the average value of four temperature values is obtained in temperature detection, discharge rate control is not substantially affected by the ripples of temperature control. If necessary, expensive control methods, such as PID (Proportional Integral Differential) control, may be used.

Figure 22:
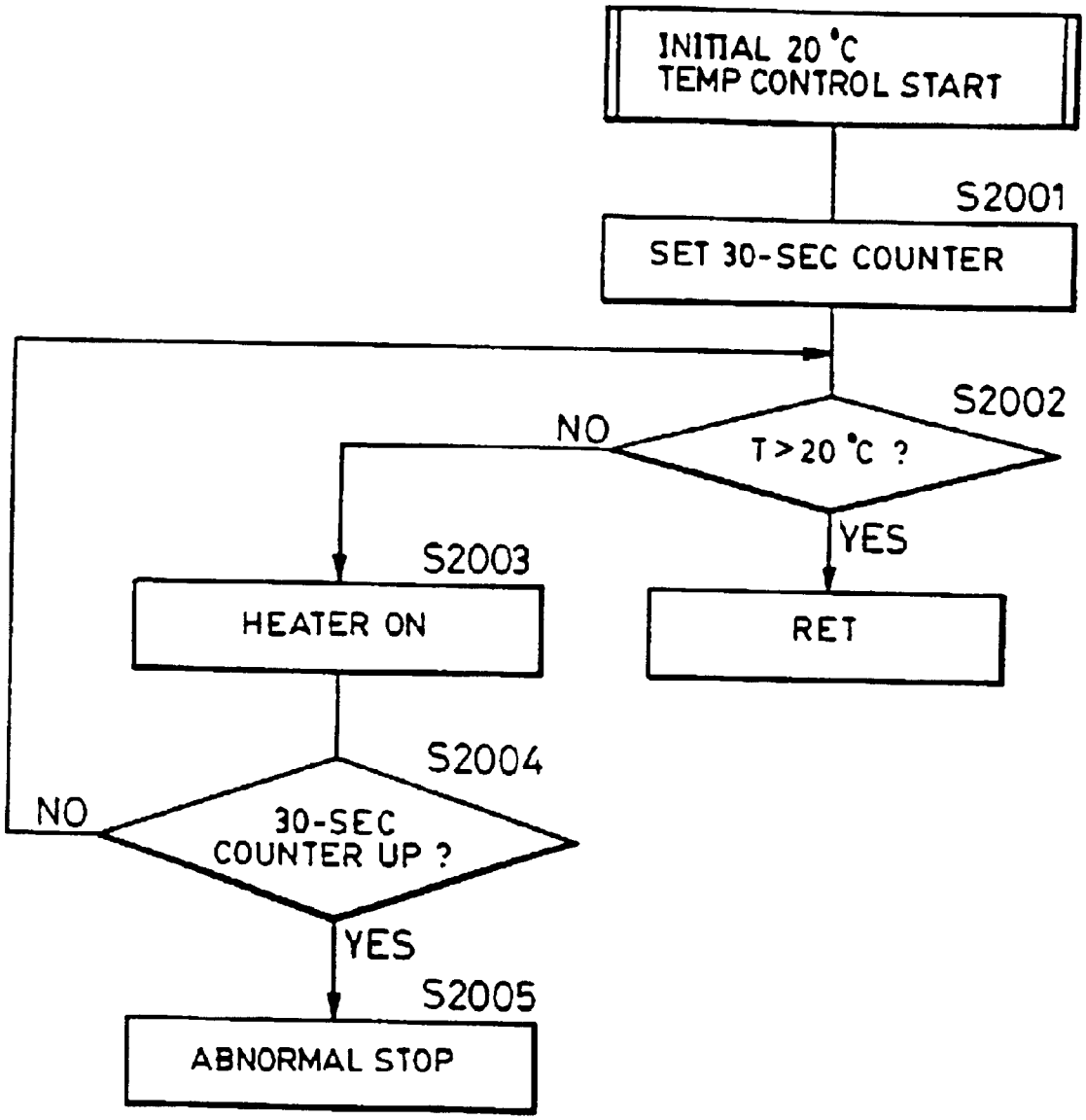
FIG. 22 is a flow chart of an initial 20° C. temperature control routine.

FIG. 22 is a flowchart of the initial 20° C. temperature control routine. After 30 seconds are set in a timer counter in step S2001, it is determined whether or not the temperature is higher than 20° C. If the temperature is higher than 20° C., the process is completed. If the temperature is equal to or lower than 20° C., the heaters of the head are turned on in step S2003. Next, it is determined in step S2004 whether or not 30 seconds have elapsed. If 30 seconds have elapsed, the apparatus is abnormally stopped in step S2005. If 30 seconds have not elapsed, the process returns to step S2002.

FIG. 23 are flowcharts of 20° temperature control and 25° temperature control routines. In step S2101, it is determined whether or not the head temperature is higher than 20° C. If the head temperature is higher than 20° C., the heaters of the head are turned off in step S2102. If the head temperature is equal to or lower than 20° C., the heaters of the head are turned on in step S2103, thereby completing 20° temperature control routine.

The process in steps S2104 to S2106 in 25° temperature control routine is the same as the process in steps S2101 to S2103 in the 20° temperature control routine, description thereof being omitted.

(HS Table)

A method of effectively utilizing the HS control method employed in this embodiment will be described below. Since the head employed in this embodiment is a replaceable one (cartridge type) that the user can replace when desired, detailed adjustment of the head by a service man is not necessary. Furthermore, since cartridge heads are mass produced, individual heads have their own characteristics, and variations in the area, resistance and film structure of the heater board and nozzle formation occur during manufacture. Consequently, discharge characteristic distribution or discharge diameter distribution is generated in a head, and non-uniform density caused by changes in the discharge rate must be corrected.

A method of correcting changes in the discharge rate in a head and thereby performing optimum image formation which is free from non-uniformity will be explained below. When the apparatus is switched on, ID no., color and driving conditions, together with table THS as HS data, are read in as the ROM data of the head. This table THS is copied by the apparatus body.

THS is determined in the manner described below. Dot diameter distribution of the head is measured under the standard driving conditions during manufacture, and HS data is calculated. The results of the calculation are stored in a tabulated form as the ROM data of the head.

Thus, density non-uniformity due to variations in the discharge rate of the head can be absorbed by reading in the HS data table THS as the ROM data of the head and correcting non-uniformity of the head in the apparatus body. Consequently, even when a replaceable head is used, stable color images can be obtained easily.

(Paper Feed Operation)

Figure 24:
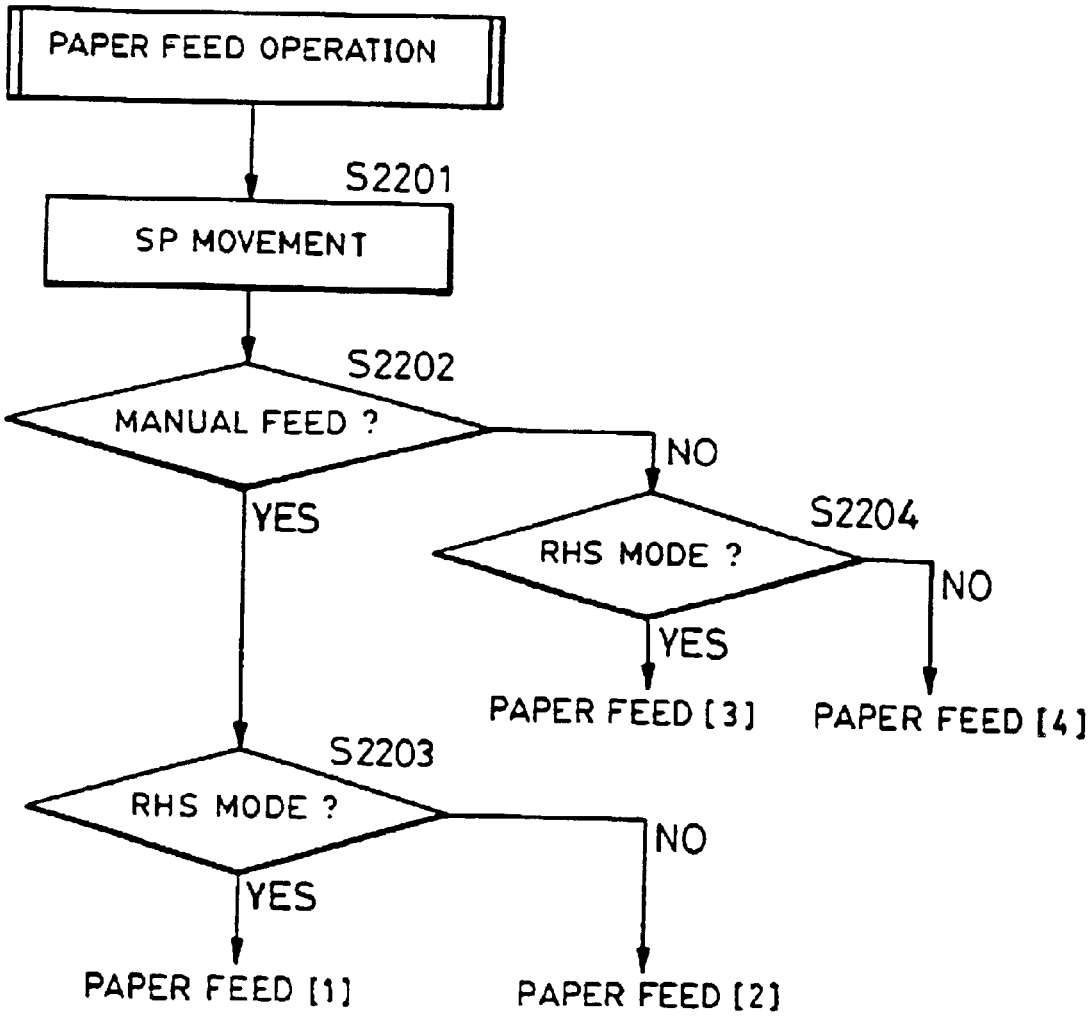
FIG. 24 is a flow chart illustrative of a paper feed routine executed in Step 21 of the control process.

FIG. 24 is a flowchart of the paper feed operation routine executed in step S27.

In step S2201, a carriage is moved to its starting position (SP). In step S2202, it is determined whether or not manual feed is conducted. If a manual feed flag is set, the process goes to step S2203. If the manual feed flag is not set, the process goes to step S2204. In both steps S2203 and S2204, it is determined whether or not the operation mode is the RHS mode. If it is determined in step S2204 that the operation mode is the RHS mode, paper feed [1] is executed. If it is determined that the operation mode is not the RHS mode, paper feed [2] is performed. If it is determined in step S2204 that the operation mode is the RHS mode, paper feed [3] is conducted. If the operation mode is not RHS mode, paper feed [4] is executed.

Figure 25:
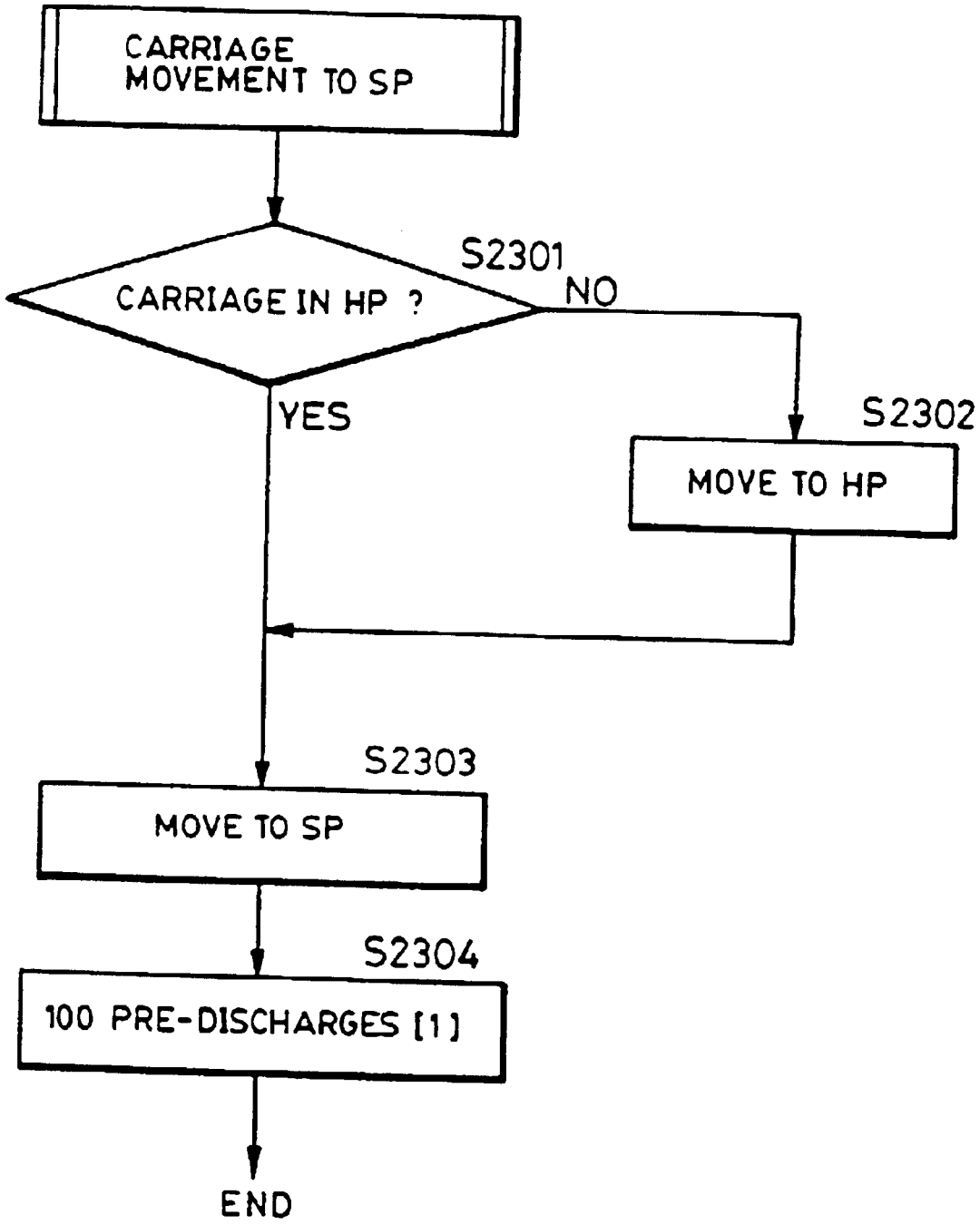
FIG. 25 is a flow chart showing the detail of a routine for moving a carriage to a start position executed in Step S2201 in the routine of FIG. 24.

FIG. 25 is a flowchart showing the carriage starting position moving routine executed in step S2201 of FIG. 24. In step S2301, it is determined whether or not the carriage is at the home position. If the carriage is not at its home position, the carriage is moved to its home position in step S2302. If the carriage is at its home position, it is moved to its starting position in step S2303. Next, in step S2304, pre-discharge [1] is performed 100 times on the carriage located at its starting position, thereby completing a carriage starting position moving routine.

(Paper Width and Paper Type Detection Operation)

Figure 26:
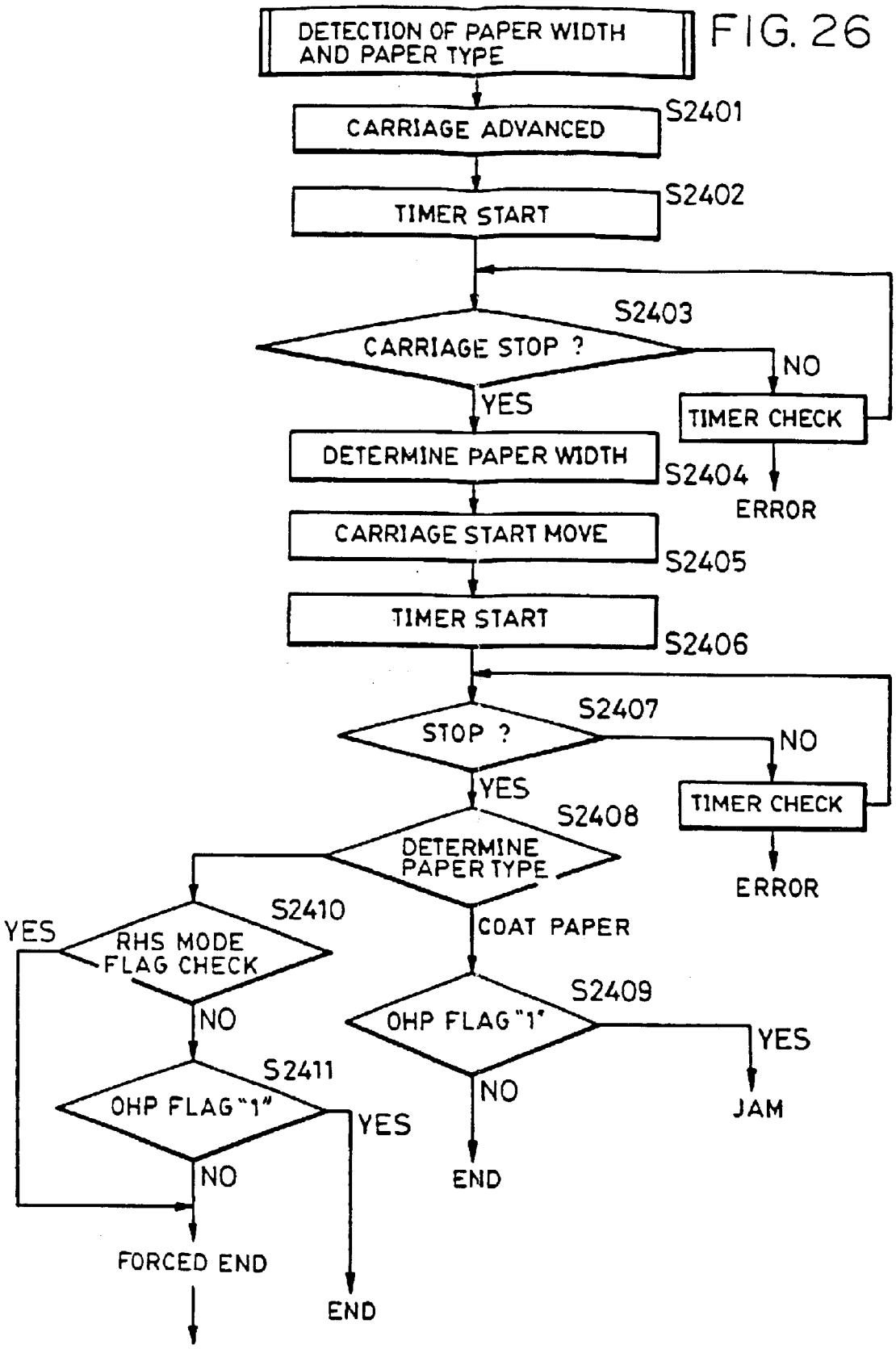
FIG. 26 is a flow chart showing the detail of a paper width/type detection routine executed in Step S22 of the control process.

FIG. 26 is a flowchart showing the paper width and paper type detection operation routine executed in step S28 in detail. After initial setting for detection is done, the carriage is moved to the paper width detection position. During movement, paper width and paper type are detected. After the carriage has moved to its paper width detection position, it returns to its starting position.

(1-Line Printing Operation)

Figure 27:
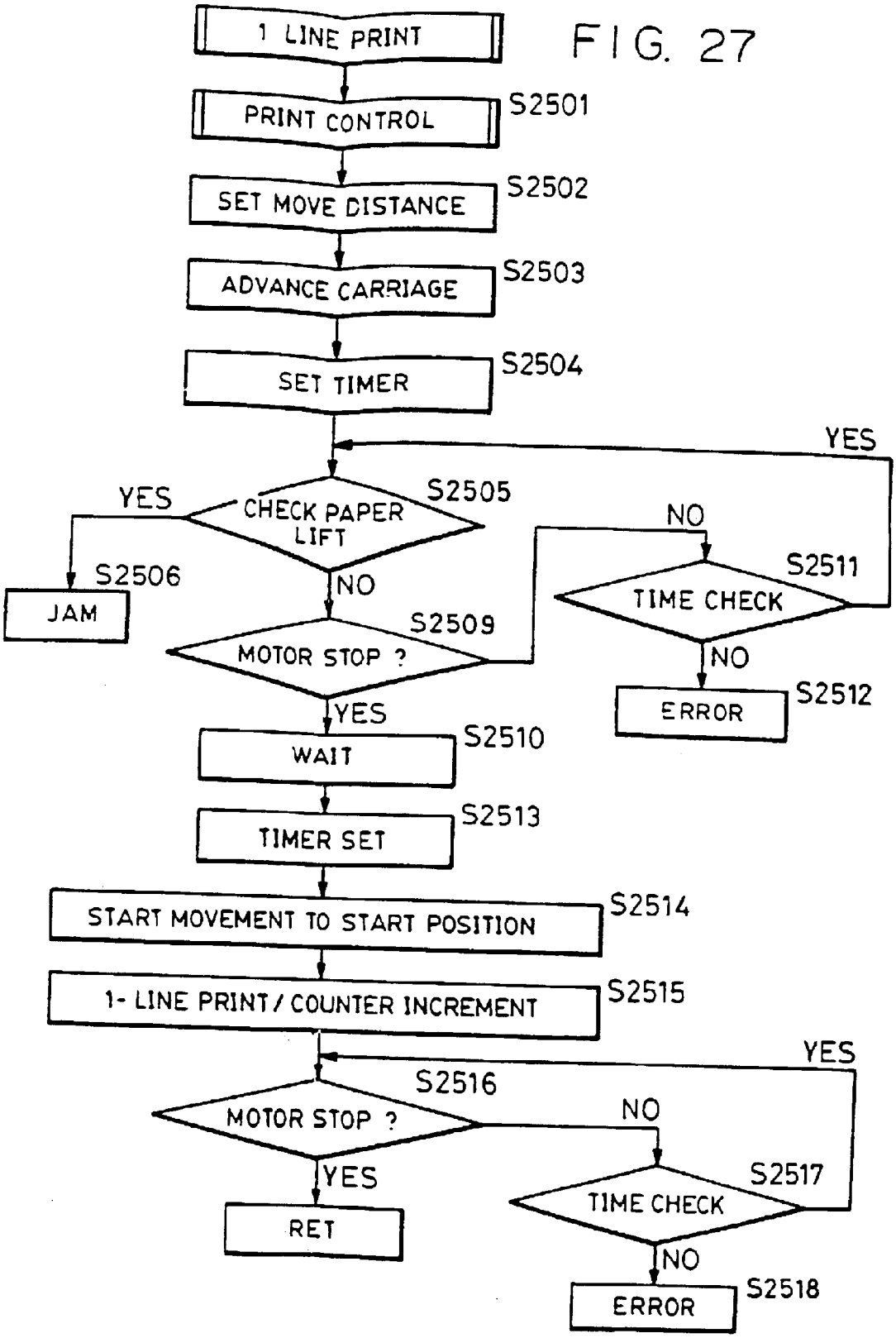
FIG. 27 is a flow chart showing the detail of a one-line printing routine executed in Step S24 of the control process.

FIG. 27 is a flowchart showing the 1-line printing routine executed in step S33 in detail. First, printing control is performed in step S2501. Next, the distance of the movement of the carriage is set in step S2502. In step S2503, the carriage is advanced, and then a timer is set in step S2504. In step S2505, it is determined whether or not there is paper floating. If there is paper floating, it is determined in step S2506 that there is paper jam.

It is determined in step S2509 whether or not the motor has stopped. If the motor has stopped, the process goes to step S2510. If the motor is operating, the timer is checked in step S2511. If the time set in the timer has expired, it is determined in step S2512 that an error has occurred. If the time has not expired, the process returns to step S2505.

In step 2513, the timer is set. Next, in step 2514, the carriage starts moving from its starting position. In step S2515, 1-line printing is conducted, and addition of a counter is conducted. In step S2516, it is determined whether or not the motor has stopped. If the motor has stopped, 1-line printing routine is completed. If the motor is operating, the timer is checked in step S2517. If the time set in the timer has expired, it is determined in step S2518 that the error has occurred. If the time has not expired, the process returns to step S2516.

Figure 28:
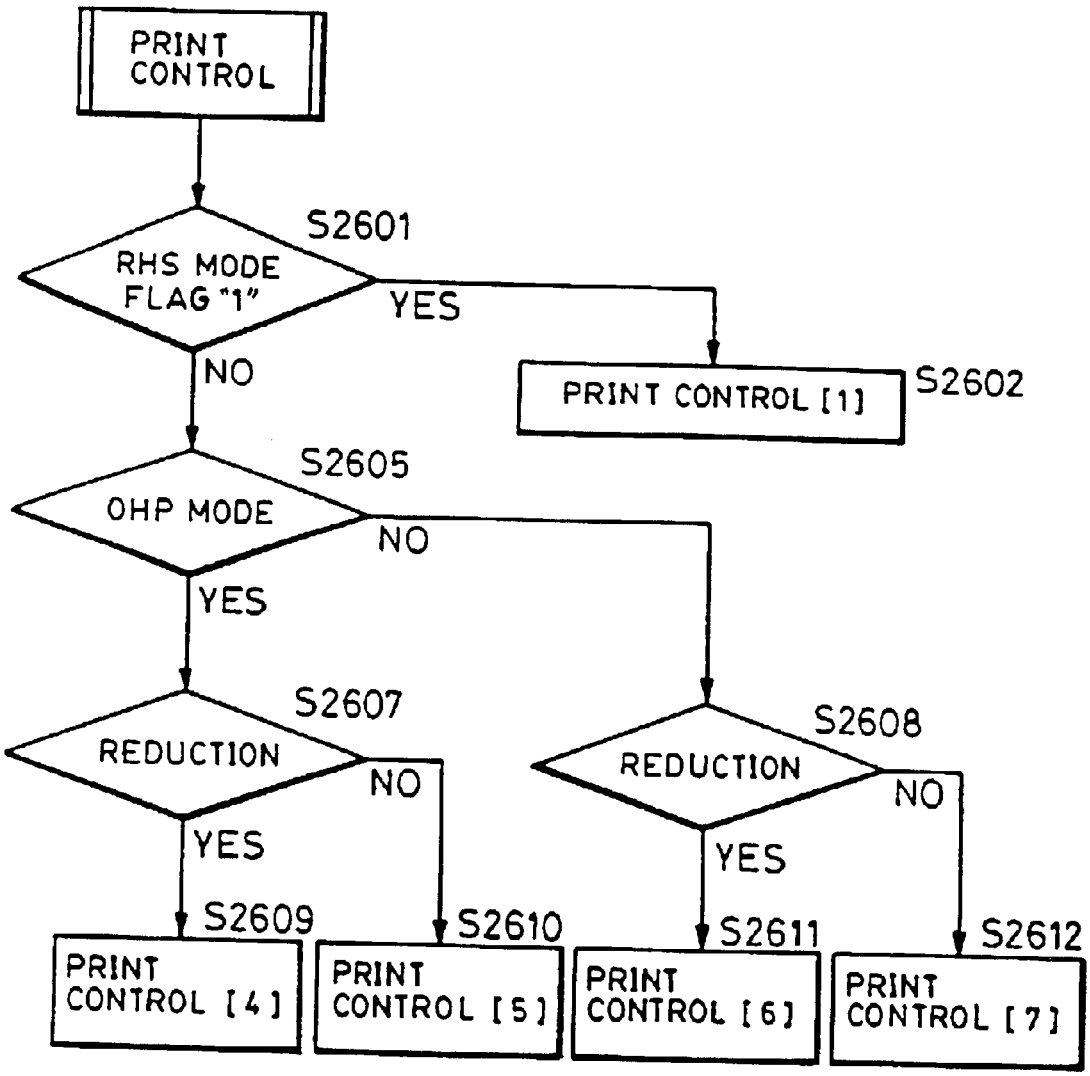
FIG. 28 is a flow chart illustrative of a printing control routine executed in Step S24 of the routine shown in FIG. 27.

FIG. 28 is a flowchart showing the printing control routine executed in step S2501. In step S2601, it is determined whether or not the operation mode is the RHS mode. If the operation mode is the RHS mode, printing control [1] is conducted in step S2602. If the operation mode is not the RHS mode, it is determined in step S2605 whether or not the operation mode is the OHP mode. If the operation mode is the OHP mode, the process goes to step S2607. If the operation mode is not the OHP mode, the process goes to step S2608.

Figure 29:
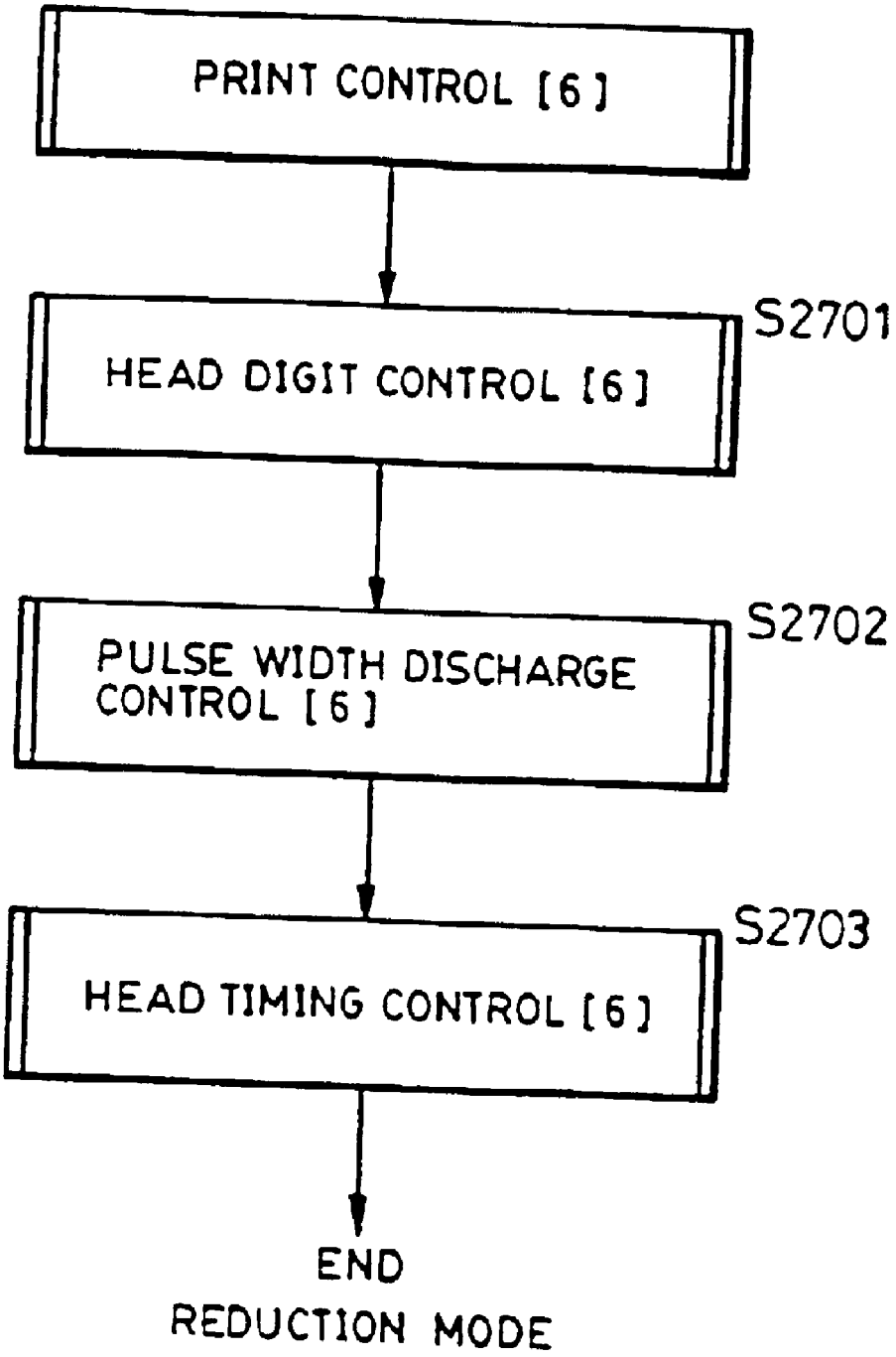
FIG. 29 is a flow chart illustrative of a print control routine [6] in size reduction mode.

In step S2607, it is determined whether or not the operation mode is the reduction mode. If the operation mode is the reduction mode, printing control [4] is conducted in step S2609. If the operation mode is not the reduction mode, printing control [5] is performed in step S2610. It is also determined in step S2608 whether or not the operation mode is the reduction mode. If it is determined that the operation mode is the reduction mode, printing control [6] is conducted in step S2611. If it is determined that the operation mode is not the reduction mode, printing control [7] is conducted in step S2612. FIG. 29 is a flowchart showing printing control [6] which is the reduction printing mode. In printing control [6], head digit control, ink discharge control and head timing control are performed. First, head digit control will be explained in detail.

Figure 31A:
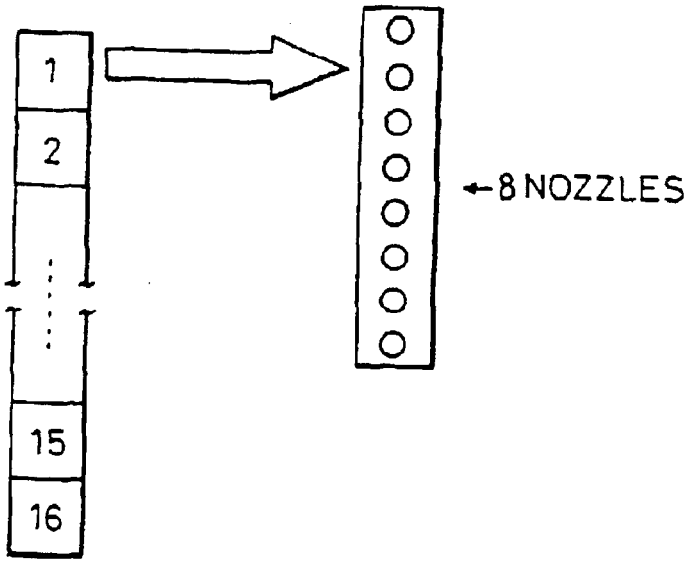
FIGS. 31(A)–31(C) are illustrations of the head digit control [6[.
Figure 31B:
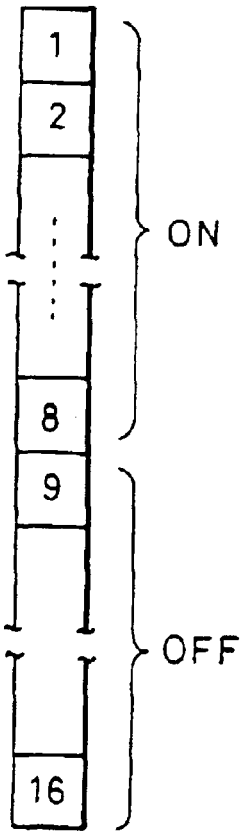
Figure 31C:
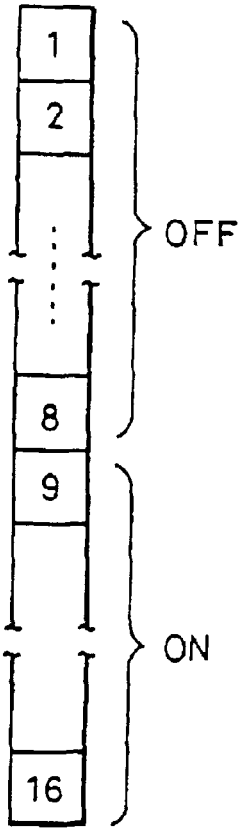

The number of nozzles of the recording head is 128. Head digit control is on/off control of these nozzles of the head in the unit of 8 nozzles, which is a digit. FIGS. 31(A) to 31(C) illustrate the digits. Digit 1 consists of, for example, 8 nozzles from nozzle 1 to nozzle 8, and digit 16 consists of 8 nozzles from nozzle 121 to nozzle 128. The number of digits to be controlled in a single head is 16.

Figure 30:
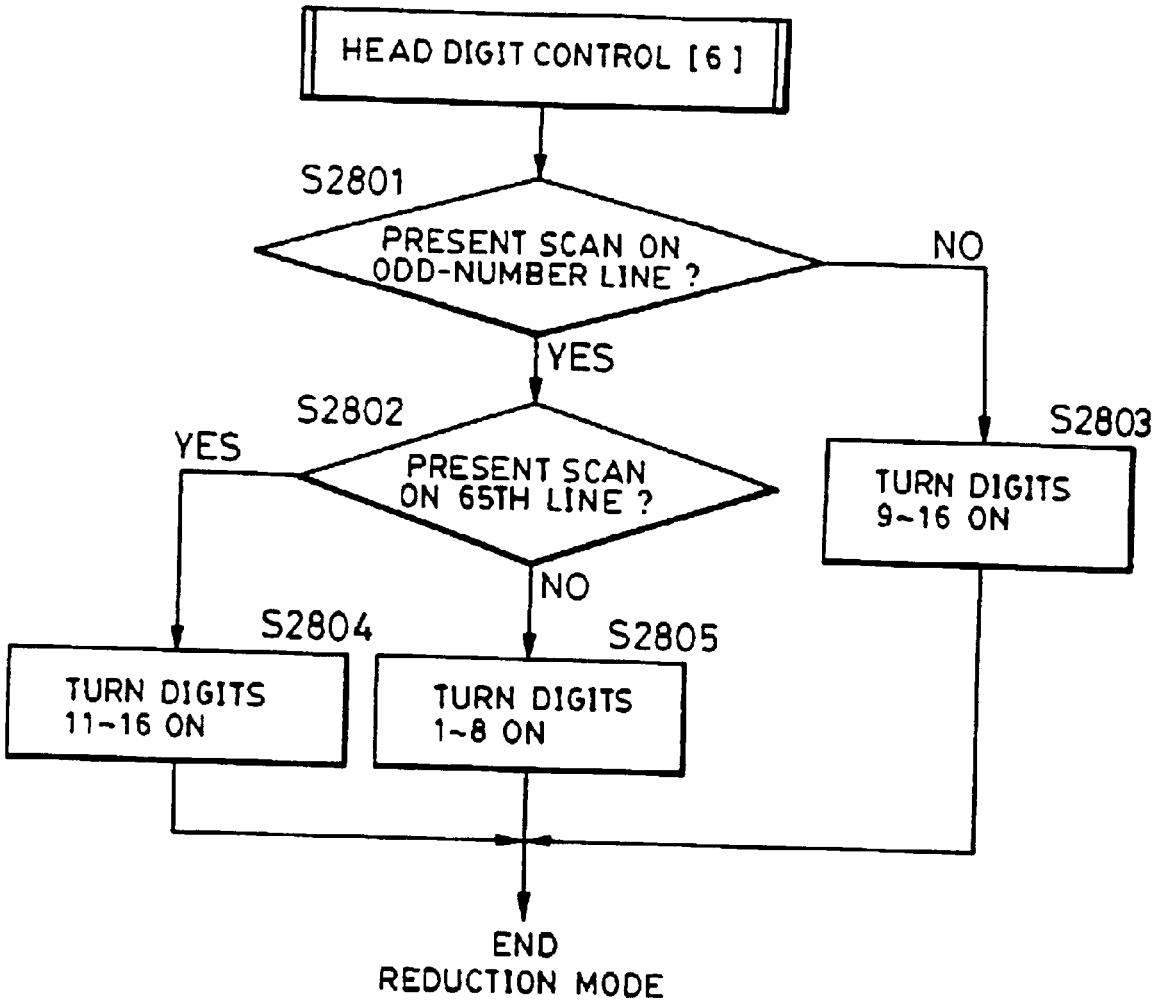
FIG. 30 is a flow chart illustrative of a head digit control routine [6]

FIG. 30 is a flowchart of the head digit control [6] routine, and FIGS. 31(A) to 31(C) illustrate it. When reduction printing is conducted on a sheet of paper of A4 size, the carriage makes 1-line printing 65 times. Hence, in this routine, digit control is performed 65 times. When it is determined in steps S2801 and S2802 that the line on which 1-line printing is to be conducted is an odd-numbered line, ink discharge is conducted on the nozzles from 1 to 64 in step S2805. That is, ink discharge is not conducted on the nozzles from 65 to 128 in step S2805.

If it is determined in step S2801 that the line on which 1-line printing is conducted is an even-numbered line, ink discharge is conducted on the nozzles from 65 to 128 in step S2803. That is, no ink is discharged from the nozzles 1 to 64 in step S2803. When 1-line printing is conducted on the final 65th line, ink discharge is conducted on the nozzles from 81 to 128 in step S2804.

Figure 32:
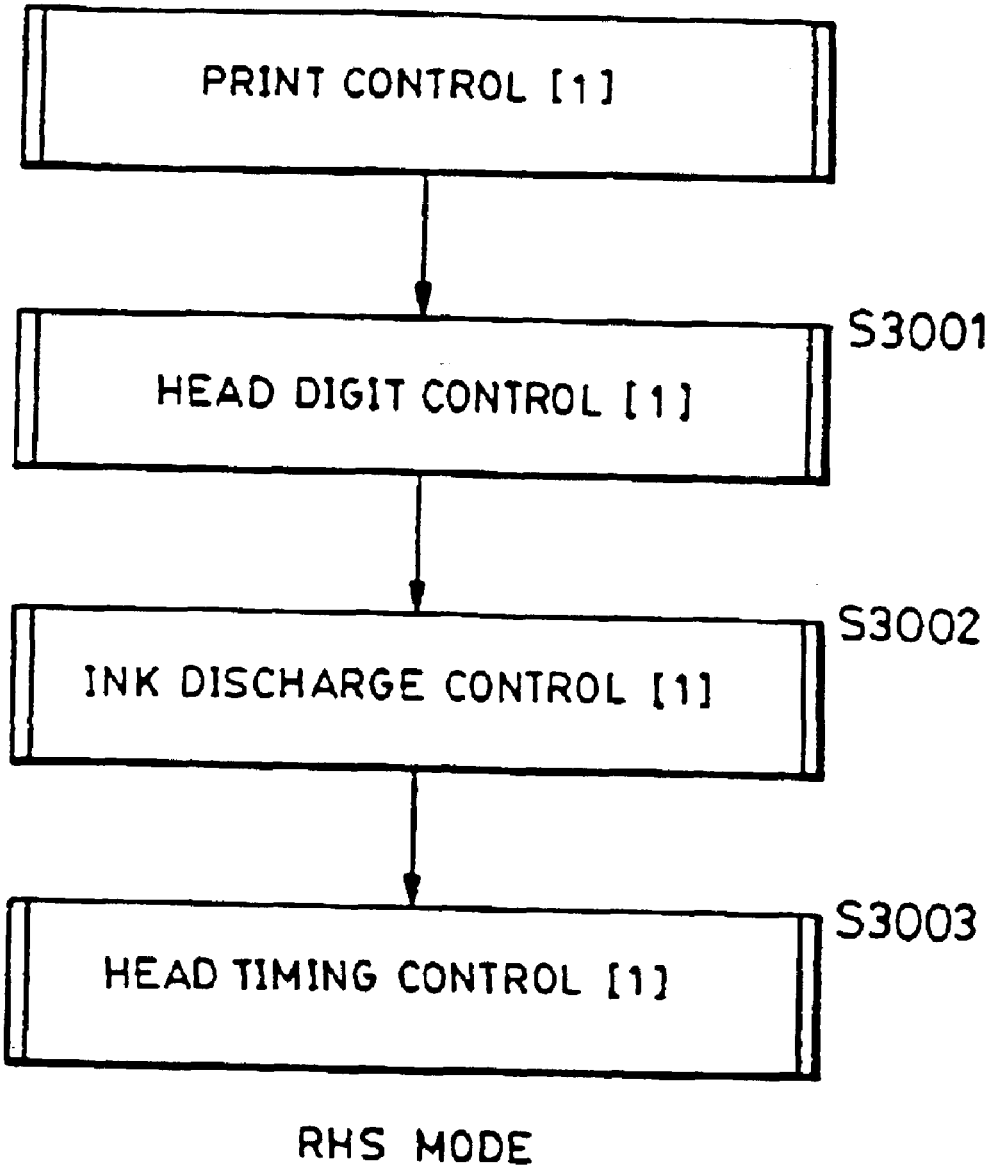
FIG. 32 is a flow chart illustrative of the print control routine [1] in an RHS printing mode.

FIG. 32 is a flowchart showing printing control [1] which is the RHS printing mode. In this printing control operation, head digit control, ink discharge control and head timing control are performed. Now, head digit control and head timing control will be explained. Explanation of ink discharge control is omitted.

Figure 33:
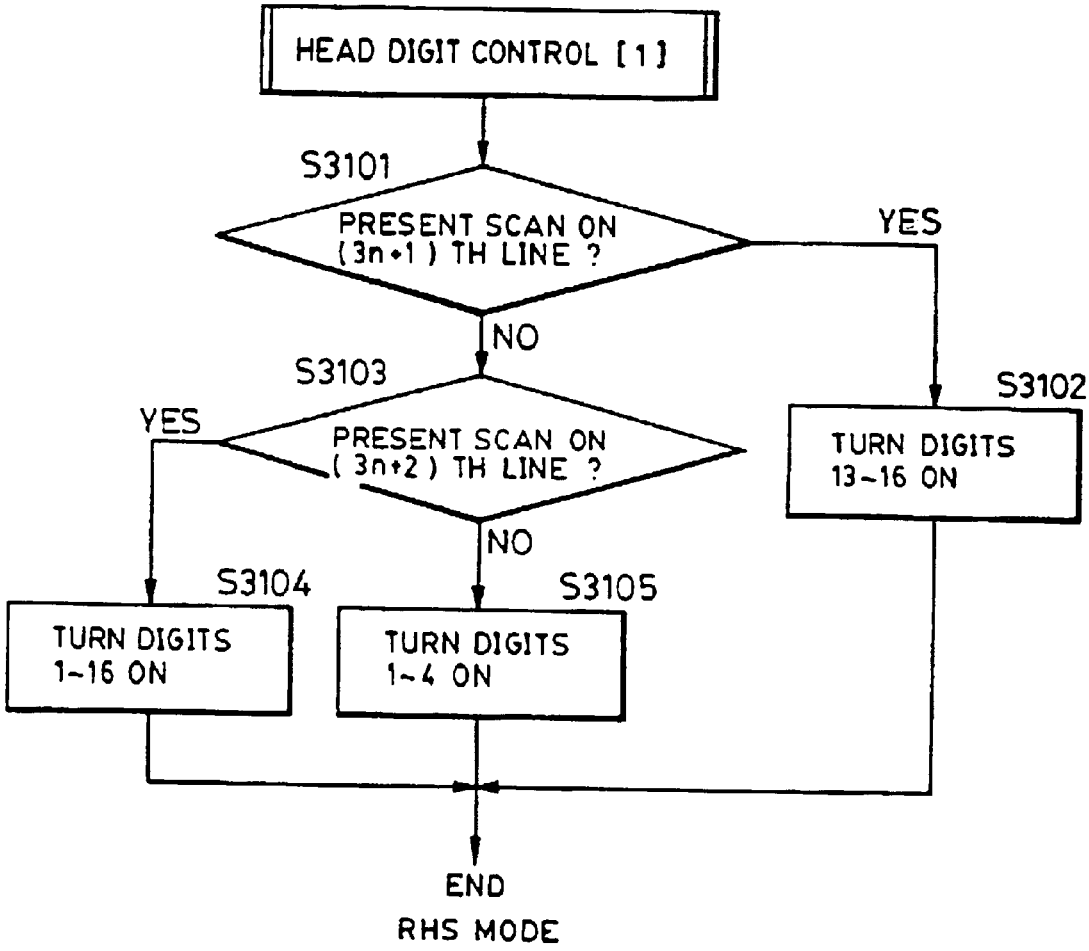
FIG. 33 is a flow chart illustrative of a head digit control routine in the RHS printing mode.
Figure 34A:
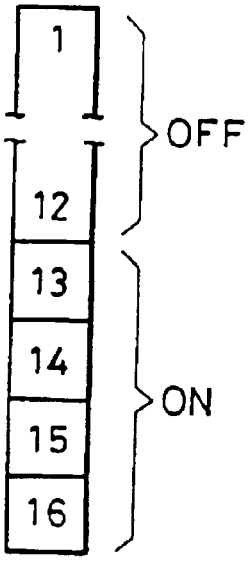
FIGS. 34(A)–34(C) are illustrations of the head digit control [1] in the RHS printing mode.
Figure 34B:
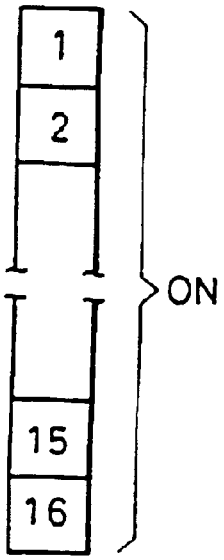
Figure 34C:
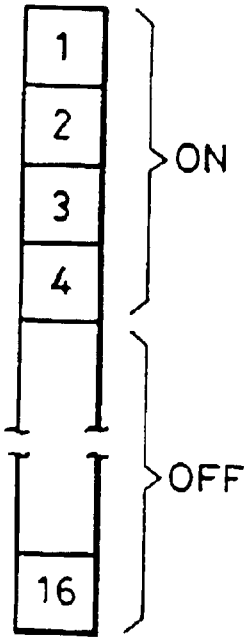

FIG. 33 is a flowchart showing head digit control [1] which is executed in the RHS printing mode. FIGS. 34(A) to 34(C) illustrate the head digit control in this mode. Since the carriage makes 1-line printing 12 times during RHS printing, digit control is performed 12 times in this routine. If it is determined in step S3101 that the line on which 1-line printing is conducted is 3n+1th line (n=0, 1, 2, 3), ink discharge is conducted on the digits from 13 to 16 (the nozzles from 97 to 128) in step S3102.

If it is determined in step S3103 that the line on which 1-line printing is conducted is 3n+2th line, ink discharge is conducted on the digits from 1 to 16 (the nozzles from 1 to 128) in step S3104. If the line on which 1-line printing is conducted is the line other than 3n+1th or 3n+2th line (3n+3th line), ink discharge is conducted on the digits from 1 to 4 (the nozzles from 1 to 32) in step S3105.

Figure 35:
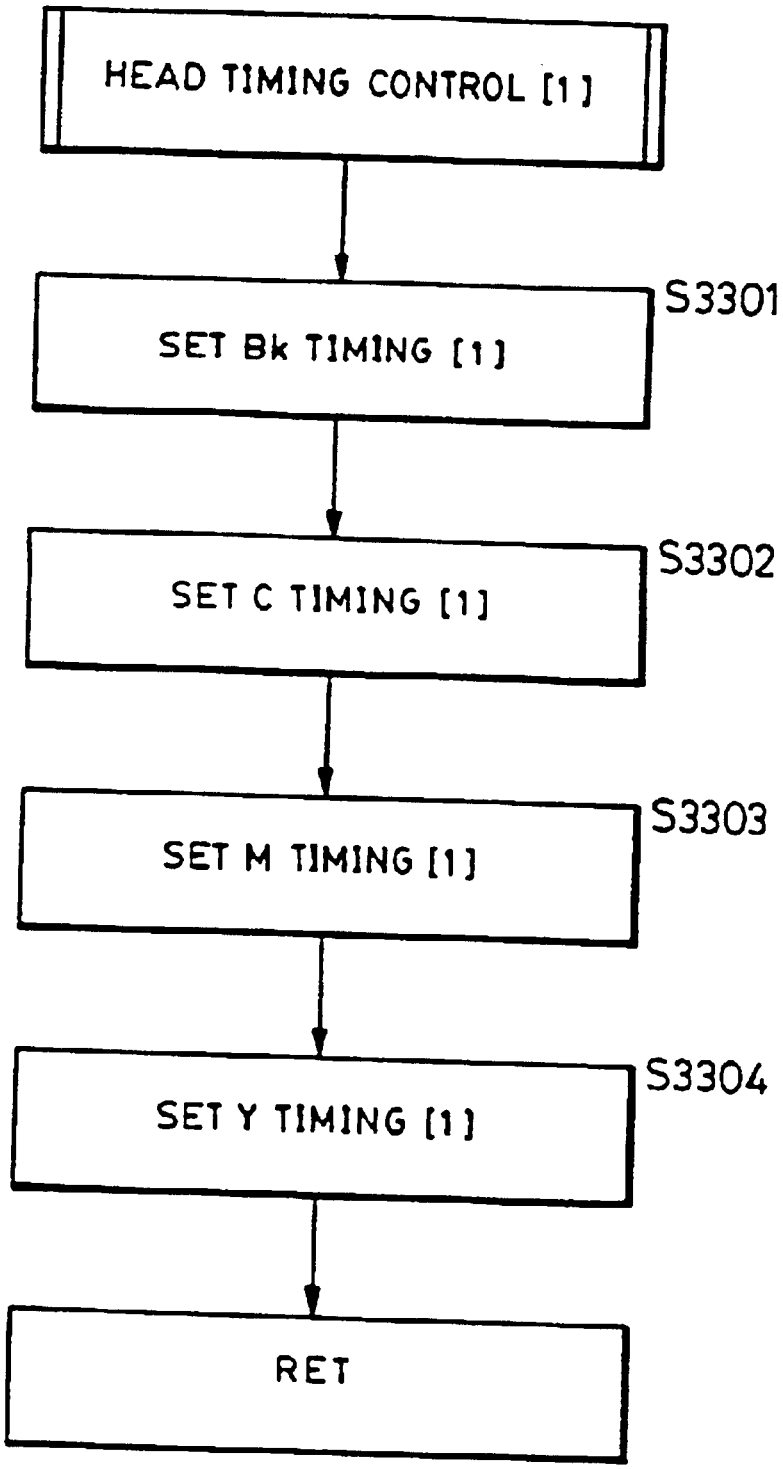
FIG. 35 is a flow chart illustrative of a head timing control routine [1] in the RHS printing mode.

FIG. 35 is a flowchart showing head timing control [1] executed in the RHS printing mode.

Figure 36:
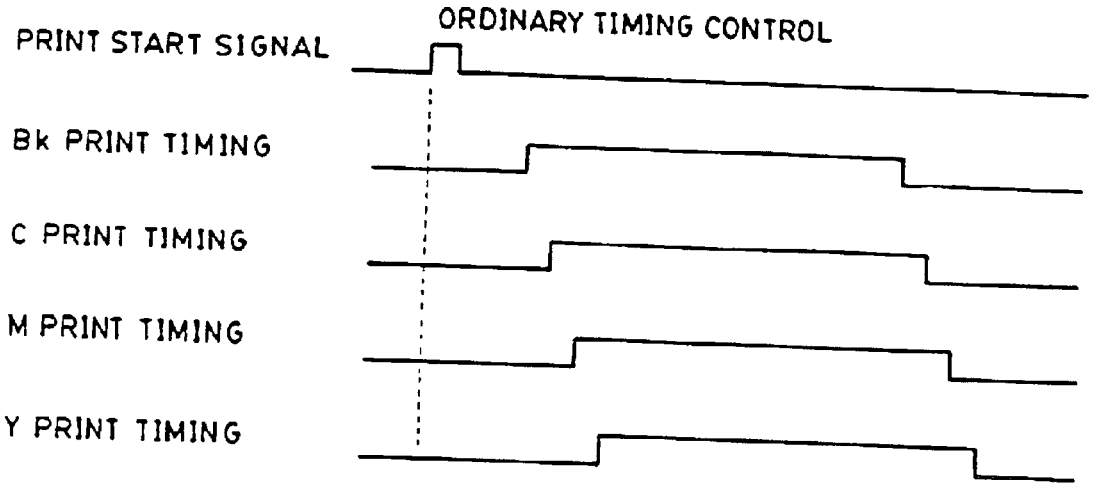
FIGS. 36(A)–36(B) are timing charts illustrative of printing timing.
Figure 36:
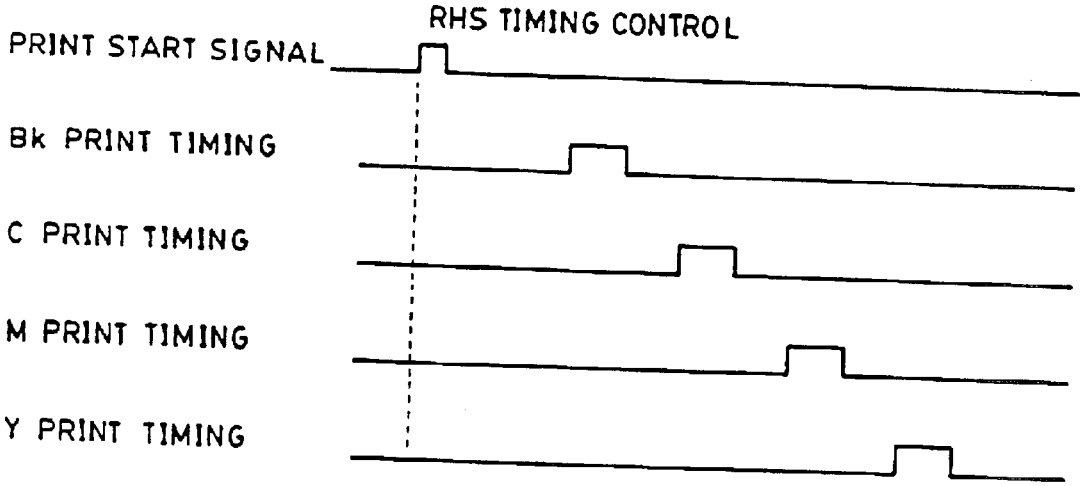
Figure 37:
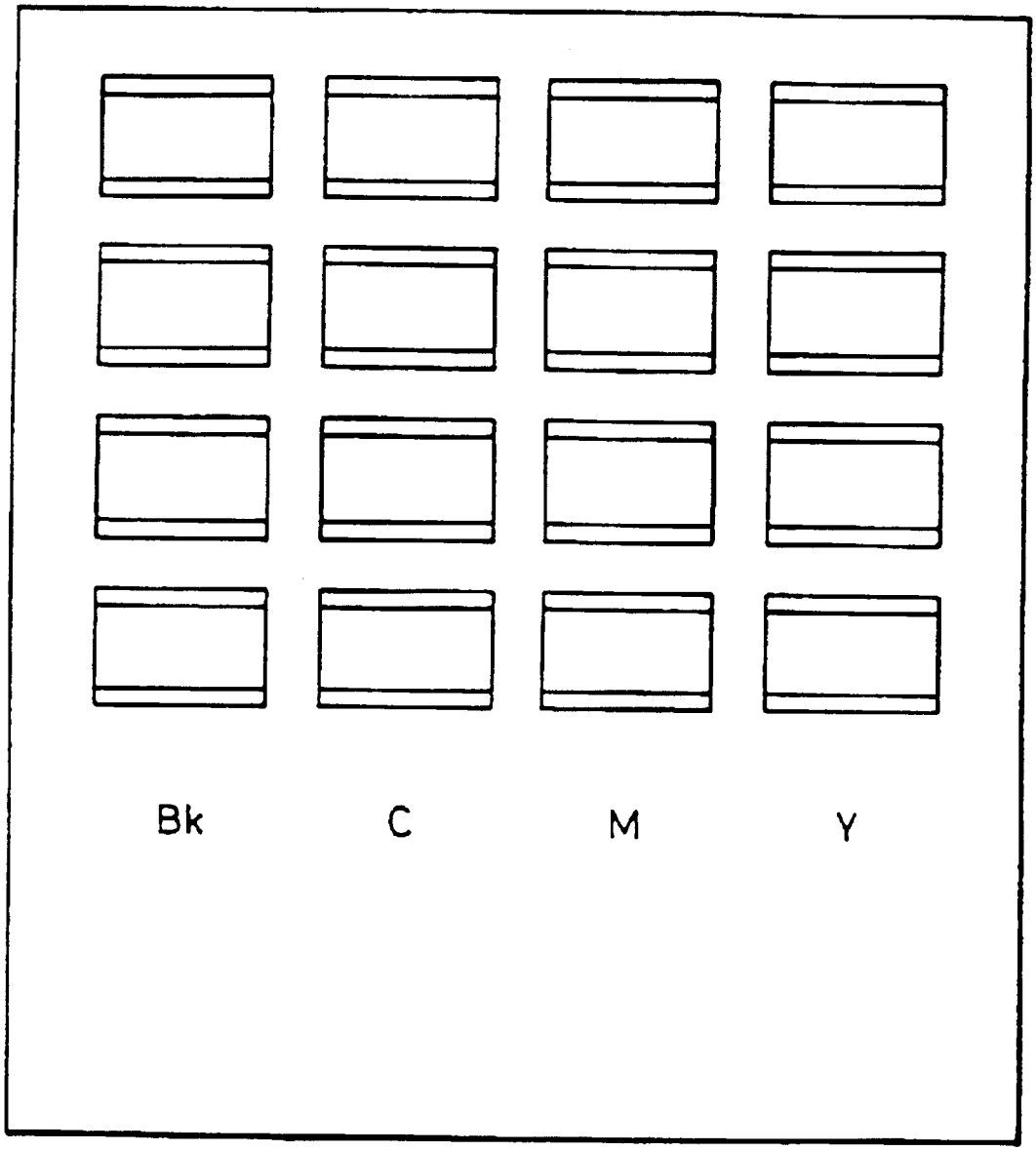
FIG. 37 is an illustration of printing areas in which patterns are to be printed in black, cyan, magenta and yellow.

Printing patterns of black, cyan, magenta and yellow are printed on regions illustrated in FIG. 37. Although explanation of the practically conducted head timing control operation is omitted, FIGS. 36(A) to 36(B) show comparison between normal printing timing and RHS printing timing. FIG. 36 (A) shows printing timing in the printing mode other than the RHS printing mode, and FIG. 36 (B) shows RHS printing timing.

Figure 38:
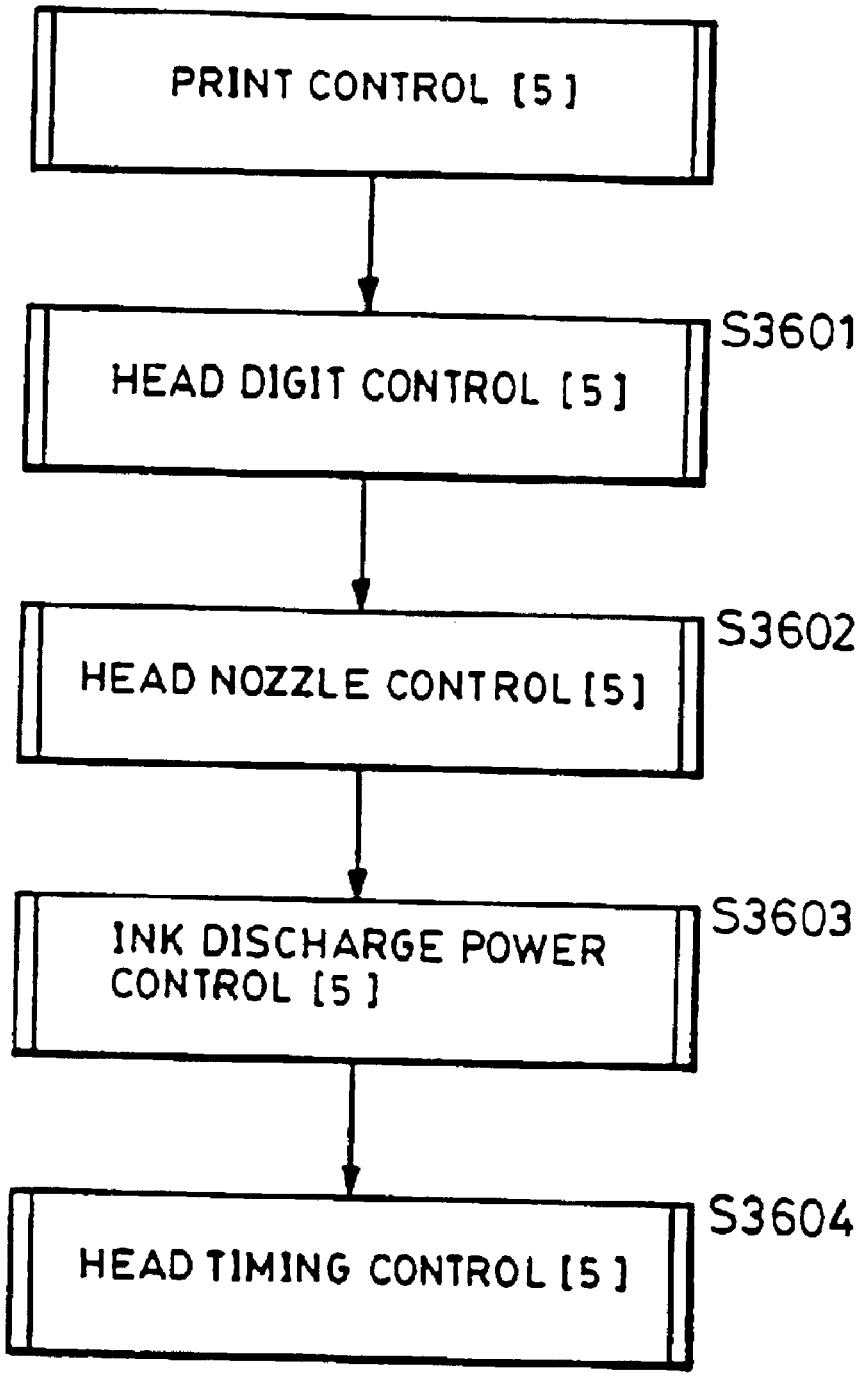
FIG. 38 is an illustration of a print control routine [5] in an OHP printing mode.

Printing control [5] is an OHP printing control. The flow of the printing control [5] routine is shown in FIG. 38. Head digit control [5] and head nozzle control [5] will be described with reference to FIGS. 39 and 40. In this routine, since recording is conducted on OHP paper, the carriage scans the same area twice to conduct intermittent printing. Hence, when recording is conducted on a sheet of paper of A4 size, the carriage makes 1-line printing 66 times, and digit control is conducted 66 times.

Figure 39:
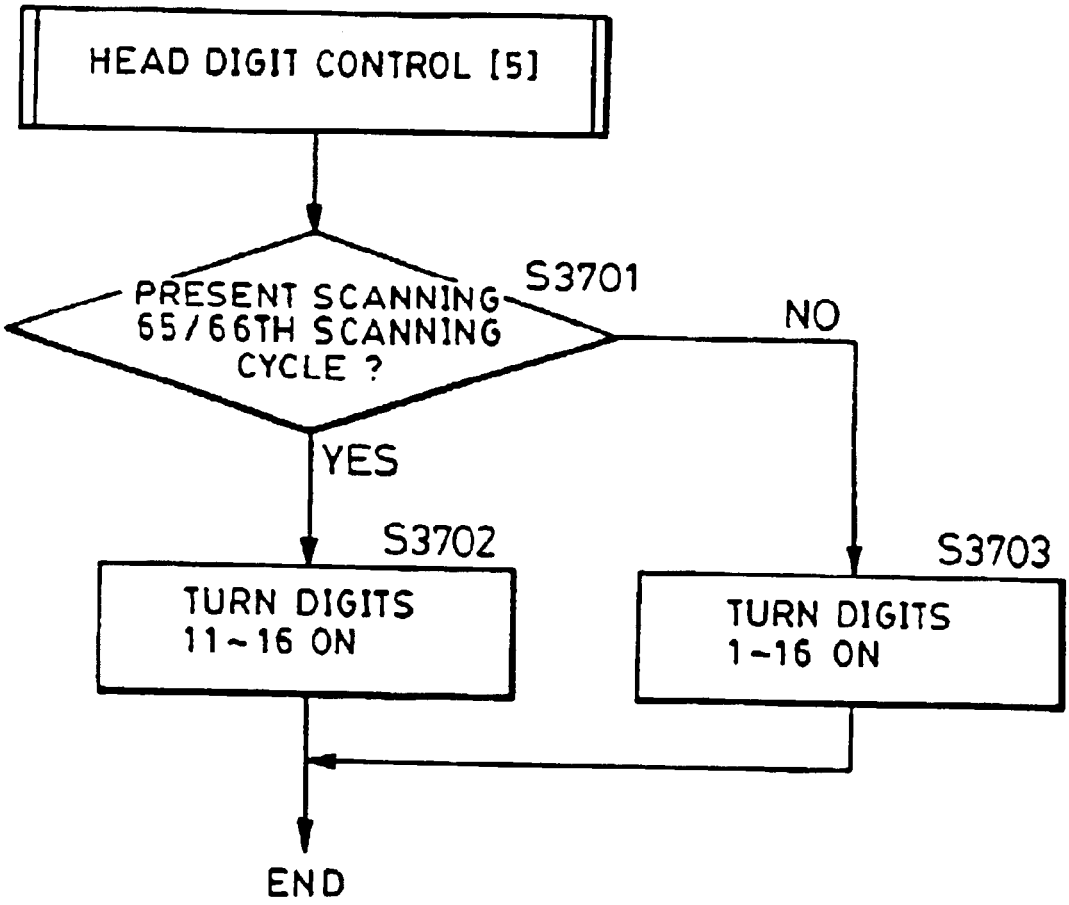
FIG. 39 is a flow chart illustrative of a head digit control routine [5]
Figure 40:
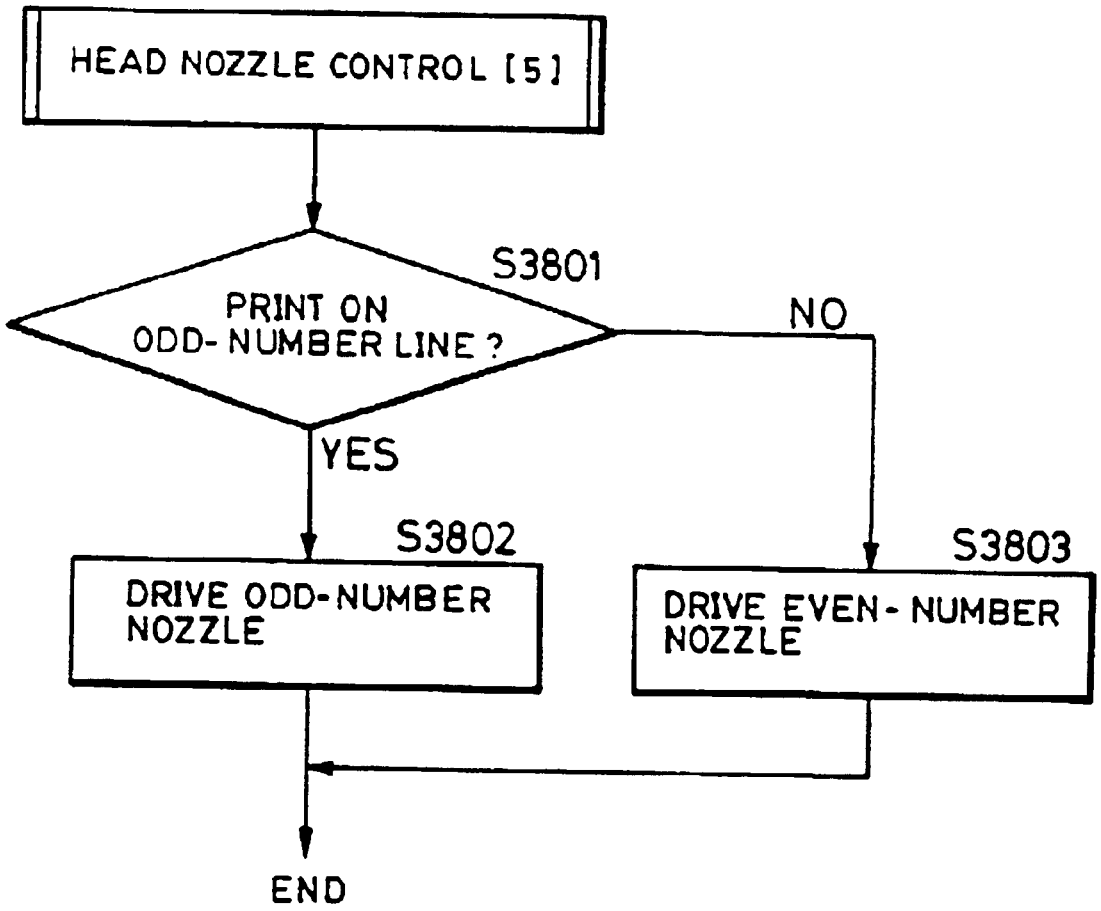
FIG. 40 is a flow chart illustrative of a head nozzle control routine [5]
Figure 41A:
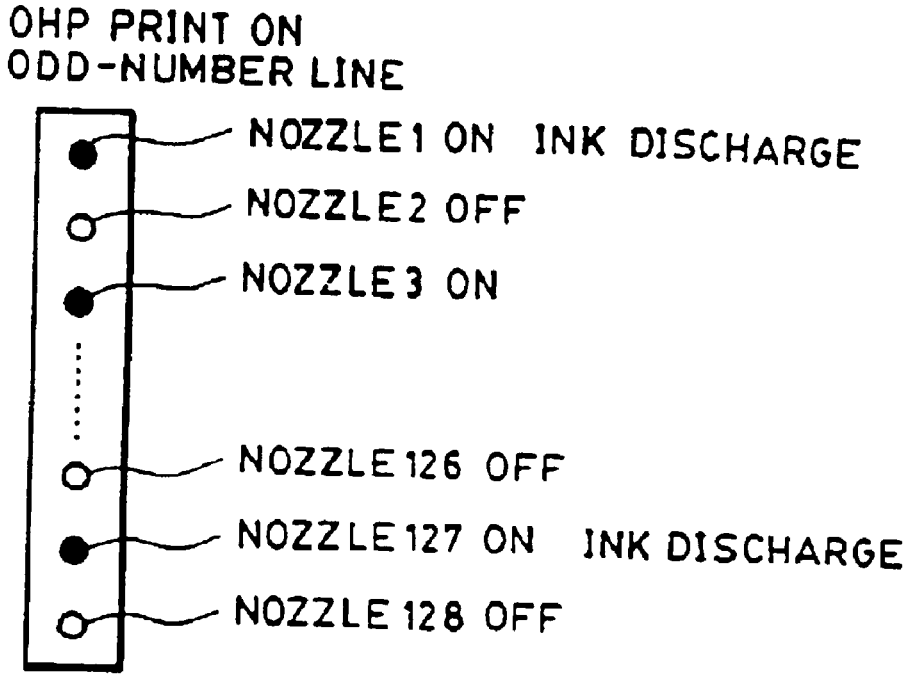
FIGS. 41(A) and 41(B) are illustrations of the manner in which a nozzle is driven under the head digit control [5] of FIG. 39 and the head nozzle control [5] of FIG. 40.
Figure 41B:
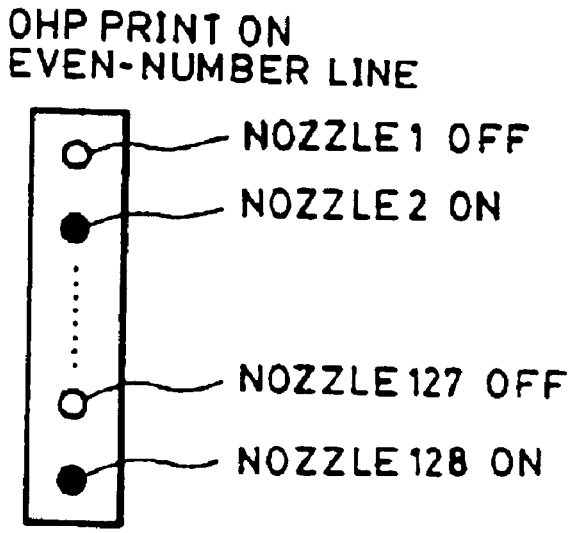
Figure 42:
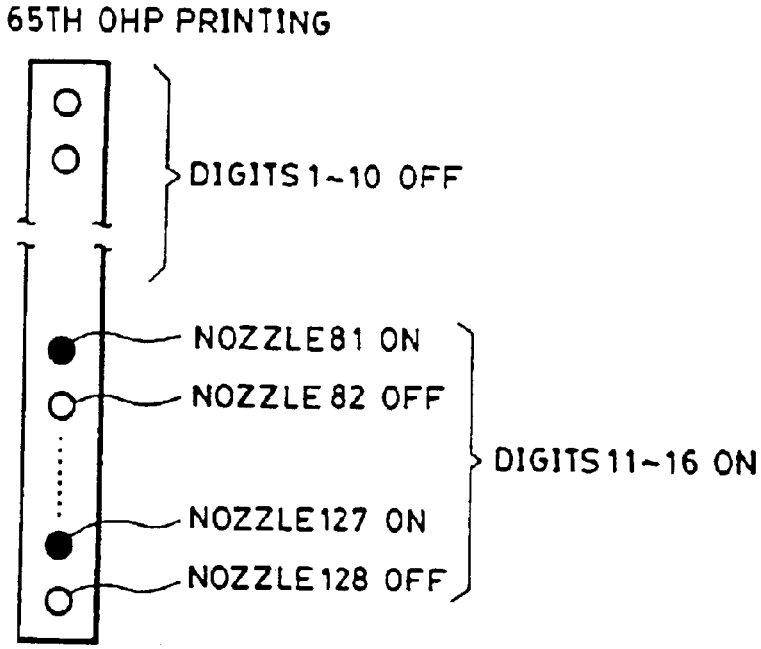
FIGS. 42(A) and 42(B) are illustrations of the manner in which the nozzle is driven under the head digit control [5] of FIG. 39 and the head nozzle control [5] of FIG. 40.
Figure 42:
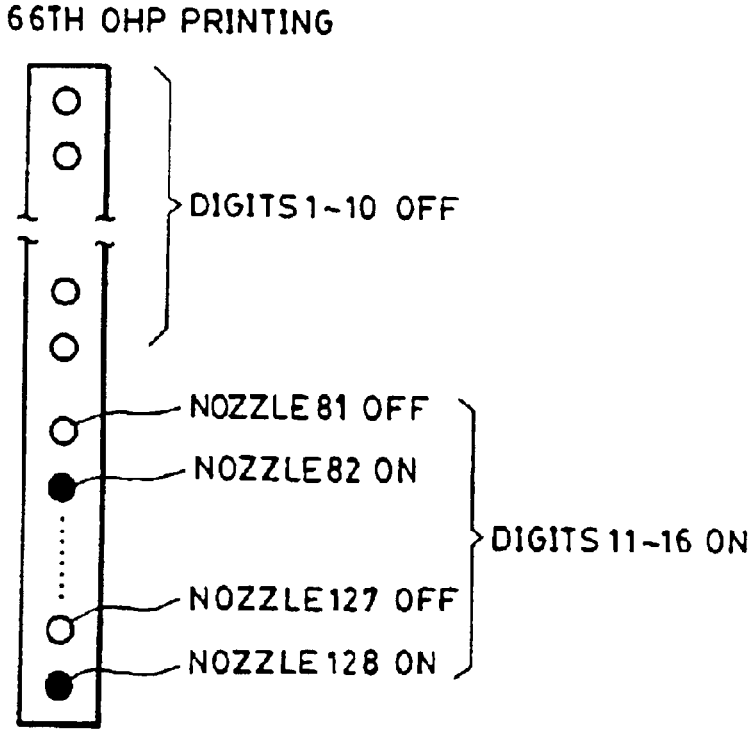

In FIGS. 39 and 40, when the line on which 1-line printing is conducted is an odd-numbered line, only odd-numbered nozzles in the nozzles from 1 to 128 (in step S3703) are activated in step S3802. When 1-line printing is conducted on an even-numbered line, only even-numbered nozzles in the nozzles from 1 to 128 (step S3703) are activated in step S3803. When 1-line printing is conducted on 65th line, only odd-numbered nozzles in the nozzles from 81 to 128 (step S3702) are activated in step S3802. When the line on which 1-line printing is conducted is 66th line, only even-numbered nozzles in the nozzles from 81 to 128 (step S3702) are activated in step S3803. FIGS. 41(A), 41(B), 42(A) and 42(B) illustrate this operation.

Figure 43:
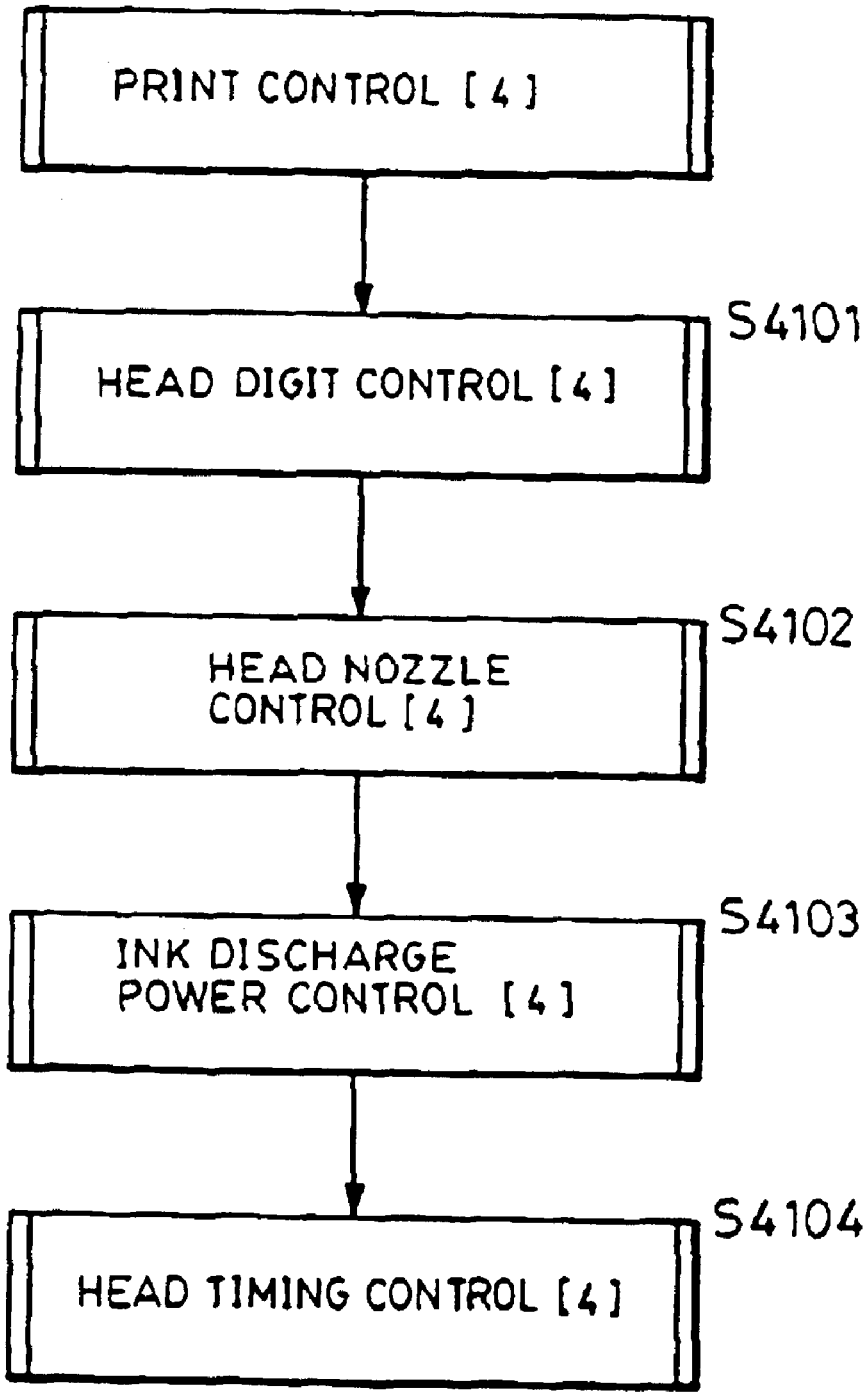
FIG. 43 is a flow chart illustrative of a printing control routine [4] in an OHP size-reduction mode.
Figure 44:
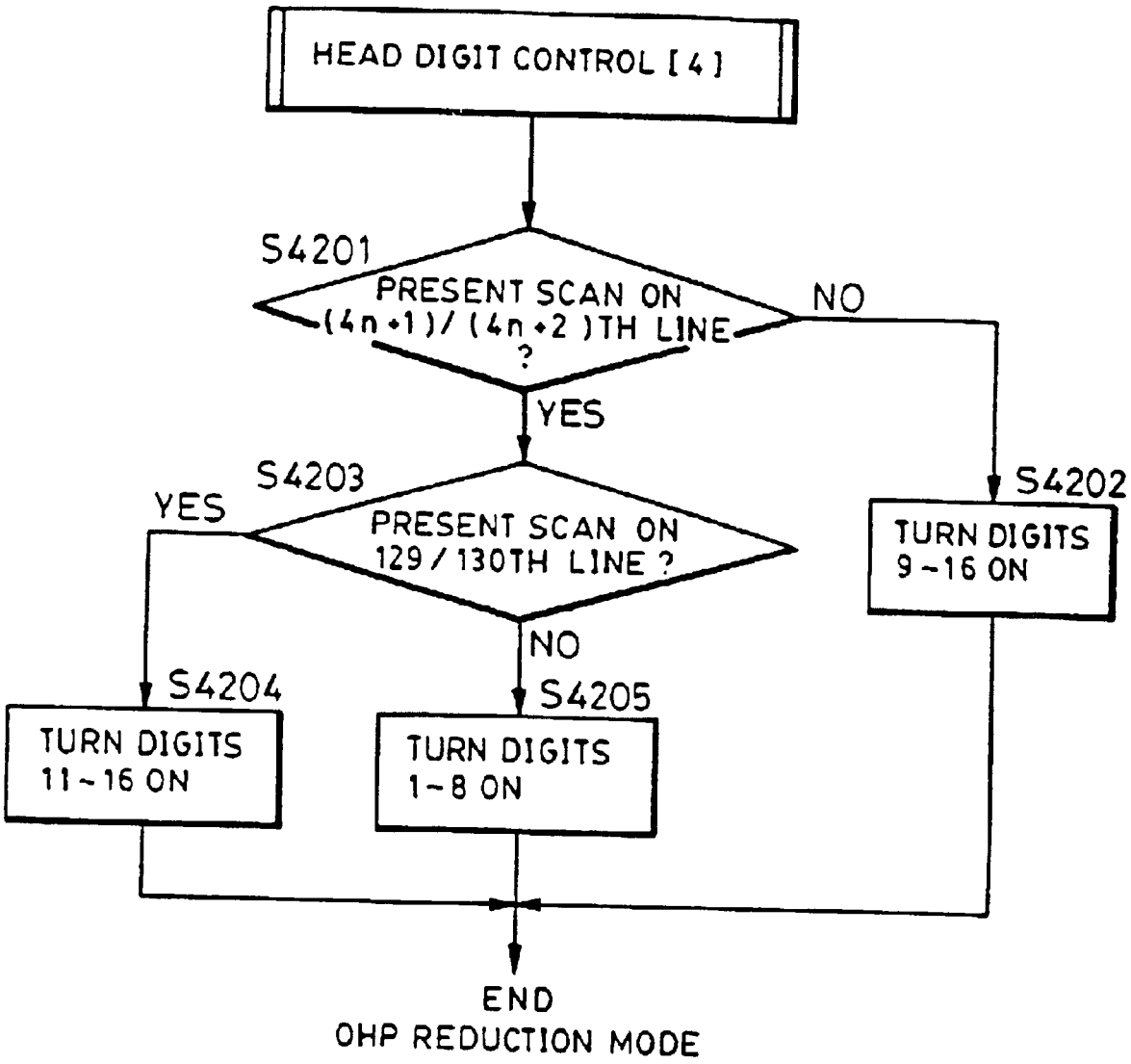
FIG. 44 is a flow chart illustrative of a head digit control routine [4]
Figure 45:
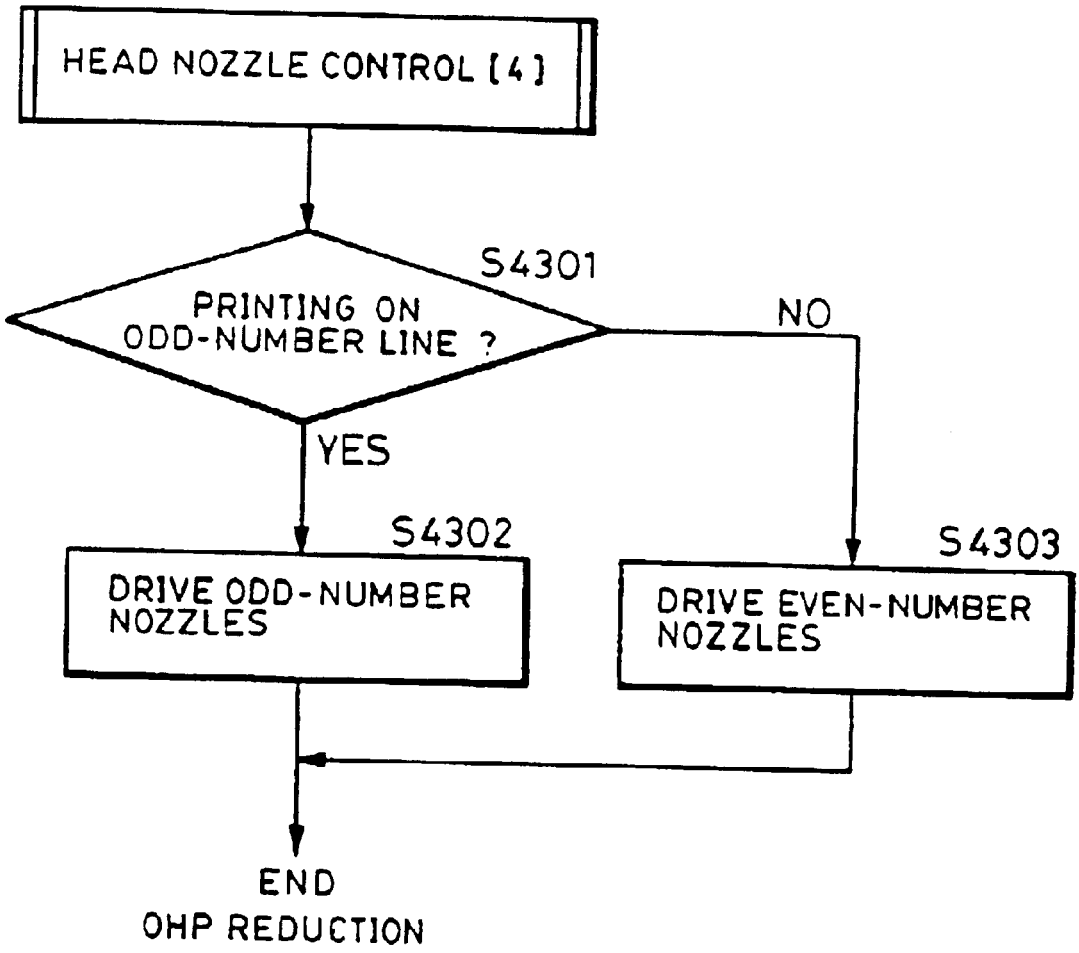
FIG. 45 is a flow chart illustrative of a head nozzle control routine [4]
Figure 46:
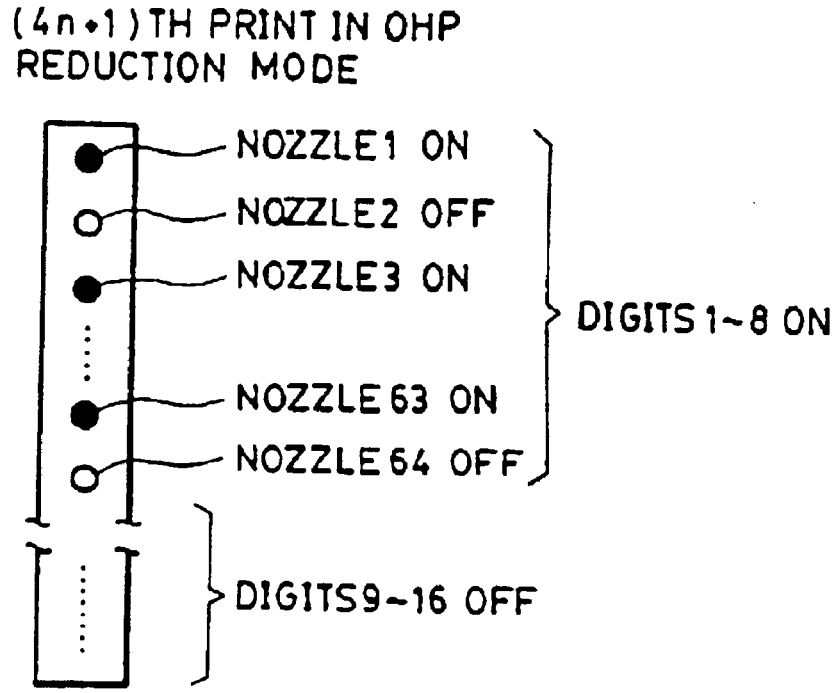
FIGS. 46(A) and 46(B) are illustrations of the manner in which a nozzle is driven under the head digit control [4] of FIG. 44 and the head nozzle control [4] of FIG. 45.
Figure 46:
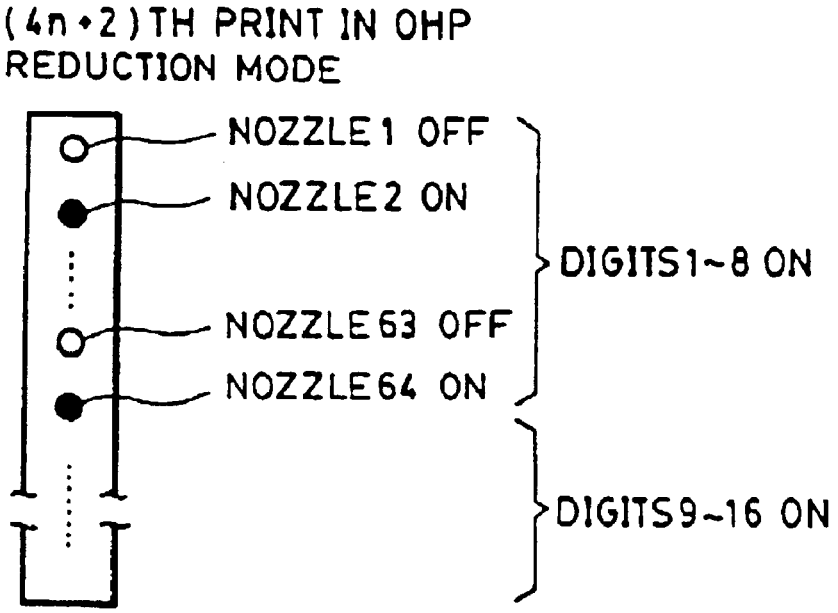
Figure 47A:
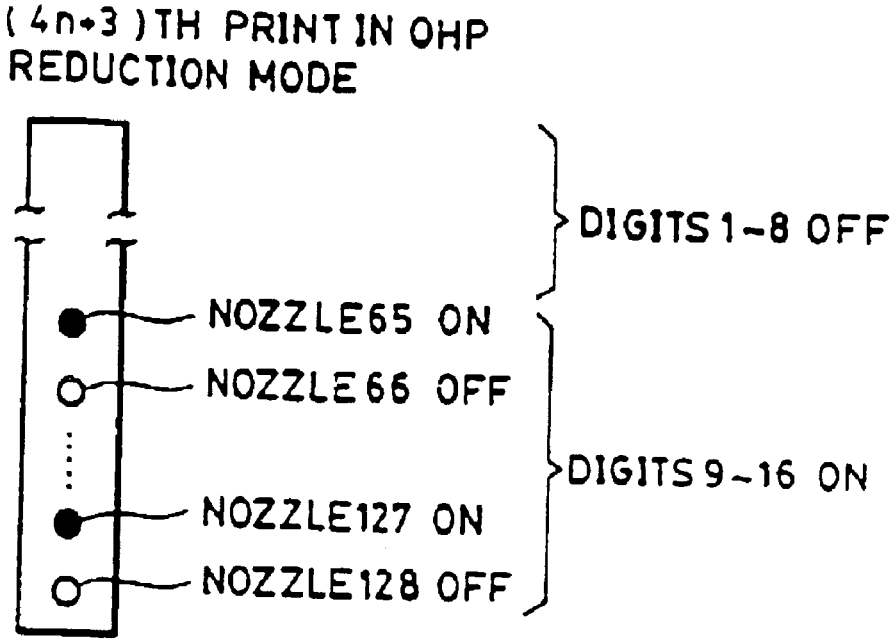
FIGS. 47(A) and 47(B) are illustrations of the manner in which the nozzle is driven under the head digit control [5] of FIG. 39 and the head nozzle control [5] of FIG. 40.
Figure 47B:
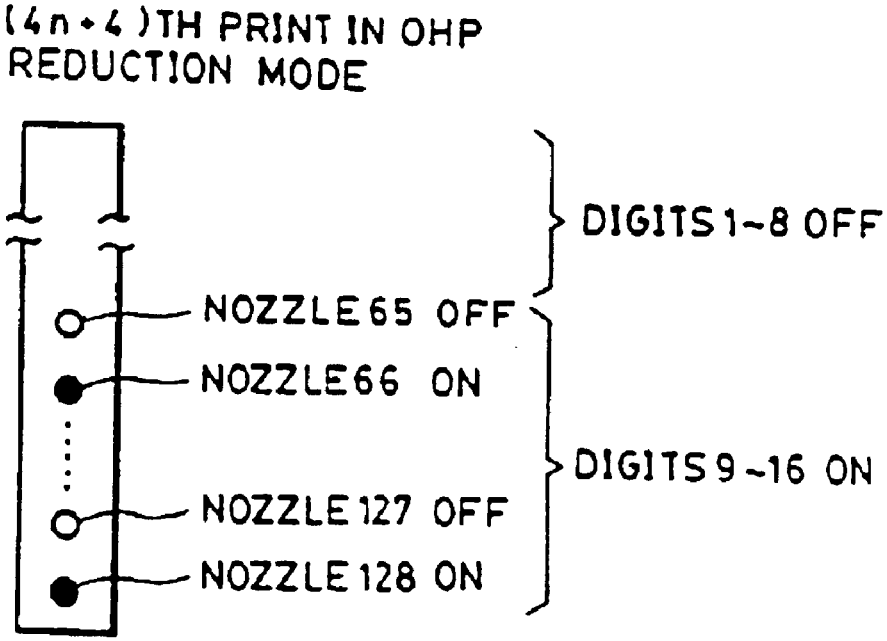

Printing control [4] is OHP reduction printing control. FIG. 43 is a flowchart showing this printing control [4]. Head digit control [4] and head nozzle control [4] will be described below with reference to FIGS. 44 and 45. In this routine, since recording is conducted on OHP paper, the carriage scans the same area four times to conduct intermittent printing. Hence, when recording is conducted on a sheet of paper of A4 size, the carriage makes 1-line printing 130 times, and digit control is conducted 130 times.

If the line on which 1-line printing is conducted is 4n+1th (n=0, 1, . . . ) line, only odd-numbered nozzles in the nozzles 1 to 64, i.e., in the digits 1 to 8, (in step S4205) are activated in step S4302. If the line on which 1-line printing is conducted is 4n+2th (n=0, 1, . . . ) line, only even-numbered nozzles in the nozzles 1 to 64 are activated in step S4303. If the line on which 1-line printing is conducted is 4n+3th (n=0, 1, . . . ) line, only odd-numbered nozzles in the nozzles 65 to 128 (step S4202), i.e., in the digits 9 to 16, are activated in step S4302. If the line on which 1-line printing is conducted is 4n+4th (n=0, 1, . . . ) line, only even-numbered nozzles in the nozzles 65 to 128 are activated in step S4303. FIGS. 46(A), 46(B), 47(A) and 47(B) illustrate this operation.

Figure 48:
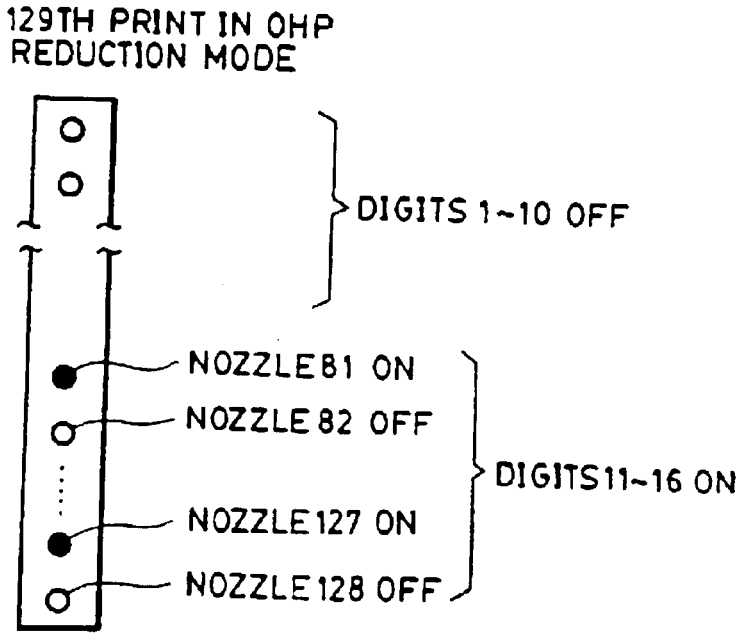
FIGS. 48(A) and 48(B) are illustrations of the manner in which the nozzle is driven under the head digit control [5] of FIG. 39 and the head nozzle control [5] of FIG. 40.
Figure 48:
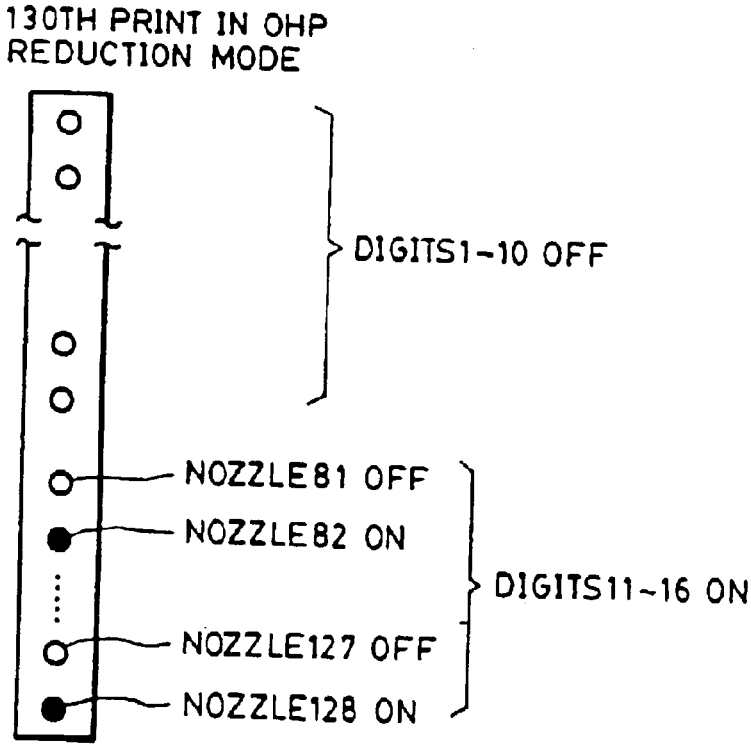

In the 1-line printing conducted on the 129th line, only odd-numbered nozzles in the nozzles 81 to 128 (step S4204), i.e., in the digits 11 to 16, are activated in step S4303. In the 1-line printing conducted on the 130th line, only even-numbered nozzles in the nozzles 81 to 128 are activated in step S4303. FIGS. 48(A) and 48(B) illustrate this operation.

(Paper Conveyance)

Figure 49:
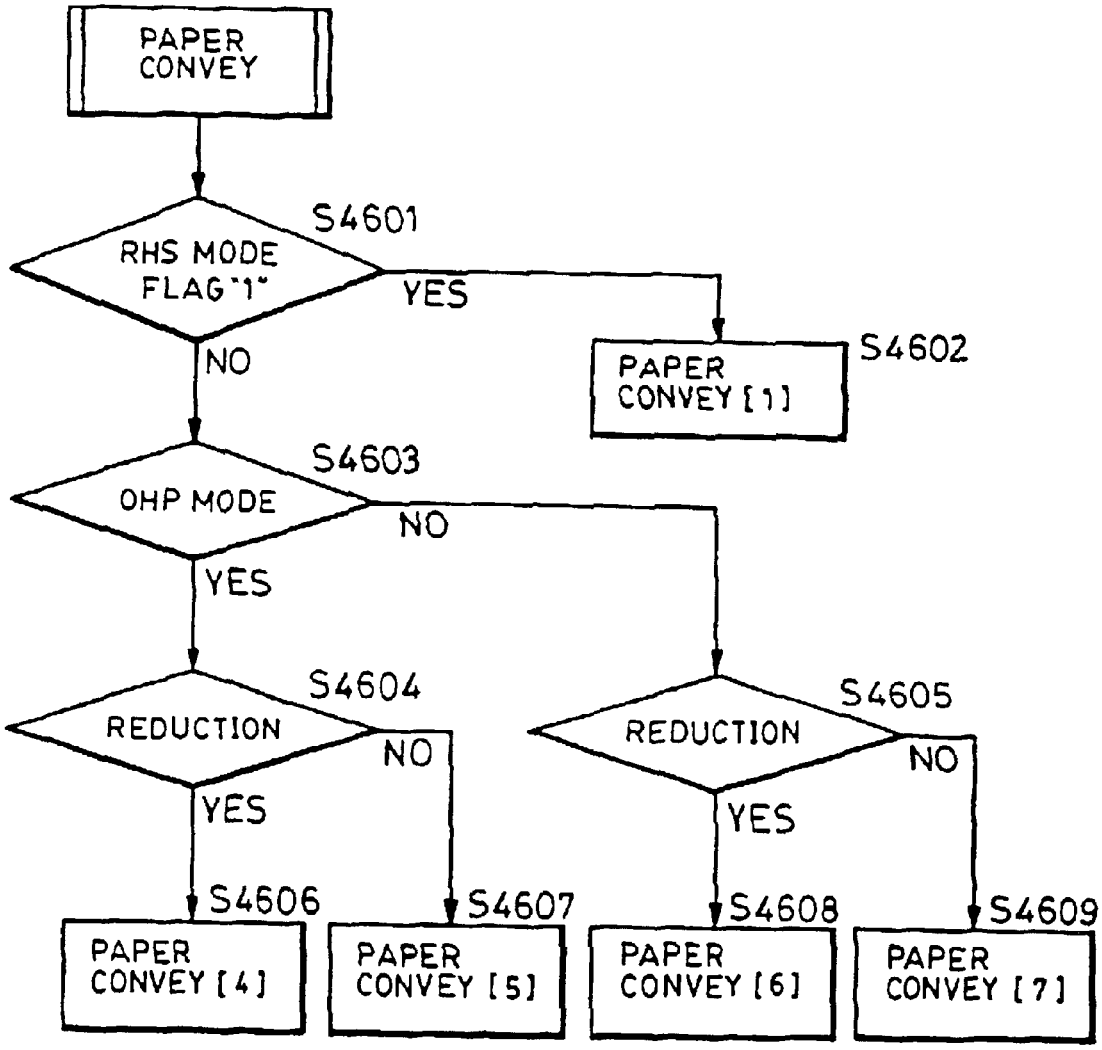
FIG. 49 is a flow chart illustrative of the detail of a paper convey routine executed in Step S25 of the control process.

FIG. 49 is a flowchart showing the paper conveying routine executed in step S35. In step S4601, it is determined whether or not the operation mode is an RHS mode. If the operation mode is the RHS mode, paper conveyance [1] is conducted in step S4602. If the operation mode is not the RHS mode, the process goes to step S4603, and it is determined whether or not the operation mode is the OHP mode. If the operation mode is the OHP mode, the process goes to step S4604, If the operation mode is not the OHP mode, the process goes to step S4605. In step S4604, it is determined whether or not the operation mode is the reduction mode. If the operation mode is the reduction mode, paper conveyance [4] is conducted in step S4606. If the operation mode is not the reduction mode, paper conveyance [5] is conducted in step S4607. If it is determined-in step S4605 that the operation mode is the reduction mode, paper conveyance [6] is conducted in step S4608. If it is determined that the operation mode is not the reduction mode, paper conveyance [7] is conducted in step S4609.

Figure 50:
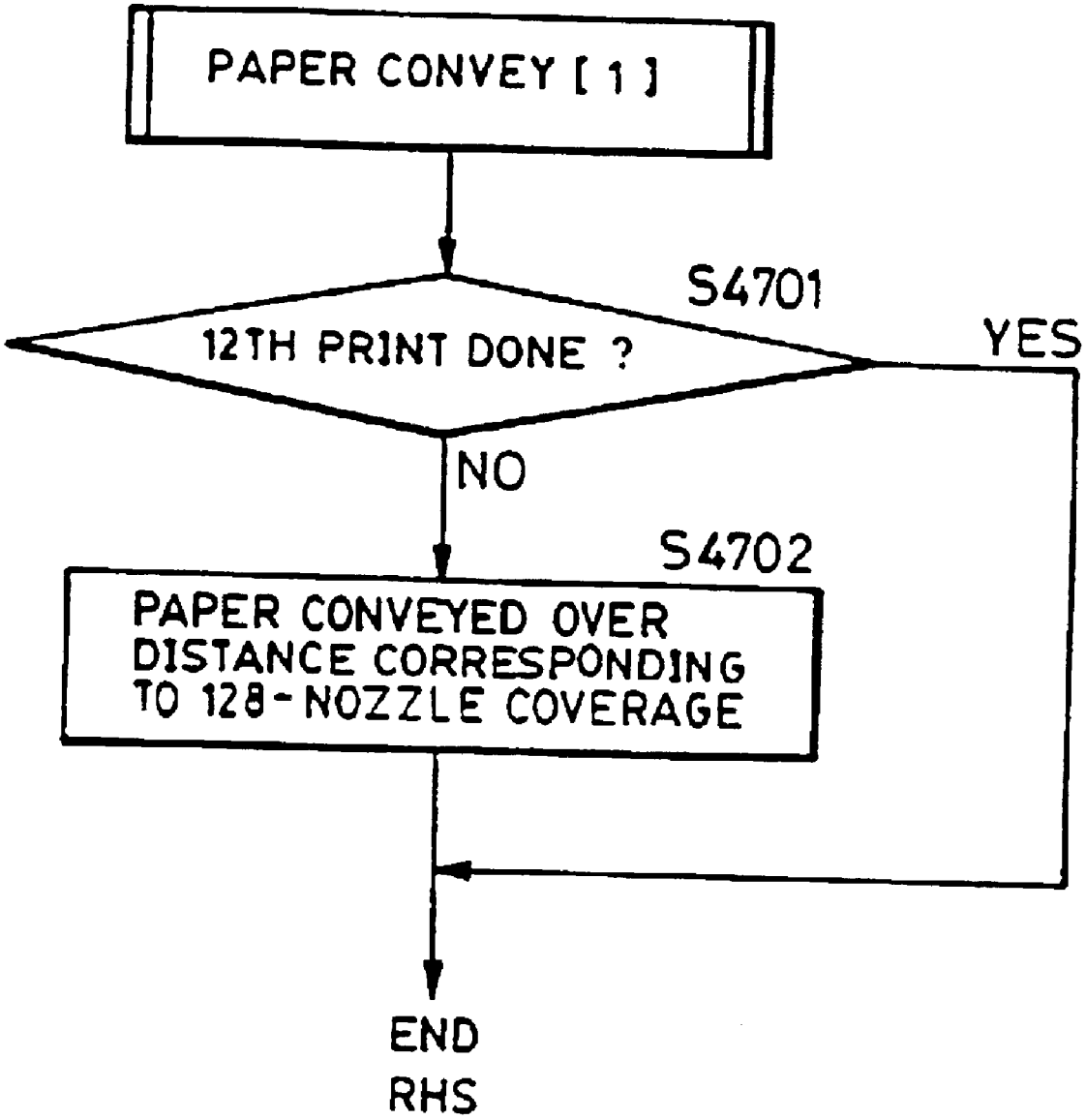
FIG. 50 is a flow chart illustrative of a paper convey routine [1]
Figure 51:
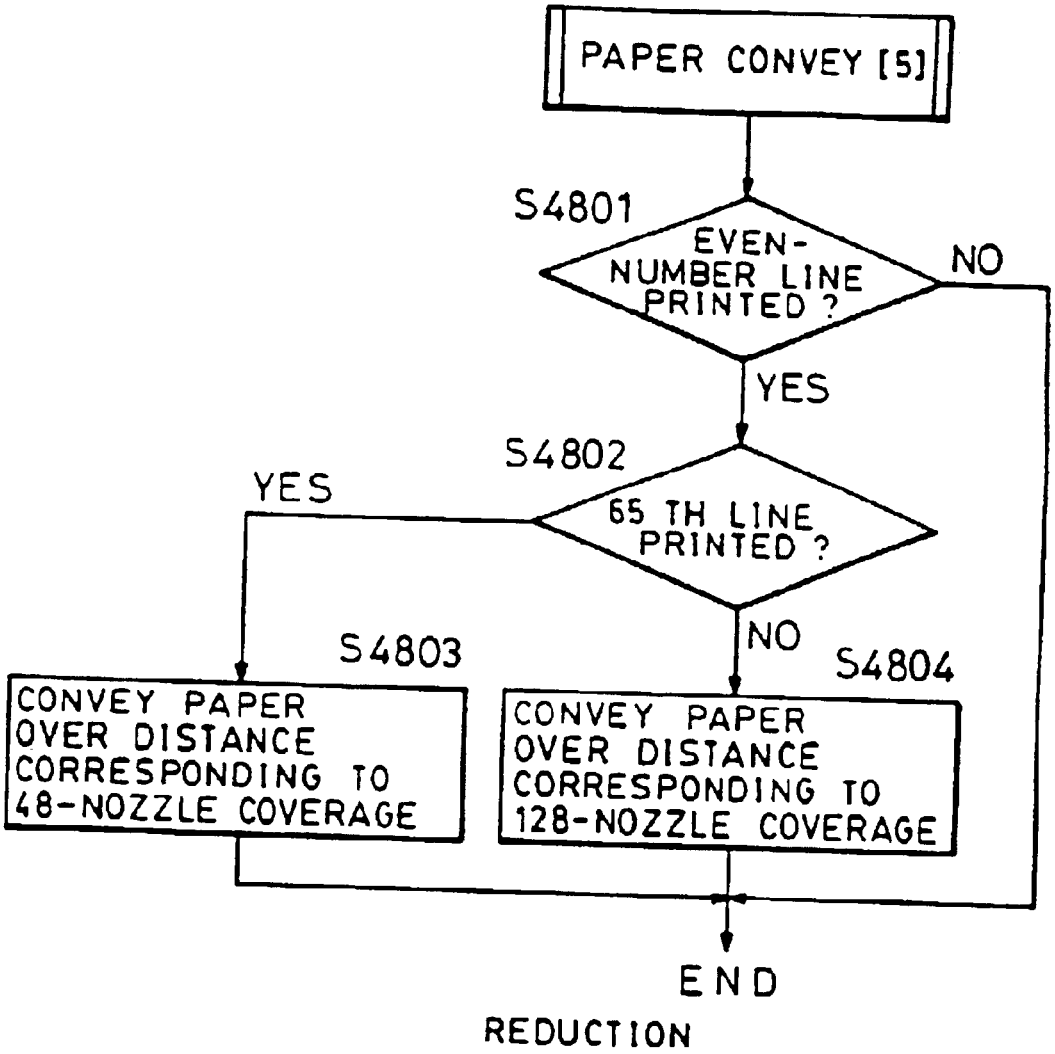
FIG. 51 is a flow chart illustrative of a paper convey routine [5]

Paper conveyance (1) is conducted in RHP printing. FIG. 50 is a flowchart showing the paper conveyance [1] routine. In RHS printing, 1-line printing is conducted 12 times, and paper conveyance is conducted once for each 1-line printing. Paper conveyance [5] is conducted in OHP printing. The paper conveyance [5] routine is shown in FIG. 51. In OHP printing, when recording is conducted on a sheet of paper of A4 size, 1-line printing is conducted 66 times, and paper feed is conducted once for two 1-line printings. Hence, paper conveyance consists of 33 paper feed operations when recording is conducted on the sheet of A4 paper. Paper feed is conducted after 1-line printing has been conducted an odd number of times. In the flowchart of FIG. 51, this paper feed is executed in step S4804. The distance through which the paper is fed corresponds to the 128 nozzle printing width. In the case of A4 paper, the distance through which the paper is fed after the 64th 1-line printing corresponds to the 48 nozzle printing width. This paper feed is executed in step S4803. Paper feed is not conducted after 1-line printing has been conducted an even number of times.

Figure 52:
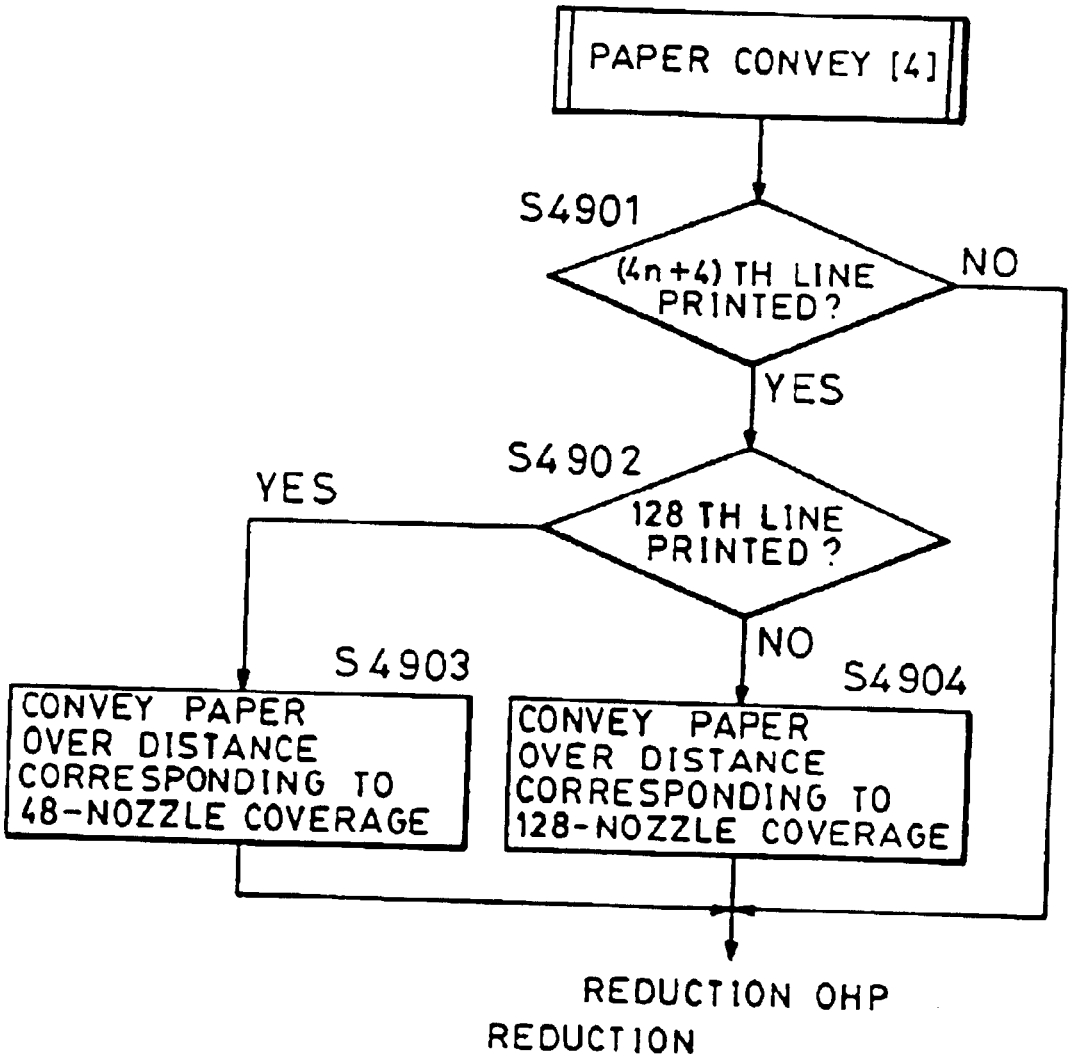
FIG. 52 is a flow chart illustrative of a paper convey routine [4]

Paper conveyance [4] is conducted in OHP reduction printing. The paper conveyance [4] routine is shown in FIG. 52. In OHP printing, when recording is conducted on the sheet of paper of A4 size, 1-line printing is conducted 130 times, and paper feed is conducted once each time 1-lien printing is conducted four times. Hence, in the case of recording on the A4 paper, paper conveyance consists of 32 paper feed operations. Paper feed is conducted after 1-line printing has been conducted an odd number of times. This paper feed is executed in step S4904. The distance through which the paper is fed in this paper feed operation corresponds to 128 nozzle printing width. In the case of A4, the distance through which the paper is fed after 64th 1-line printing is 48 nozzle printing width. This paper feed operation is executed in step S4903. Paper feed is not conducted after 1-line printing has been conducted an even number of times.

Figure 53:
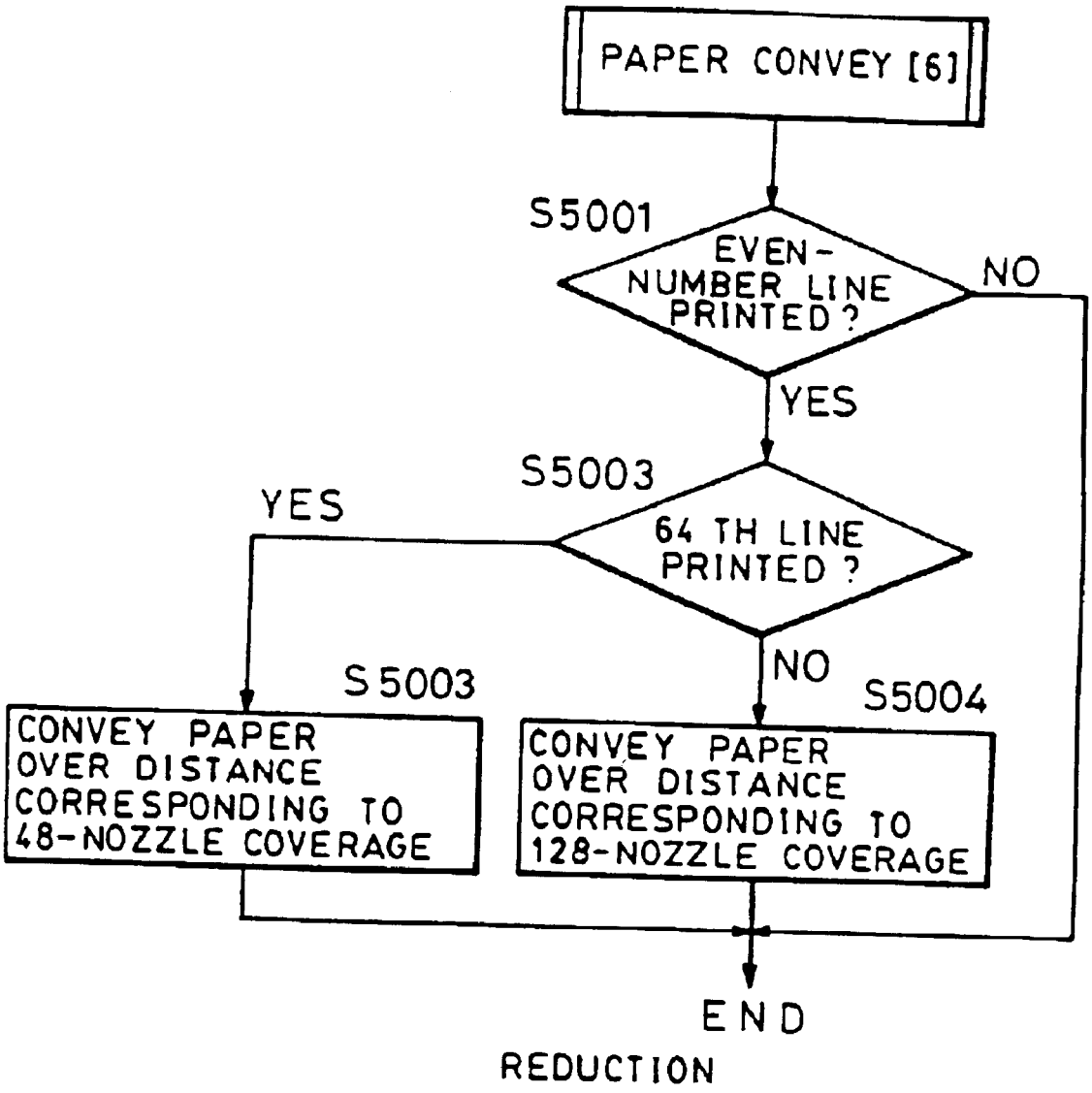
FIG. 53 is a flow chart illustrative of a paper convey routine [6]

Paper conveyance [6] is conducted in the reduction printing operation. The paper conveyance [6] routine is shown in FIG. 53. In reduction printing, when recording is conducted on the sheet of paper of A4 size, 1-line printing is conducted 65 times, and paper feed is conducted once each time 1-line printing is conducted twice.

When recording is conducted on the A4 paper, paper conveyance consists of 33 paper feed operations. Paper feed is conducted after 1-line printing has been conducted an odd number of times. This paper feed operation is executed in step S5004. The distance through which the paper is fed corresponds to 128 nozzle printing width. In the case of recording on the A4 paper, the distance through which the paper is fed after 64th 1-line printing corresponds to the 48 nozzle printing width. This 64th 1-line printing is executed in step S5003. Paper feed is not conducted after 1-line printing has been conducted an even number of times.

(Paper Ejection Operation)

Figure 54:
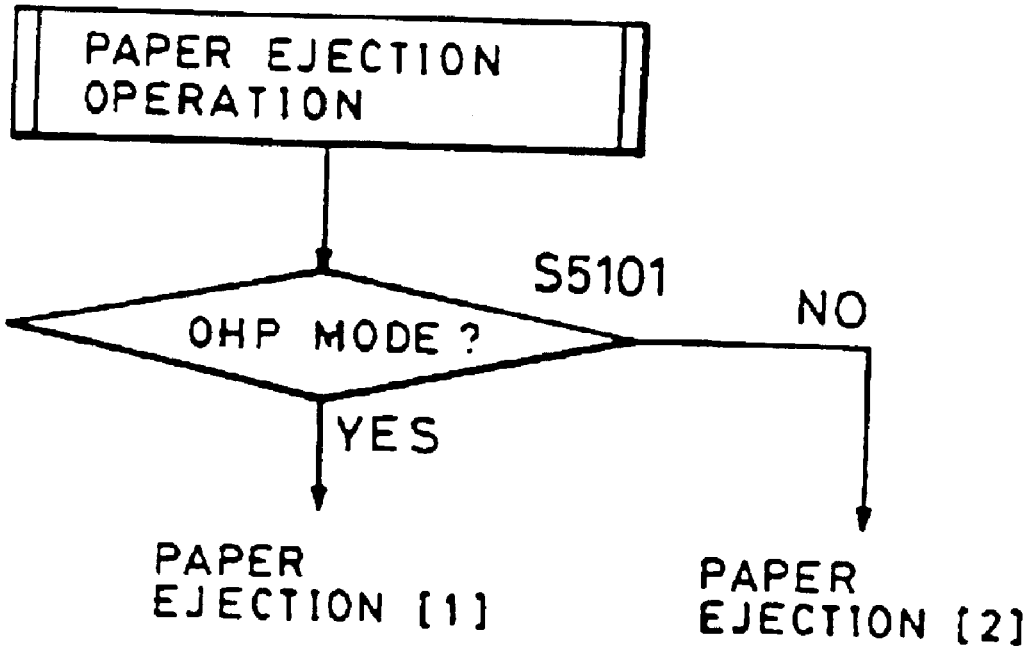
FIG. 54 is a flow chart illustrative of a paper ejection routine.

FIG. 54 is a flowchart showing the paper ejection operation routine. In this routine, it is determined whether or not the operation mode is the OHP mode. If the operation mode is the OHP mode, paper ejection [1] is conducted. If the operation mode is the coated paper mode, paper ejection [2] is conducted.

Figure 55:
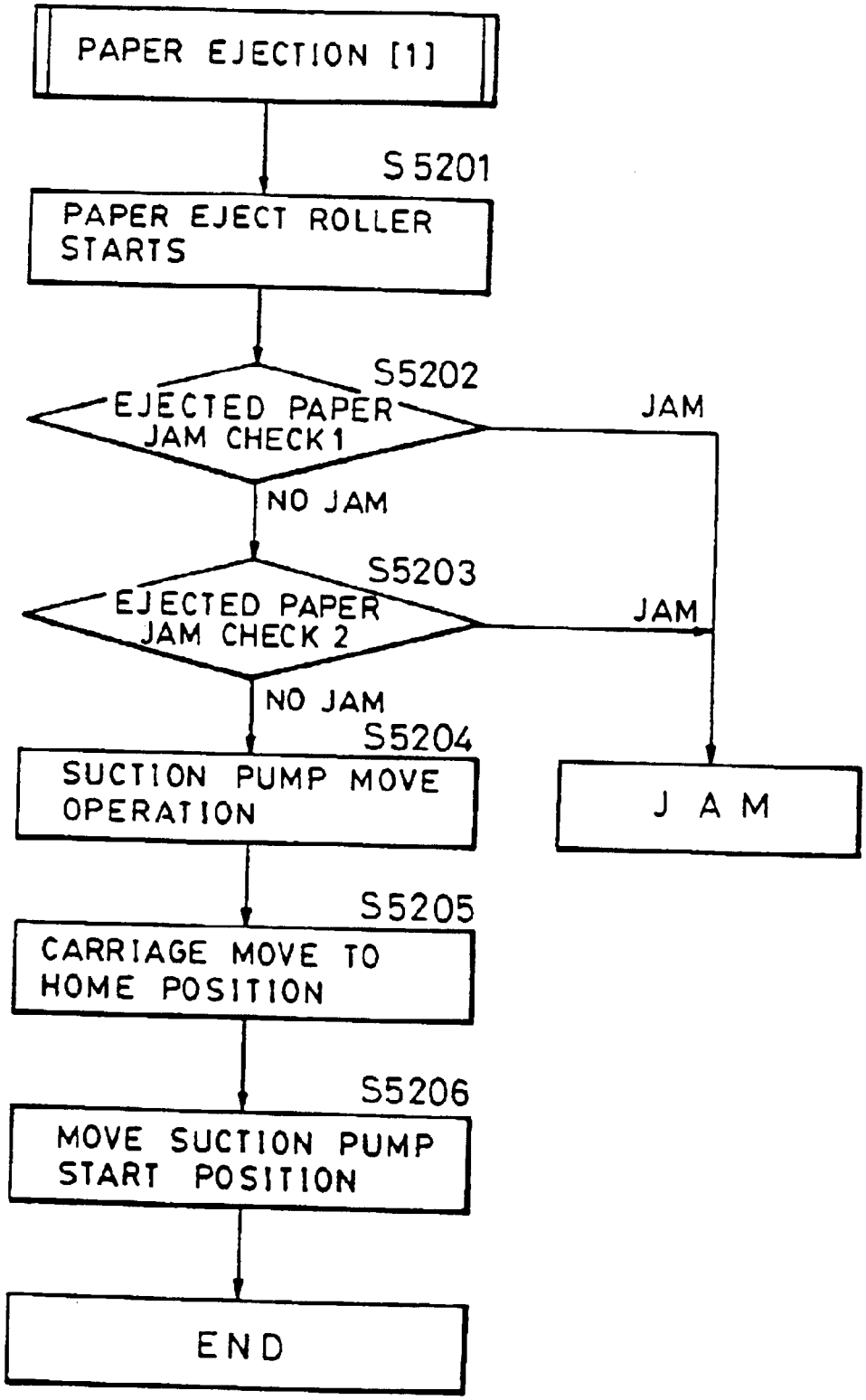
FIG. 55 is a flow chart illustrative of a paper ejection routine [1]

FIG. 55 is a flowchart showing the paper ejection [1] routine. In step S5201, the paper eject roller is rotated to eject the recording paper. At that time, the amount of rotation is set in accordance with the size of the recording paper. A value which ensures that the rear end of the recording paper passes the jam checking position is set. When predetermined paper feed is disabled due to failure of the paper eject roller, it is determined that jam has occurred. In step S5202, jam of the ejected paper is checked for the first time. In this embodiment, jam is detected by a paper feed sensor disposed on the paper conveyed path. If there is no jam, a value which ensures that the recording paper is completely ejected to the outside of the apparatus is set to further rotate the roller.

When the recording paper cannot be ejected completely due to the failure of the paper eject roller, it is determined that paper jam has occurred. In step S5203, jam of the ejected paper is checked for the second time. In this embodiment, paper jam is detected by the ejected paper sensor disposed on the paper conveyed path. Thereafter, in steps S5204, S5205 and S5206, movement of a suction pump to a predetermined position, movement of the carriage to its home position and movement of the suction pump to its starting position are conducted.

Figure 56:
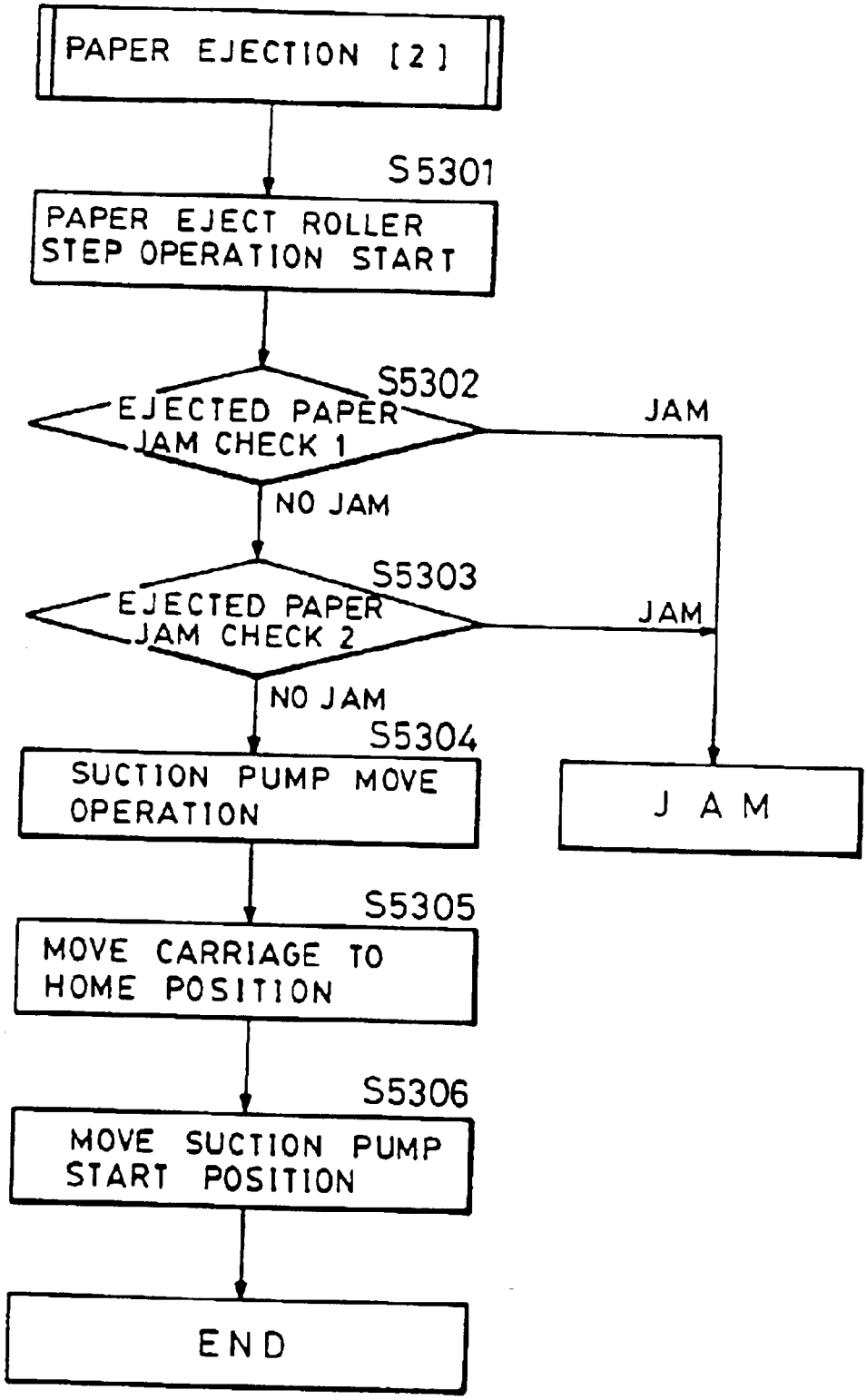
FIG. 56 is a flow chart illustrative of a paper ejection routine [2]

FIG. 56 is a flowchart showing the paper eject [2] routine. In step S5301, the paper eject roller is operated stepwise to eject the recording paper. The amount of feed is the printing width of the recording head. In this embodiment, the printing width corresponds to 128 nozzles. The distance through which the paper is fed is set in accordance with the size of the recording paper. A value which ensures that the rear end of the recording paper passes the jam checking position is set. When predetermined paper feed is disabled due to the failure of the paper eject roller, it is determined that jam has occurred. In step S5302, jam of the ejected paper is checked for the first time. In this embodiment, jam is detected by a paper feed sensor disposed on the paper conveyed path. If there is no jam, a value which ensures that the recording paper is completely ejected to the outside of the apparatus is set to further rotate the roller.

When the recording paper cannot be ejected completely due to the failure of the paper eject roller, it is determined that paper jam has occurred. In step S5303, jam of the ejected paper is checked for the second time. In this embodiment, paper jam is detected by the ejected paper sensor disposed on the paper conveyed path. Thereafter, in steps S5304, S5305 and S5306, movement of a suction pump to a predetermined position, movement of the carriage to its home position and movement of the suction pump to its starting position are conducted.

(Control Configuration)

Figure 68:
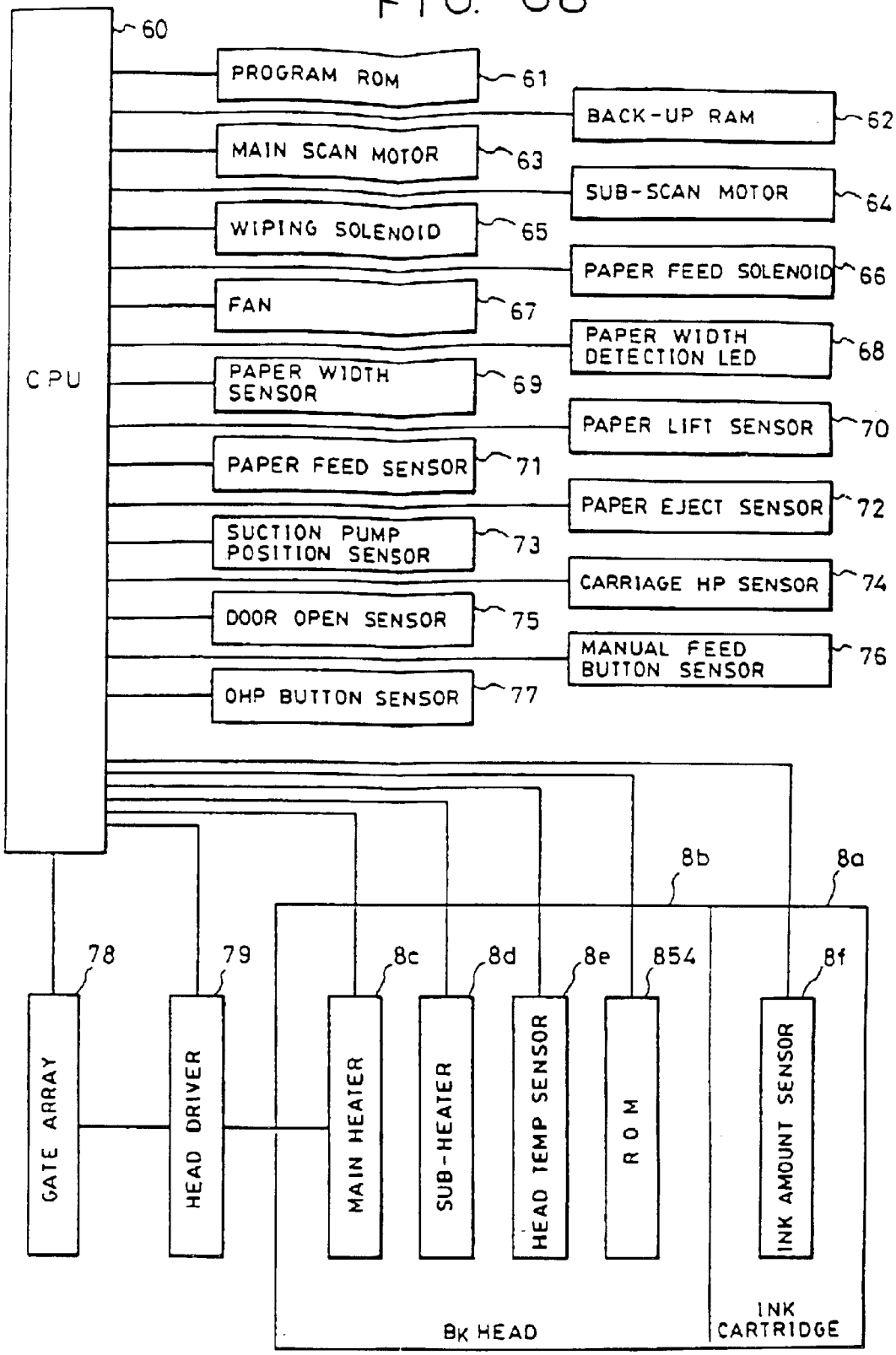
FIG. 68 is a block diagram of control means for executing a recording control flow.

The control configuration for executing the aforementioned recording control operation will be described in detail with reference to FIG. 68. In FIG. 68, reference numeral 61 denotes a program ROM for storing the control programs executed by a CPU (central processing unit) 60; 62, a backup RAM for storing various types of data; 63, a a main scan motor for conveying the recording head; 64, a sub-scan motor for conveying the recording paper, the sub-scan motor being also used for the suction operation by a pump; 65, a solenoid for wiping; 66, a paper feed solenoid used for paper feed control; 67, a cooling fan; 68, a paper width detecting LED which is turned on during the paper width detection operation; 69, a paper width sensor; 70, a paper lift sensor; 71, a paper feed sensor; 72, a paper eject sensor; 73, a suction pump position sensor for detecting the position of a suction pump; 74, a carriage home position (HP) sensor for detecting the home position of the carriage; 75, a door opening sensor for detecting opening of the door; 76, a manual feed button sensor for detecting pressing of a manual feed button; and 77, an OHP button sensor for detecting pressing of an OHP button.

Reference numeral 78 denotes a gate array for controlling supply of recording data to the heads of four colors; 79, a head driver for driving the head; 8*a,* ink cartridges of four colors; and 8*b,* recording heads of four colors. Here, an ink cartridge of black and a recording head for black are indicated by 8*a* and 8*b* as representatives of the ink cartridges and recording heads. The ink cartridge 8*a* has an ink residue sensor 8*f* for detecting the amount of remaining ink. The head 8*b* has a main heater 8*c* for discharging the ink, a sub-heater 8*d,* a head temperature sensor 8*e* for detecting the head temperature, and a ROM 854 for storing head property data.

FIG. 69(A) is an external view of an ink jet cartridge employed in this embodiment, and FIG. 69(B) illustrates a printed board 85 of FIG. 69(A) in detail. In FIG. 69(B), reference numeral 851 denotes a printed-circuit board; 852, an aluminum heat-radiating plate; 853, a heater board including a heat generating device and a diode matrix; 854, an EEPROM (electrically erasable programmable read only memory) (non-volatile memory) for storing uneven density data or the like; and 855, a contact electrode which serves as the joint portion to the apparatus body. Here, illustration of a group of discharge ports is omitted.

As mentioned above, the EEPROM 854 for storing the uneven density data characteristic to that recording head is fabricated on the printed-circuit board 851 of the ink jet recording head on which the heat-generating devices and the drive control portion are provided. When the recording head 8*b* is loaded on the apparatus body, the apparatus body reads in the data on the recording head characteristics, such as the uneven density data, from the recording head 8*b,* and performs a predetermined control operation required to improve recording characteristics on the basis of the data. Consequently, good image quality can be assured.

Figure 69:
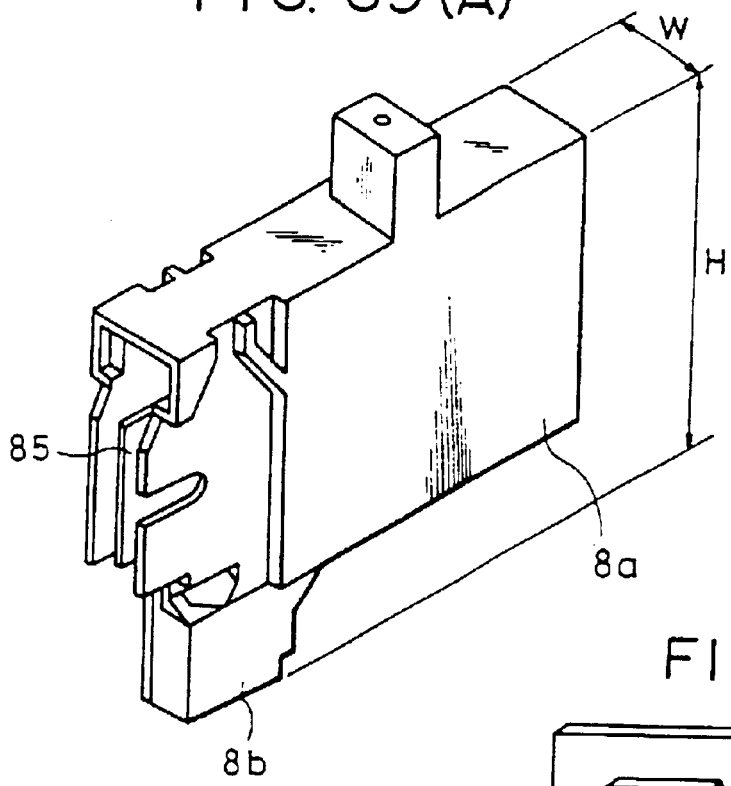
FIGS. 69(A) and 69(B) are illustrations of the construction of an ink jet cartridge used in the embodiment.
Figure 69:
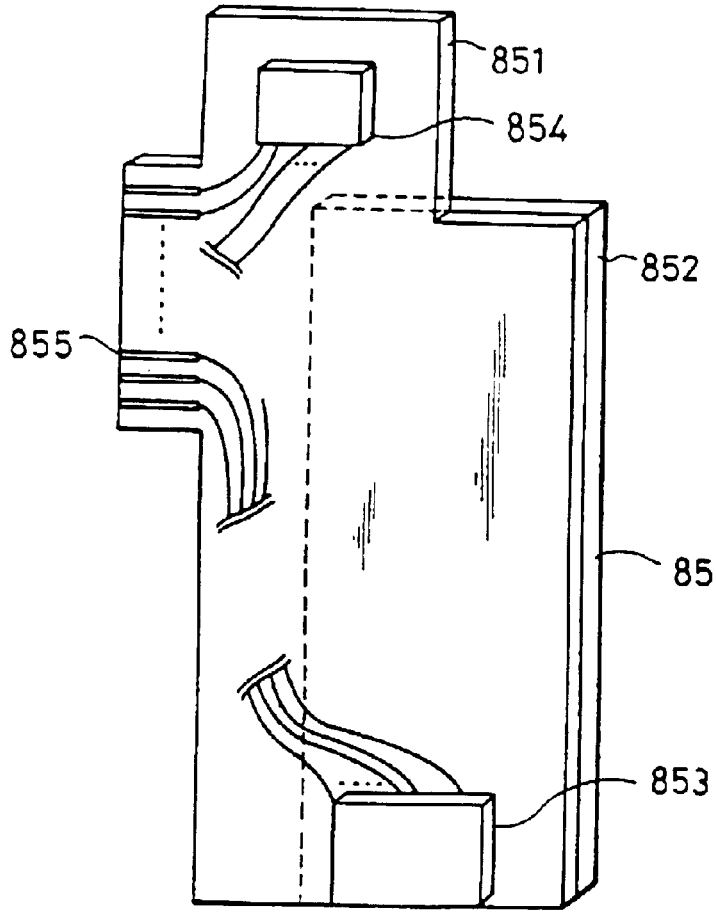
Figure 70:
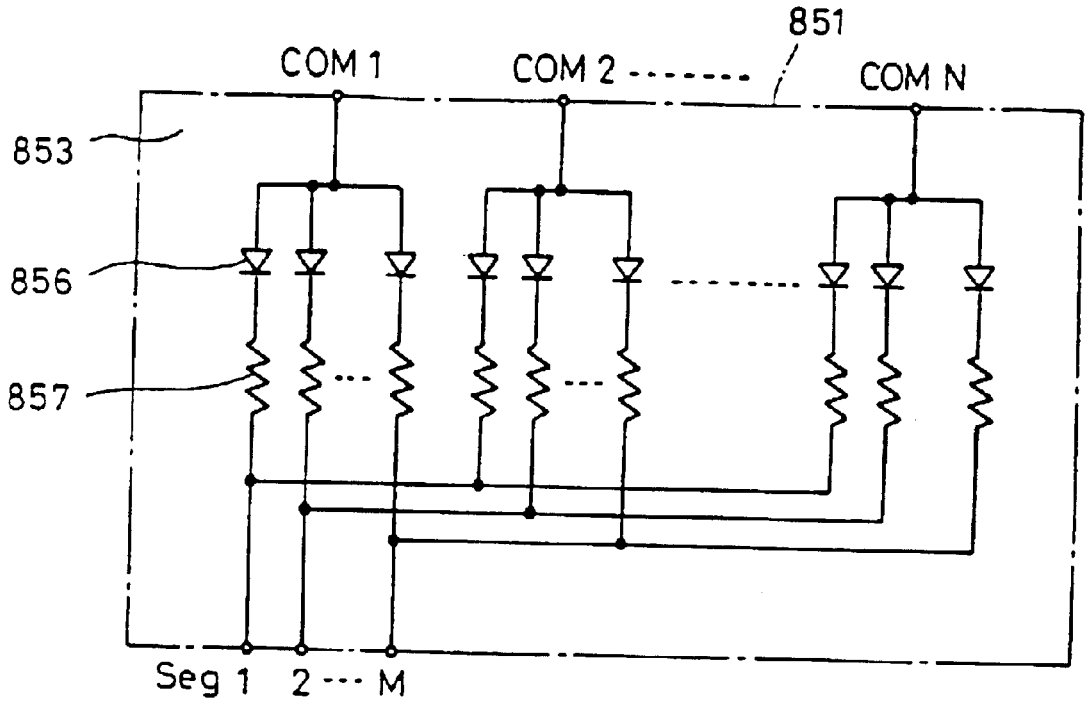
FIGS. 70(A) and 70(B) are illustrations of a critical portion of a circuit arrangement on a printed circuit board 851.
Figure 70:
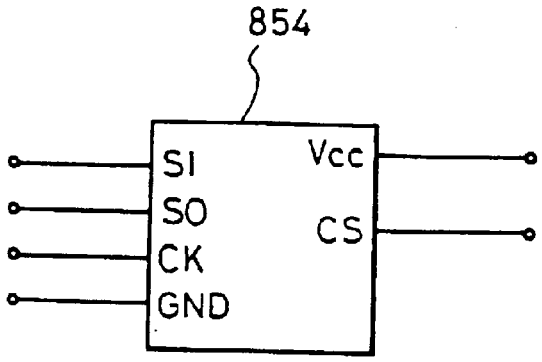
Figure 71:
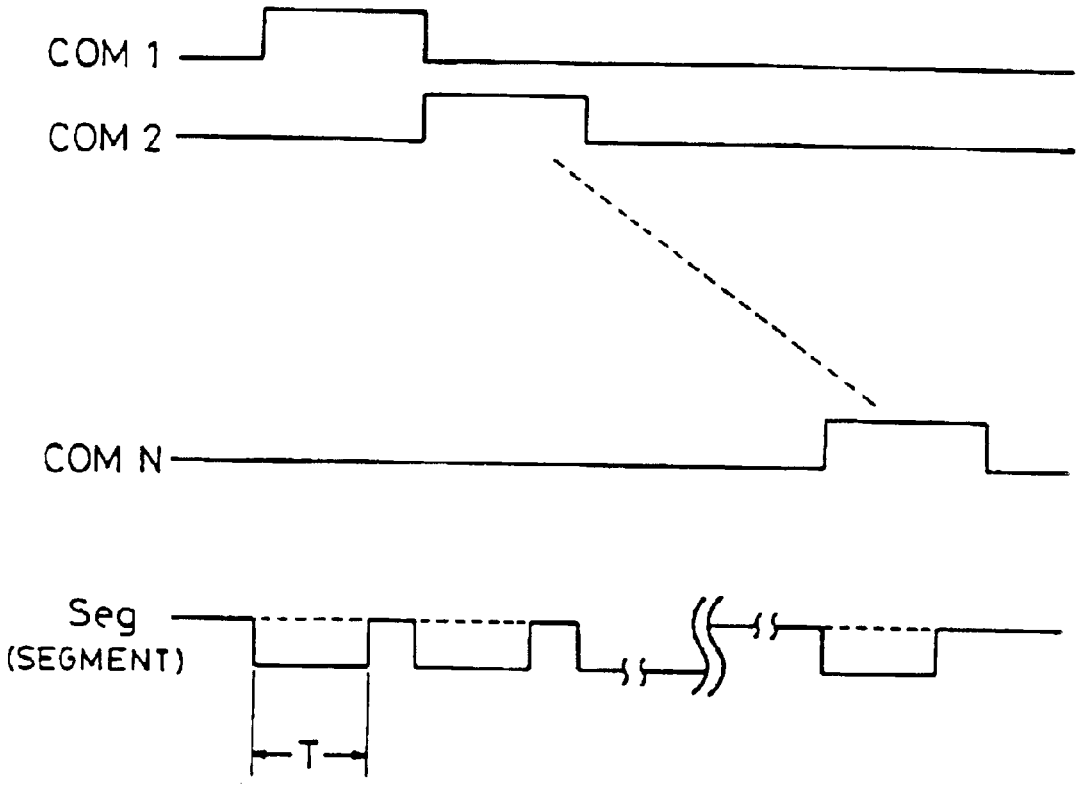
FIG. 71 is a timing chart showing the manner in which blocks of heat-generating elements 857 are driven in a time-dividing manner.

FIGS. 70(A) and 70(B) are circuit diagrams of the essential parts of the printed-circuit board 851 of FIG. 69 (B). The circuit configuration of the heater board 853 is indicated by a dot-dashed line in FIG. 70(A). The heater board 853 has the N×M (16×8, in this embodiment) matrix configuration of series connected circuits each including a heat-generating device 857 and a diode 856 for preventing reverse flow of current. That is, these heat-generating devices 857 are driven on the time-division basis in blocks. The amount of driving energy supplied to the heat-generating device 857 is controlled by changing the pulse width (T) applied to segments (seg).

FIG. 70(B) shows an example of the EEPROM 854 of FIG. 69(B). In this EEPROM 854, the uneven density data or the like is stored. The data stored in the EEPROM 854 is output to the apparatus body in response to a request signal (address signal) D1 sent from the apparatus body by serial communication.

The apparatus to which the present invention can be applied will be described below with reference to FIGS. 73 and FIG. 74.

First, the configuration of the apparatus will be explained. The apparatus includes a reading device R and a recording device P. The reading device R includes reading means 1 and a reading carriage 2 on which the reading means 1 is provided. The carriage 2 is movable back and forth in a main-scanning direction (indicated by an arrow 'a'). The carriage 2 is loaded on a reading unit 3 which is movable back and forth in a sub-scan direction (indicated by an arrow 'b').

When an original 5 is placed with its original surface directed downward on an original glass base 4 mounted on the upper surface of the apparatus, the original 5 is fixed by a cover 6 and a copying switch (not shown) is pressed, the carriage 2 is moved in the main scan direction to read the original by 1 line. The read data is transmitted to a control system (not shown) via a signal cable 7. After 1 line of the original has been read in the aforementioned manner, the carriage 2 is returned to its home position, while the reading unit 3 is moved in the sub scan direction through a distance corresponding to one line, and reading of subsequent lines is then conducted similarly.

In the recording apparatus P, recording means 8 is mounted on a recording carriage 9, and a recording sheet 11 is conveyed to the position of the recording means 8 by means of sheet conveying means 10.

When the reading signal is transmitted from the reading device R via the signal cable 7, the recording sheet 11 is conveyed in a direction indicated by an arrow 'c' by means of the conveying means 10. When the sheet 11 reaches the recording position, the carriage 9 is moved back and forth in a direction indicated by an arrow 'd' of FIG. 73 synchronously with drive of the recording means 8 which is conducted in response to the image signal to record an image. When 1 line has been recorded, the recording sheet 11 is conveyed in the direction indicated by the arrow 'c' through a distance corresponding to one line. Thereafter, recording is conducted on the recording sheet 11 similarly. After recording, the sheet 11 is ejected onto an ejection tray 12.

Part of a bottom of the reading unit 3 protrudes to a position which is lower than the highest portion of the recording device P. One end of the signal cable 7 is connected to that portion of the bottom of the reading unit 3.

The individual components of the apparatus will be explained in sequence.

(Reading Means)

The reading means 1 optically reads the data on the original 5, and converts the read data into an electrical signal. As shown in FIG. 74, the original surface of the original is illuminated by a light source 1*a*. The light reflected by the original surface reaches a photoelectric conversion device 1*c*, such as a CCD (charge-coupled device), through a lens 1*b*. The photoelectric conversion device 1*c* converts the light into an electric signal, and sends that electric signal to the recording device P as an image signal.

The photoelectric conversion device 1*c* is mounted on a substrate 1*d* to which one end of the signal cable 7 is connected.

(Reading Carriage)

The reading carriage 2 moves the reading means 1 in the main scan direction. The reading carriage 2 on which the reading means 1 is mounted is slidable along a main scanning rail 2*a*. A driving pulley 2*b* and a driven pulley 2*c* are mounted near the two ends of the rail 2*a*. A timing belt 2*d* extending between the two pulleys 2*b* and 2*c* is connected to the reading carriage 2. A reading carriage motor 2*e* is coupled to the driving pulley 2*b*.

When the carriage motor 2*e* is rotated in two directions, the carriage 2 is moved back and forth along the rail 2*a* in the main scan direction.

(Reading Unit)

The reading unit 3 moves the carriage 2 in the sub-scan direction. The main scanning rail 2*a*, the pulleys 2*b* and 2*c* and the carriage motor 2*e* are mounted on this reading unit 3. One end of the reading unit 3 is slidable along a sub-scan rail 3*a*, and the other end thereof is provided with a guide roller 3*b* which is movable along a guide portion 13*a* formed on apparatus body frame 13. A driving pulley 3*c* and a driven pulley (not shown) are mounted near the two ends of the sub-scan rail 3*a*. A timing belt 3*d* extending between the two pulleys is connected to the reading unit 3. A unit motor 3*e* is coupled to the driving pulley 3*c*.

Thus, when the unit motor 3*e* is rotated in two directions, the reading unit 3 moves back and forth along the sub-scan rail 3*a* in the sub-scan direction (in a direction perpendicular to the main scan direction in which the carriage is moved).

(Recording Means)

The recording means records ink images on the recording sheet 11. In this embodiment, recording is made by the ink jet recording method.

The ink jet recording type recording means includes, for each recording dot, a liquid discharge port for discharging recording ink in droplets, a liquid passage connected to the discharge port, and discharging energy generation means provided in the portion of the liquid passage for supplying discharging energy required to discharge the ink in the flow passage. The discharging energy generation means is driven in response to an image signal to discharge ink droplets for recording.

The discharging energy generation means may be pressure energy generation means which may be an electromechanical energy conversion body, such as a piezoelectric device, microwave energy generation means for generating ink droplets by irradiating ink with microwaves of, for example, a laser, or heat energy generation means which may be an electrothermal energy conversion body. Among these types of discharging energy generation means, the heat energy generation means, such as an electrothermal energy conversion body, is desirable, because it enables the discharge ports to be arranged at a high density and because it allows a compact recording head to be provided.

The recording head 8*b* is mounted at the lower end of the ink cartridge 8*a*. When the recording head 8*b* is driven with liquid ink contained in the ink cartridge 8*a*, the electrothermal energy conversion body generates heat in response to the image signal from the reading device R,-and ink is thus ejected downward from the discharge port in response to that heat generation.

Synchronously with the drive of the recording head 8*b*, the recording carriage 9 is moved in the main scan direction (which is indicated by the bidirectional arrow 'd' in FIG. 73) to perform recording on the recording sheet 11 over a width of 8.128 mm per a single scanning.

(Recording Carriage)

Figure 73:
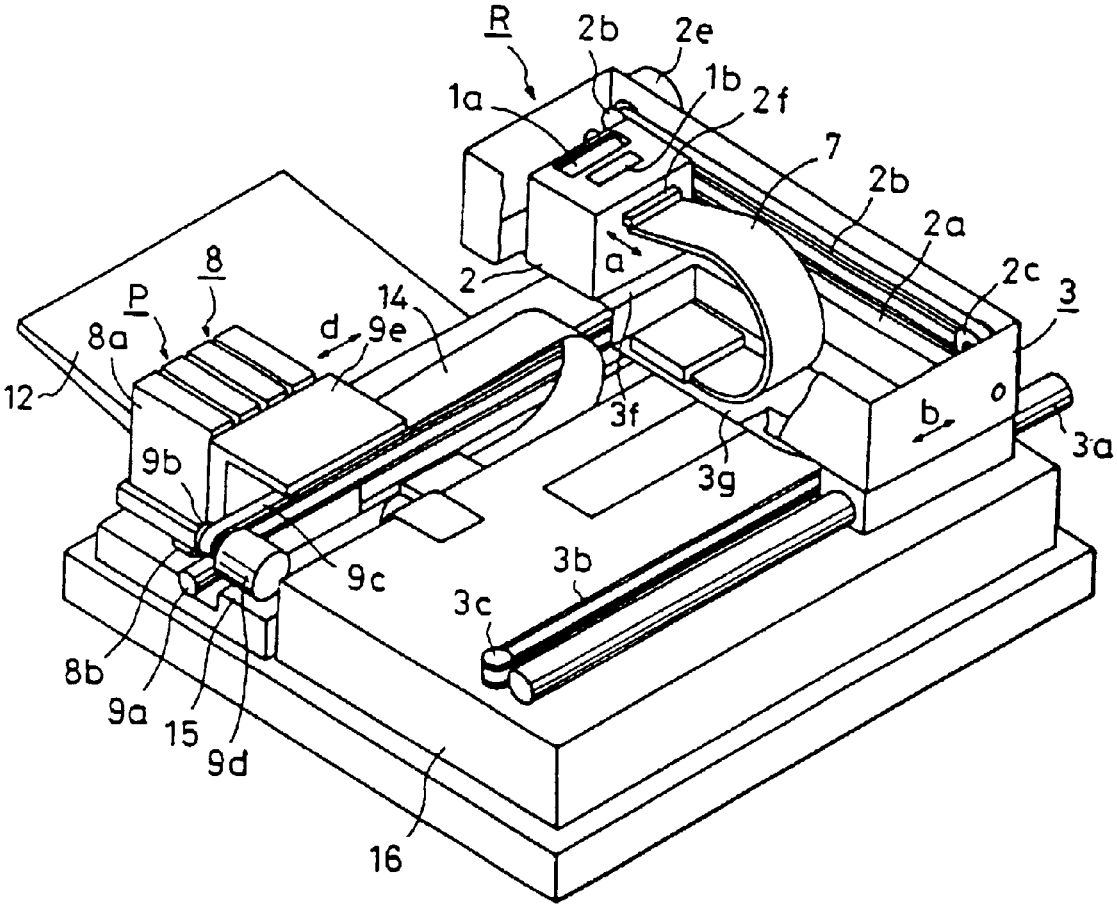
FIG. 73 is a perspective illustration of the embodiment.

To move the recording means 8 back and forth in the main scan direction, the recording carriage 9 is made slidable along a main scan rail 9*a*, and the recording means 8 is mounted on this recording carriage 9, as shown in FIG. 73.

A driving pulley 9*b* and a driven pulley (not shown) are provided near the two ends of the main scan rail 9*a*, and a timing belt 9*c* extending between these two pulleys is connected to the recording carriage 9. A recording carriage motor 9*d* is coupled to the driving pulley 9*b*.

When the carriage motor 9*d* is rotated in two directions, the recording carriage 9 moves back and forth along the rail 9*a* in the main scan direction. An electrical signal is transmitted to the recording head 8*b* through the signal cable 14. One end of the signal cable 14 is connected to an arm 9*e* formed substantially at the same level as the ink cartridge 8*a*, and the other end thereof is fixed to the recording unit 15, as shown in FIG. 73.

(Sheet Conveying Means)

The sheet conveyance means 10 conveys the recording sheet 11. As shown in FIG. 74, a cassette 10*a* is removably mounted at the lower portion of the apparatus. A plurality of recording sheets 11 are accommodated in layers in the cassette 10*a*. The recording sheets 11 are fed out in a direction indicated by an arrow 'c' one by one by a pickup roller 10*b* and a separation claw 10*al* provided at the front end of the cassette 10*a*. The fed out recording sheet 11 is conveyed by a pair of rollers 10*c* and a pair of rollers 10*d* respectively disposed on the downstream and upstream sides of the recording head 8*b* with respect to the direction in which the sheet is conveyed.

Since recording is performed by the recording means 8 over a recording width of 8.128 mm, the sheet 11 is conveyed intermittently at a pitch of 8.128 mm synchronously with the recording operation during recording. The sheet 11 on which recording has been completed is ejected onto an ejection tray 12.

Where manual paper feed of, for example, OHP is performed, the sheet 11 on which recording is to be made is inserted from the ejection tray 12 along a guide (not shown). The inserted sheet 11 is fed in a direction reverse to that indicated by the arrow 'c' to the recording starting position by means of the conveying roller pairs 10*c* and 10*d*. Thereafter, the sheet 11 is intermittently conveyed in the direction indicated by the arrow 'c' synchronously with the recording operation.

(Signal Cable)

Connection of the signal cable 7 will now be described below. Prior to that description, the positional relation between the reading device R and the recording device P will be explained.

Figure 74:
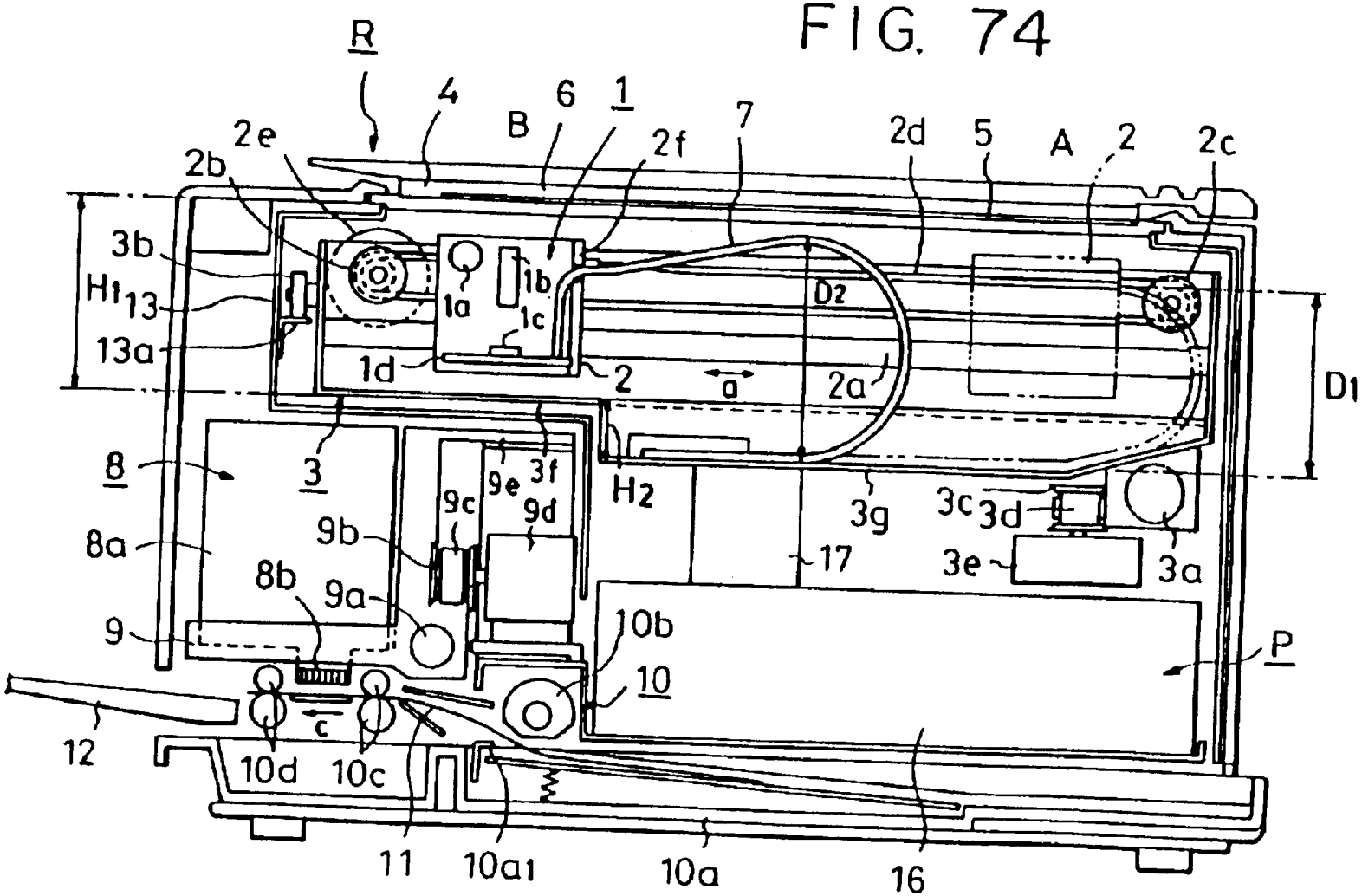
FIG. 74 is a sectional view of the embodiment.

As shown in FIG. 74, the reading device R is disposed in the upper portion of the apparatus body, and the recording device P is disposed below the reading device R. In the recording device, the recording means is disposed on the left-hand side, as viewed in FIG. 74, while an electric unit 16 for supplying signals to the individual components is disposed on the right-hand side.

The upper end of the electric unit 16 is lower than the highest portion of the recording device P (which is the upper end of the ink cartridge 8*a* and arm 9*e* in this embodiment). Part of the reading unit 3 projects downward in the space provided above the electric unit 16. That is, a low bottom portion 3*g* of a bottom portion of the reading unit 3 projects downward with respect to a high bottom portion 3*f* thereof, and the high bottom portion 3*f* is located above the recording means 8 while the low bottom portion 3*g* is located above the electric unit 16. The low bottom portion 3*g* is lower than the ink cartridge 8*a* or the arm 9*e* of the recording device P. In this way, the reading unit 3 can move in the sub-scan direction (indicated by the bidirectional arrow 'b') without trouble.

One end of the signal cable 7 is connected to a substrate 1*d*, and the other end thereof is connected to the low bottom portion 3*g* of the reading unit 3. The intermediate portion of the signal cable 7 is fixed by a pressing portion 2*f* of the reading carriage 2.

In this embodiment, a height H1 between the high bottom portion 3*f* of the reading unit 3 and the original glass base 4 is 55 mm, and a height H2 between the high bottom portion 3*f* and the low bottom portion 3*g* is 19 mm. When the reading carriage stroke is about 250 mm and a cable 7 having a diameter of 1.5 mm is used, a loop diameter D1 of the signal cable 7 when the reading carriage 2 is at a right end 'A', indicated by a dot-dot-dashed line in FIG. 74, is 48 mm, and a maximum loop diameter D2 when the carriage 2 is at the stroke position B is 65 mm.

Even when the maximum loop diameter D2 is larger than the height H1 between the high bottom portion 3*f* of the reading unit 3 and the original glass base 4, because one end of the signal cable 7 is fixed to the low bottom portion 3*g*, the signal cable 7 does not make contact with the original glass base 4. Hence, it is not necessary to provide the reading device R above the recording device P at a unnecessarily high position. The signal cable 7 is connected to the electric unit 16 via a cable 17.

A recording signal cable 14 which forms a loop as a consequence of the movement of the recording carriage 9 does not make contact with the high bottom portion 3*f* of the reading unit 3 located above the cable 14, because the height between the bottom portion of the recording unit 15 and the arm 9*e* is sufficiently large.

(Recovery System Unit)

A recovery system unit according to the present embodiment will be explained.

Figure 75:
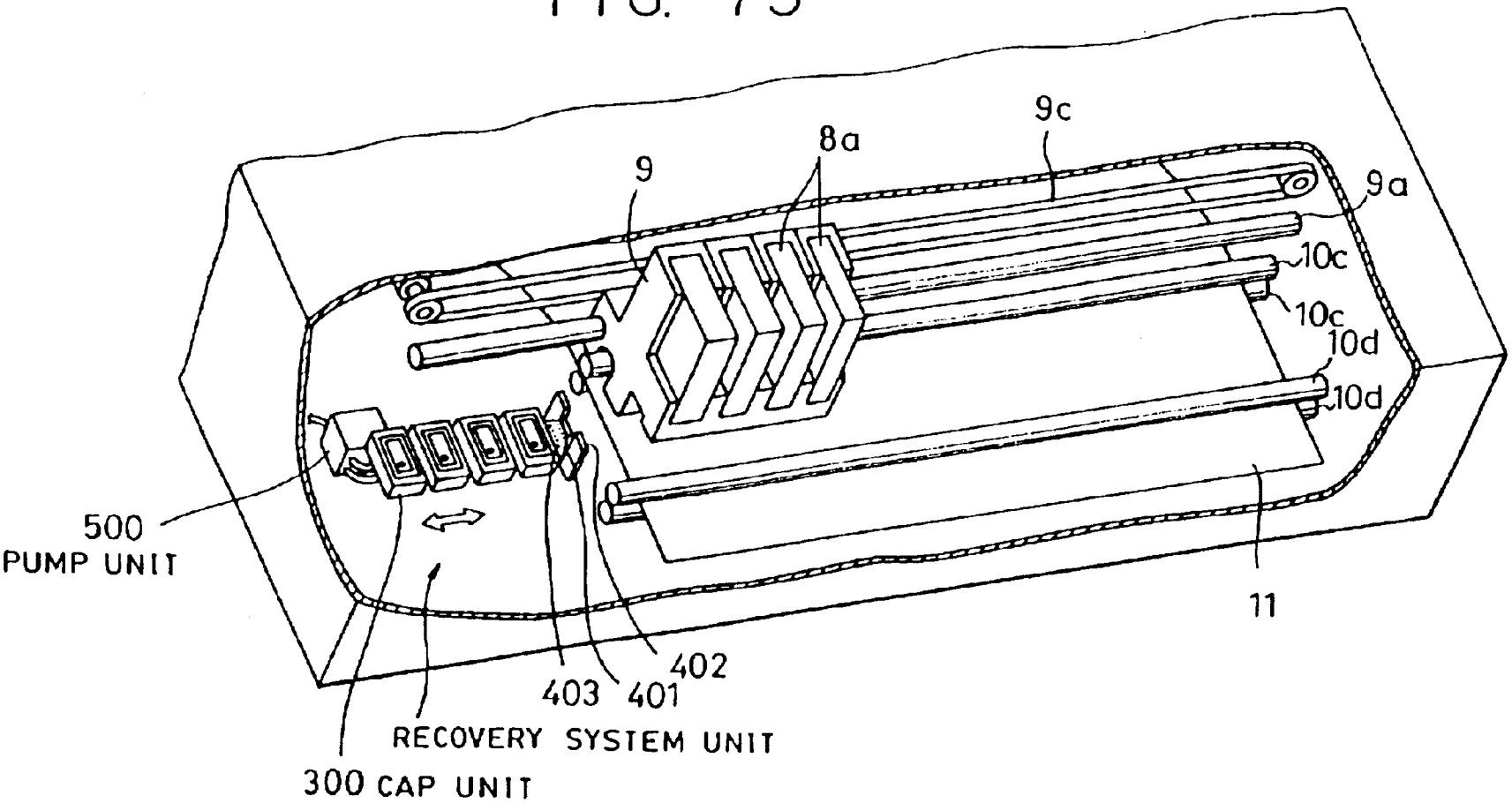
FIG. 75 is a schematic perspective view of a discharge recovery system unit.

FIG. 75 is a schematic view illustrating the location and structure of the recovery system unit. In this embodiment, the recovery system unit is disposed near the home position indicated by HP in FIG. 77.

In the recovery system unit, a capping unit 300 is provided for each of the plurality of ink cartridges 8*a* each having a recording head 8*b*. The capping unit 300 is slidable rightwardly and leftwardly and movable up and down, as viewed in FIG. 75, in response to the movement of the recording carriage 9. When the recording carriage 9 is at the home position, the capping units 300 are joined to the recording heads 8*b* to cap them. The detailed structure of the capping unit 300 will be described later with reference to FIGS. 78, 79 and 80.

Figure 76:
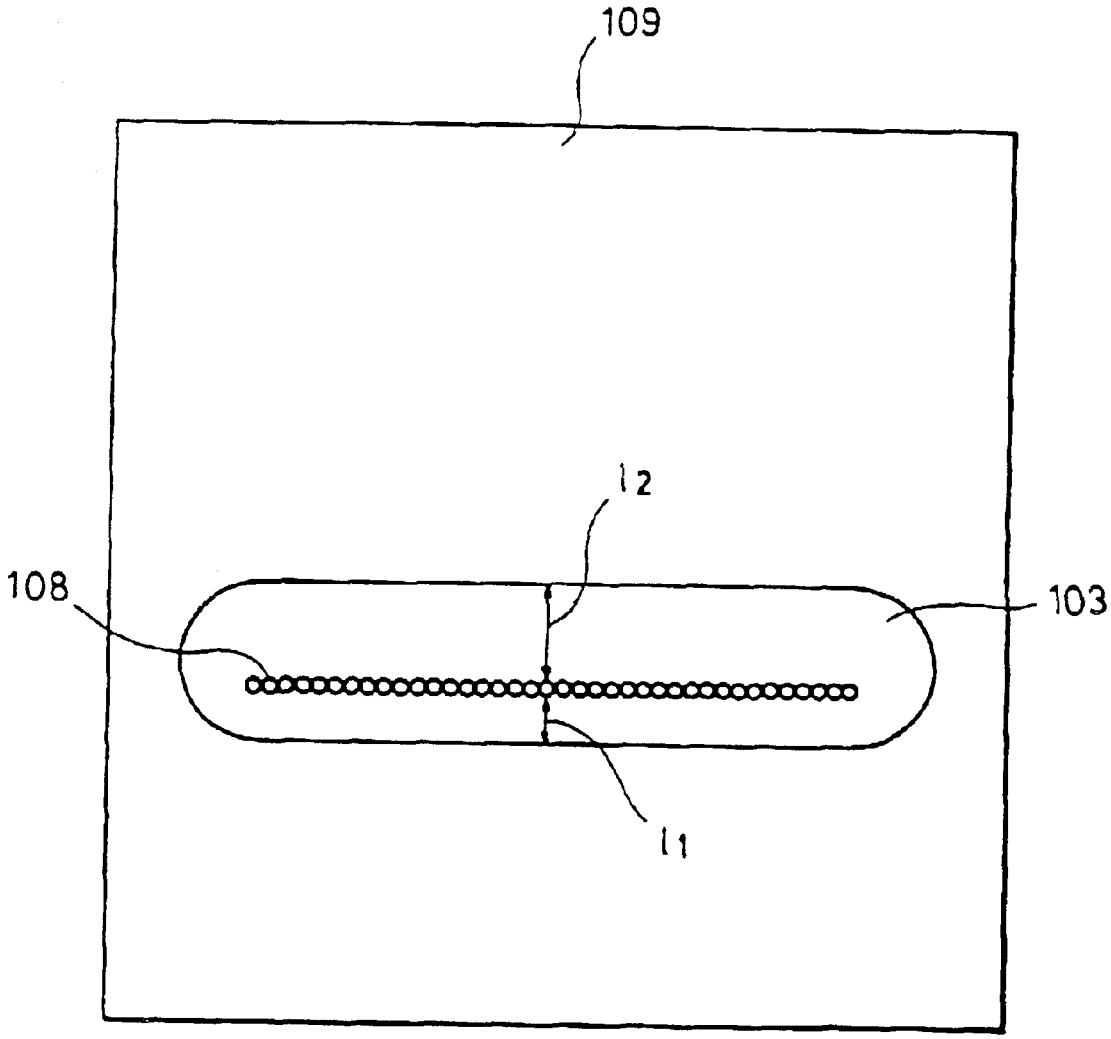
FIG. 76 is a front elevational view of a head.

In the recovery system unit shown in FIG. 75, first and second blades 401 and 402 serve as a wiping member. A blade cleaner 403, which is made of, for example, an absorber, cleans the first blade 401. In this embodiment, the first blade 401 is retained by a blade elevation mechanism driven by the movement of the recording carriage 9 so that it can be moved between a projecting (upper) position at which the first blade 401 wipes the surface of an exposing orifice plate 103 in the discharge port formed surface of the recording head 8*b* and a retracted (lower) position where the first blade 401 does not interfere with the orifice plate 103. In this embodiment, the recording head 8*b* is mounted such that the portion thereof having a width 12 in FIG. 76 is located on the left-hand side of FIG. 78 so that it can be wiped by the first blade 401 when the recording carriage 9 moves from the left-hand side to the right-hand side, as viewed in FIG. 78. At that time, the first blade 401 wipes only the surface of the exposing orifice plate 103 starting from a narrow portion (a portion having a width 11) toward a wide portion (a portion having a width 12) which are defined by the discharge ports. The second blade 402 is fixed to a position where it wipes the portion of the discharge port formed surface of the recording head 8*b* which is not wiped by the first blade 401, i.e., the surface of a pressing member 109 located on the two sides of the exposing orifice plate surface shown in FIG. 76.

In the recovery system unit, a pump unit 500 communicates with the cap units 300. The pump unit 500 generates a negative pressure required for suction performed when the capping units 300 are joined to the recording heads 8*b*.

Figure 77:
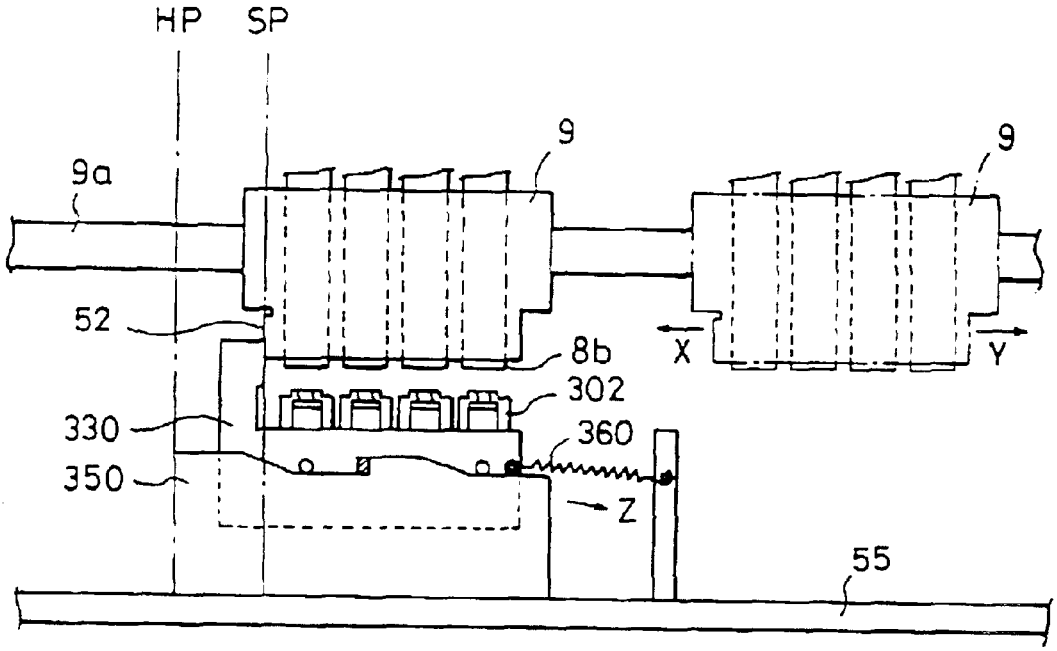
FIG. 77 is a front elevational view of a head recovery system.

FIG. 77 is a front view of the head recovering system. The recording carriage 9 having the recording heads 8*b* is movable for recording in directions indicated by arrows X and Y in a state wherein it is supported on the main scan rail 9*a*. A cap holder 330 formed of an elastic body and having caps 302 for covering the forward ends of the recording heads 8*b* so as to prevent clogging of the discharge ports is provided near a bottom plate 55. The cap holder 330 is made slidable by positioning pins 332 and 334 (see FIG. 74) with respect to a recovery system base 350 fixed to the bottom plate 55. Also, the cap holder 330 is urged in a direction indicated by an arrow Z by a spring 360. HP (home position) denotes a non-recording position which is the waiting position of the recording carriage 9, where clog-preventing capping and a clogged discharge port recovering operation are performed by, for example, circulating recovery of the ink in the head, such as suction recovery or pressure recovery. SP (starting position) denotes a position where the recording carriage 9 initiates the recording operation. Home position HP and starting position SP are defined using a positioning portion 52 of the recording carriage 9 as a reference.

(Capping Unit)

Figure 78:
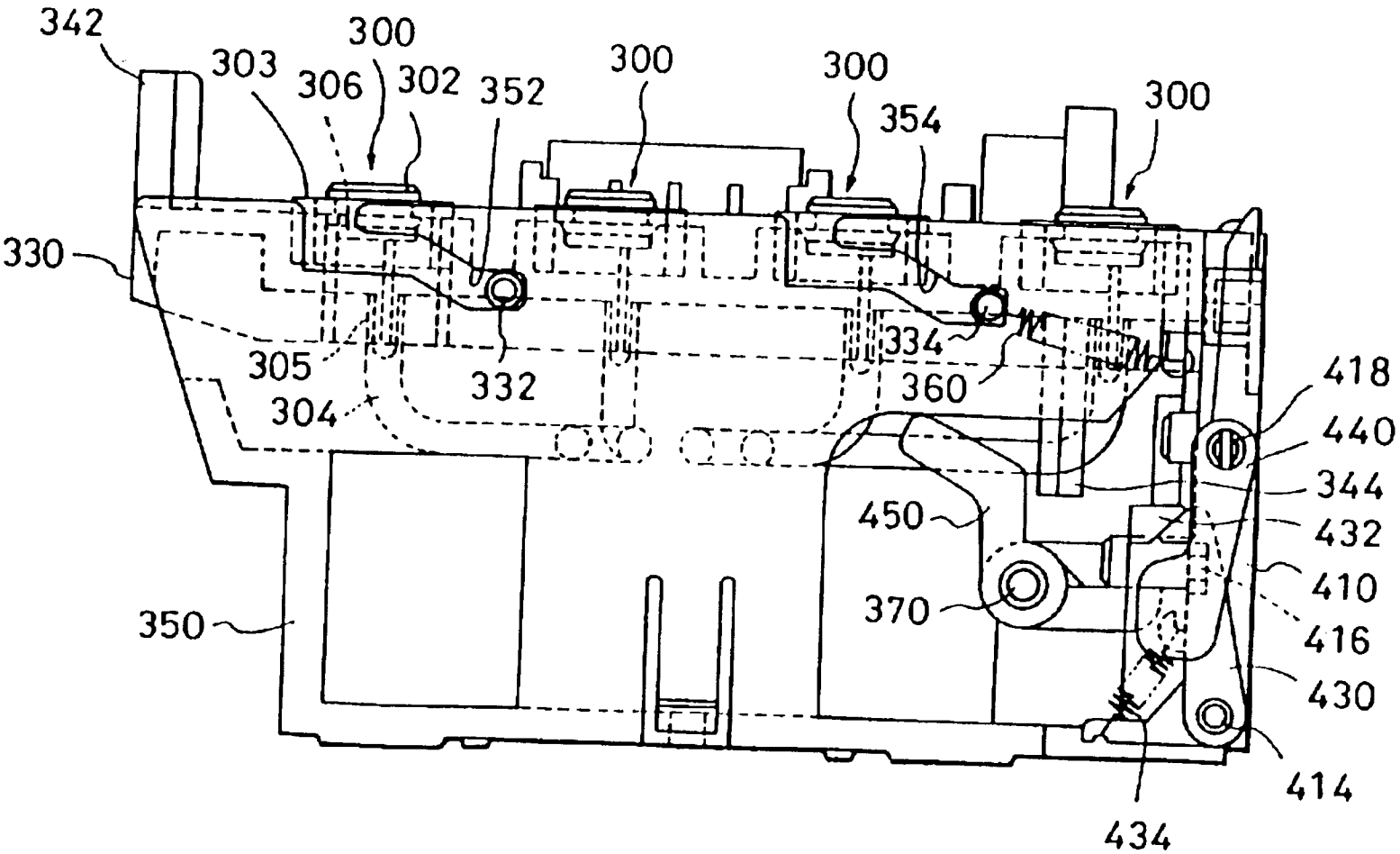
FIG. 78 is a front elevational view of a recovery system unit.
Figure 79:
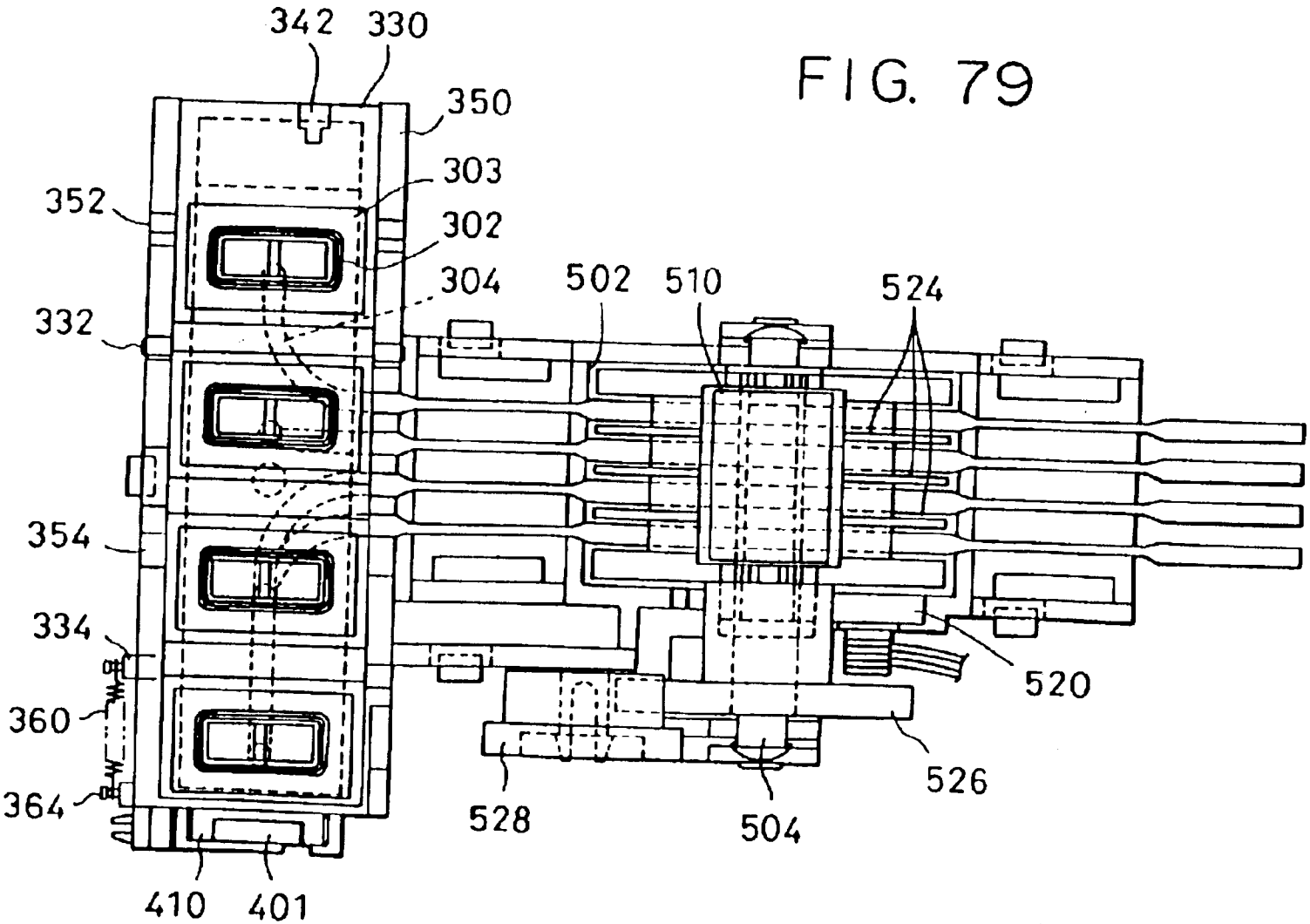
FIG. 79 is a plan view of the recovery system unit.
Figure 80:
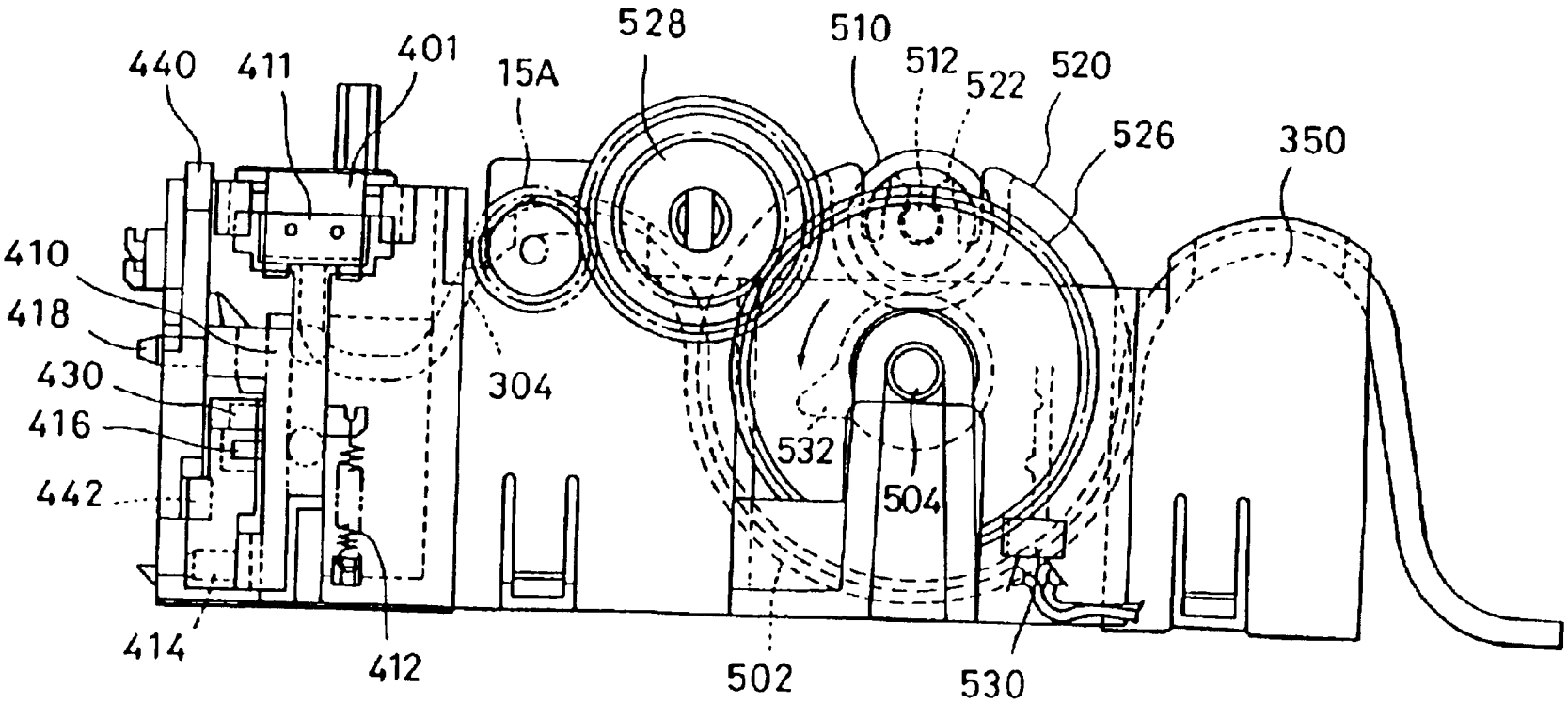
FIG. 80 is a side elevational view of the recovery system unit.
Figure 90:
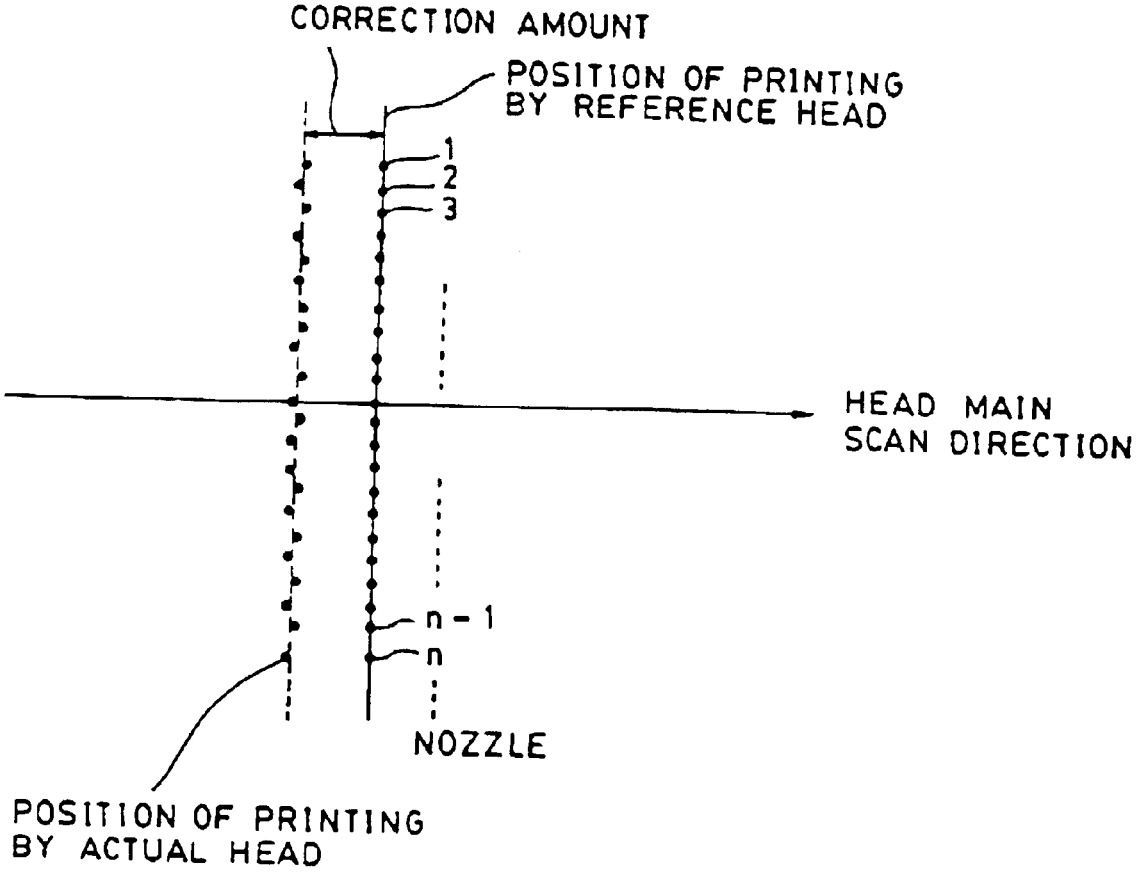
FIG. 90 is an illustration of an amount of head registration correction.

FIGS. 78, 79 and 90 are respectively front, plan and side elevational views of the recovery system unit.

The capping unit 300 includes the cap 302 closely attached to the discharge ports of the recording head 8*b*, the holder 303 for supporting the cap 302, an absorber 306 for receiving ink during pre-discharge and suction, a suction tube 304 for sucking the received ink, and a connecting tube 305 which communicates with the pump unit 500. The capping units 300 are provided in the same number (four in this embodiment) as the ink cartridges 8*a* at a position where they face the corresponding ink cartridges 8*a*. The capping units 300 are supported by the cap holder 330.

The pins 332 and 334 projecting from the cap holder 330 are respectively in engagement with cam grooves 352 and 354 provided in the fixed recovery system base 350 for guiding the cap holder 330 in the horizontal and vertical directions as viewed in FIG. 78. The spring 360 extends between the pin 334 of the cap holder 330 and a rising portion 364 of the recovery system base 350 to urge and thereby hold the cap holder 330 at the position shown in FIG. 78, i.e., at the right end and at the lowest position. When recording carriage 9 is at the starting position (SP) where it starts recording, the recording heads 8*b* of the ink cartridges 8*a* mounted on the recording carriage 9 are opposite the cap holder 330 or cap unit 300 located at that position.

An engaging portion 342 project upward from the cap holder 330. The engaging portion 342 engages with the recording carriage 9 at a position on the left side of the starting position. When the recording carriage 9 is moved further leftward from the starting position, the cap holder 330 moves against the urging force of the spring 360. At that time, the cap holder 330 is guided along the cam grooves 352 and 354 through the pins 332 and 334 and displaces leftwardly and upwardly. Consequently, the caps 302 are closely attached to the discharge ports of the recording heads 8*b* for capping. The position where the recording carriage 9 is located when this capping is performed is its home position.

In this embodiment, since the head data is read out and stored in a memory in the apparatus when a head is loaded on the apparatus, optimum drive can be performed on the loaded head. Furthermore, since the head recovery operation is automatically performed on the loaded head, it is not necessary for the user to perform the troublesome recovery operation. Furthermore, since the recovery operation conducted exclusively when the head replacement is performed is conducted, reliable recovery is possible.

Furthermore, head replacement detection is performed immediately after initial checking (hardware check), and then head data is read in. It is therefore possible to read in the head data reliably and quickly. Head replacement detection is performed by the comparison of the read head data. This makes quick detection of a newly supplied head possible.

In this embodiment, even when the door is opened, the apparatus is not switched off but a door-opened state is temporarily provided. When the door is closed the apparatus returns to its normal state. However, opening/closing of the door and switching on and off of the apparatus may be synchronized. In that case, when the front door is closed, initial checking in step S1 shown in FIG. 1 is executed. In this way, although it takes more time to perform recovery of the apparatus, reliable checking is possible.

In this embodiment, head replacement detection is performed using the data in the ROM of the head. However, determination as to whether a new head is mounted may be made utilizing a simple mechanical structure, such as a pin. Mechanical determination of the new head allows cost of the head replacement detection to be reduced and the degree of freedom of the head structure to be increased.

<Second Embodiment>

A second embodiment of the present invention will be described below with reference to the accompanying drawings. This embodiment is intended to eliminate the waste of ink in the head which is not newly mounted due to pre-discharge in an apparatus having a plurality of heads. This is achieved by making the time pre-discharge is performed on the newly mounted head different from that for the head which is not newly mounted. Other structure of this embodiment is the same as that of the first embodiment, a description thereof being omitted.

Figure 81:
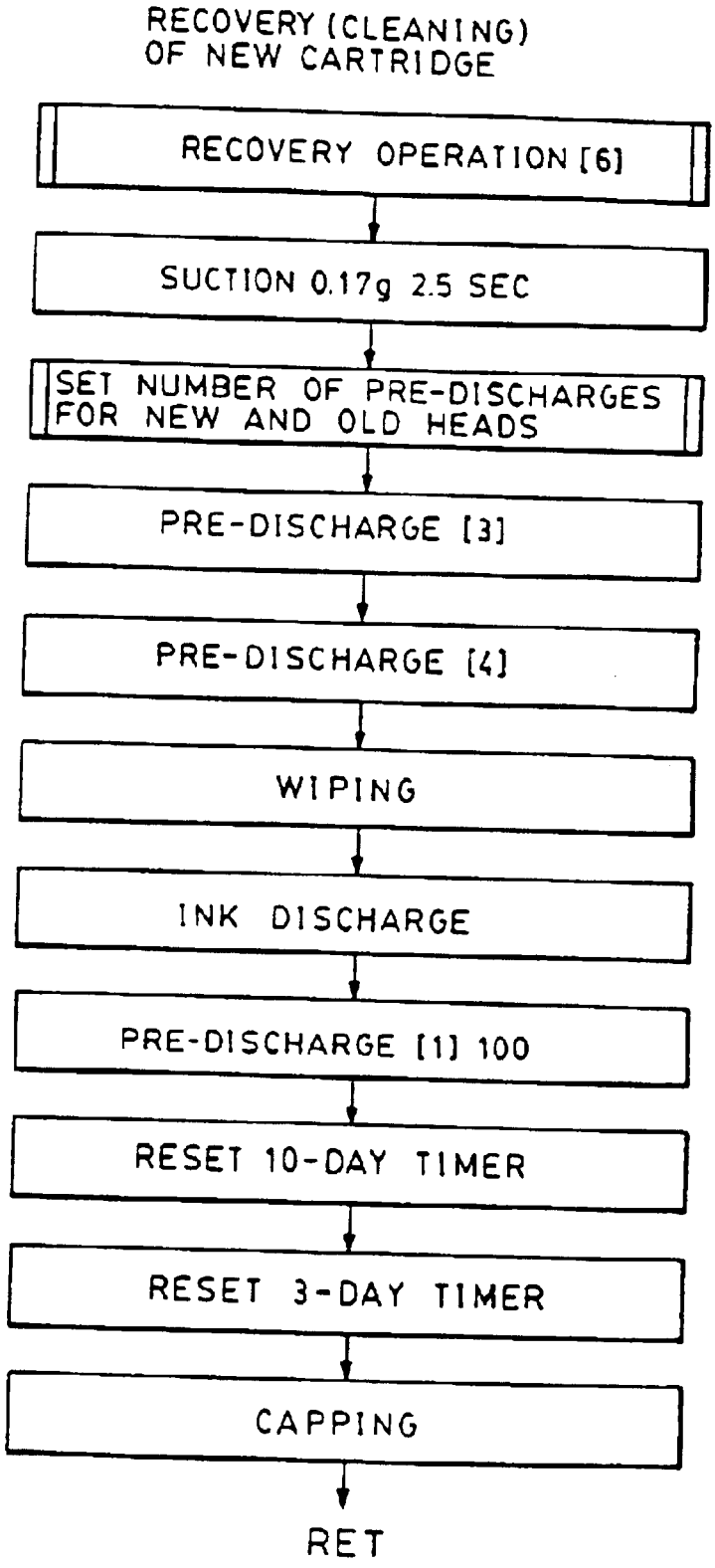
FIG. 81 is a flow chart showing the detail of a discharge recovery routine which is executed by suction on a newly mounted cartridge in a second embodiment of the present invention.

FIG. 81 is a flowchart showing the new cartridge suction recovery routine executed in this embodiment in detail. In this routine, 2000 and 6000 are respectively set as the numbers of times pre-discharge is conducted on the central portion and end portions of a new head, while 100 and 300 are respectively set as the numbers of times pre-discharge is conducted on the central portion and end portions of a head which is not newly supplied. Thereafter, pre-discharge [3] and pre-discharge [4] are performed numbers of times corresponding to the set numbers.

Figure 82:
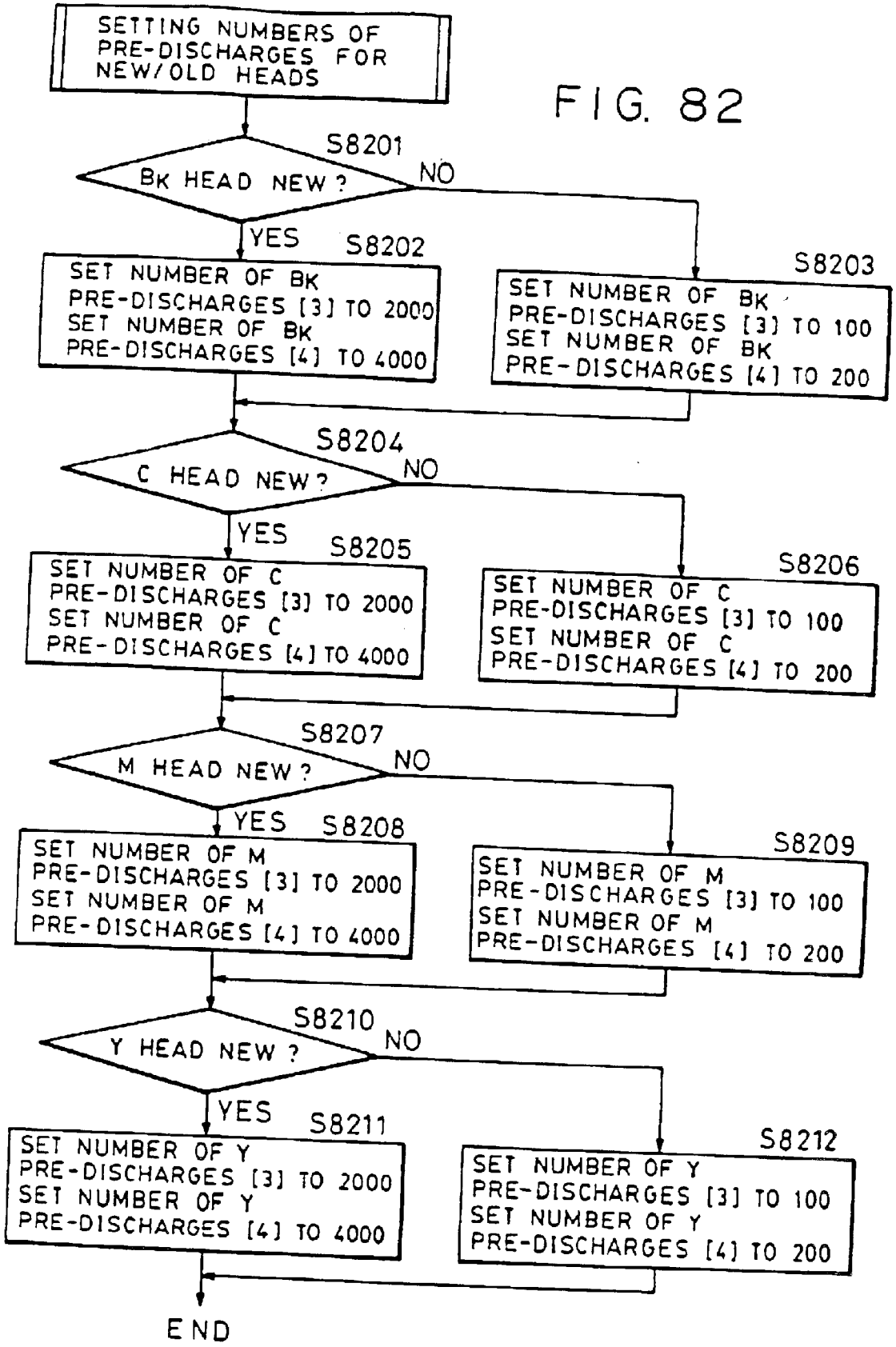
FIG. 82 is a flow chart showing the detail of a routine for setting numbers of pre-discharges to be effected on a head to be demounted and a newly mounted head.

Setting of numbers of times pre-discharge is conducted on new and old heads will be explained with reference to FIG. 82. In steps S8201, S8204, 8207 and 8210, it is determined whether black, cyan, magenta and yellow heads are new. For example, if a black head is new, 2000 and 6000 are respectively set as the numbers of times pre-discharge is conducted on the central portion and end portions of the new head in step S8202. If the black head is not new, 100 and 300 are respectively set as the numbers of times pre-discharge is conducted on the central portion and end portions of the old head in step S8203. The numbers of times pre-discharge is conducted on cyan, magenta and yellow heads are similarly set in steps S8205 and S8206, steps S8208 and S8209, and steps S8211 and S8212, respectively.

In the second embodiment, in the apparatus having heads of a plurality of colors, the number of times pre-discharge is conducted on a new head is made different from that for a head which is not new. The number of times pre-discharge is performed on the new head is larger than that for the head which is not newly supplied. It is therefore possible to prevent the ink in the head which is not newly supplied from being wasted by unnecessary pre-discharges.

In the second embodiment, the number of times pre-discharge is performed on a new head is the same in all the colors. However, it may be varied in accordance with the color or type of ink. In this way, better head recovery can be performed. In the second embodiment, the number of times pre-discharge is performed on a new head is made different from that for the head which is not newly supplied. However, the use of different driving frequencies for pre-discharge provides the same effect.

<Third Embodiment>

Figure 83:
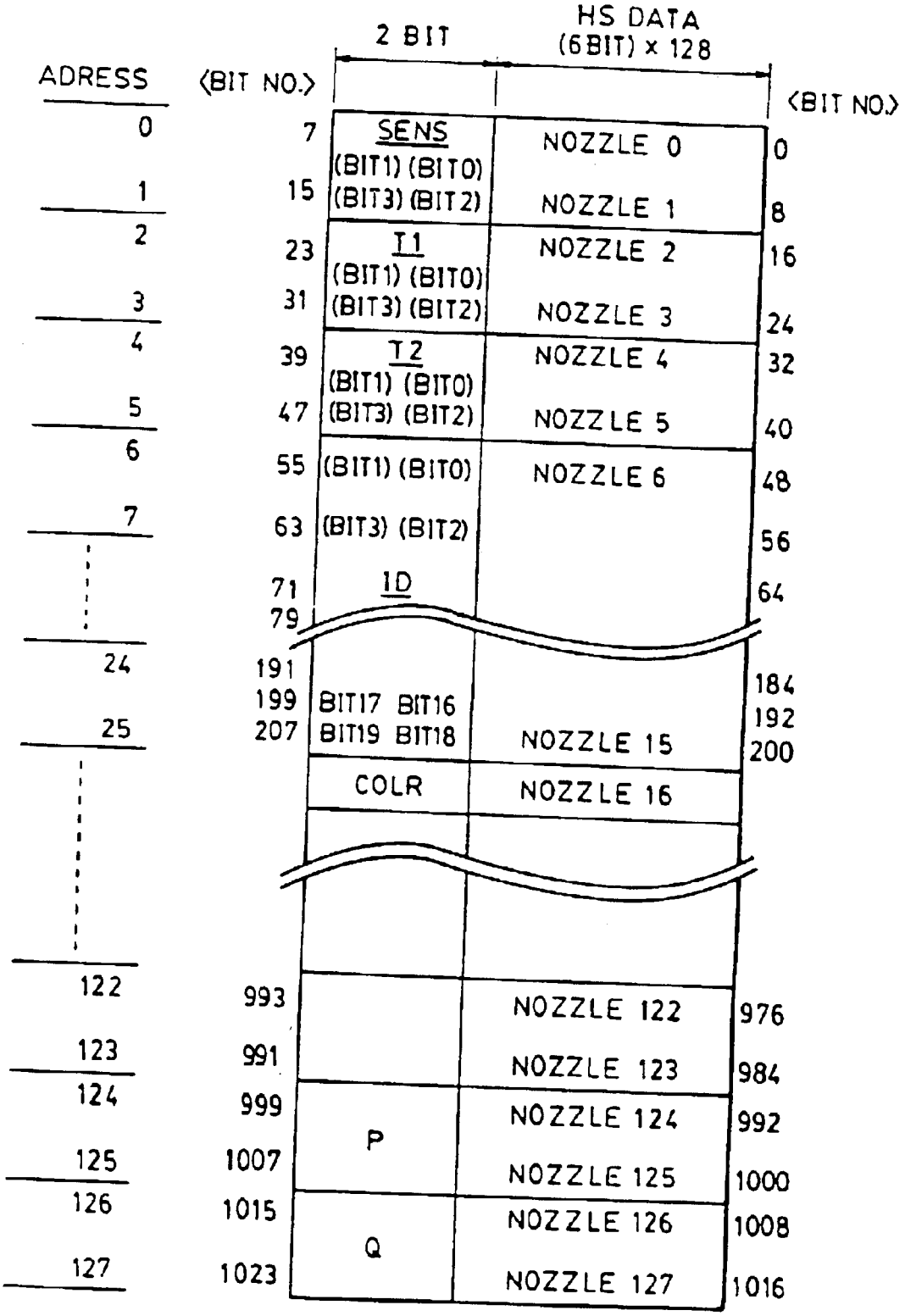
FIG. 83 is an illustration of the manner in which data stored in a ROM 854 is used in a third embodiment of the present invention.

A third embodiment of the present invention will now be described with reference to the accompanying drawings. The third embodiment is characterized by the data stored in the ROM of the head and its storage format. FIG. 83 illustrates the format of the data stored in the ROM, and FIG. 84 illustrates the contents of the data. In this embodiment, EEPROM is used as the ROM.

In the EEPROM, manufacture No., uneven density correction data, ink color data and characteristics (classification) of a temperature sensor, i.e., a diode sensor, are written. In this embodiment, a EEPROM of 1 K bits (128 bytes) is used. Since the number of nozzles is 128, there are 128 different types of uneven density correction data. Each of the 128 uneven density correction data is 6-bit data and is selected from 64 types of data correction tables from 0 to 63. The address of the EEPROM corresponds to that nozzle no. The lower 6 bits of each address represent density correction table no. of that nozzle. To denote manufacture no., 20 bits are prepared in this embodiment. As can be seen from FIG. 83, the upper 2 bits of each address are used to represent data other than the density correction data. The manufacture no. includes the manufacturing date and manufacturer's serial no. The apparatus body reads in this manufacture no. to detect head replacement.

Figure 85:
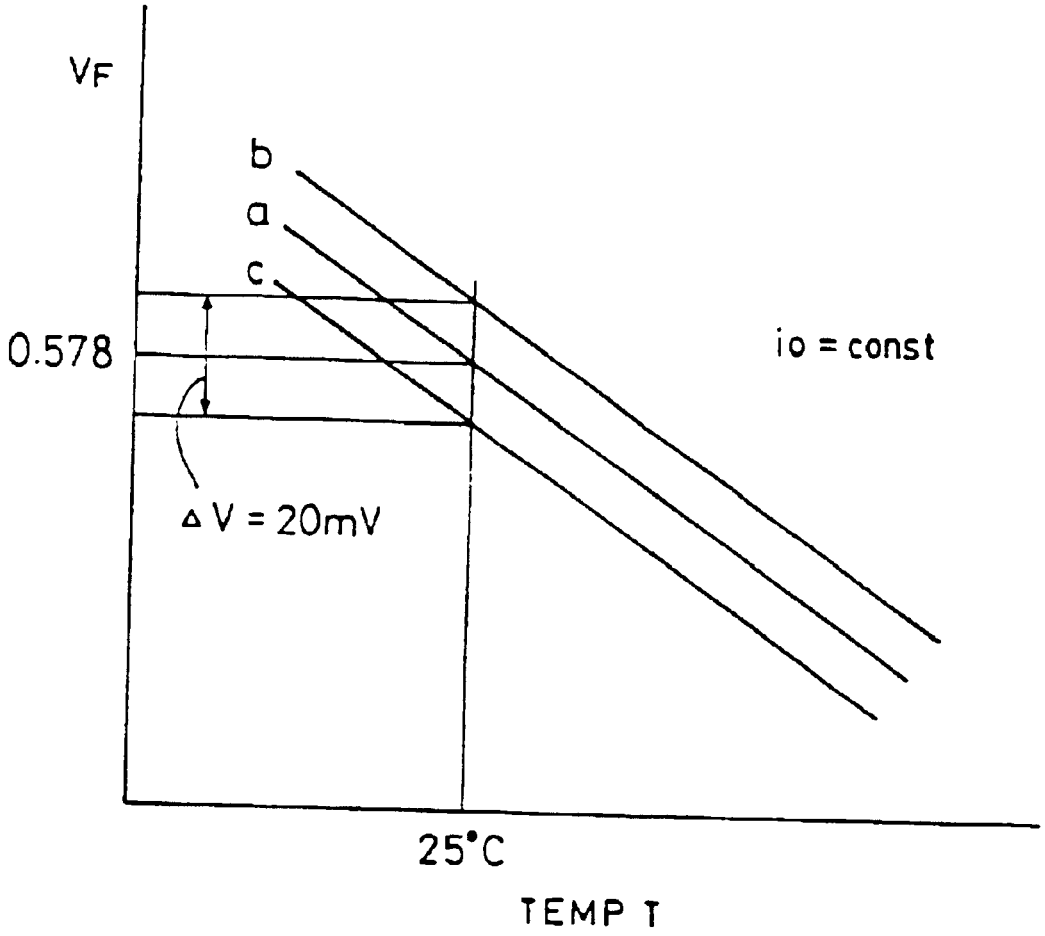
FIG. 85 is a diagram showing temperature-voltage characteristics of a diode sensor.

2 bits are used for ink color. 00 represents black; 01, cyan; 10, magenta; and 11, yellow. Hence, even when a plurality of heads having exactly the same appearance are mounted in the apparatus body, electrical discrimination of the color of the head is possible. This allows for detection of a head of an inadequate color. 4 bits are used to represent the characteristics of the diode sensors, that is, the characteristics of the diode sensors are classified into 16 ranks. The temperature characteristics, i.e., changes in the voltages relative to the temperature, of the diodes manufactured by the same process are uniform, as shown in FIG. 85. However, the absolute value of a voltage drop varies within a certain range depending on an individual diode. Hence, to detect the temperature with a high degree of accuracy, the characteristics of an individual diode must be supplied to the apparatus body. At that time, since it has been confirmed that variations in the characteristics which occur within the same wafer are negligible, it is not necessary to prepare different data for right and left sensors. 4 bits are used to represent the driving current pulse width TA1 (T2:P3) and TA3 (T1:P1).

<Fourth Embodiment>

Figure 86:
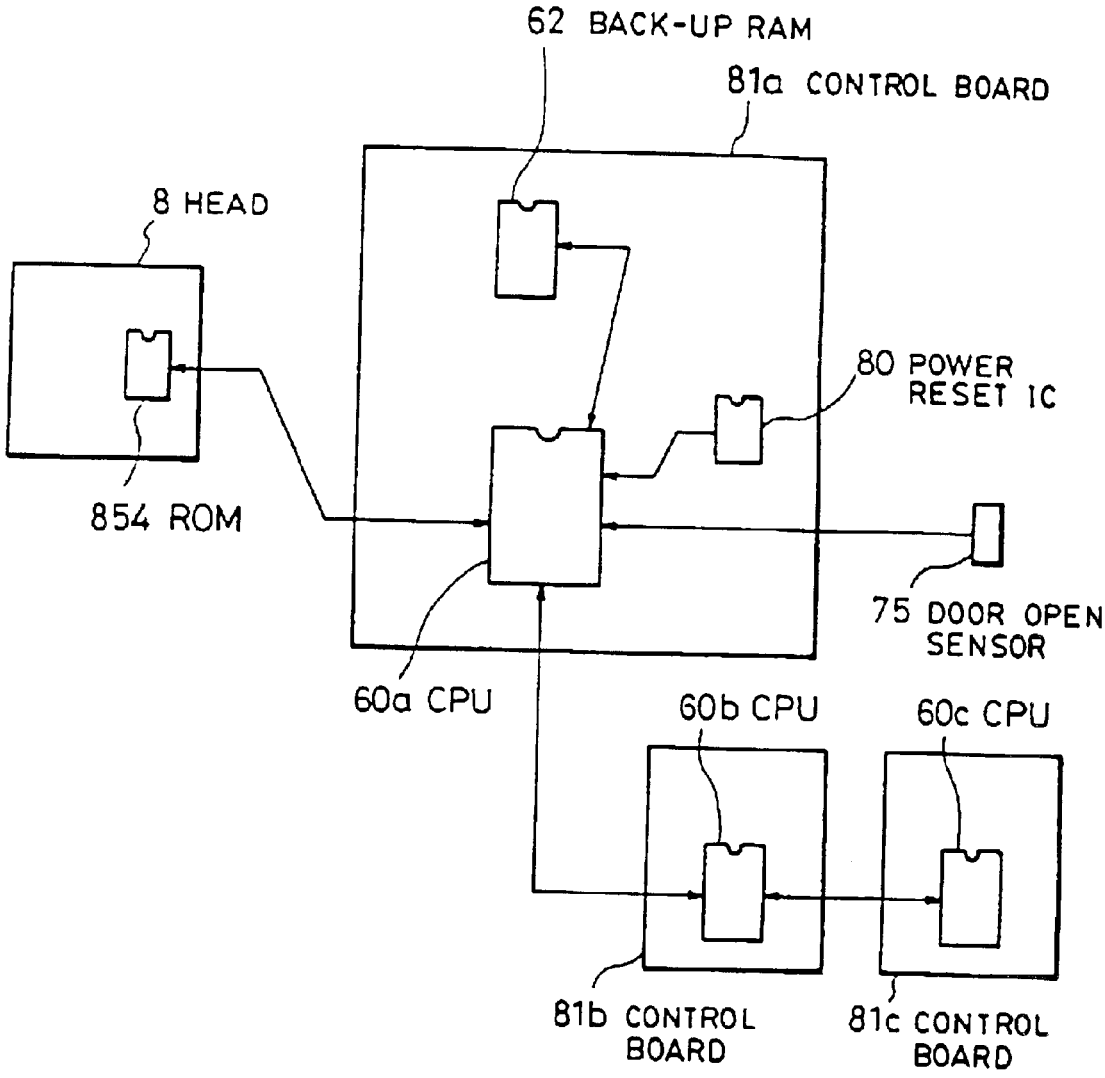
FIG. 86 is a circuit diagram showing a circuit incorporated in a fourth embodiment of the present invention.

A fourth embodiment of the present invention will be described with reference to FIG. 86. In FIG. 86, reference numeral 8 denotes a head (recording means) which can be replaced with a new one when it runs out of ink or breaks. A ROM 854 for storing various head data similar to the data stored in the previous embodiment is incorporated in the head 8. A CPU 60*a* reads out the data in the ROM 854 and writes it in a backup RAM 62 to perform control using that data. The backup RAM 62 is backed up by a battery so that the data stored in the backup RAM 62 does not disappear when the apparatus is switched off. Alternatively, a non-volatile memory, such as a EEPROM, may be used.

A door opening sensor 75 determines whether or not the door is opened by the user. The user opens the door when he removes the paper remaining in the apparatus or changes the head. A power resetting IC 80 releases a reset state of the system including the CPU 60*a* when the voltage reaches a predetermined value after the apparatus is switched on. A control board 81*b* and a control board 81*c* are systems connected to a control board 81*a* to build up a copier system. The control board 81*b*, for example, manages an image reader and exchanges data with the control board 81*a* serving as a printer managing controller through communications. The control board 81*c* is an optional device, such as an image editing device, which may exchange communications or image data with the control board 81*b* to provide a more sophisticated copier system. If necessary, a predetermined control may be performed by CPUs 60*b* and 60*c* using the data in the ROM 854. The contents of such a control are not related to this embodiment, description thereof being omitted.

Figure 87:
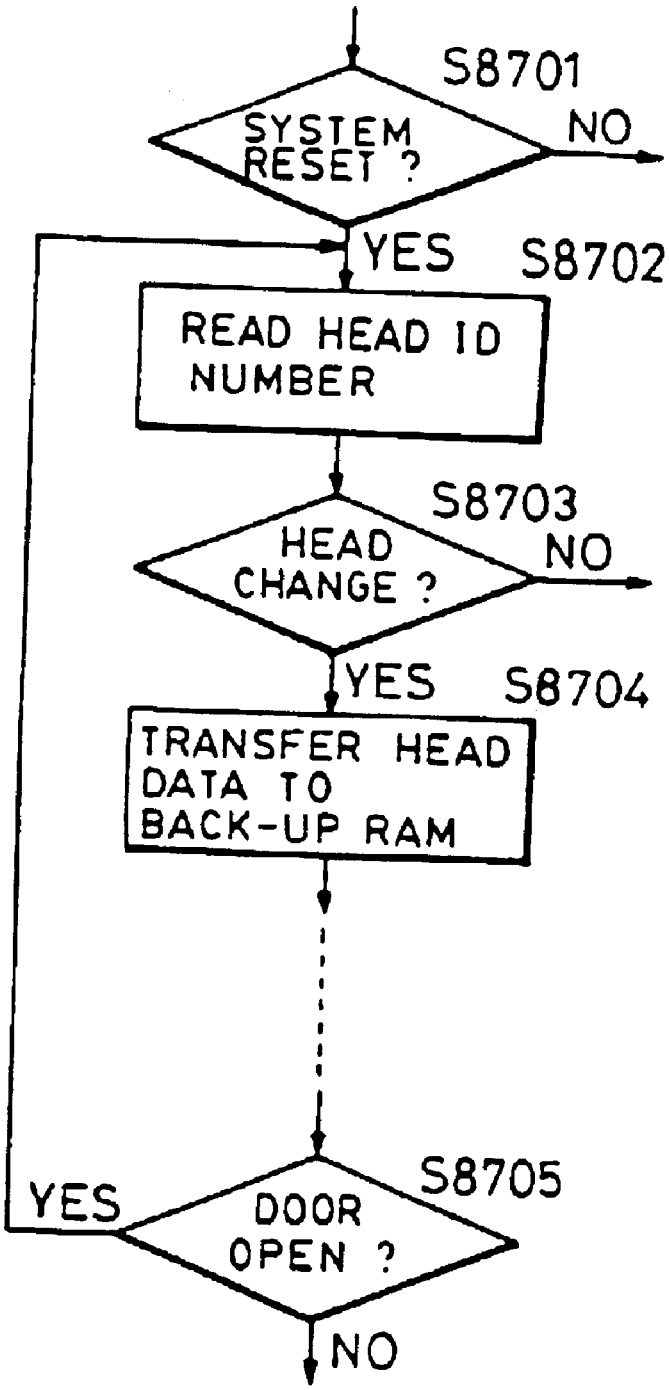
FIG. 87 is a flow chart illustrative of the operation of the circuit shown in FIG. 86.

The operation of the fourth embodiment will be described below with reference to FIG. 87. When the CPU 60*a* detects switching on of the apparatus by means of the, power resetting IC 86 in step S8701 and opening of the door by means of the door opening sensor 75 in step S8705, it reads in the head identification no. from the ROM 854 of the head 8 in step S8702, and compares the identification no. with the head identification no stored in the backup RAM 62 to determine whether the replaceable head 8 has been changed in step S8703. Only when the head 8 has been changed, predetermined head characteristic data, including the aforementioned head identification no., is transferred to the backup RAM 62 or a non-volatile memory in step S8704.

As mentioned above, in this embodiment, each of the replaceable heads 8 is provided with a head identification no., and that identification no. is compared with that stored in the backup RAM 62 to determine whether a new head has been mounted after the apparatus is switched on or the door is opened. Only when the head 8 has been changed, the predetermined head characteristic data, including the head identification no., is transferred to the backup RAM 62. Consequently, the time required for the copying or printing operation can be reduced when compared with the case in which the head characteristic data is transferred each time the apparatus is switched on.

<Fifth Embodiment>

A fifth embodiment of the present invention will be described below. In the ink jet recording apparatus, temporary use of a recording head in place of an original head may occur. That is, in the midway of the recording operation, a recording head with which recording is conducted may be replaced with another head for some reason. After recording with that head, the used head may be replaced with the head with which recording has been conducted initially. This may not happen with a permanent head which is mounted on the apparatus body during manufacture thereof and whose ink tank or ink bottle is replaced with a new one. However, such a temporary use of another head during printing may occur frequently with a cartridge type recording head in which a head and an ink tank are provided as one unit. Particularly, in the case of printing by means of a recording apparatus in which recording heads are mounted on a single head carriage using inks of a plurality of colors, temporary use of another recording head always occurs.

When a new recording head is loaded on the apparatus body, as in the aforementioned case, stable discharge of ink from the head may be disabled or made difficult. Hence, in this embodiment, the recording head is provided with a storage member (memory) which stores the head characteristic data thereof, and the data in the storage member of the head is read into the recording apparatus body at predetermined time intervals. In this embodiment, a cartridge type recording head in which a head and an ink tank are formed as one unit is used.

(ID NO. of Head)

Head ID no. is used to identify an individual cartridge. When the apparatus is switched on, ID no. of the head is compared with that of the cartridge which has been loaded in the previous printing operation. If they are not identical, it is determined that a new cartridge has been loaded, and various types of initial operations are performed.

A change in the ID no. indicates that the previous cartridge has run out of ink and a new cartridge has been unpacked and loaded. Loading of the new cartridge, however, does not ensure stable ink discharge from the head. Hence, a recovery operation suitable to the new cartridge is performed.

Also, the data on the previous cartridge is initialized. The data to be initialized includes the data read out from the ROM of the cartridge when the apparatus is switched on and data required to control only the previous cartridge.

ID no. is read into the apparatus body when the apparatus is switched on, and the read ID no. is compared with that used in the previous operation. If they are identical, it is not necessary to read in the data from the ROM of the cartridge. However, in an apparatus of the type in which the ROM of the cartridge is rewritten during the operation of the apparatus body, the data is read out from the ROM of the cartridge when the apparatus is switched on or at adequate time intervals, and various operations are performed.

(Color of Ink)

If a cartridge of a predetermined ink is not loaded at a predetermined carriage position, an image which is printed has an undesired color.

Hence, color data is stored in the cartridge, and erroneous cartridge loading is prevented using that color data.

(Amount of Remaining Ink)

A fixed amount of current is supplied to a pin which is inserted into an absorber in an ink tank, and a voltage is measured after a certain period of time has elapsed to obtain a remaining ink value. When this remaining ink value is larger than a predetermined threshold voltage, a lamp may be lit up to alert the user that the amount of remaining ink is less.

Figure 88:
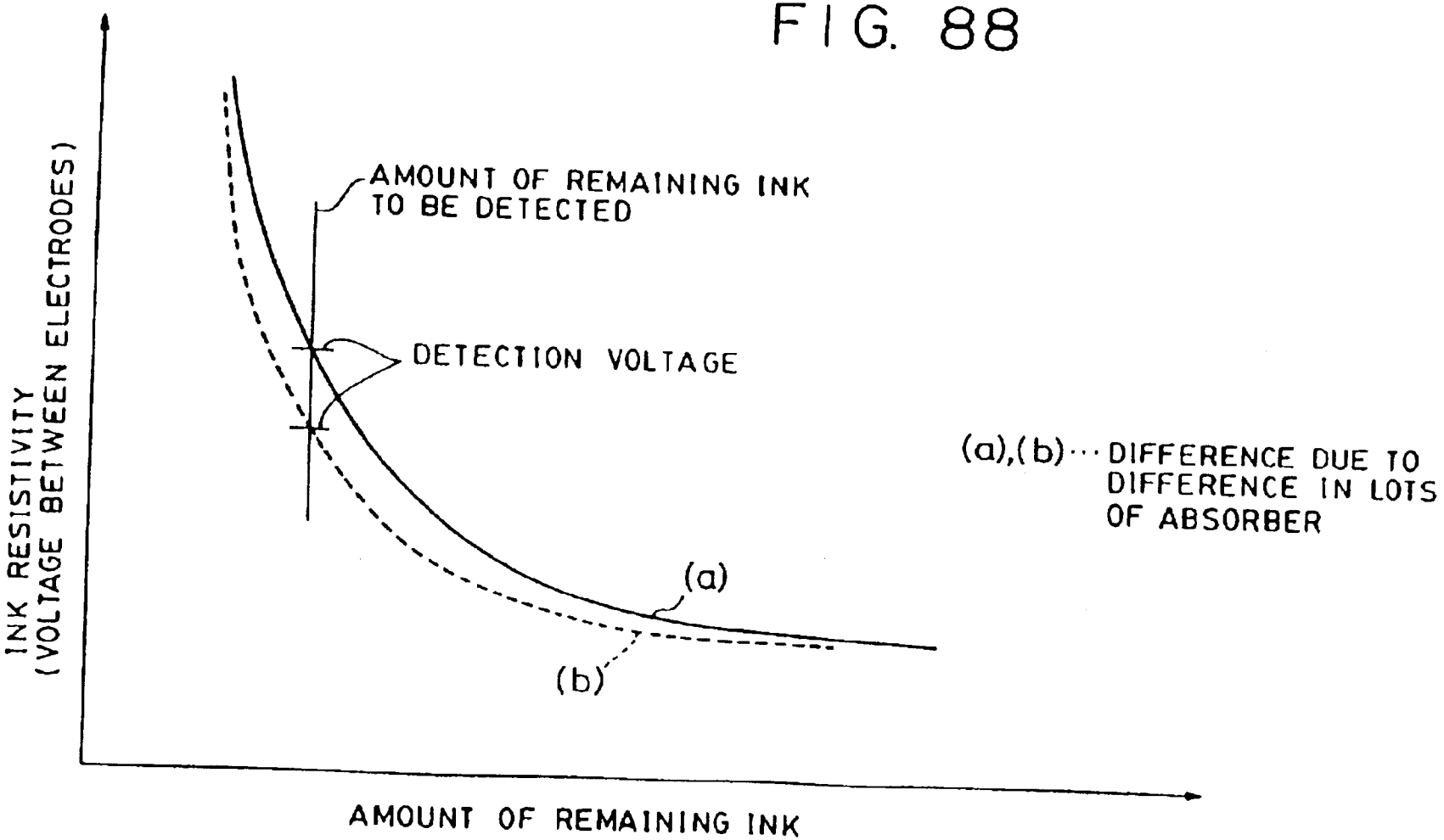
FIG. 88 is an illustration of the relationship between the electrical resistance of ink and the amount of remaining ink.

The remaining ink value varies depending on the electric resistance of ink: it increases as the temperature of the ink decreases. Hence, to detect the amount of remaining ink accurately, a threshold voltage is varied in accordance with the temperature of the ink. The characteristics of the remaining ink value also vary depending on the type of ink or a lot of the absorber in the ink tank (see FIG. 88).

Hence, the detection voltage is stored at each temperature in each cartridge to allow accurate detection of the amount of remaining ink to be performed. Practically, either of the following methods is used.

Figure 89:
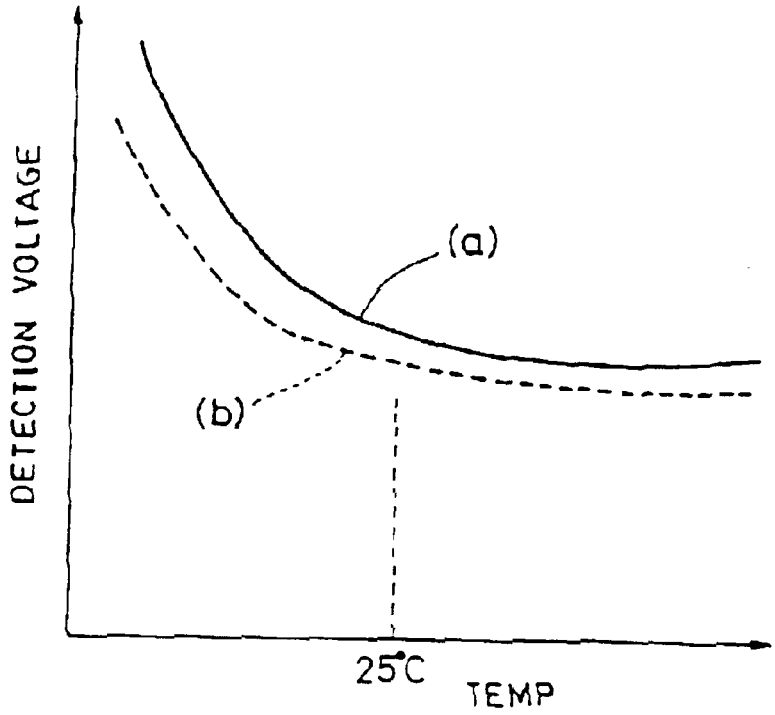
FIGS. 89(A) and 89(B) are illustrations of the relationship between temperature and detected voltage.
Figure 89:
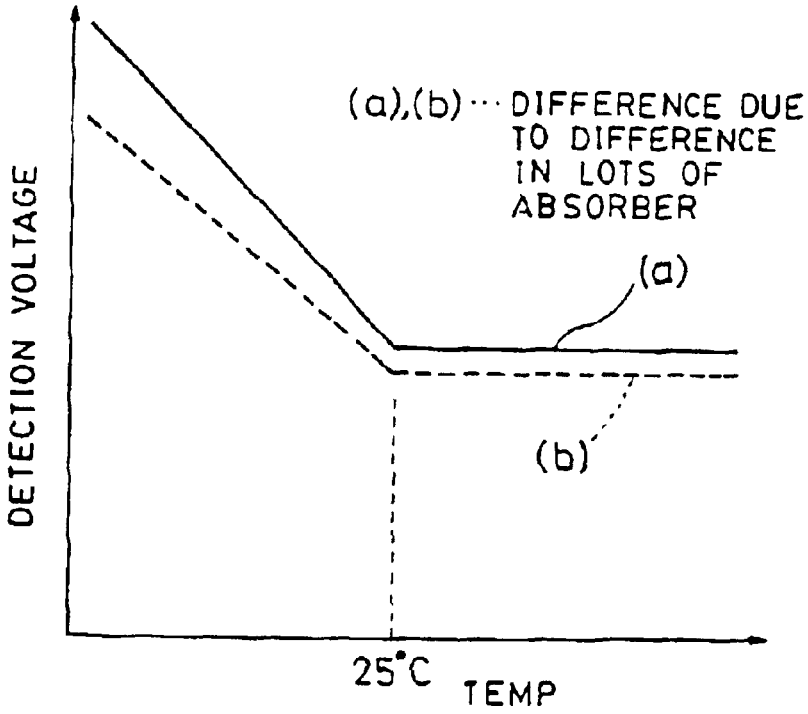

[1] A table is stored for each temperature. With the capacity of the memory and the precision of the temperature sensor taken into consideration, data over a range between 0° C. and 30° C. is prepared at intervals of 3 to 5° C. At that time, 0° C. represents 0° C. and the values lower than 0° C., 30° C. represents 30° C. and the values higher than 30° C. (see FIG. 89(A)).

[2] Since the detection value for each temperature can be expressed using a simple function, data representing a few types of numerics is enough as the data. Since a temperature which is 25° C. or above is expressed by a fixed value while a temperature which is less than 25° C. can be linearly approximated, two types of numeric data are enough (see FIG. 89(B)).

(HS Data)

Head shading (HS) is performed to correct density non-uniformity in the head and thereby enhance image quality. HS is performed before the head is shipped, and the obtained data is written in the ROM in the head. Non-uniformity may vary during the use of the head. In that case, RHS is performed, and newly obtained HS data is written in a SRAM in the apparatus body.

(Manufacturing Date)

The user can know with the manufacturing date how much time has passed since the cartridge is manufactured when he loads the cartridge in the apparatus. Consequently, the user can perform a recovery operation suited to that period of time on the new cartridge.

That is, in a cartridge which has been manufactured a long time ago, since the concentration of the ink in the nozzle has been increased, the amount of ink which is sucked or the number of times pre-discharge is conducted is increased so as to provide stable discharge of ink having an adequate concentration. Practically, the type of recovery operation to be performed is decided by the number of months between the manufacturing date and the loaded date.

(Term of Validity)

The composition or property of the ink in a cartridge manufactured a long period of time before varies, varying discharge stability and ink concentration. This change in the composition or property of the ink is significant in a packed cartridge. That is, ink in the cartridge evaporates, and the degree of evaporation varies depending of the components of the ink. Consequently, the composition ratio of the ink varies, varying the discharge characteristics. Furthermore, since the dye in the ink does not evaporate, the concentration of the ink increases. Such an ink provides an image having a tint different from a desired one. Hence, if it is determined that a predetermined period of time or longer has elapsed since the cartridge is unpacked and loaded in the apparatus, the apparatus body may issue an alarm or automatically stop the operation so that the user can replace the cartridge with a new one.

Even when the cartridge is not unpacked, i.e., even when the ink does not evaporate from the cartridge, ink in the cartridge manufactured a long period of time before reacts with the absorber in the ink tank, and the properties of its components thus change, degrading discharge stability. Consequently, the apparatus body may issue an alarm or automatically stop the operation so that the user can replace the cartridge with a new one.

The aforementioned period of time is in the order of several years. To the user which uses the apparatus in a normal manner, such a time has no meaning. However, alarming made when the cartridge has not been used for a long period of time ensures that the user always has images of high definition.

(Rank of the Temperature Sensor)

In this ink jet recording apparatus, since discharge control is varied depending on the temperature of the head, a highly accurate temperature detection is required. Temperature of the head is detected by the temperature sensor provided on the same substrate as the discharge heaters of the head. However, characteristics of the sensor, made of a semiconductor resistor device, vary during manufacture. Hence, the resistance thereof is measured in the manufacturing process, and the sensor is ranked in accordance with that measured value so as to allow for accurate temperature detection in each head.

This rank data is read out when the apparatus is switched on, and the head temperature is calculated in accordance with that rank and thereby detected accurately. Consequently, a high-definition image which does not vary depending on the head and which is free from density non-uniformity can be provided.

(Registration Correction Data in X (Scanning) Direction)

In this ink jet recording apparatus, four head cartridges are mounted on the carriage which scans the recording sheet in a serial fashion to print a full-color image. Practically, the heads are disposed in alignment at fixed spacings in the scanning direction, and ink droplets are discharged at fixed time intervals from the adjacent heads so that they can be placed on the same spot to provide a desired color pixel. However, positional offset of the discharged ink droplets may occur due to poor mechanical precision of the head cartridge or discharge of the ink in a twisted fashion. In that case, since the tint or thin lines of images cannot be finely expressed, a high-definition image cannot be obtained.

Hence, the registration data in the scanning direction is stored in the ROM during manufacture. When a new cartridge is loaded in the apparatus, that data is read out to perform control of timings in which ink is discharged.

Registration correction data will be explained more concretely. The head having a plurality of discharge ports is positioned such that the discharge ports are aligned in a direction substantially perpendicular to the scanning direction. Precisely speaking, the discharge ports are disposed slightly slantingly. That is, provision of the discharge ports in the direction perpendicular to the scanning direction necessitates simultaneously discharge of ink from the discharge ports to provide an image in a direction perpendicular to the scanning direction. However, simultaneous discharge of the ink from the plurality of discharge ports requires large instantaneous power. Also, the number of discharge ports from which ink is discharged simultaneously may differ. A difference in the number of discharge ports generates a difference in the amount of current which flows in the discharge heater, generating a difference in the voltage drop and thus causing variations in the voltage of the power source. Consequently, stable discharge under the optimum drive conditions is made difficult. Hence, in an actual operation, discharge is made not simultaneously but on a time-division basis. In that case, the carriage scans during a time from the initial discharge to the final discharge, and hence orderly discharge of N nozzles starting from nozzle 1 and completing discharge with nozzle N provides slanting printing. To avoid such a disadvantage, the head is disposed slantingly by itself.

However, as mentioned above, offset of the discharged inks may occur due to poor mechanical precision of the head or discharge of the ink in a twisted fashion. Hence, the degree of offset is measured during inspection of the head beforehand, and the time corresponding to that degree of offset is written in the head as data so that discharge can be made earlier or delayed by that time. When the apparatus is switched on, the data is read out and discharge is controlled using that data. The data may be one for the entire head or one for an individual nozzle (see FIG. 80). By timing ink discharge in each head or in each nozzle, offset of the discharged ink droplets in the scanning direction can be corrected and a high-definition image can be output. In this embodiment, data is written in the head cartridge beforehand. When the apparatus body is switched on, the data is read out from the cartridge and various control operations are performed using the data. It is therefore possible to perform reliable printing of high-definition images.

All of the aforementioned types of data may not be necessary. However, the larger the amount of data, the more accurate control is obtained to provide high-definition images.

<Sixth Embodiment>

A sixth embodiment of the present invention employs a cartridge of the type in which a head and an ink tank are provided separately. Since the head and the ink tank are provided separately, when ink has been used up, only the ink tank is replaced with a new one. However, the same head is used with many ink tanks, that is, the head can be used as long as it breaks, reducing running cost. In that type of head cartridge, provision of a memory in both the head and the ink tank is desired. However, provision of the memory at least in the head is enough.

First, the case in which the storage memory is provided in both the head and ink tank will be explained. In that case, the data on the ink tank in the data explained in connection with the fifth embodiment is read out from the ink tank, while the data on the head is read out from the head. Description of parts identical to those of the fifth embodiment is omitted.

(ID No. of Head)

A change in the ID no. indicates that the life of the old head has ended and the new one has been unpacked and loaded. Just loading of the new head does not ensure stable discharge of ink from that head. Particularly, in this type of cartridge in which the ink tank and the head are provided separately, no ink may be present in the liquid chamber of the head, and the optimum recovery operation for a new head is required.

(HS Data)

Head shading (HS) is performed to correct density non-uniformity in the head and thereby enhance image quality. HS is performed before the head is shipped, and the obtained data is written in the ROM in the head. Non-uniformity may vary during the use of the head. In that case, RHS is performed, and newly obtained HS data is written in a SRAM in the apparatus body.

(Manufacturing Date)

The user can know with the manufacturing date how much time has passed since the cartridge is manufactured when he loads the cartridge in the apparatus. Consequently, the user can perform a recovery operation suited to that period of time on the new cartridge.

That is, in a cartridge which has been manufactured a long time ago, since the performance of the heater in the head may vary for some unknown reasons, the number of times pre-discharge is conducted is increased so as to provide stable discharge of ink having an adequate concentration. Practically, the type of recovery operation to be performed is decided by the number of months between the manufacturing date and the loading date, and the number of times pre-discharge is conducted is increased.

(Term of Validity)

In a head cartridge which has been manufactured a long time ago, durability of the head may be deteriorated. This tendency is particularly noticeable with a head cartridge which has been used once for printing. That is, since ink makes contact with the discharge heater and a voltage is applied to the heater, durability of the discharge heater deteriorates. Hence, if it is determined that a predetermined period of time or longer has elapsed since the cartridge is unpacked and loaded in the apparatus, the apparatus body may issue an alarm or automatically stop the operation so that the user can replace the cartridge with a new one.

In an actual operation, such an operation is performed after discharge has been conducted a number of times or after quite a number of sheets of paper have been printed. During that time, replacement of the ink tank may occur several times. However, alarming made when the predetermined value is reached ensures that the user always has images of high definition.

(Rank of the Temperature Sensor)

The resistance of a semiconductor device is measured in the manufacturing process, and the sensor is ranked in accordance with that measured value so as to allow for accurate temperature detection in each head.

(Registration Correction Data in X (Scanning) Direction)

Registration data in the scanning direction is stored during manufacture of the head cartridge. When a new cartridge is loaded, the data is read out, and timing of ink discharge is controlled using the data.

(ID No. of Ink Tank)

Ink tank ID no. is used to identify an individual ink tank cartridge. When the apparatus is switched on, the ID no. of the ink tank is compared with that of the ink tank cartridge which has been loaded in the previous printing operation. If they are not identical, it is determined that a new ink tank cartridge has been loaded, and various types of initial operations are performed.

A change in the ID no. indicates that the previous ink tank cartridge has run out of ink and a new ink tank cartridge has been unpacked and loaded. Loading of the new ink tank cartridge, however, does not ensure stable ink discharge. Also, absence of ink in the ink tank may indicate that no ink is present in the liquid chamber of the head. Hence, a recovery operation suitable to the new ink tank cartridge is performed.

Also, the data on the previous ink tank cartridge is initialized. The data to be initialized includes the data read out from the ROM of the cartridge when the apparatus is switched on and the data required to control only the previous cartridge.

The ID no. is read into the apparatus body when the apparatus is switched on, and the read ID no. is compared with that used in the previous operation. If they are identical, it is not necessary to read in the data from the ROM of the cartridge. However, in an apparatus of the type in which the ROM of the cartridge is rewritten during the operation of the apparatus body, the data is read out from the ROM of the cartridge when the apparatus is switched on or at adequate time intervals, and various operations are performed.

(Color of Ink)

If a cartridge of a predetermined ink is not loaded at a predetermined carriage position, an image which is printed has an undesired color.

Hence, color data is stored in the cartridge, and erroneous cartridge loading is prevented using that color data.

(Amount of Remaining Ink)

Detection voltage at each temperature is stored in each cartridge as data so as to ensure accurate detection of the amount of remaining ink.

(Manufacturing Date)

The user can know by the manufacturing date how much time has passed since the ink tank cartridge is manufactured when he loads the ink tank cartridge in the apparatus. Consequently, the user can perform a recovery operation suited to that period of time on the new ink tank cartridge.

That is, in a cartridge which has been manufactured a long time ago, since the concentration of the ink in the connected portion between the ink tank and the head cartridge has been increased, the amount of ink which is sucked is increased so as to ensure stable discharge of ink with an adequate concentration. Practically, the type of recovery operation to be performed is decided by the number of months between the manufacturing date and the loading date.

(Term of Validity)

The composition or property of the ink in an ink tank cartridge manufactured a long time ago can vary in terms of discharge stability and ink concentration. This change in the composition or property of the ink is significant in a packed cartridge. That is, ink in the cartridge evaporates, and the degree of evaporation varies depending of the components of the ink. Consequently, the composition ratio of the ink varies, varying the discharge characteristics. Furthermore, since the dye in the ink does not evaporate, the concentration of the ink increases. Such an ink provides an image having a tint different from a desired one. Hence, if it is determined that a predetermined period of time or longer has elapsed since the cartridge is unpacked and loaded in the apparatus, the apparatus body may issue an alarm or automatically stop the operation so that the user can replace the cartridge with a new one.

Even when the cartridge is not unpacked, i.e., even when the ink does not evaporate from the cartridge, ink in the cartridge manufactured a long time ago reacts with the absorber in the ink tank, and the properties of its components thus change, degrading discharge stability. Consequently, the apparatus body may issue an alarm or automatically stop the operation so that the user can replace the cartridge with a new one.

In a cartridge of the type in which the head and the ink tank are provided separately, a memory is provided separately in the head and in the ink tank. Data is read out from each of the memories separately at predetermined time intervals. Consequently, suitable apparatus body and head control can be performed separately in accordance with the head and ink tank, and stable high-definition images can thus be printed.

Furthermore, since a plurality of ink tanks which are relatively less expensive than the head can be used while the single head is used up, even when the size of the ink tank is not large, the running cost can be reduced. Furthermore, reduction in the size of the ink tank reduces the weight of the head cartridge, thus reducing the torque of the motor for driving the carriage and, hence, the size of the motor and power source.

<Seventh Embodiment>

Unlike the sixth embodiment, in the seventh embodiment, the storage memory is provided only on the head. That is, no memory is provided on the ink tank.

Since control can be performed using only the memory on the head, production cost of the ink tank can be reduced. However, the capacity of the memory provided on the head in that case must be increased to be more than that of the memory provided on the head when the ink tank has its own memory.

<Eighth Embodiment>

In this embodiment, the case in which only a single head is loaded on the apparatus body will be explained. In a cartridge of the type in which the ink tank and the head are provided separately, ink tanks of a plurality of colors or of different types of ink may be used in the cartridge one at a time.

In that case, if the color of the new ink differs from the color of the previous ink, suction or pre-discharge must be conducted a larger number of times compared to that in which it is conducted when the same color is used in order to prevent mixture of colors. Hence, the color of the previous ink is written in the memory in the apparatus body, and that data is compared with the data representing the color or type of the ink tank when the apparatus is switched on. In this way, an adequate recovery operation is ensured, and excessive consumption or mixture of colors of inks can be prevented.

In that case, it is necessary to provide data on the ink tank. If only color data is required, the apparatus body can identify the ink tank by using a mechanical configuration, such as a projection provided on the tank.

In a cartridge of the type in which the ink tank and the head are formed as one unit (when different types of ink are used), the data on the type is written in the cartridge. Since recovering property changes depending on the type of ink, the number of times pre-discharge is conducted or the amount of suction pressure is changed to provide an optimum recovery operation.

The present invention brings about excellent effects particularly in a recording head of an ink jet recording apparatus of the type which utilizes thermal energy.

As to its typical construction and principle, for example, one practiced by use of the basic principle disclosed in, for example, U.S. Pat. Nos. 4,723,129 and 4,740,796 is preferred. This system is applicable to either of the so-called on-demand type and the continuous type recording apparatus. Particularly, the case of the on-demand type is effective because, by applying at least one driving signal which gives rapid temperature elevation exceeding nucleous boiling corresponding to the recording information on electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferable discharging of the liquid (ink) with particularly excellent response characteristics. As the driving signals of such pulse shapes, those as disclosed in U.S. Pat. Nos. 4,463,359 and 4,345,262 are suitable. Furthermore, excellent recording can be performed by employment of the conditions described in U.S. Pat. No. 4,313,124 concerning the temperature elevation rate of the above-mentioned heat acting surface.

As for the construction of the recording head, in addition to the combination of a discharging orifice, a liquid channel, and an electricity-heat converter (linear liquid channel or right angle liquid channel) as disclosed in the above-mentioned respective specifications, the disclosures in U.S. Pat. Nos. 4,558,333 and 4,459,600 regarding the heat acting portion being arranged in the flexed region is also included in the present invention. In addition, the present invention can also be effectively used with Japanese Patent Laid-Open Application No. 59-123670, which discloses using a slit common to a plurality of electricity-heat convertors as the discharging portion of the electricity-heat convertor, or with Japanese Patent Laid-Open Application No. 59-138461, which discloses having the opening for absorbing the pressure wave of heat energy corresponding to the discharging portion.

Further, as the recording head of the full line type having a length corresponding to the maximum width of a recording medium which can be recorded by the recording device, either the constitution which satisfies its length by combination of a plurality of recording heads as disclosed in the above-mentioned specifications or the constitution as one recording head integral formed may be used, and the present invention can effectively exhibit the effects as described above.

In addition, the present invention is effective for a recording head of a freely exchangeable chip type which enables electrical connection to the main device or a supply of ink from the main device by being mounted on the main device, or for use with a recording head of the cartridge type provided integrally on the recording head itself.

Also, addition of a restoration means for the recording head, a preliminary auxiliary means, etc. provided with the recording device of the present invention is preferable, because the effect of the present invention can be further stabilized. Specific examples of these may include capping means, cleaning means, pressurization or aspiration means, electricity-heat convertors or an alternative heating element or preliminary heating means, or even a combination of these. It is also effective for performing stable recording to perform a preliminary mode which performs discharging separately from recording.

Further, as the recording mode of the recording device, the present invention is extremely effective for not only the recording mode of a primary (stream) color such as black etc., but also for a device equipped with at least one of a plurality of different colors or a device equipped with several colors for color mixing, whether the recording head is integral with the recording device, or connected thereto.

As will be understood from the foregoing description, according to the present invention, a discharge recovery operation is automatically performed to recover the expected discharging conditions, in response to detection of replacement of a recording head. It is therefore possible to optimize the recording conditions after the replacement, without any aid of manual adjusting work. Furthermore, head characteristic information is automatically stored in response to the replacement of the recording head, so that the recording conditions are optimized after each replacement of the recording head without manual operation by the user.

What is claimed is:

1. An ink jet recording apparatus for recording on a recording medium by using a replaceable recording head having head characteristic information, comprising:

detection means for detecting replacement of the recording head;

memory means for storing the head characteristic information read from the recording head;

driving means for outputting to the recording head a driving signal based on the head characteristic information stored in said memory means; and control means for causing said memory means to store the head characteristic information read from a newly mounted recording head when replacement of the recording head is detected by said detection means, wherein said detection means detects replacement of the recording head immediately after hardware checking of said recording apparatus.

2. An ink jet recording apparatus for recording on a recording medium by using a replaceable recording head having head characteristic information, comprising:

detection means for detecting replacement of the recording head;

memory means for storing the head characteristic information read from the recording head;

driving means for outputting to the recording head a driving signal based on the head characteristic information stored in said memory means; and control means for causing said memory means to store the head characteristic information read from a newly mounted recording head when replacement of the recording head is detected by said detction means, wherein said control means stores a start time of use of the newly mounted recording head in the newly mounted recording head when replacement of the recording head is detected by said detection means.

* * * * *